US012215453B2

(12) United States Patent
Jung et al.

(10) Patent No.: US 12,215,453 B2
(45) Date of Patent: Feb. 4, 2025

(54) WASHING MACHINE

(71) Applicant: LG Electronics Inc., Seoul (KR)

(72) Inventors: Hwanjin Jung, Seoul (KR); Myunghun Im, Seoul (KR); Junghoon Lee, Seoul (KR); Kyungchul Woo, Seoul (KR); Jaehyun Kim, Seoul (KR); Hyundong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/097,737

(22) Filed: Jan. 17, 2023

(65) Prior Publication Data

US 2023/0151531 A1 May 18, 2023

Related U.S. Application Data

(62) Division of application No. 16/474,937, filed as application No. PCT/KR2017/015681 on Dec. 28, 2017, now Pat. No. 11,920,278.

(30) Foreign Application Priority Data

Dec. 28, 2016 (KR) ..... 10-2016-0180853
Dec. 28, 2016 (KR) ..... 10-2016-0180854
(Continued)

(51) Int. Cl.
*D06F 37/26* (2006.01)
*D06F 33/36* (2020.01)
(Continued)

(52) U.S. Cl.
CPC ..... *D06F 37/266* (2013.01); *D06F 33/36* (2020.02); *D06F 37/06* (2013.01); *D06F 37/22* (2013.01);
(Continued)

(58) Field of Classification Search
CPC ..... D06F 37/266; D06F 39/088
See application file for complete search history.

(56) References Cited

U.S. PATENT DOCUMENTS 7,942,025 B1 5/2011 Musone
11,208,756 B2 12/2021 Lee et al.
(Continued)

FOREIGN PATENT DOCUMENTS

CN 102121186 7/2011
CN 102575412 7/2012
(Continued)

OTHER PUBLICATIONS

Extended European Search Report in European Appln. No. 23171028.6, mailed on Sep. 15, 2023, 7 pages.
(Continued)

*Primary Examiner* — Spencer E. Bell
(74) *Attorney, Agent, or Firm* — Fish & Richardson P.C.

(57) ABSTRACT

A washing machine includes a casing, a tub, a drum, a pump for sending water discharged from the tub, a gasket connecting an input port of the casing to an opening of the tub and having nozzles for spraying water into the drum, and a nozzle water supply pipe configured to guide water introduced through the opening into a first sub-flow and a second sub-flow. The nozzle water pipe includes first nozzle water supply ports, formed on a first flow path to which the first sub-flow is guided, for supplying the first sub-flow to any two or more nozzles among the plurality of nozzles, and second nozzle water supply ports, formed on a second flow path to which the second sub-flow is guided, for supplying the second sub-flow to other two or more nozzles among the plurality of nozzles.

19 Claims, 73 Drawing Sheets

(30) Foreign Application Priority Data

| | | |
|---|---|---|
| Dec. 28, 2016 | (KR) | 10-2016-0180855 |
| Dec. 28, 2016 | (KR) | 10-2016-0180857 |
| Dec. 28, 2016 | (KR) | 10-2016-0180858 |
| Jun. 1, 2017 | (KR) | 10-2017-0068596 |
| Jun. 28, 2017 | (KR) | 10-2017-0082007 |
| Jun. 28, 2017 | (KR) | 10-2017-0082009 |
| Nov. 9, 2017 | (KR) | 10-2017-0148922 |

(51) Int. Cl.

| | |
|---|---|
| ***D06F 37/06*** | (2006.01) |
| ***D06F 37/22*** | (2006.01) |
| ***D06F 37/30*** | (2020.01) |
| ***D06F 39/08*** | (2006.01) |
| ***D06F 105/06*** | (2020.01) |
| *D06F 103/04* | (2020.01) |
| *D06F 103/24* | (2020.01) |
| *D06F 105/48* | (2020.01) |

(52) U.S. Cl.

CPC ..... *D06F 37/30* (2013.01); *D06F 39/083* (2013.01); *D06F 39/088* (2013.01); *D06F 2103/04* (2020.02); *D06F 2103/24* (2020.02); *D06F 2105/06* (2020.02); *D06F 2105/48* (2020.02)

(56) References Cited

U.S. PATENT DOCUMENTS

| | | | |
|---|---|---|---|
| 11,499,261 | B2 | 11/2022 | Lee et al. |
| 11,519,121 | B2 | 12/2022 | Jang et al. |
| 2009/0249840 | A1 | 10/2009 | Jo et al. |
| 2011/0083477 | A1 | 4/2011 | Kim et al. |
| 2011/0265525 | A1 | 4/2011 | Gweon |
| 2014/0311189 | A1 | 10/2014 | Im et al. |

FOREIGN PATENT DOCUMENTS

| | | | |
|---|---|---|---|
| CN | 103562459 | | 2/2014 |
| CN | 104631060 | | 5/2015 |
| DE | 19962257 | | 6/2001 |
| EP | 2108731 | | 10/2009 |
| EP | 2634303 | | 9/2013 |
| EP | 2692930 | A1 | 2/2014 |
| EP | 2719814 | | 4/2014 |
| EP | 2754743 | A1 | 7/2014 |
| JP | 2006239141 | | 9/2006 |
| JP | 2008-194255 | | 8/2008 |
| JP | 2010-036016 | | 2/2010 |
| JP | 2011-056113 | | 3/2011 |
| JP | 2011250921 | | 12/2011 |
| JP | 2014004276 | | 1/2014 |
| KR | 10-2005-0086204 | | 8/2005 |
| KR | 10-2007-0090638 | | 9/2007 |
| KR | 20100106260 | | 10/2010 |
| KR | 10-2011-0036027 | | 4/2011 |
| KR | 10-2011-0040178 | | 4/2011 |
| KR | 20110040180 | | 4/2011 |
| KR | 101397053 | | 5/2014 |
| KR | 20140102014 | | 8/2014 |
| KR | 10-2014-0140435 | | 12/2014 |
| KR | 10-2015- 0121581 | | 10/2015 |
| KR | 10-1593001 | | 2/2016 |
| KR | 10-2016-0044901 | | 4/2016 |
| KR | 101327201 | | 6/2016 |
| KR | 20160119045 | | 10/2016 |
| KR | 101708666 | | 2/2017 |
| WO | WO2011024611 | | 3/2011 |
| WO | WO2011046363 | | 4/2011 |
| WO | WO2012141407 | | 10/2012 |
| WO | WO2014037840 | | 3/2014 |
| WO | WO2016136154 | | 9/2016 |

OTHER PUBLICATIONS

Office Action in U.S. Appl. No. 17/534,980, dated Mar. 16, 2023, 14 pages.
Office Action in Australian Appln. No. 2022228172, mailed on Sep. 15, 2023, 5 pages.
Office Action in Australian Appln. No. 2022228184, mailed on Sep. 1, 2023, 4 pages.
Office Action in Korean Appln. No. 10-2016-0180854, mailed on Sep. 17, 2023, 8 pages (with English translation).
Office Action in Korean Appln. No. 10-2016-0180853, mailed on Sep. 12, 2023, 8 pages (with English translation).
Notice of Allowance in Korean Appln. No. 10-2017-0148922, dated Jan. 19, 2023, 7 pages (with English translation).
Chinese Office Action in Chinese Application No. 201780087594.6, dated Nov. 3, 2020, 18 pages (with English translation).
Extended European Search Report in European Application No. 17889287.3, dated May 4, 2020, 8 pages.
KR Office Action in Korean Appln. No. 10-2017-0082009, dated Jun. 16, 2021, 10 pages (with English translation).
Office Action in Korean Appln. No. 10-2017-0148922, dated Sep. 26, 2022, 9 pages (with English translation).
Office Action in Korean Appln. No. 10-2016-0180855, mailed on May 18, 2023, 8 pages(with English translation).
Notice of Allowance in Korean Appln. No. 10-2016-0180858, mailed on Nov. 28, 2023, 4 pages (with English translation).
Office Action in Australian Appln. No. 2023204372, mailed on Sep. 10, 2024, 7 pages.

WASHING MACHINE

CROSS-REFERENCE TO RELATED APPLICATIONS

This application is a divisional of US application Ser. No. 16/474,937, filed on Jun. 28, 2019, which is a National Stage application under 35 U.S.C. § 371 of International Application No. PCT/KR2017/015681, filed on Dec. 28, 2017, which claims the benefit of Korean Application No. 10-2017-0148922, filed on Nov. 9, 2017, Korean Application No. 10-2017-0082007, filed on Jun. 28, 2017, Korean Application No. 10-2017-0082009, filed on Jun. 28, 2017, Korean Application No. 10-2017-0068596, filed on Jun. 1, 2017, Korean Application No. 10-2016-0180858, filed on Dec. 28, 2016, Korean Application No. 10-2016-0180857, filed on Dec. 28, 2016, Korean Application No. 10-2016-0180855, filed on Dec. 28, 2016, Korean Application No. 10-2016-0180854, filed on Dec. 28, 2016, and Korean Application No. 10-2016-0180853, filed on Dec. 28, 2016. The disclosures of the prior applications are incorporated by reference in their entirety.

TECHNICAL FIELD

The present invention relates to a washing machine having a nozzle for discharging water which is discharged from a tub and circulated along a circulation pipe into a drum.

BACKGROUND

Generally, a washing machine is an apparatus that separates contaminants from clothing, bedding, and the like (hereinafter, referred to as "laundry") by using a chemical decomposition of water and detergent and a physical action such as friction between water and laundry.

Such a washing machine includes a tub containing water and a drum rotatably installed in the tub to receive the laundry. A recent washing machine is configured to circulate water discharged from the tub by using a circulation pump, and to spray the circulated water into the drum through a nozzle. However, since such a conventional washing machine usually includes a single or two nozzles, not only in the case of the single nozzle but also in the case of the two nozzles, the spraying direction is restricted, so that the laundry is not wet evenly. In particular, in recent years, although new technologies for controlling the rotation of the drum have been developed in order to impart variety to the flow of laundry put into the drum, there is a limit in that a remarkable improvement in performance cannot be expected with a conventional structure.

In addition, in the conventional washing machine, a circulation pipe is connected to the circulation pump, and water sent by the circulation pump is guided along the circulation pipe, and the guided water is supplied again to the nozzle through a connector that connects the nozzle and the circulation pipe. Conventionally, when two nozzles are provided, two circulation pipes connected to the circulation pump and two nozzle water supply pipes connected respectively to the two circulation pipes are required, so that the structure of the product is complicated, and the manufacturing process of the product is cumbersome due to the process of assembling the circulation pipes and the nozzle water supply pipes.

In addition, since there are many connection portions between the circulation pipe, the nozzle water supply pipes, and the nozzles, there is a possibility that water may leak from the connection portions during operation of the washing machine. Particularly, since the outer circumferential surface of the nozzle water supply pipe is wet by the circulating water current sprayed from the nozzle, there is a problem that hygiene problems occur due to the coagulation of the detergent contained in the circulating water and the deposition of contaminants.

The washing machine is an apparatus for removing contamination from laundry by inputting clothes, bedding, or the like (hereinafter, referred to as laundry) into the drum. The washing machine may perform processes such as washing, rinsing, spin-dry, and drying, and is divided into a top loading type and a front loading type based on a method of inputting the laundry. Generally, the front loading type washing machine is called a drum washing machine.

Such a drum washing machine (hereinafter, referred to as 'washing machine') includes a main body forming an outer appearance, a tub accommodated in the main body, and a drum rotatably mounted in the tub and into which laundry is inputted. When the drum is rotated by a motor in a state where fluid is supplied to the laundry contained in the drum, contaminants adhered to the laundry can be removed by friction between the laundry and the drum or the fluid.

In the general structure, that the water discharged from the tub of the washing machine is circulated by using the circulation pump and the circulated water is sprayed into the drum through the nozzle. However, since the conventional washing machine usually has only one or two nozzles, the direction of spraying the fluid sprayed into the drum is restricted, so that there is a problem in that the fluid cannot be uniformly sprayed to the laundry contained in the drum.

In addition, the conventional washing machine has a structure in which a circulation pipe is connected to the circulation pump and the fluid moved by the circulation pump is supplied to the nozzle by the connector connecting the nozzle and the circulation pipe. In this case, since the circulation pipe connected to the circulation pump and the nozzle water supply pipe connected to the circulation pipe are separately required, there is a problem in that the structure of the product is complicated and the manufacturing process is increased.

Accordingly, there is a need for a washing machine that has a relatively simple structure to achieve a simple manufacturing process, and can spray fluid into the drum with various degrees.

A recent washing machine is configured to circulate water discharged from the tub by using the circulation pump, and to spray the circulated water into the drum through the nozzle. However, since such a conventional washing machine usually has one or two nozzles, the direction of spraying through the nozzles is restricted, so that the laundry cannot be wet evenly.

In recent years, although new technologies for controlling the rotation of the drum have been developed in order to impart variety to the flow of laundry put into the drum, there is a limit in that a remarkable improvement in performance cannot be expected under the conventional nozzle structure.

In recent years, new technologies have been developed to control the rotation of the drum to impart variety to the flow of laundry put into the drum. Meanwhile, technologies for changing the water pressure sprayed through the nozzle depending on the rotation of the drum and improving the washing effect have been developed.

However, in order to further improve the washing effect, there is a need for an improved control method of controlling the rotation of the drum and controlling the water pressure sprayed through the nozzle in association with the rotation of the drum.

SUMMARY

The present invention has been made in view of the above problems, and provides a washing machine which has a gasket which is provided with a plurality of nozzles for spraying water into a drum, and sprays water (hereinafter, referred to as circulating water) discharged from a tub and sent by a pump through the plurality of nozzles. In particular, a nozzle water supply pipe for supplying circulating water to the plurality of nozzles is provided in the gasket, and the outer circumferential surface of the nozzle water supply pipe is not exposed to the fluid current sprayed from the plurality of nozzles.

The present invention further provides a washing machine which sprays water, guided through a nozzle water supply pipe, through the nozzles disposed at different heights on the gasket, when the water discharged from the tub is guided through a single common nozzle water supply a pipe.

The present invention further provides a washing machine which prevents a transferring pipe guiding circulating water to the nozzles from interfering with a door.

The present invention further provides a washing machine which is capable of varying the flow rate (or water pressure) of water sprayed through the nozzles.

The present invention further provides a washing machine in which the water sprayed through the nozzle can reach deep inside the drum.

The present invention further provides a washing machine which in which the water current sprayed from the nozzles can evenly wet laundry even when permeation washing is performed in a state in which a large amount of laundry is inputted.

The present invention further provides a washing machine structure in which fluid sprayed toward the inside of the drum is sprayed with various angles and can be uniformly sprayed onto laundry contained in the drum.

The present invention further provides a washing machine structure in which the water circulated from a drain pump is introduced into annular flow paths which are installed separately from each other, and fluid is sprayed into the drum through nozzles disposed at different heights on the gasket.

The present invention further provides a washing machine structure capable of varying a flow rate of fluid sprayed through each nozzle and spraying evenly fluid current sprayed from each nozzle even when a large amount of laundry is put into the drum.

The present invention further provides a washing machine in which water discharged from a tub is sprayed into the drum at three or more different heights.

The present invention further provides a washing machine in which water discharged from the tub is guided through a single common flow path and the water guided through the flow path is sprayed through nozzles disposed at different heights on the flow path.

The present invention further provides a washing machine in which the flow path and the three or more nozzles are provided in a gasket.

The present invention further provides a washing machine which capable of varying the flow rate (or water pressure) of water sprayed through the nozzles.

The present invention further provides a washing machine in which water sprayed through the nozzle can reach deep inside the drum.

The present invention further provides a washing machine in which water current sprayed from the nozzle can evenly wet laundry even when permeation washing is performed in a state in which a large amount of laundry is inputted.

The present invention further provides a control method of a washing machine that improves washing performance while reducing power consumption by devising the best procedure in which filtration, rolling, and tumbling motions are performed, and optimizing control of a pump during operation of each motion.

The present invention further provides a control method of a washing machine that uniformly loosens laundry so that spin-dry can be easily entered.

The present invention further provides a control method of a washing machine capable of varying a spraying direction of the plurality of nozzles in response to the flow of laundry inside a drum.

The present invention further provides a control method of a washing machine capable of appropriately controlling the intensity of water current sprayed through a nozzle in response to the flow of laundry that rises to a certain height and then falls, such as swing motion, step motion, or scrub motion.

The present invention further provides a control method of a washing machine in which laundry can be uniformly wet by a circulating water sprayed through a nozzle during a swing motion, a step motion, or a scrub motion process.

The present invention further provides a control method of a washing machine which improves washing performance due to rolling motion and tumbling motion.

The present invention further provides a control method of a washing machine in which the intensity of circulating water sprayed through a nozzle while performing rolling motion and tumbling motion is optimized.

The present invention further provides a control method of a washing machine which improves the variation in washing performance.

The present invention further provides a control method of a washing machine in which laundry can be uniformly wet by a circulating water sprayed through a nozzle during a rolling motion and a tumbling motion.

The present invention further provides a control method of a washing machine which improves washing performance due to filtration motion.

The present invention further provides a control method of a washing machine in which both the laundry placed at the front end of the drum and the laundry positioned at the rear end of the drum are effectively wet by the water current sprayed from the nozzle during the filtration motion.

The present invention further provides a control method of a washing machine which optimally controls the intensity of water sprayed through a nozzle so that laundry can be appropriately wet in consideration of the flow of laundry during filtration motion.

The present invention further provides a control method of a washing machine which varies the speed of the pump motor while performing the drum driving motion in which the laundry is raised to a certain height and then falls such as swing motion, step motion or scrub motion, and provides an optimum washing power according to the amount of laundry (hereinafter, referred to as "laundry amount") inputted into the drum.

The present invention further provides a washing machine which can evenly mix detergent and water by using a circulation pump capable of varying the speed, and a control method thereof.

The present invention further provides a washing machine which prevents un-dissolved detergent from being added to laundry so that contamination of laundry due to detergent solidification can be prevented, and a control method thereof.

The present invention further provides a washing machine capable of selectively dissolving detergent and circulating fluid according to the speed of the circulation pump, by varying the speed of the circulation pump circulating the wash water, based on a structure in which fluid in an outer tank is circulated and sprayed through a nozzle, and a control method thereof.

The present invention further provides a control method of a washing machine which improves rinsing performance.

The present invention further provides a control method of a washing machine which improves the washing effect during the washing motion causing a falling.

The present invention further provides a control method of a washing machine which improves wetness of laundry at the initial stage of washing.

The present invention is intended to solve the problem that the wetness of laundry is concentrated on a part of the laundry during the filtration motion.

The present invention further provides a control method of a washing machine in which the washing effect is improved and the washing time is reduced.

The present invention further provides a control method of a washing machine which enhances the washing effect of a detergent.

In an aspect, there is provided a washing machine comprising: a casing which has an input port, which is formed in a front surface thereof, through which laundry is inputted; a tub which is disposed in the casing to contain fluid, and has an opening communicating with the input port; a drum which is rotatably disposed in the tub, and contains the laundry; a pump which sends water discharged from the tub; a gasket which communicates the input port and the opening of the tub, and has a plurality of nozzles for spraying water into the drum; and a nozzle water supply pipe which is fixed to the gasket, has an opening into which the water sent by the pump is introduced, branches and guides the water introduced through the opening into a first sub-flow and a second sub-flow, has a plurality of first nozzle water supply ports, which is formed on a first flow path to which the first sub-flow is guided, for supplying the first sub-flow to any two or more nozzles among the plurality of nozzles, and has a plurality of second nozzle water supply ports, which is formed on a second flow path to which the second sub-flow is guided, for supplying the second sub-flow to other two or more nozzles among the plurality of nozzles.

The washing machine further comprises a circulation pipe for guiding the water sent by the pump, wherein the nozzle water supply pipe comprises: a circulation pipe connection port which forms the opening and is connected to the circulation pipe; and a transfer conduit which is connected to the circulation pipe connection port, and branches and guides the water introduced through the circulation pipe connection port to the first flow path and the second flow path.

The transfer conduit comprises: a first conduit portion which extends from the circulation pipe connection port in a first direction to form the first flow path, and is connected to the plurality of first nozzle water supply ports; and a second conduit which extends from the circulation pipe connection port in a second direction to form the second flow path, and is connected to the plurality of second nozzle water supply ports.

One end of each of the first conduit portion and the second conduit is connected to the circulation pipe connection port, and the other end of the first conduit portion and the other end of the second conduit are separated from each other.

One end of each of the first conduit portion and the second conduit is connected to the circulation pipe connection port, and the other end of the first conduit portion and the other end of the second conduit are connected to each other.

The transfer conduit is disposed around an outer circumferential portion of the gasket, wherein each of the plurality of nozzles is disposed in an inner circumferential portion of the gasket, wherein the plurality of first nozzle water supply ports and the plurality of second nozzle water supply ports pass through the gasket respectively to supply water to the nozzle.

A cross-section of the transfer conduit has a shape in which a height defined in a radial direction is shorter than a width defined in a longitudinal direction of the gasket.

The washing machine further comprises at least one balancer, having a certain weight, disposed along the opening of the tub, wherein the transfer conduit is disposed between the gasket and the at least one balancer.

The gasket comprises: a casing coupling unit which is coupled to circumference of the input port of the casing; a tub coupling unit which is coupled to circumference of the opening of the tub; and an extension unit which extends from between the casing coupling unit and the tub coupling unit, wherein each of the nozzles comprises: a nozzle inflow pipe which is protruded from an inner circumferential surface of the extension unit and receives water through a corresponding nozzle water supply port; and a nozzle head for spraying water supplied through the nozzle inflow pipe into the drum.

The gasket further comprises a plurality of port insertion pipes which are protruded from an outer circumferential surface of the extension unit, and communicate with the nozzle inflow pipes respectively, wherein the plurality of first nozzle water supply ports and the plurality of second nozzle water supply ports are inserted into the plurality of port insertion pipes respectively.

The transfer conduit comprises a plurality of uplift portions which are convex in a direction away from an outer circumferential portion of the gasket, in a position corresponding to the plurality of port insertion pipes, respectively, wherein the plurality of first nozzle water supply ports and the plurality of second nozzle water supply ports are protruded from the plurality of uplift portions, respectively.

On a front surface of the tub, a plurality of balancers having a certain weight are disposed along the circumference of the opening of the tub, wherein the uplift portion is disposed between the plurality of balancers.

The extension unit comprises: a cylindrical rim unit which extends from the casing coupling unit toward the tub coupling unit; and a folded unit which is formed between the rim unit and the tub coupling unit, and folded according to displacement of the tub, wherein the folded unit comprises: an inner diameter unit bent from the rim unit toward the casing coupling unit side; and an outer diameter unit bent from the inner diameter unit toward the tub coupling unit side, wherein the nozzle inflow pipe is protruded from an inner circumferential surface of the outer diameter unit.

In an inner side cross-section of the transfer conduit, an area of the cross-section of the transfer conduit is gradually reduced from a lower side of the transfer conduit to an upper side.

In an inner side cross-section of the transfer conduit, a width of the cross-section of the transfer conduit is gradually reduced from a lower side of the transfer conduit to an upper side.

The pump is able to perform a speed control.

In another aspect, there is provided a washing machine comprising: a casing which has an input port, which is formed in a front surface thereof, through which laundry is inputted; a tub which is disposed in the casing to contain fluid, and has an opening communicating with the input port; a drum which is rotatably disposed in the tub, and contains the laundry; a pump which sends water discharged from the tub; a gasket which communicates the input port and the opening of the tub, and has a plurality of nozzles for spraying water into the drum; and a nozzle water supply pipe which is fixed to the gasket, has an opening into which the water sent by the pump is introduced, branches and guides the water introduced through the opening into a first flow path and a second flow path, has a plurality of first nozzle water supply ports, which is formed on the first flow path, for guiding water to any two or more nozzles among the plurality of nozzles, and has a plurality of second nozzle water supply ports, which is formed on a second flow path, for supplying water to other two or more nozzles among the plurality of nozzles.

The plurality of nozzles comprises: an upper nozzle which sprays water downward; a pair of intermediate nozzles which is disposed in a lower side of the upper nozzle, and disposed in both sides based on an inflow port of the nozzle water supply pipe into which the water supplied by the pump flows, and a pair of lower nozzles which is disposed in an upper side of the inflow port, disposed in a lower side of the intermediate nozzle, and is disposed on both sides based on the inflow port.

The pair of intermediate nozzles are disposed in an upper side of a center of the drum.

The pair of lower nozzles are disposed in a lower side of a center of the drum.

The plurality of nozzles comprises: an upper nozzle which sprays water downward; a first intermediate nozzle which is disposed in a lower side of the upper nozzle, and disposed in a first area divided into left and right sides based on a vertical plane to which a center of the drum belongs and sprays water downward toward a second area corresponding to an opposite side to the first area; a second intermediate nozzle which is disposed in the second area in the lower side of the upper nozzle, and sprays water downward toward the second area; a first lower nozzle which is disposed in the first area below the first and second intermediate nozzles, and sprays water upward toward the second area; and a second lower nozzle which is disposed in the second area below the first and second intermediate nozzles, and sprays water upward toward the second area.

Each of the plurality of nozzles sprays a water current having a width defined between one side boundary close to itself and the other side boundary opposite to the one side boundary, and at least one of the first intermediate nozzle and the second intermediate nozzle may spray a water current in such a manner that the one side boundary is positioned below the other side boundary.

At least one of the first intermediate nozzle and the second intermediate nozzle may spray water current in such a manner that the one side boundary meets the side surface portion of the drum and the other side boundary meets the side surface portion of the drum above the one side boundary. The water current sprayed through at least one of the first intermediate nozzle and the second intermediate nozzle may form a water film having a shape inclined downward from the other side boundary to the one side boundary. The water current sprayed through at least one of the first intermediate nozzle and the second intermediate nozzle may include an area which meets the rear surface of the drum between the point where the one side boundary meets the side surface of the drum and the point where the other side boundary meets the side surface of the drum.

The section where the water sprayed through at least one of the first intermediate nozzle and the second intermediate nozzle meets the drum travels from a point where the other side boundary meets the side surface of the drum, meets the rear surface of the drum, and then reaches the point where the one side boundary meets the side surface of the drum while meeting the side surface of the drum again.

The portion where the water current sprayed from the first intermediate nozzle and the water current sprayed from the second intermediate nozzle are intersected with each other may start from the front side than the middle depth of the drum and then progress backward and may be terminated before reaching the rear surface portion of the drum.

The first intermediate nozzle and the second intermediate nozzle may be disposed symmetrically with respect to the vertical plane.

Each of the plurality of nozzles is capable of spraying water current having a width defined between one side boundary close to itself and the other side boundary opposite to the one side boundary, and at least one of the first lower nozzle and the second lower nozzle may spray the water current in such a manner that the one side boundary is positioned above the other side boundary.

At least one of the first lower nozzle and the second lower nozzle may spray water current in such a manner that one side boundary meets the rear side portion of the drum and the other side boundary meets the rear side of the drum below the one side boundary. The water current sprayed through at least one of the first lower nozzle and the second lower nozzle may form a water film which is inclined downward from the one side boundary to the other side boundary. The water current sprayed through at least one of the first intermediate nozzle and the second intermediate nozzle may include an area which meets the rear surface portion of the drum between the point where the one side boundary meets the rear side portion of the drum and the point where the other side boundary meets the rear side portion of the drum. The section where the water sprayed through at least one of the first lower nozzle and the second lower nozzle meets the drum may be extended downwardly inclined from the point where the one side boundary meets the rear side portion of the drum to the point where the other side boundary meets the rear side portion of the drum.

The portion where the water current sprayed from the first lower nozzle and the water current sprayed from the second lower nozzle are intersected with each other can form a line upward from the front end to the rear end when viewed from the side.

The intersecting portion may reach deeper than the intermediate depth of the drum.

An annular flow path fixed to the gasket and guiding water supplied from the pump may be further included. The plurality of nozzles can be supplied with water through the annular flow path. The pump may be able to accomplish a speed control.

In another aspect, there is provided a washing machine comprising a casing which has an input port, which is formed in a front surface thereof, through which laundry is inputted; a tub which is disposed in the casing to contain fluid, and has a front surface opened to communicate with the input port, a drum which is rotatably disposed in the tub, and contains the laundry; a pump which sends water discharged from the tub; a gasket which communicates the input port and an opening of the tub, and has a plurality of first nozzles and a plurality of second nozzles for spraying water into the drum; a circulation pipe which guides the water sent by the pump, and a nozzle water supply pipe which is fixed to the gasket and guides the water guided through the circulation pipe to the plurality of nozzles, wherein the nozzle water supply pipe comprises: a circulation pipe connection port which is connected to the circulation pipe, a first conduit portion which extends from the circulation pipe connection port and forms a first flow path for guiding the first sub-flow, a plurality of first nozzle water supply ports which are protruded from the first conduit portion and guide the first sub-flow to the plurality of first nozzles, a second conduit portion which extends from the circulation pipe connection port and forms a second flow path for guiding the second sub-flow, and a plurality of second nozzle water supply ports which are protruded from the second conduit portion and guide the second sub-flow to the plurality of second nozzles.

In another aspect, there is provided a washing machine comprising: a casing which has an input port, which is formed in a front surface thereof, through which laundry is inputted; a tub which is disposed in the casing to contain fluid, and has a front surface opened to communicate with the input port; a drum which is rotatably disposed in the tub, and contains the laundry; a pump which sends water discharged from the tub; a gasket which communicates the input port and an opening of the tub, and has a plurality of nozzles for spraying water into the drum; a circulation pipe which guides the water sent by the pump, and a nozzle water supply pipe which is fixed to the gasket and guides the water guided through the circulation pipe to the plurality of nozzles, wherein the nozzle water supply pipe comprises: a circulation pipe connection port which is connected to the circulation pipe, a transfer conduit which branches the water introduced through the circulation pipe connection port in both directions; and a plurality of nozzle water supply ports which are disposed in the transfer conduit, and supply the water guided along the transfer conduit to the plurality of nozzles respectively.

The transfer conduit comprises a first conduit portion extending from the nozzle connection port in a first direction to form a first flow path and a second conduit portion extending from the nozzle connection port in a second direction to form a second flow path.

One end of each of the first conduit portion and the second conduit portion may be connected to the circulation pipe connection port, and the other end of the first conduit and the other end of the second conduit may be separated from each other.

One end of each of the first conduit portion and the second conduit portion may be connected to the circulation pipe connection port, and the other end of the first conduit and the other end of the second conduit may be connected to each other.

In another aspect, there is provided a method of controlling a washing machine, the method comprising the steps of: (a) rotating a drum in one direction so that laundry in a drum rotatably installed in a tub containing water is not dropped from an inner circumferential surface of the drum, and increasing a rotation speed of a pump for supplying water discharged from the tub to at least one nozzle configured to spray water into the drum; (b) controlling the rotation speed of the pump to a preset first rotation speed while rotating the drum in one direction so that the laundry on the inner circumferential surface of the drum rises to a position of less than 90 degrees of the rotational angle of the drum and then is dropped; and (c) rotating the drum in one direction so that the laundry on the inner circumferential surface of the drum rises to a position corresponding to 90 to 110 degrees of a rotation angle of the drum and then is dropped, and controlling the rotation speed of the pump so that the first rotation speed is higher than a second rotation speed.

In addition, the step (a) may include a step of increasing the rotation speed of the pump in correspondence with a time point at which the rotation of the drum starts to accelerate.

In addition, the step (a) may further include a step of braking the pump when the rotation speed of the pump reaches a preset certain rotation speed.

In addition, the step (a) may further include a step of braking the drum in correspondence with a timing at which braking of the pump is started.

In addition, the first rotation speed may be set within a range in which water sprayed through the nozzle does not reach the rear surface portion of the drum.

In addition, the step (b) may include the steps of: accelerating the drum in a stopped state to a preset target rotation speed and maintaining the target rotation speed; and increasing the rotation speed of the pump to the first rotation speed. The step of increasing to the first rotation speed may be started before the rotation speed of the drum reaches the target rotation speed.

In addition, the step (c) may include the steps of: accelerating the drum in a stopped state to a preset target rotation speed and maintaining the target rotation speed; and increasing the rotation speed of the pump to the second rotation speed. The step of increasing to the second rotation speed may be started before the rotation speed of the drum reaches the target rotation speed.

In another aspect, there is provided a method of controlling a washing machine, the method comprising the steps of: (a) rotating the drum at a speed at which the laundry on the inner circumferential surface of the drum rotatably provided in the tub containing water is raised due to the centrifugal force without failing from the inner circumferential surface of the drum, and then braking the drum so that the laundry is dropped from the inner circumferential surface of the drum; and (b) increasing the rotation speed of the pump that sends water discharged from the tub into at least one nozzle configured to spray water into the drum while the laundry is raised due to the rotation of the drum.

The step (b) may include a step of lowering the rotation speed of the pump in response to a time point at which the drum is braked.

The step (a) may include a step of braking the drum after the laundry positioned in the lowermost point of the drum reaches a height corresponding to a rotation angle of the drum of 90 degrees or more and less than 180 degrees.

The step (a) may include a step of braking the drum after the laundry positioned in the lowermost point of the drum reaches a height corresponding to the rotation angle of the drum of degrees.

The step (a) may further include a step of braking the drum and rotating the drum in the opposite direction before the laundry in the drum reaches a position of a rotation angle of the drum of 90 degrees.

The step (a) may be repeatedly performed while changing the rotation direction of the drum, and the step (b) may be repeatedly performed in response to the repetition of step (a).

In the step (b), the rotation speed of the pump may be increased to a speed higher than a rotation speed at which the water current sprayed through the at least one nozzle starts to reach the uppermost point of the drum.

In another aspect, there is provided a method of controlling a washing machine, the method comprising the steps of: (a) rotating the drum in one direction so that the laundry on the inner circumferential surface of the drum rotatably installed in the tub containing water rises to a position of less than 90 degrees in the rotational direction of the drum, and then is dropped; and (b) rotating the drum in one direction so that the laundry on the inner circumferential surface of the drum falls from a position raised to a height higher than a position corresponding to the rotation angle of the drum of less than 90 degrees, wherein the rotation speed of the pump for sending the water discharged from the tub to at least one nozzle configured to spray water into the drum can be controlled to be a preset first rotation speed, during operation of the step (a), and the rotation speed of the pump can be controlled to be a second rotation speed higher than the first rotation speed, during operation of the step (b).

Further, the control method of the washing machine may further include a step of sensing the laundry amount, and the first rotation speed may be determined according to the sensed laundry amount.

In another aspect, the method of controlling a washing machine may include a step of rotating the drum in one direction so that laundry in a drum rotatably disposed in a water-containing tub does not fall from an inner circumferential surface of the drum, and may increase the rotation speed of the pump that supplies water discharged from the tub to at least one nozzle configured to spray water into the drum, while performing the step of rotating the drum in one direction.

In addition, the rotation speed of the pump can start to rise in response to the time point at which the rotation of the drum starts to accelerate.

Further, the control method of the washing machine may further include a step of braking the drum when the rotation speed of the pump reaches a preset maximum rotation speed.

In addition, the rotation speed of the pump may be increased to the maximum rotation speed at a second acceleration slope lower than a first acceleration slope, after rising to a preset spraying rotation speed at the first acceleration slope.

In addition, at the latest when the pump reaches the spraying rotation speed, spraying of water through the at least one nozzle can be started.

Further, the control method of the washing machine may further include a step of sensing an amount of the laundry in the drum. The maximum rotation speed may be set according to the sensed laundry amount.

In addition, if the sensed amount of laundry is less than a preset reference value, the maximum rotation speed is set to a first rotation speed, and if the sensed amount of laundry is equal to or greater than the reference value, the maximum rotation speed can be set to a second rotation speed higher than the first rotation speed.

In addition, the spraying rotation speed may be set according to the sensed laundry amount.

In addition, when the sensed laundry amount is less than the preset reference value, the spraying rotation speed may be set to be higher than when the sensed laundry amount is equal to or greater than the reference value.

In another aspect, there is provided a method of controlling a washing machine comprising a tub containing water; a drum rotatably disposed in the tub; at least one nozzle for spraying water into the drum; a washing motor for rotating the drum; and a pump for sending the water discharged from the tub to the at least one nozzle, the method comprising the steps of: (a) sensing an amount of laundry put in the drum; (b) accelerating the washing motor so that the laundry on the inner circumferential surface of the drum is raised without falling from the inner circumferential surface due to centrifugal force in a state in which water is contained in the tub, and then braking the washing motor so that the laundry falls from the inner circumferential surface: and (c) controlling the pump motor configuring the pump so that water is sprayed through the at least one nozzle while accelerating in response to the acceleration of the washing motor, and decelerating in response to the braking of the washing motor; wherein the acceleration and deceleration of the pump motor in the step (c) may be performed within a rotation speed range set according to the amount of laundry sensed in the step (a).

In addition, the upper and lower limits of the rotation speed range may be set higher as the amount of the laundry sensed in the step (a) falls within a higher laundry amount range.

In addition, the braking of the washing motor in the step (a) may be performed in a state in which the laundry positioned in the lowermost point of the drum reaches a height corresponding to a set angle set at a rotational angle of the drum of less than 90 degrees.

In addition, the set angle may have a value between 30 degrees and 35 degrees.

In addition, the rotation speed range may be set within a range (2200 to 2800 rpm) in which the water current sprayed from the at least one nozzle does not reach the rear surface of the drum.

In addition, the braking of the washing motor in the step (a) may be performed in a state in which the laundry positioned in the lowermost point of the drum reaches a height corresponding to a set angle set at a rotational angle of the drum of less than 90 degrees.

In addition, the braking in the step (a) may be performed in a state in which the laundry positioned in the lowermost point of the drum reaches a height corresponding to a set angle set at a rotation angle of the drum of 90 degrees or more and less than 180 degrees.

Meanwhile, the set angle may have a value ranging from 139 to 150 degrees.

At this time, the upper and lower limits of the rotation speed range may be set higher as the amount of the laundry sensed in the step (a) falls within the higher laundry amount range.

At this time, the upper limit of the rotation speed range may be set within a range in which the water current sprayed from the at least one nozzle reaches the rear surface of the drum.

Meanwhile, the set angle may have a value ranging from 146 to 161 degrees.

In this case, the rotation speed range may be set within a range in which the water current sprayed from the at least one nozzle does not reach the rear surface of the drum when the laundry amount sensed in the step (a) falls within a first laundry amount range, and may be set within a range in which the water current sprayed from the at least one nozzle reaches the rear surface of the drum when the laundry amount sensed in the step (a) falls within a second laundry amount range higher than the first laundry amount range.

In another aspect, there is provided a method of controlling a washing machine comprising a tub containing water; a drum rotatably disposed in the tub; at least one circulation nozzle for spraying water into the drum; a washing motor for rotating the drum; and a pump for sending the water discharged from the tub to the at least one circulation nozzle, the method comprising the steps of: (a) supplying water together with detergent into the tub, and washing the laundry introduced into the drum by rotating the drum; (b) draining water from the tub; (c) supplying detergent-undissolved water into the tub; and (d) rotating the washing motor in one direction so that the laundry is rotated together with the drum without falling from the inner circumferential surface of the drum, and rotating the pump motor configuring the pump so that water is sprayed through the at least one circulation nozzle while the drum is rotating, thereby rinsing the laundry, wherein the step (d) includes the steps of: accelerating the washing motor up to a speed at which the laundry is adhered to the inner circumferential surface of the drum by centrifugal force; and accelerating the pump motor in response to acceleration of the washing motor.

The control method of the washing machine may further include a step of draining water from the tub, during the step (d).

The steps (c) and (d) may be repeatedly performed.

The control method of the washing machine may further include a step (c-1) of rotating the washing motor in one direction at a certain speed so that the laundry on the inner circumferential surface of the drum is raised by the rotation of the drum and then dropped, during the step (c).

In addition, in the step (c-1), the rotation speed of the washing motor may be set so that the laundry is raised to a position corresponding to a certain rotation angle between 90 degrees and degrees of rotation of the drum, and then dropped.

In addition, in the step (d), the washing motor may be accelerated from the rotation speed of the washing motor in the step (c-1).

In addition, the control method of the washing machine may further include a step of following the step (d), and rotating the washing motor at a high speed to spin-dry the laundry in a state in which the operation of the pump motor is stopped.

In addition, the washing machine may further include a direct water nozzle for spraying the water supplied through the water supply valve into the drum. The control method of the washing machine may further include the step of opening the water supply valve and spraying water through the direct water nozzle, during operation of the step (d).

In the step (d), the pump motor may be accelerated up to a speed at which the water current sprayed through the at least one circulation nozzle reaches the rear surface of the drum.

In another aspect, there is provided a method of controlling a washing machine comprising a tub containing water; a drum rotatably disposed in the tub; at least one nozzle for spraying water into the drum; a washing motor for rotating the drum; and a pump for sending the water discharged from the tub to the at least one circulation nozzle, the method comprising the steps of: (a) accelerating the washing motor so that the laundry on the inner circumferential surface of the drum is raised by centrifugal force while being in contact with the drum, in a state in which water is contained in the tub, and then, braking the washing motor so that the laundry is dropped from the inner circumferential surface of the drum; and (b) controlling the pump motor configuring the pump to spray the water through the at least one nozzle while accelerating the pump motor in response to the acceleration of the washing motor, and decelerating the pump motor in response to the braking of the washing motor, wherein the step (b) may include a step of starting the deceleration of the pump motor, after a first time from the braking time point of the washing motor.

The step (b) may include a step of accelerating the pump motor tip to an upper limit of a set rotation speed range, before the first time elapses from the braking time point of the washing motor.

The step (b) includes the steps of accelerating the pump motor at a first rotation acceleration from an acceleration time point of the pump motor to a braking time point of the washing motor; and accelerating the pump motor at a second rotation acceleration lower than the first rotation acceleration until the pump motor reaches the upper limit of the rotation speed range from the braking point of the washing motor.

In addition, when it is determined that the pump motor has reached the upper limit of the rotation speed range before the first time elapses from the braking time point of the washing motor, the step (b) may include a step of controlling the pump motor to maintain the rotation speed which is the upper limit of the rotation speed range.

Meanwhile, in the step (b), the pump motor may be controlled to reach the upper limit of the set rotation speed range, after the second time from the time point at which the washing motor reaches the maximum rotation speed.

In the step (b), the pump motor may be controlled to reach the lower limit of the rotation speed range, after a third time from the time point at which the washing motor reaches the minimum rotation speed. The third time may be equal to or shorter than the second time.

In addition, in the step (b), the pump motor may be configured to reach the upper limit of the rotation speed range, in a section between a time point at which the washing motor reaches the maximum rotation speed and a time point at which the washing motor reaches a minimum rotation speed.

The step (a) may be repeatedly performed while changing the direction of rotation of the drum, and the step (b) may be repeatedly performed in response to the repetition of step (a).

The control method of the washing machine may further include the step (a-1) of sensing the amount of the laundry put into the drum. In the step (b), the acceleration and deceleration of the pump motor may be performed within a rotation speed range set according to the amount of fluid sensed in the step (a-1).

In addition, the upper and lower limits of the rotation speed range may be set higher as the amount of the laundry sensed in the step (a-1) falls within a higher laundry amount range.

In another aspect, there is provided a method of controlling a washing machine comprising a tub containing water; a drum rotatably disposed in the tub; at least one nozzle for spraying water into the drum; a washing motor for rotating the drum; and a pump for sending the water discharged from the tub to the at least one circulation nozzle, the method comprising the steps of (a) accelerating the washing motor so that the laundry in the drum rotates while being in contact with the inner circumferential surface of the drum; (b) accelerating the pump motor configuring the pump in response to acceleration of the washing motor so that water is sprayed through the at least one nozzle; (c) maintaining a first rotation speed at which the laundry is rotated while being in contact with the drum, after accelerating the washing motor up to a set maximum rotation speed; and (d)

decelerating the pump motor within a set rotation range while maintaining the washing motor at the first rotation speed, and then accelerating.

In addition, in the drum, a space between the opened front surface and the rear surface may be divided into a plurality of areas including a first area and a second area closer to the rear surface than the first area. The step (d) may include a step of controlling the pump motor so that the orientation of the water current sprayed through the at least one nozzle is changed from the second area to the first area, while the washing motor is maintained at the first rotation speed.

Further, the control method of the washing machine may further include a step of sensing the amount of the laundry in the drum. The range in which the water current is sprayed in the drum through the at least one nozzle can be set based on the sensed laundry amount.

The step (d) may include a step of controlling the pump motor so that a water current sprayed through the at least one nozzle reaches the rear surface of the drum, when reaching the upper limit of the rotation range.

The step (d) may include the step of controlling the pump motor so as to repeat the process of decelerating when reaching the upper limit of the rotation range and accelerating again when reaching the lower limit of the rotation range.

In the step (b), the pump motor may be accelerated by an acceleration slope corresponding to an acceleration slope of the washing motor.

Further, the control method of the washing machine may further include, after the step (d), the steps of (e) draining water from the tub; and (f) supplying detergent-undissolved water into the tub. The steps (c) to (f) may be repeated the set number of times or for a set period of time.

In another aspect, there is provided a method of controlling a washing machine comprising a tub containing water; a drum rotatably disposed in the tub; at least one nozzle for spraying water into the drum; a washing motor for rotating the drum; and a pump for sending the water discharged from the tub to the at least one nozzle, the method comprising the steps of: (a) rotating the laundry in the drum together with the drum, and accelerating the washing motor up to a first rotation speed so that an empty space surrounded by the laundry is formed by a centrifugal force; (b) accelerating the pump motor configuring the pump within the rotation speed range in response to the acceleration of the washing motor so that water is sprayed through the at least one nozzle; (c) decelerating the washing motor up to a second rotation speed so that the empty space surrounded by the laundry in the drum is reduced; and (d) decelerating the pump motor within the rotation speed range in response to deceleration of the washing motor.

Further, the control method of a washing machine may further include, before the step (a), the steps of: (a-1) accelerating the washing motor so that the laundry on the inner circumferential surface of the drum is raised without falling from the inner circumferential surface due to centrifugal force in a state in which water is contained in the tub, and then braking the washing motor so that the laundry falls from the inner circumferential surface; and (a-2) controlling the pump motor so that water is sprayed through the at least one nozzle, while accelerating in response to the acceleration of the washing motor and decelerating in response to the braking of the washing motor.

The braking of the washing motor in the step (a-1) may be performed in a state in which the laundry positioned in the lowermost point of the drum reaches a height corresponding to a set angle set at a rotational angle of the drum of less than 180 degrees.

In addition, the step (a-1) may be performed in a state in which water in which detergent is dissolved is filled in the drum by a first water level, and the step (a) may be performed in a state in which the water in which detergent is dissolved is filled in the drum by a second water level higher than the first water level.

In addition, the first rotation speed may be 70 rpm or more, and the second rotation speed may be 35 rpm or more and less than 55 rpm.

The control method of a washing machine may further include the step (e) of sensing the amount of laundry in the drum, and the first rotation speed and the second rotation speed may be set according to the laundry amount sensed in the step (e).

Further, the step of (e) sensing the amount of laundry in the drum may be further included, and the rotation speed range may be set according to the amount of laundry sensed in the step (e).

The at least one nozzle may include a pair of upper nozzles for spraying water into a first area on the inner circumferential surface of the drum and a pair of lower nozzles for spraying water to a second area on the inner circumferential surface of the drum. At least a portion of the first area and the second area may be overlapped.

In the step (b), the pump motor may be accelerated up to a rotation speed (2200 to 3600 rpm) at which the water current sprayed from the at least one nozzle reaches the rear surface of the drum, and in the step (d), the pump motor may be decelerated to a rotation speed (1100 to 1600 rpm) at which the water current sprayed from the at least one nozzle reaches a point closer to the front surface than the rear surface on the inner circumferential surface of the drum.

In another aspect, there is provided a method of controlling a washing machine comprising a tub containing water; a drum rotatably disposed in the tub; at least one nozzle for spraying water into the drum; a washing motor for rotating the drum; and a pump for sending the water discharged from the tub to the at least one nozzle, the method comprising the steps of: (a) controlling the washing motor so that the laundry in the drum rises by a first angle in the rotation direction of the drum while being in contact with the inner circumferential surface of the drum, and then is dropped; and (b) controlling the pump motor configuring the pump to rotate at a rotation speed set in correspondence with the water level in the drum so that water is sprayed through the at least one nozzle, during operation of the step (a).

The step (a) may include the steps of: (a-1) controlling the washing motor so that the drum rotates in a state where the water level in the drum is a first water level; and (a-2) controlling the washing motor so that the drum rotates in a state where the water level in the drum is a second water level higher than the first water level. The step (b-1) may include the steps of: (b-1) controlling the pump motor at a first rotation speed in a state in which the water level in the drum is the first water level; and (b-2) controlling the pump motor at a second rotation speed faster than the first rotation speed in a state in which the water level in the drum is the second water level.

The control method of the washing machine may further include the step of (c) sensing the amount of the laundry in the drum. The second water level may be set according to the laundry amount sensed in the step (c).

The step (a) may further include, between the step (a-1) and the step (a-2), a step (a-3) of controlling the washing motor so that the drum rotates in a state in which the water level in the drum is a third water level which is equal to or higher than the second water level and is lower than the first water level, wherein a difference of time (hereinafter, referred to as "first time difference") between the time point of the water supply of the detergent water in the step (a-1) and the time point of the water supply of the detergent water in the step (a-3) is set, a difference of time (hereinafter, referred to as "second time difference") between the time point of the water supply of the detergent water in the step (a-3) and the time point of the water supply of the detergent water in the step (a-2) is set, and the second time difference may be set to a larger value than the first time difference.

The step (b) may include the step (b-3) of changing the rotation speed of the pump motor, in correspondence with the time point when the detergent water is supplied in the step (a).

In the step (b-3), the pump motor may be accelerated by a rotation speed increase amount set based on the water supply amount in the step (a).

In addition, the maximum rotation speed of pump motor may be set according to the amount of laundry sensed in the step (a-1).

The step (b) includes the steps of: (b-1) controlling the pump motor at a first rotation speed; and (b-2) controlling the pump motor at a second rotation speed faster than the first rotation speed, wherein, in the step (b), the pump motor can be accelerated stepwise through a plurality of steps until reaching the maximum rotation speed.

The step (b) may include a step of controlling the pump motor, which has reached the maximum rotation speed, to maintain the maximum rotation speed.

In another aspect, there is provided a method of controlling a washing machine comprising a tub containing water; a drum rotatably disposed in the tub; at least one nozzle for spraying water into the drum: a washing motor for rotating the drum; and a pump for sending the water discharged from the tub to the at least one nozzle, the method comprising the steps of: (a) accelerating and then braking the washing motor, in a state where the detergent-dissolved water is contained in the tub, and controlling the pump motor configuring the pump at a first rotation speed; (b) accelerating and then decelerating the washing motor, in a state where the water level in the drum is a first water level, accelerating the pump motor in response to the acceleration of the washing motor, and decelerating the pump motor in response to the deceleration of the washing motor; (c) accelerating and then decelerating the washing motor, in a state where the water level in the drum is a second water level higher than the first water level, accelerating the pump motor in response to the acceleration of the washing motor, and decelerating the pump motor in response to the deceleration of the washing motor.

In addition, even if the pump motor is rotated at the same speed, the pump motor may be configured such that the distance that the water current sprayed from the at least one nozzle reaches is larger than that in the reverse rotation during the normal rotation. In the step (a), the pump motor may be controlled to rotate in the reverse direction.

Further, the first rotation speed may be set to 1500 rpm or less.

The control method of a washing machine may include, between the step (a) and the step (b), (a-1) accelerating the washing motor up to a second rotation speed so that the laundry in the drum rotates together with the drum and an empty space surrounded by the laundry is formed by centrifugal force; (a-2) accelerating the pump motor configuring the pump within a rotation speed range in response to the acceleration of the washing motor so that water is sprayed through the at least one nozzle; (a-3) decelerating the washing motor up to a third rotation speed so as to reduce the empty space surrounded by the laundry in the drum; and (a-4) decelerating the pump motor within the rotation speed range in response to deceleration of the washing motor.

In addition, the second rotation speed may be 70 rpm or more, and the third rotation speed may be 35 rpm or more and less than 55 rpm.

In addition, in the step (b), the pump motor may be controlled within a rotation speed range lower than the second rotation speed, and in the step (c), the pump motor may be controlled within a rotation speed range which is equal to or lower than the third rotational speed higher than the second rotation speed.

In addition, the step (c) may include a step of changing the rotation speed range of the pump motor, in response to the time point when water is supplied into the tub.

In addition, the at least one nozzle may include a pair of upper nozzles for spraying water into a first area on the inner circumferential surface of the drum and a pair of lower nozzles for spraying water to a second area on the inner circumferential surface of the drum. The step (b) may include a step of controlling the pump motor at a fourth rotation speed so that water is sprayed through the pair of lower nozzles. The step (c) may include a step of controlling the pump motor at a fifth rotation speed so that water is sprayed through the pair of upper nozzles and the pair of lower nozzles.

The at least one nozzle may be provided so that at least a part of the first area is overlapped with at least a part of the second area, when water is sprayed from the pair of upper nozzles and the pair of lower nozzles.

Meanwhile, in the step (a), the pump motor may be controlled at the first rotation speed so that water is sprayed only through the pair of lower nozzles except for the pair of upper nozzles.

In the washing machine of the present invention, since the transfer conduit forming the nozzle water supply pipe is disposed in the outer circumferential portion of the gasket, the circulating water sprayed from the plurality of nozzles is prevented from reaching the transfer conduit, and therefore, the outer circumferential surface of the transfer conduit can be kept clean.

In addition, since the transfer conduit is installed outside the gasket, it is easy to separate the transfer conduit for maintenance repair.

In addition, since the transfer conduit is installed outside the gasket, it is not interfered with the door.

Further, since the water discharged from the tub is guided to the plurality of nozzles through a single common nozzle water supply pipe, there is an effect that the flow path structure for supplying water to the plurality of nozzles is simplified.

In addition, even if permeation washing is performed in a state in which a large amount of laundry is put in, the water sprayed from the nozzle can evenly wet the laundry.

In order to accomplish the above object, the washing machine according to the present invention may spray fluid with various degrees toward the inside of the drum by an annular flow path which is separately installed in the outer side of the gasket.

In addition, since a plurality of nozzle water supply ports are installed at regular intervals in the annular flow path, the water circulated from the drain pump is sprayed into the drum through the nozzle formed in the gasket after passing through each annular flow path connected through the distribution pipe, it is possible to reach the deep position.

Further, since the annular flow path is installed outside the gasket, it is easy to install and separate, and the manufacturing process for installing the annular flow path can be simplified.

Further, since the separately installed annular flow path can be connected to a different circulation pipe formed in the drain pump, the flow rate of the fluid sprayed through the nozzle can be varied.

The control method of the washing machine of the present invention can form the spray water current optimized for each motion, by controlling the rotation speed of the pump differently in the rolling motion and the tumbling motion.

In particular, by controlling the speed variable pump to be lower in the rolling motion than in the tumbling motion, it is possible to induce the spray pattern suitable for the rolling motion, improve the washing performance in the rolling motion, and reduce the variation in the washing performance.

Particularly, in the filtration spraying step, even the laundry positioned deep inside the drum are sufficiently wet. In addition, in the following rolling spray, the physical force applied to the laundry is strengthened, water is saved, and power consumption is reduced. Thereafter, the tumbling spraying step is performed, so that the laundry can be uniformly released to easily enter the spin-dry, and furthermore, the contamination on the laundry can be smoothly removed.

According to the control method of the washing machine of the present invention, in a motion in which the flow of laundry, such as the swing motion, the step motion, or the scrub motion, occurs such that the laundry is raised to a certain height and then falls, the rotation speed of the pump is increased in the course of the rising of the laundry, the water current sprayed through the nozzle can follow the rising laundry, so that the laundry can be effectively wet.

Furthermore, by controlling the rotation speed of the pump to be lowered when the drum is braked, the laundry can be effectively wet by the water sprayed through the nozzle even when the laundry falls.

The control method of the washing machine of the present invention can form the spray water current optimized for each motion, by controlling the rotation speed of the pump in the rolling motion and the tumbling motion differently.

Particularly, by controlling the rotation speed of the speed variable pump lower in the rolling motion than in the tumbling motion during, so that it is possible to induce the spray pattern suitable for the rolling motion, thereby improving the washing performance in the rolling motion, and reducing the deviation of performance.

The control method of the washing machine of the present invention has an effect of evenly washing laundry in the drum by raising the rotation speed of the pump in the filtration motion. That is, when a large amount of the laundry is inputted, in correspondence with the process of expanding an empty space in the drum in the depth direction of the drum, the sprayed water can flow deep inside the drum through the empty space and effectively wet the laundry positioned deep inside the drum, by increasing the water pressure of the water current sprayed from the nozzle.

The control method of the washing machine of the present invention has an effect that both the laundry positioned in the front end of the drum and the laundry positioned in the rear end of the drum can be effectively wet by the water sprayed from the nozzle in the filtration mode, by varying the rotation speed of the pump.

A control method of a washing machine according to the present invention has an effect that the washing performance can be improved, energy consumption is reduced, and laundry wetting is enhanced, by varying the speed of the pump motor in response to the movement of the laundry in the drum caused by the drum driving motion. Particularly, in setting the range in which the speed of the pump motor can be varied, by taking into account the amount of laundry put into the drum, the water current sprayed through the nozzle can be optimized in consideration of the parameters depending on the amount of laundry, such as the movement of the laundry, the portion of the area occupied by the laundry in the drum, and the like.

The washing machine and the control method of the present invention have the effect of evenly dissolving detergent in water by using a circulation pump without adding a separate mechanism for detergent dissolution.

Further, since the detergent is applied to the laundry after the detergent is sufficiently dissolved in the water, the washing power is improved.

Further, since the additional configuration for dissolving the detergent is unnecessary, the manufacturing cost of the washing machine is not increased.

In addition, there is an effect that the un-dissolved detergent is prevented from being applied to the laundry, thereby preventing contamination of the laundry due to detergent coagulation.

The control method of the washing machine of the present invention has an effect of evenly wetting laundry in the drum by increasing the rotation speed of the pump in the filtration motion.

That is, when a large amount of the laundry is inputted, by increasing the water pressure of the water current sprayed from the nozzle in correspondence with the process of expanding the empty space in the drum in the depth direction of the drum, the sprayed water current flows deep into the drum through the empty space so that the laundry positioned deep inside the drum can be effectively wet.

In addition, the control method of the washing machine of the present invention has an effect that both the laundry positioned in the front end of the drum and the laundry positioned in the rear end of the drum can be effectively wet by the water sprayed from the nozzle in the filtration mode, by varying the rotation speed of the pump.

Further, the rinsing performance can be improved, the number of rinsing times can be reduced, and the time required for rinsing can be reduced.

The control method of the washing machine of the present invention has an effect that a time delay is provided between a time point at which the rotation speed of the washing motor starts to decelerate at the time of the drop-inducing motion and a time point at which the rotation speed of the circulation pump motor starts to decelerate so that the laundry can be effectively washed by using the water pressure of the water current sprayed from the nozzle. That is, the rotation speed of the circulation pump motor is maintained at a high speed and the water sprayed from the nozzle applies a physical impact on the laundry with a strong water pressure, with respect to the laundry dropping to the lowermost point from the upper end of the drum as the washing motor starts to decelerate (or brake), so that the washing effect can be improved.

The control method of the washing machine of the present invention has the effect of allowing the laundry to be evenly wet, by using the squeeze motion in the laundry wetting step at the initial stage of washing. That is, by using a squeezing effect of the squeeze motion and an effect of mixing the laundry, it is possible to improve the wetting of the laundry.

In addition, since water is sprayed tridimensionally from a plurality of nozzles including the intermediate nozzle and the lower nozzle, and the circulation pump motor is controlled to vary the spraying point, water is evenly sprayed to the laundry, thereby improving the effect of the laundry wetting.

The control method of the washing machine of the present invention can control the rotation speed of the circulation pump motor to be varied within a certain speed range when the rotation speed of the drum is maintained at high speed during the filtration motion, so that the washing effect during the filtration motion can be improved. That is, by spraying water evenly on the laundry, the rinsing effect can be improved when the filtration motion is performed in the rinsing step.

Further, by spraying water evenly on the laundry during the filtration motion, the laundry can be fixed in a wide open state without being shifted to one place in the drum, thereby improving the spin-dry effect.

The control method of the washing machine of the present invention has an effect of improving the washing effect by using detergent water of high concentration at the initial stage of washing. That is, by increasing the water level in the tub stepwise, it is possible to remove the contaminants of the laundry by using the detergent water of high concentration at the initial stage of washing, and then improve the washing effect by using the water current sprayed from the nozzle in a state where the water level in the tub is increased.

In addition, by controlling the circulation pump motor so that the number of the water currents sprayed from the plurality of nozzles changes during the washing, the circulating water amount can be controlled according to the water level, and washing can be efficiently performed.

The control method of the washing machine of the present invention has an effect of improving the washing effect by using detergent water of high concentration at the initial stage of washing. That is, by increasing the water level in the tub stepwise, it is possible to remove the foreign matter of the laundry by using the detergent water of high concentration at the initial stage of washing, and then, improve the washing effect by using the water current sprayed from the nozzle in a state where the water level in the tub is increased.

DETAILED DESCRIPTION

Figure 1:
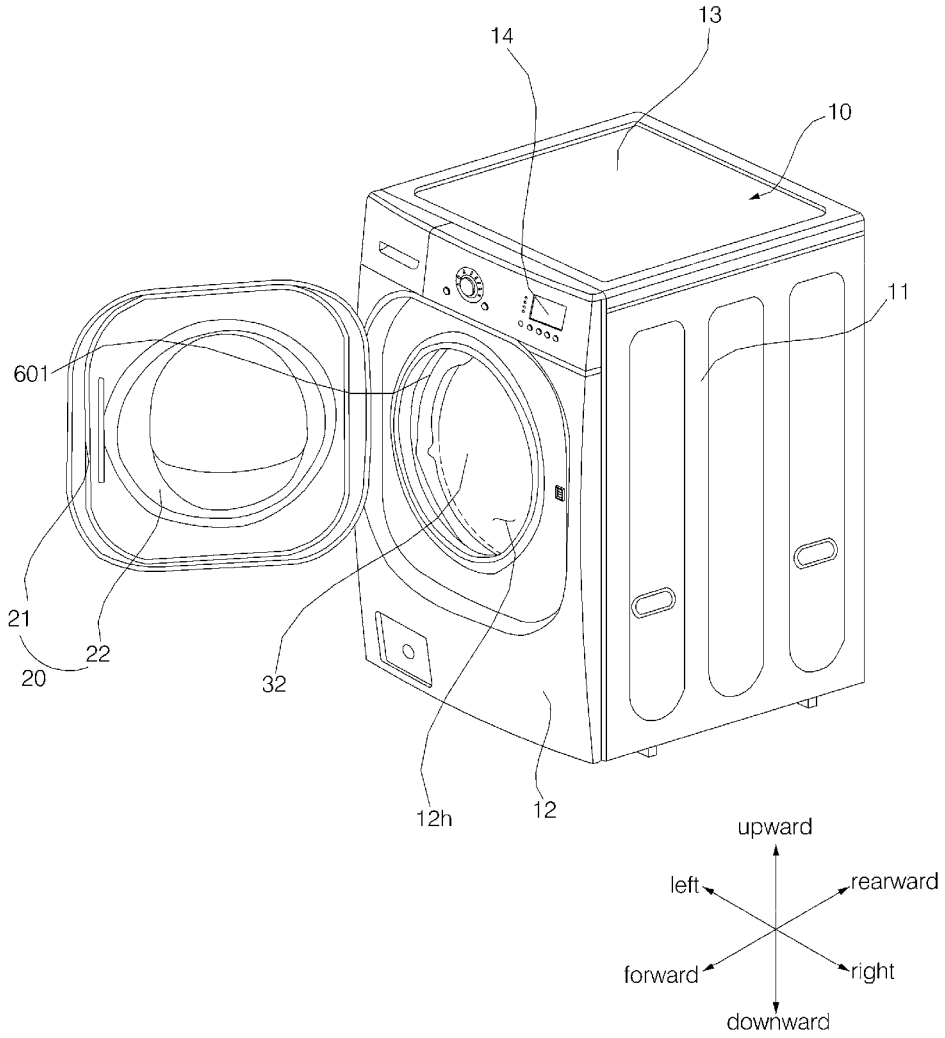
FIG. 1 is a perspective view showing a washing machine according to a first embodiment of the present invention.
Figure 2:
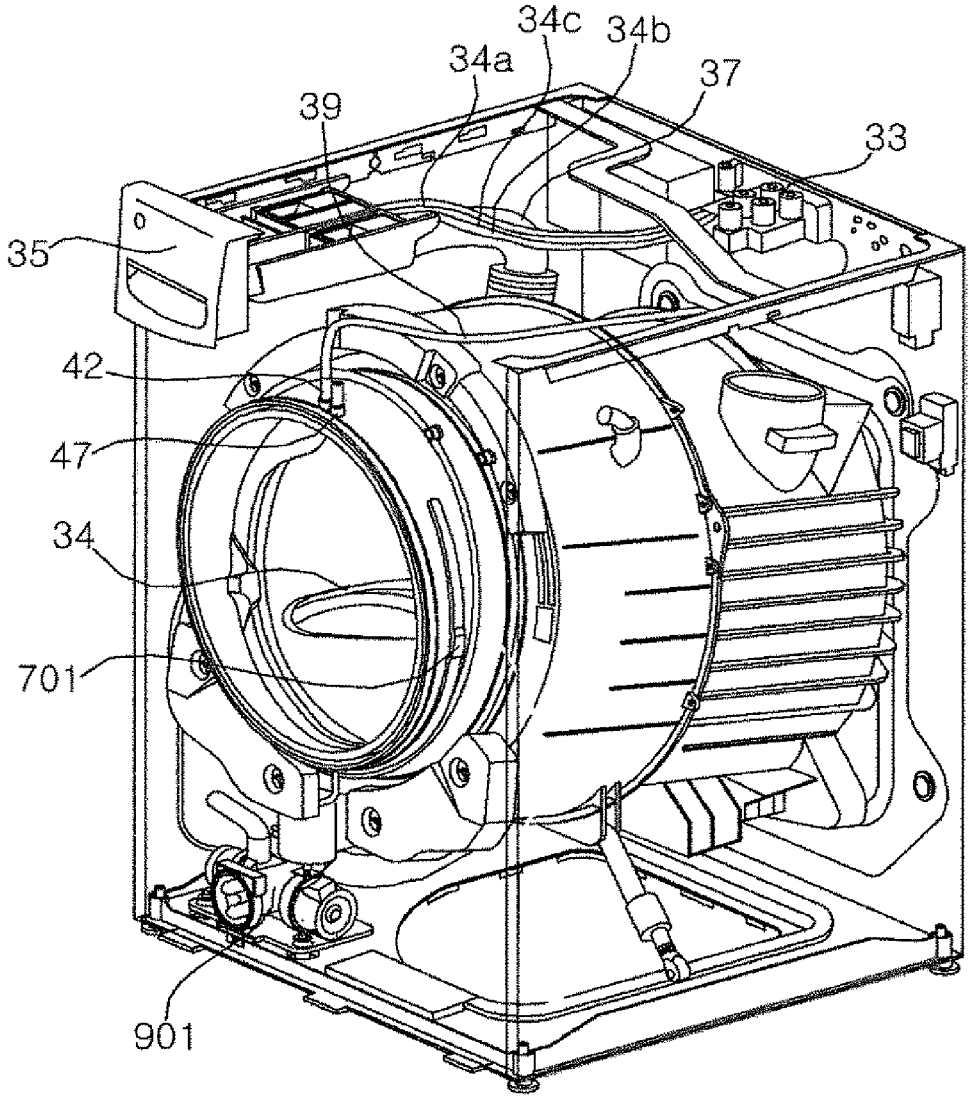
FIG. 2 shows a part of the washing machine shown in FIG. 1.
Figure 3:
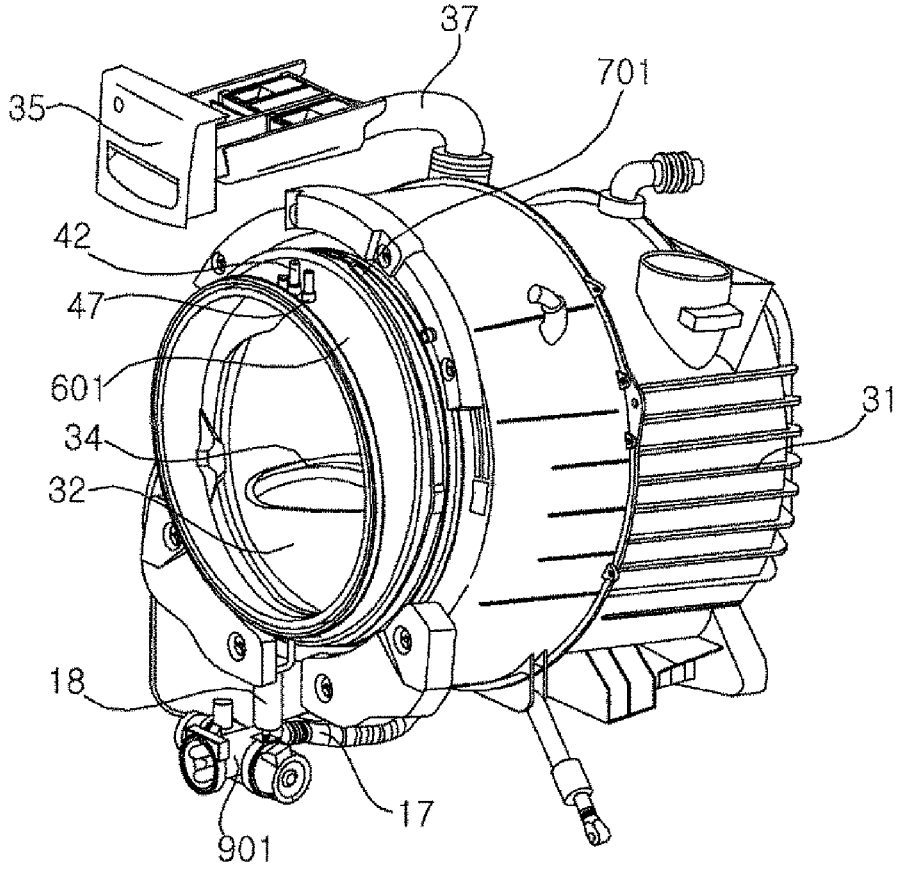
FIG. 3 shows a part of the washing machine shown in FIG. 2.
Figure 4:
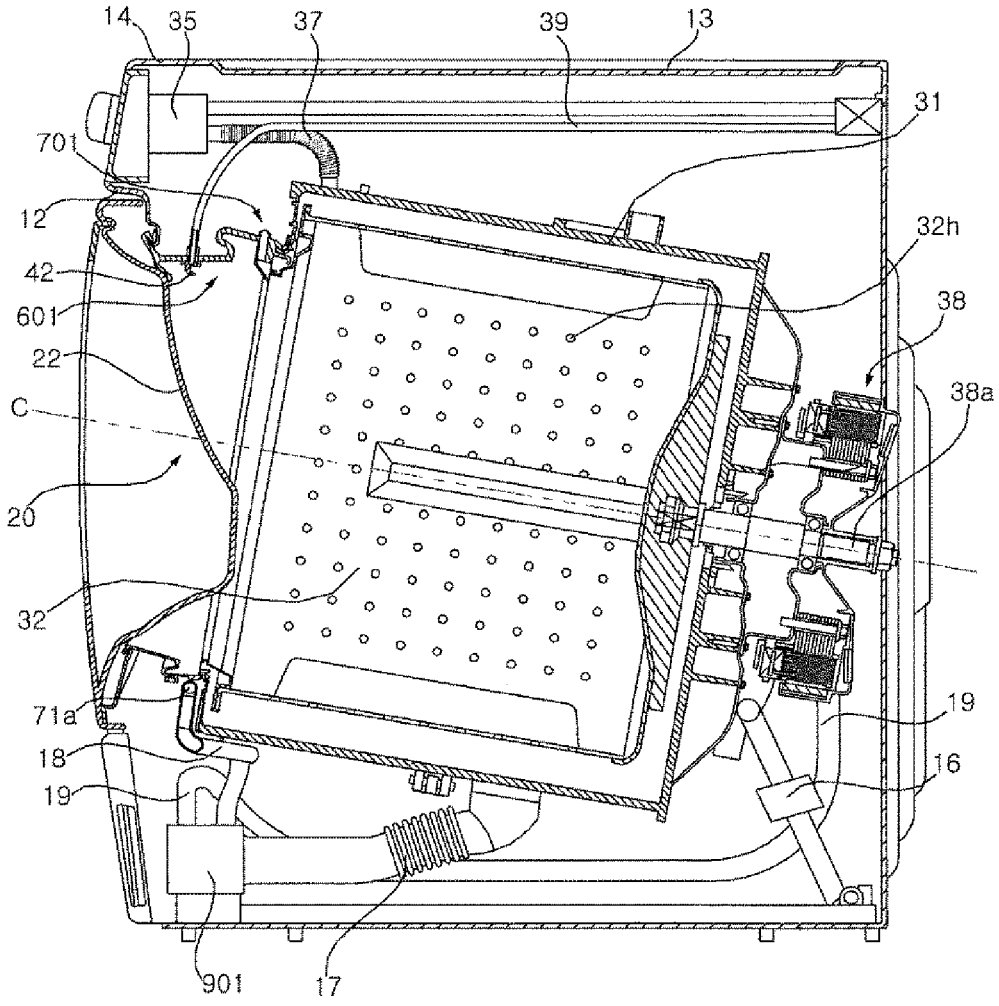
FIG. 4 is a side sectional view of the washing machine shown in FIG. 2.
Figure 5:
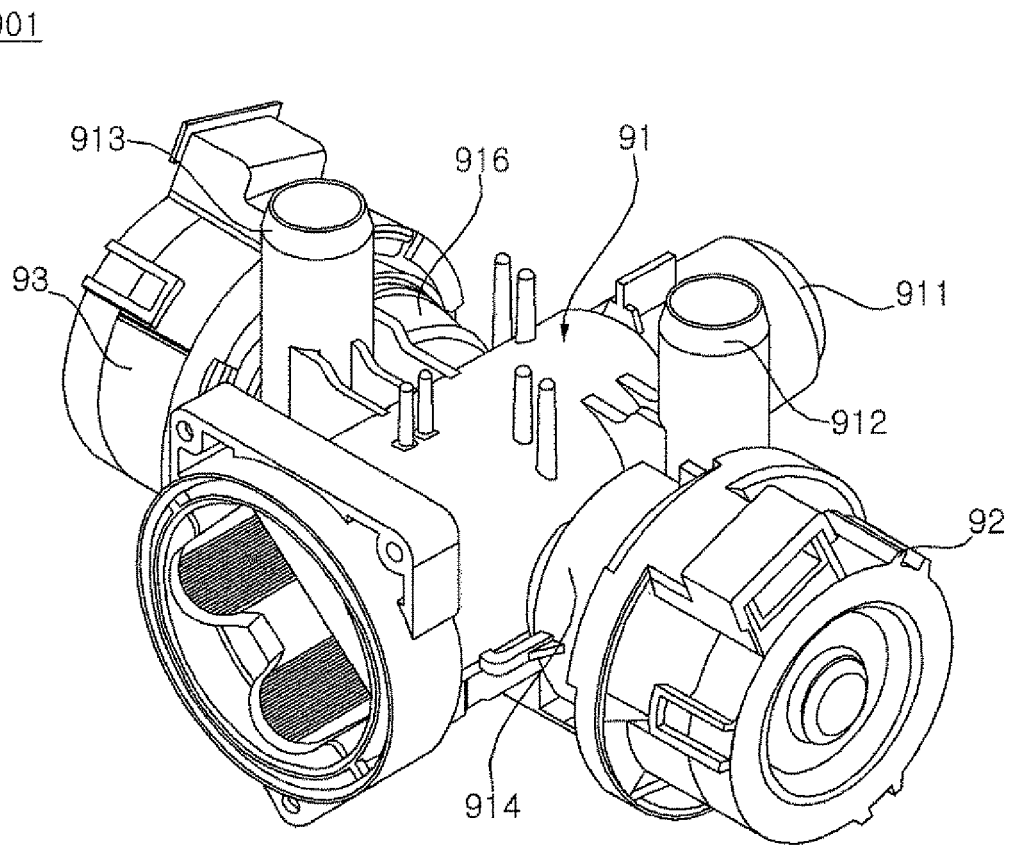
FIG. 5 is a perspective view showing a pump.
Figure 6:
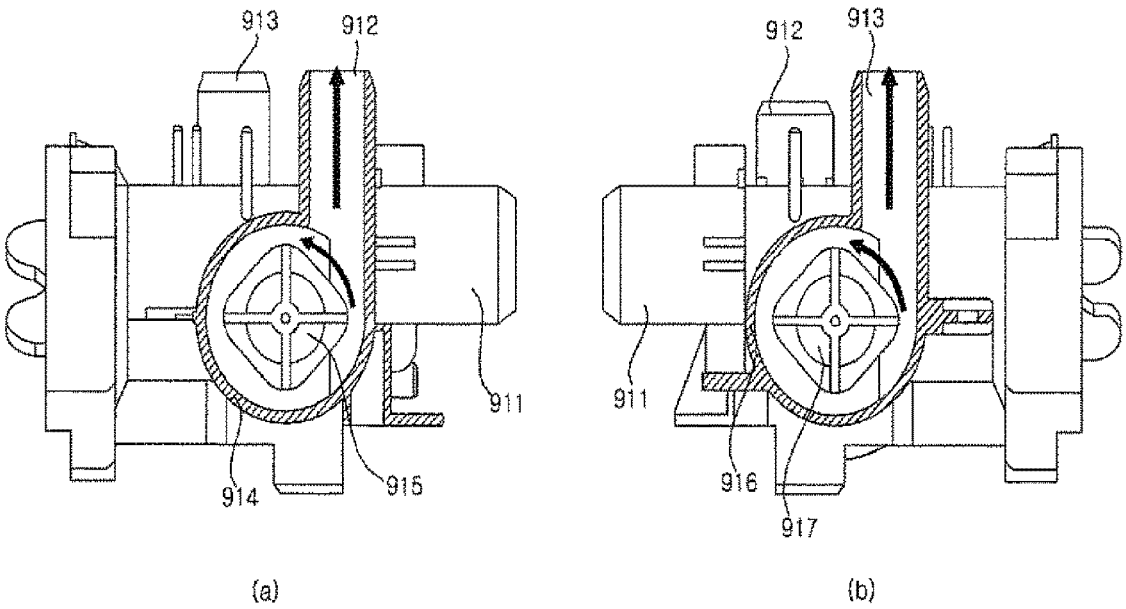
FIG. 6 is a cross-sectional view (a) of a circulating water chamber of the pump shown in FIG. 5, and is a cross-sectional view (b) of a drain chamber.

FIG. 1 is a perspective view showing a washing machine according to a first embodiment of the present invention. FIG. 2 shows a part of the washing machine shown in FIG. 1. FIG. 3 shows a part of the washing machine shown in FIG. 2. FIG. 4 is a side sectional view of the washing machine shown in FIG. 2. FIG. 5 is a perspective view showing a pump. FIG. 6 is a cross-sectional view (a) of a circulating water chamber of the pump shown in FIG. 5, and is a cross-sectional view (b) of a drain chamber.

Referring to FIGS. 1 to 6, a casing 10 forms an outer appearance of the washing machine, and an input port 12*h* through which laundry is inputted is formed on the front surface thereof. The casing 10 may include a cabinet 11 that has a front surface which is opened and has a left surface, a right surface, and a rear surface, and a front panel 12 that is coupled to the opened front surface of the cabinet 11 and has the input port 12*h*. A bottom surface and an upper surface of the cabinet 11 are opened, and a horizontal base 15 supporting the washing machine may be coupled to the bottom surface. In addition, the casing 10 may further include a top plate 13 covering an open top surface of the cabinet 11 and a control panel 14 disposed on the top side of the front panel 12.

In the casing 10, a tub 31 containing water may be disposed. An opening is formed in the front surface of the tub 31 so that the laundry can be inputted. The cabinet 11 and the tub 31 are connected to each other by an annular gasket 601 so that a path for inputting and taking out the laundry is formed in a section ranging from the opening of the tub 31 to the input port 12*h*.

A door 20 for opening and closing the input port 12*h* may be rotatably coupled to the casing 10. The door 20 may include a door frame 21 which is opened at a substantially central portion and is rotatably coupled to the front panel 12 and a transparent window 22 provided at the opened central portion of the door frame 21. The window 22 may be formed in a rearward convex shape so that at least a pail thereof may be positioned within an area surrounded by the inner circumferential surface of the gasket 601.

The gasket 601 serves to prevent water contained in the tub 31 from leaking. The gasket 601 has a front end portion and a rear end portion which are formed in an annular shape respectively, and has a cylindrical shape which is extended from the front end portion to the rear end portion. The front end portion of the gasket 601 is fixed to the casing 10 and the rear end portion is fixed around the opening of the tub 31. The gasket 601 may be made of a flexible or resilient material. The gasket 601 may be made of natural rubber or synthetic resin.

Hereinafter, a portion defining the cylindrical shaped inner side of the gasket 601 is referred to as an inner circumferential portion (or an inner circumferential surface) of the gasket 601 and a portion opposite to the inner circumferential portion is referred to as an outer circumferential portion (or an outer surface) of the gasket 601.

In the tub 31, a drum 32 in which laundry is accommodated may be rotatably provided. The drum 32 accommodates the laundry, is disposed so that an opening through which the laundry is introduced is positioned on the front side, and is rotated around a substantially horizontal rotation center line C. However, in this case, the "horizontal" is not a term used in mathematical sense, That is, when the rotation center line C is inclined at a certain angle with respect to the horizontal as in the embodiment, it may be also considered as substantially horizontal because it is closer to horizontal than vertical. A plurality of through holes 32*h* may be formed in the drum 32 so that water in the tub 31 can be introduced into the drum 32.

A plurality of lifters 34 may be provided on the inner surface of the drum 32. The plurality of lifters 34 may be disposed at a certain angle with respect to the center of the drum 32. When the drum 32 rotates, the laundry is repeatedly lifted up and then dropped by the lifter 34.

A driving unit 38 for rotating the drum 32 may be further provided, and a driving shaft 38*a* rotated by the driving unit 38 may pass through the rear surface portion of the tub 31 and be coupled to the drum 32.

Preferably, the driving unit 38 includes a direct-connection type washing motor. The washing motor includes a stator fixed to the rear side of the tub 31, and a rotor rotated by a magnetic force applied between the rotor and the stator. The driving shaft 38*a* may be rotated integrally with the rotor.

The tub 31 may be supported by a damper 16 provided on the base 15. The vibration of the tub 31 caused by the rotation of the drum 32 is attenuated by the damper 16. Although not shown, according to the embodiment, a hanger (e.g., a spring) for hanging the tub 31 in the casing 10 may be further provided.

At least one water supply hose (not shown) for guiding water supplied from an external water source such as a faucet to the tub 31, and a water supply unit 33 for controlling the water supplied through the at least one water supply hose to be supplied to at least one water supply pipe 34*a*, 34*b*, 34*c* which is described later may be provided.

A dispenser 35 for supplying an additive such as a detergent, a fabric softener or the like into the tub 31 or the drum 32 may be provided. In the dispenser 35, the additives may be classified and accommodated according to their kinds. The dispenser 35 may include a detergent accommodating portion (not shown) for accommodating the detergent and a softening agent accommodating portion (not shown) for accommodating the fabric softener.

At least one water supply pipe 34*a*, 34*b*, 34*c* for selectively guiding the water supplied through the water supply unit 33 to the respective accommodating portions of the dispenser 35 may be provided. The water supply unit 33 may include at least one water supply valve 94 (see FIG. 42) for controlling at least one water supply pipe 34*a*, 34*b*, 34*c*, respectively.

The at least one water supply pipe 34*a*, 34*b*, 34*c* includes a first water supply pipe 34*a* for supplying cold water supplied through a cold water supply hose to the detergent accommodating portion, a second water supply pipe 34*b* for supplying the cold water supplied through the cold water supply hose to the softening agent accommodating portion, and a third water supply pipe 34*c* for supplying hot water supplied through a hot water supply hose to the detergent accommodating portion.

The gasket 601 may be provided with a direct water nozzle 42 for spraying water into the drum 32, and a direct water supply pipe 39 for guiding the water supplied through the water supply unit 33 to the direct water nozzle 42. The direct water nozzle 42 may be a vortex nozzle or a spray nozzle, but is not limited thereto. The direct water nozzle 42 may be disposed on a vertical line V when viewed from the front.

The water discharged from the dispenser 35 is supplied to the tub 31 through a water supply bellows 37. A water supply port (not shown) connected to the water supply bellows 37 may be formed on the side surface of the tub 31.

The tub 31 is provided with a drain port for discharging water, and a drain bellows 17 may be connected to the drain port. A pump 901 for pumping water discharged from the tub 31 through the drain bellows 17 may be provided. A drain valve 96 for controlling the drain bellows 17 may be further provided.

The pump 901 may perform the function of sending the water discharged through the drain bellows 17 to a drain pipe 19, and to a circulation pipe 18 selectively. Hereinafter, the water that is sent by the pump 901 and guided along the circulation pipe 18 is referred to as circulating water.

The pump 901 may include a pump housing 91, a first pump motor 92, a first impeller 915, a second pump motor 93, and a second impeller 917.

An opening port 911, a first discharge port 912, and a second discharge port 913 may be formed in the pump housing 91. A first chamber 914 in which the first impeller 915 is accommodated and a second chamber 916 in which the second impeller 917 is accommodated may be formed in the pump housing 91. The first impeller 915 is rotated by the first pump motor 92 and the second impeller 917 is rotated by the second pump motor 93.

The first chamber 914 and the first discharge port 912 form a volute-shaped flow path wound in the rotation direction of the first impeller 915. The second chamber 916 and the second discharge port 913 form a volute-shaped flow path wound in the rotation direction of the second impeller 917. Here, the rotation direction of each impeller 915, 917 is controllable, and is predetermined. The opening port 911 is connected to the drain bellows 17, and the first chamber 914 and the second chamber 916 communicate with the opening port 911. The water discharged from the tub 31 through the drain bellows 17 is supplied to the first chamber 914 and the second chamber 916 through the opening port 911.

The first chamber 914 communicates with the first discharge port 912, and the second chamber 916 communicates with the second discharge port 913. Accordingly, when the first pump motor 92 is operated and the first impeller 915 is rotated, water in the first chamber 914 is discharged through the first discharge port 912. When the second pump motor 93 is operated, the second impeller 917 is rotated, and water in the second chamber 916 is discharged through the second discharge port 913. The first discharge port 912 is connected to the circulation pipe 18, and the second discharge port 913 is connected to the discharge pipe 19.

The flow rate (or discharge water pressure) of the pump 901 is variable. To this end, the pump motors 92 and 93 may be a variable speed motor capable of controlling a rotation speed. Each of the pump motors 92 and 93 may be a brushless direct current motor (BLDC) motor, but is not necessarily limited thereto. A driver for controlling the speed of the pump motor 92, 93 may be further provided, and the driver may be an inverter driver. The inverter driver converts AC power to DC power, and inputs it to the motor with a target frequency.

A controller 91 (see FIG. 42) for controlling the pump motor 92, 93 may be further provided. The controller may include a proportional-integral controller (PI controller), a proportional-integral-derivative controller (PID controller), and the like. The controller receives an output value (e.g., output current) of the pump motor as an input and, based on this, controls the output value of the driver so that the number of rotations of the pump motor follows a preset target number of revolutions.

The controller 91 (see FIG. 42) may control not only the rotation speed of the pump motor 92, 93, but also the rotation direction thereof. In particular, since an induction motor used in the conventional pump cannot control the rotation direction during operation, it is difficult to control the rotation of each impeller in a preset direction as shown in FIG. 6. Accordingly, there is a problem in that the flow rate discharged from the discharge port 912, 913 varies depending on the rotation direction of the impeller. However, since the present invention can control the rotation direction of the pump motors 92, 93 during operation, the conventional problems do not occur, and the flow rate discharged through the discharge port 912 can be managed constantly.

Meanwhile, it is to be understood that the controller 91 (see FIG. 42) can control not only the pump motor 92, 93 but also the entire operation of the washing machine, and the control of each unit mentioned below is performed under the control of the controller.

Figure 7:
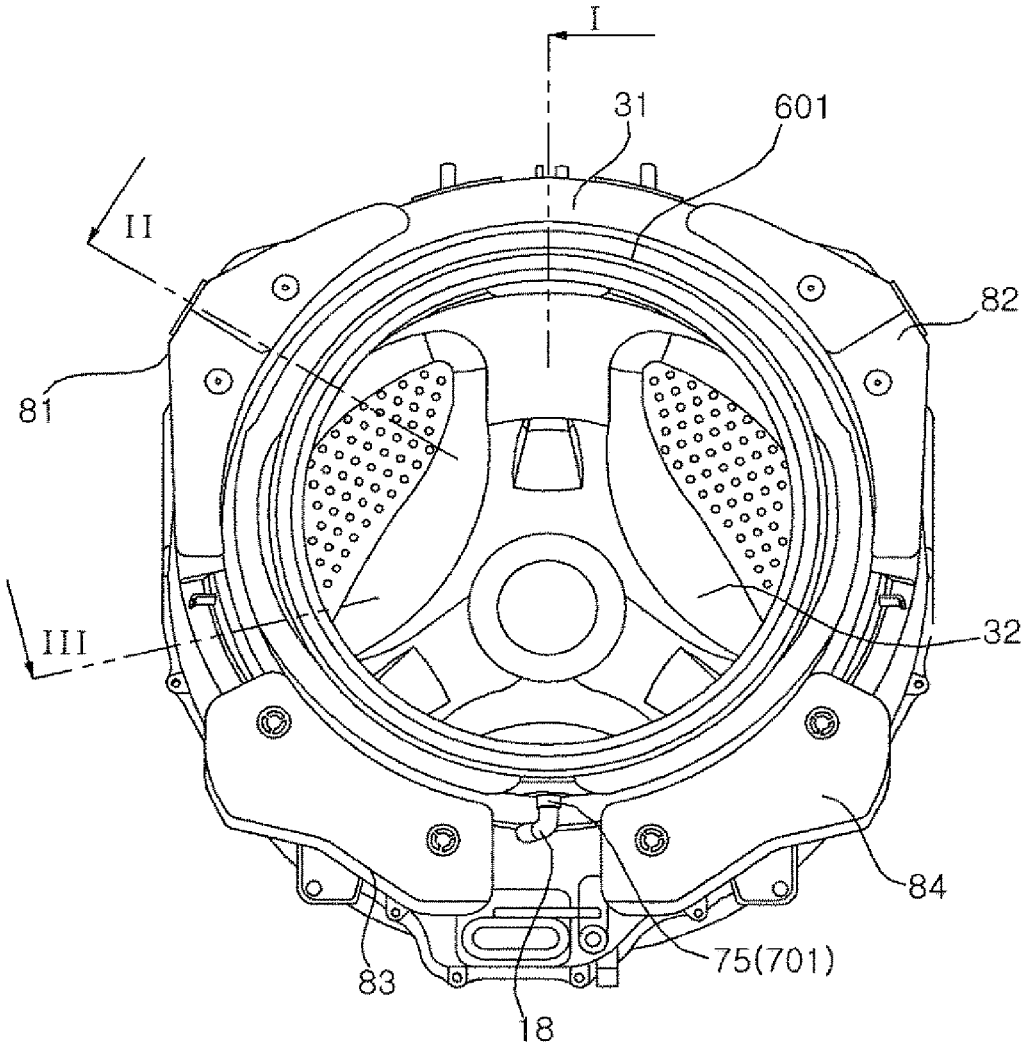
FIG. 7 is a front view of an assembly shown in FIG. 3.

FIG. 7 is a front view of an assembly shown in FIG. 3. Referring to FIG. 7, at least one balancer 81, 82, 83, 84 may be provided on the front surface of the tub 31 along around the opening of the tub 31. The balancer 81, 82, 83, 84 is implemented to reduce the vibration of the tub 31, and is a weight body having a certain weight. A plurality of balancers 81, 82, 83, 84 may be provided. A first upper balancer 81 and a second upper balancer 82 may be provided in the left and right sides in an upper side of the front surface of the tub 31, and a first lower balancer 83 and a second lower balancer 84 may be provided in the left and right sides in a lower side of the front surface of the tub 31.

Figure 8:
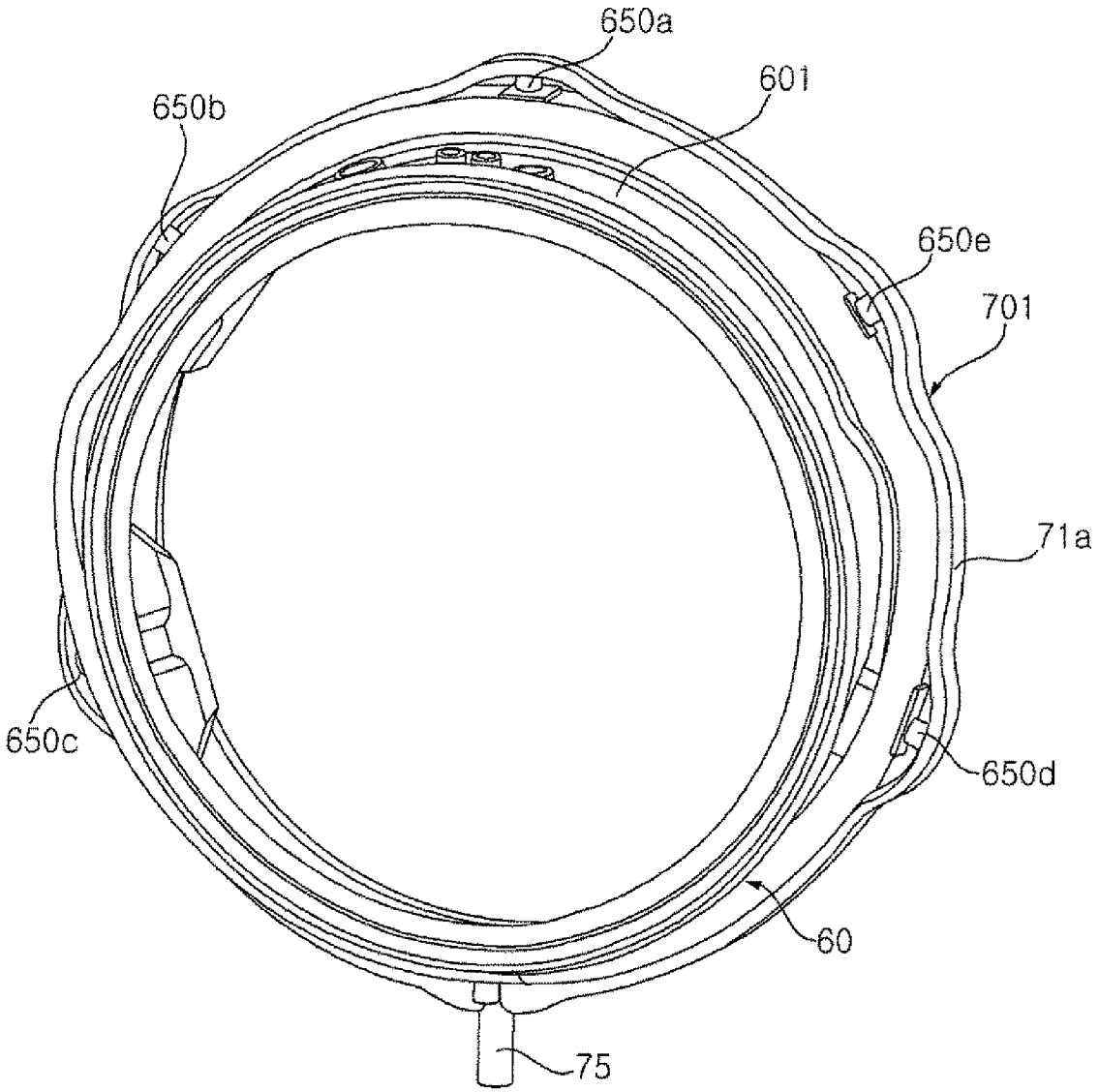
FIG. 8 shows an assembly of a gasket and a nozzle water supply pipe.
Figure 9:
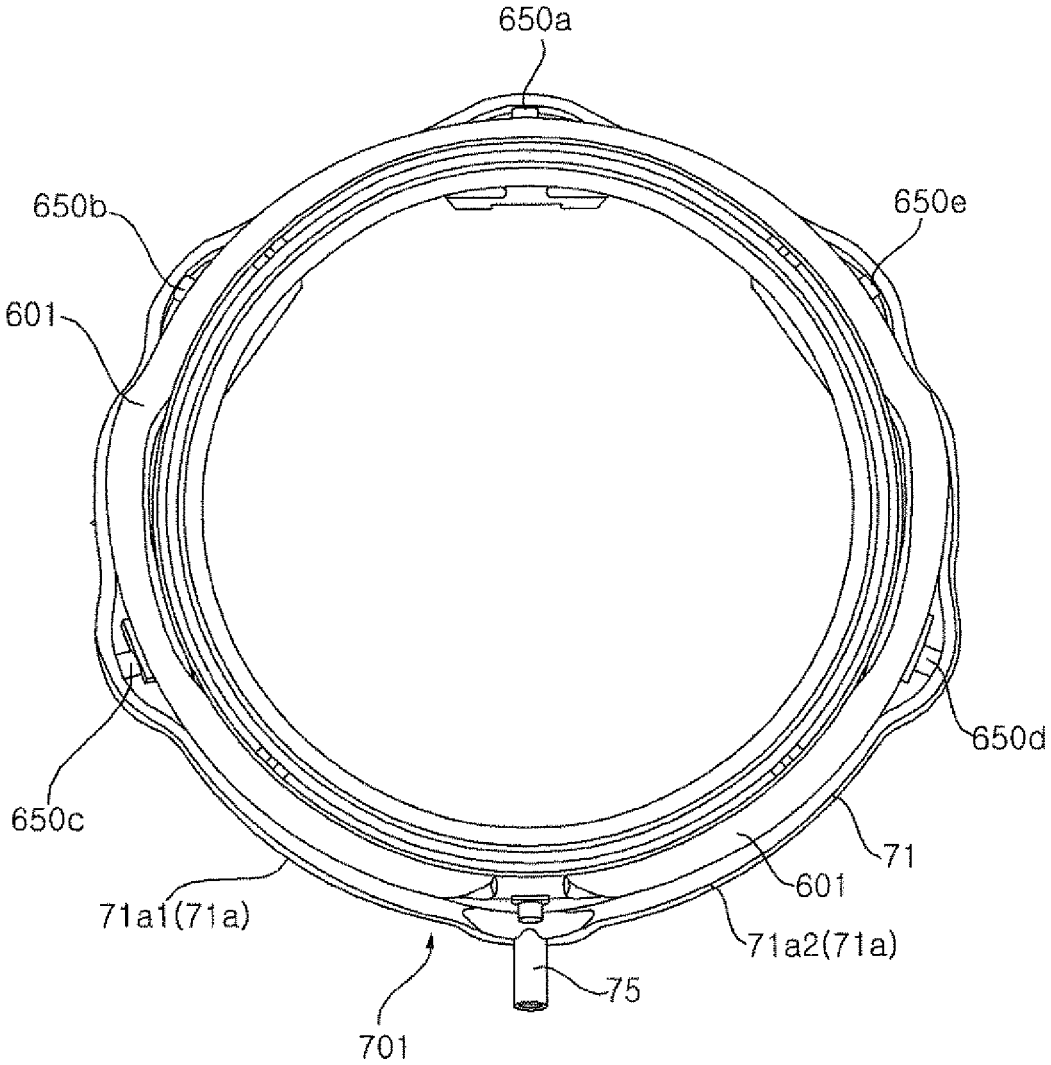
FIG. 9 is a front view of the assembly shown in FIG. 8.
Figure 10:
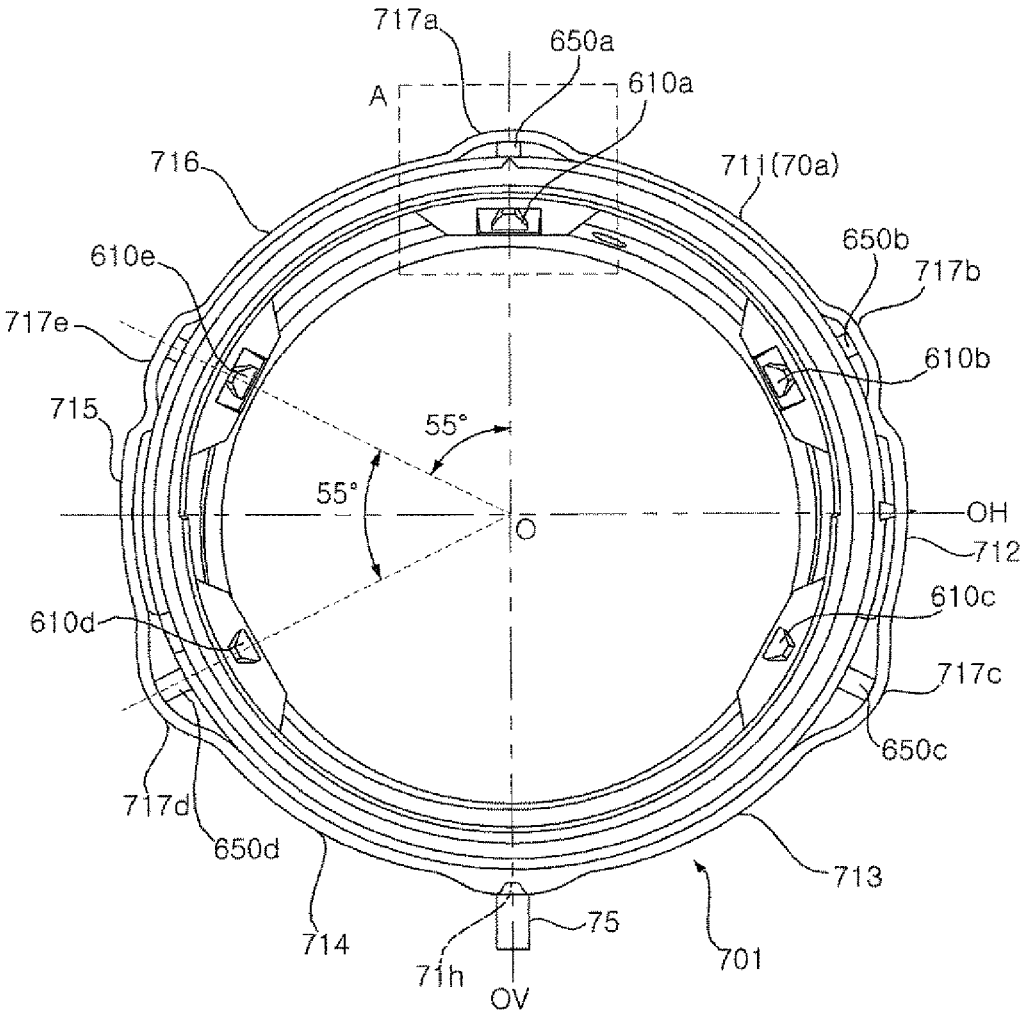
FIG. 10 is a rear view of the assembly shown in FIG. 8.
Figure 11:
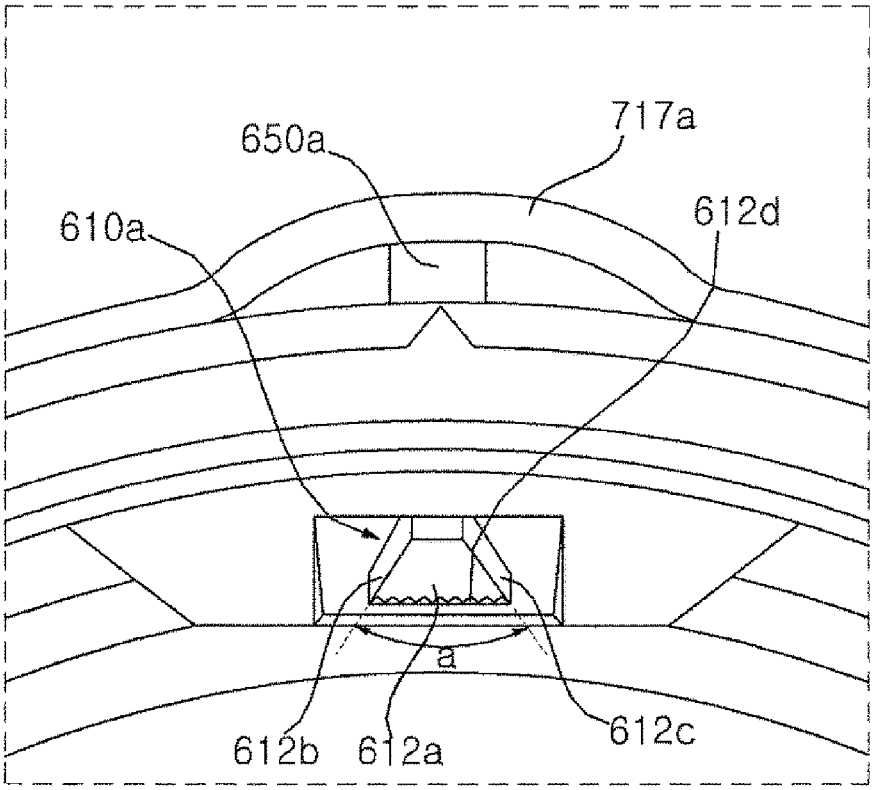
FIG. 11 is an enlarged view of a portion A of FIG. 10.
Figure 12:
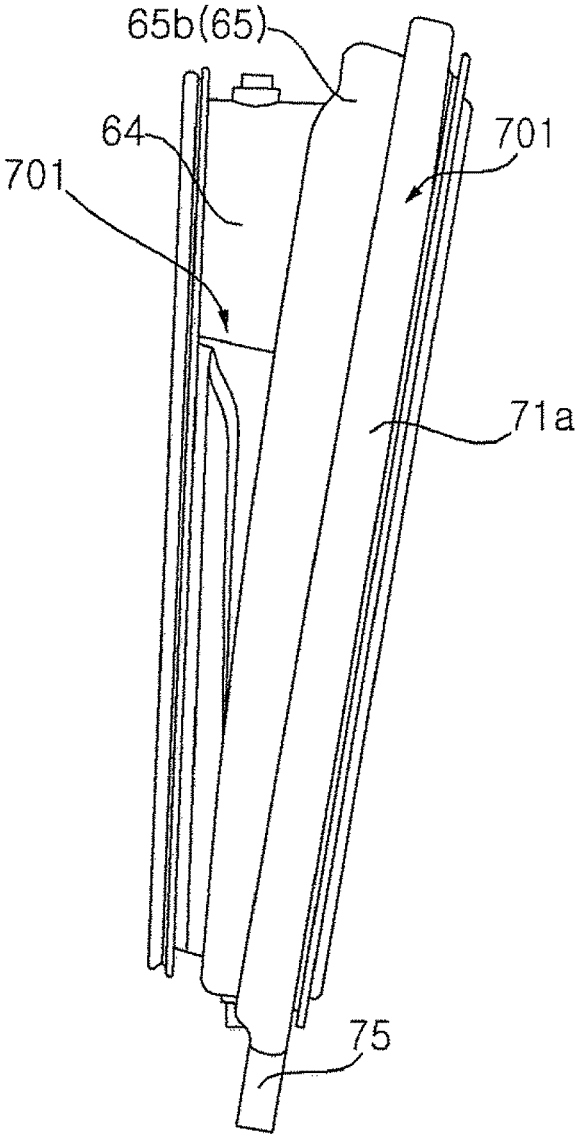
FIG. 12 is a right side view of the assembly shown in FIG. 8.
Figure 13:
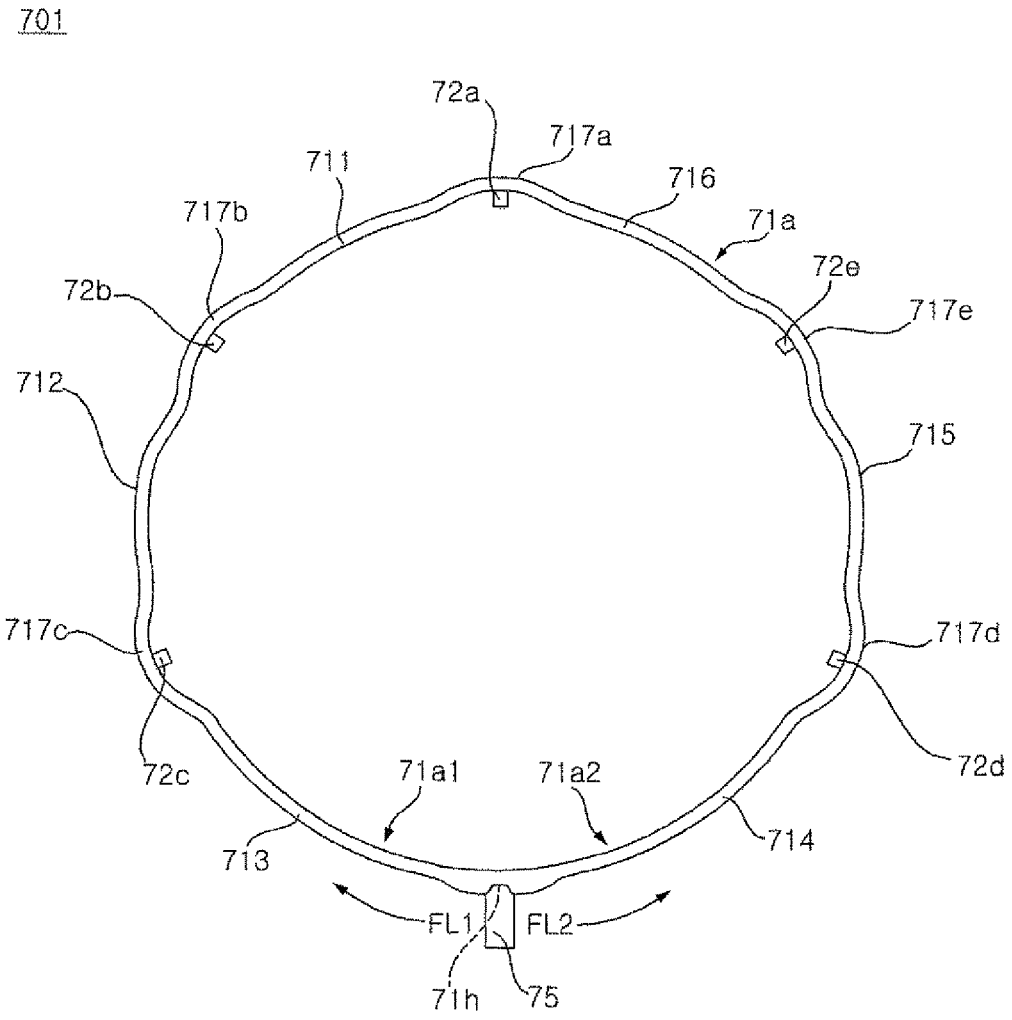
FIG. 13 is a front view of a nozzle water supply pipe.
Figure 14:
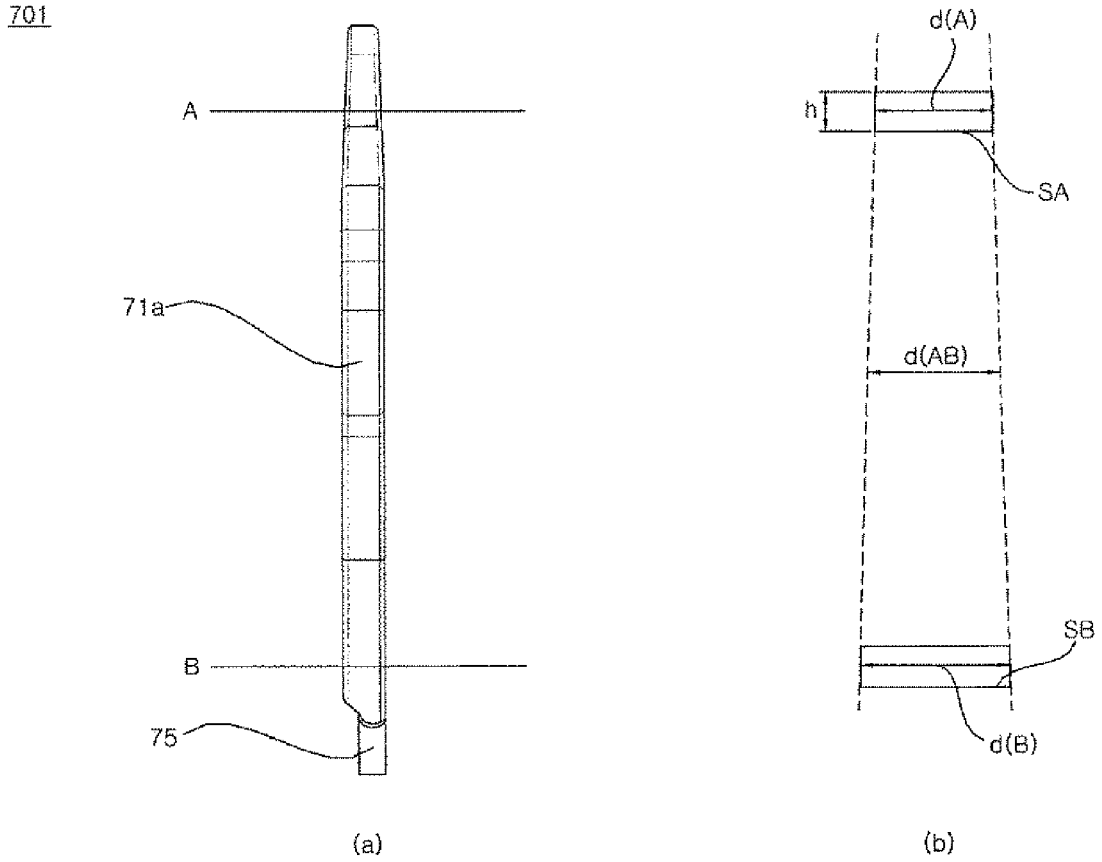
FIG. 14 is a right side view (a) of the nozzle water supply pipe shown in FIG. 13, and a cross-sectional view (b) at points A and B indicated in (a).
Figure 15:
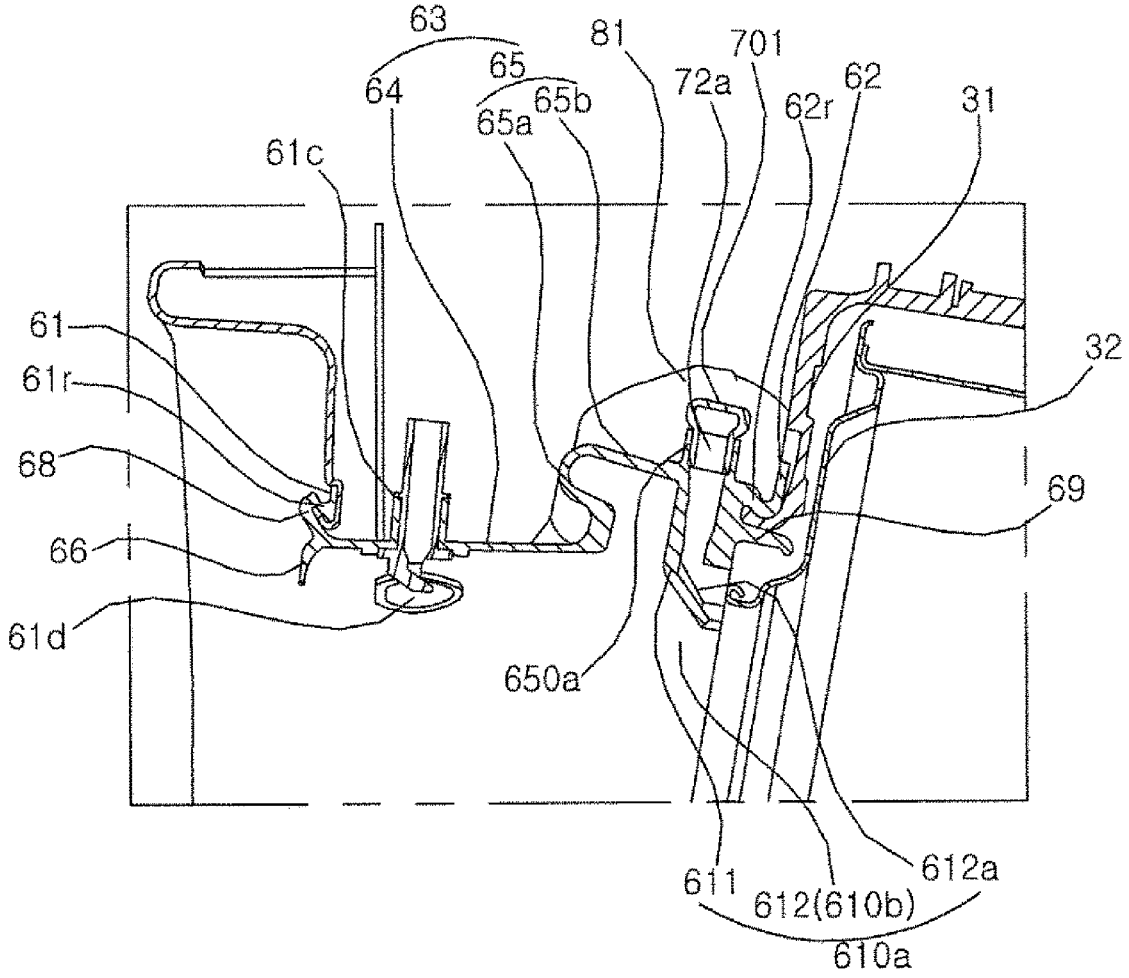
FIG. 15 is a cross-sectional view taken along line I-I of FIG. 7.
Figure 16:
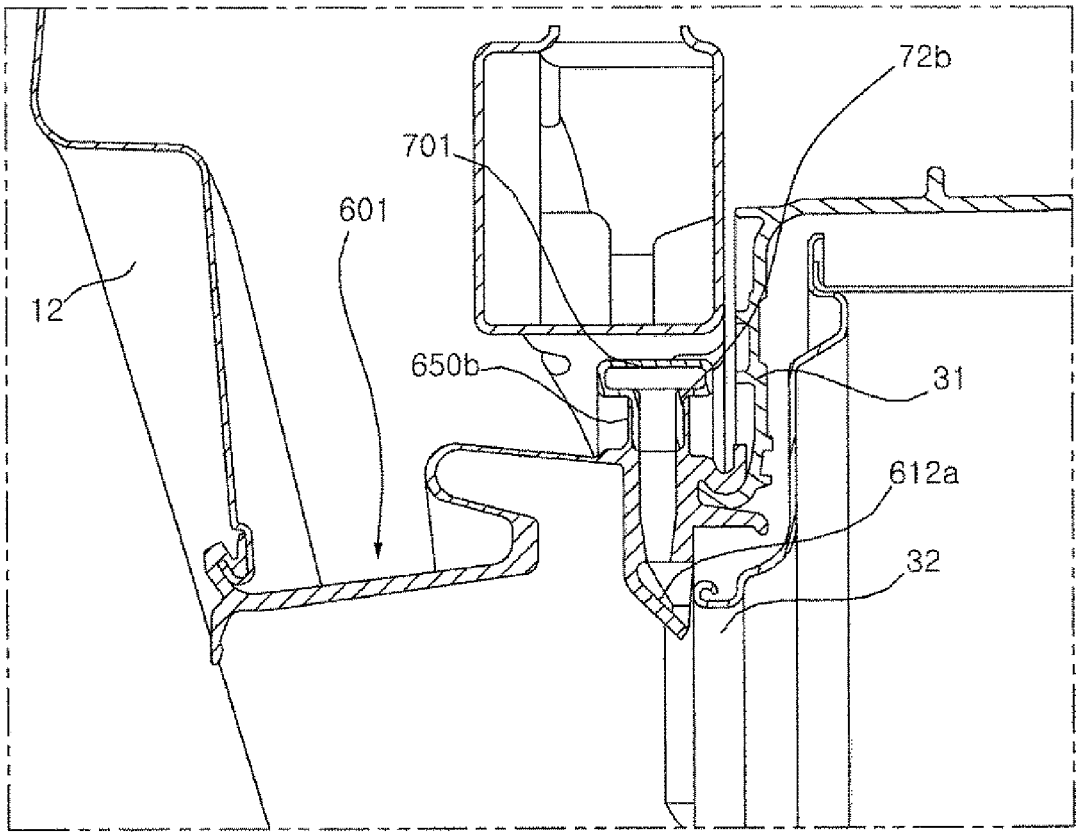
FIG. 16 is a cross-sectional view taken along line II-II of FIG. 7.
Figure 17:
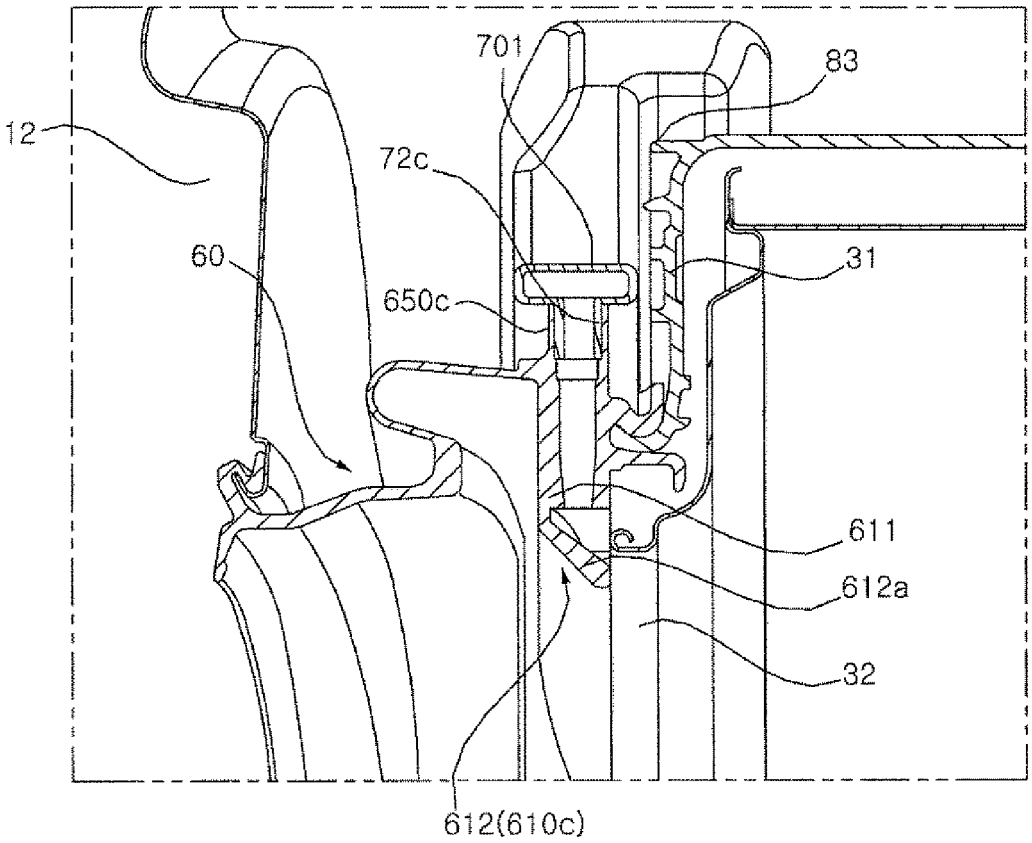
FIG. 17 is a cross-sectional view taken along line III-III of FIG. 7.

FIG. 8 shows an assembly of a gasket and a nozzle water supply pipe. FIG. 9 is a front view of the assembly shown in FIG. 8. FIG. 10 is a rear view of the assembly shown in FIG. 8. FIG. 11 is an enlarged view of a portion A of FIG. 10. FIG. 12 is a right side view of the assembly shown in FIG. 8. FIG. 13 is a front view of a nozzle water supply pipe. FIG. 14 is a right side view (a) of the nozzle water supply pipe shown in FIG. 13, and a cross-sectional view (b) at points A and B indicated in (a). FIG. 15 is a cross-sectional view taken along line I-I of FIG. 7. FIG. 16 is a cross-sectional view taken along line II-II of FIG. 7. FIG. 17 is a cross-sectional view taken along line III-III of FIG. 7.

First, referring to FIG. 15, the gasket 601 includes a casing coupling unit 61 coupled to the circumference of the input port 12*h* of the casing 10, a tub coupling unit 62 coupled to the circumference of the opening of the tub 31, and an extension unit 63 extending from between the casing coupling unit 61 and the tub coupling unit 62.

The casing coupling unit 61 and the tub coupling unit 62 are formed in an annular shape, and the extension unit 63 has an annular rear end portion connected to the tub coupling unit 62 from an annular front end portion connected to the casing coupling unit 61, and may be formed in a cylindrical shape extending from the front end portion to the rear end portion.

In the front panel 12, the circumference of the input port 12*h* is curled outward, and the casing coupling unit 61 may be fitted in a concave portion formed by the curled portion.

The casing coupling unit 61 may be provided with an annular groove 61*r* through which a wire is wound. After the wire is wound along the groove 61*r*, both ends of the wire are engaged so that the casing coupling unit 61 is firmly fixed around the input port 12*h*.

The tub 31 is curled outward around the opening, and the tub coupling unit 62 is fitted in the concave portion formed by the curled portion. The tub coupling unit 62 may be provided with an annular groove 62*r* through which a wire is wound. After the wire is wound along the groove 62*r*, the both ends of the wire are engaged so that the tub coupling unit 62 is firmly fixed around the opening of the tub 31.

Meanwhile, the casing coupling unit 61 is fixed to the front panel 12, but the tub coupling unit 62 is displaced according to the movement of the tub 31. Therefore, the extension unit 63 should be able to be deformed in correspondence with the displacement of the tub coupling unit 62. In order to smoothly perform such a deformation, the gasket 601 may be provided with a folded unit 65 which is folded as the tub 31 is moved in the direction (or radial direction) of movement due to eccentric may be formed in a section (or the extension unit 63) between the casing coupling unit 61 and the tub coupling unit 62.

In more detail, a cylindrical rim unit 64 extending from the casing coupling unit 61 toward the tub coupling unit 62 (or toward the rear side) is formed in the extension unit 63, and the folded unit 65 may be formed between the rim unit 64 and the tub coupling unit 62.

The gasket 601 may include an outer door contact unit 68 which is bent outward from the front end of the rim unit 64 and is in contact with the rear surface of the door 20 in the outside of the opening port 12*h* in a state in which the door 20 is closed. In the casing coupling unit 61, the above-described groove 61*r* may be formed in a portion extending from the outer end of the outer door contact unit 68.

The gasket 601 may further include an inner door contact portion 66 which is bent inward from the front end of the rim unit 64 and is in contact with the rear surface (preferably, the window 22) of the door 20 in the inside of the opening port 12*h* in a state in which the door 20 is closed.

Meanwhile, the drum 32 is vibrated (i.e., the rotation center line C of the drum 32 is moved) during the rotation process, and accordingly, the center line of the tub 31 (approximately, the same as the rotation center line C of the drum 32) also moves, and the moving direction (hereinafter, referred to as "eccentric direction") at this time has a radial component.

The folded unit 65 is folded or unfolded when the tub 31 moves in the eccentric direction. The folded unit 65 may include an inner diameter unit 65*a* bent from the rim unit 64 toward the casing coupling unit 61, and an outer diameter unit 65*b* bent from the inner diameter unit 65*a* toward the tub coupling unit 62 and coupled to the tub coupling unit 62. When the center of the tub 31 is moved in the eccentric direction, if a part of the folded unit 65 is folded, at this portion, a gap between the inner diameter unit 65*a* and the outer diameter unit 65*b* is reduced, whereas the gap between the inner diameter unit 65*a* and the outer diameter unit 65*b* is increased in the other portion where the folded unit 65 is unfolded.

Referring to FIG. 8 to FIG. 17, the gasket 601 includes a plurality of nozzles 610*a*, 610*b*, 610*c*, 610*d*, 610*e* for spraying the circulating water into the drum 32. The plurality of nozzles 610*a*, 610*b*, 610*c*, 610*d*, 610*e* may be formed on the inner circumferential portion of the gasket 601.

A nozzle water supply pipe 701 guides the circulating water sent by the pump 901 to the plurality of nozzles 610*a*, 610*b*, 610*c*, 610*d*, 610*e*, and is fixed to the gasket 601.

The nozzle water supply pipe 701 includes a circulation pipe connection port 75 connected to the circulation pipe 18, a transfer conduit 71*a* for guiding the water introduced through the circulation pipe connection port 75, and a plurality of nozzle water supply ports 72*a*, 72*b*, 72*c*, 72*d*, 72*e* protruded from the transfer conduit 71*a*.

The nozzle water supply pipe 701 branches the circulating water discharged from the circulation pipe 18 to form a first sub-flow FL1 (see FIG. 13) and a second sub-flow FL2 (see FIG. 13). The nozzle water supply pipe 701 is provided with at least one first nozzle water supply port 72*b*, 72*c* formed on a first flow path through which the first sub-flow EL1 is guided so that the circulating water is discharged to a corresponding first nozzle 610*b*, 610*c* through each of the first nozzle water supply ports 72*b*, 72*c*. Similarly, at least one second nozzle water supply port 72*d*, 72*e* is formed on a second flow path through which the second sub-flow FL2 is guided so that the circulating water is discharged to a corresponding second nozzles 610*d*, 610*e* through each of the second nozzle water supply ports 72*d*, 72*e*. The transfer conduit 71*a* may include a first conduit portion 71*a*1 forming the first flow path and a second conduit portion 71*a*2 forming the second flow path.

The nozzles 610*a*, 610*b*, 610*c*, 610*d*, and 610*e* may be divided into a lower nozzle 610*c* and 610*d*, an intermediate nozzle 610*b* and 610*e*, and an upper nozzle 610*a* according to their height on the gasket 601. In the embodiment, five nozzles 610*a*, 610*b*, 610*c*, 610*d*, and 610*e* are provided, and may include a first lower nozzle 610*c* and a second lower nozzle 610*d* disposed tinder the gasket 601, a first intermediate nozzle 610*b* and a second intermediate nozzle 610*e* disposed above the lower nozzles 610*c* and 610*d*, and the upper nozzle 610*a* disposed above the intermediate nozzles 610*b* and 610*e*.

The nozzle water supply ports 72*a*, 72*b*, 72*c*, 72*d*, and 72*e* are provided in correspondence with the number of the nozzles 610*a*, 610*b*, 610*c*, 610*d*, and 610*e*, and each of the nozzle water supply ports 72*a*, 72*b*, 72*c*, 72*d*, and 72*e* supplies the circulating water to a corresponding nozzle 610*a*, 610*b*, 610*c*, 610*d*, and 610*e*. Hereinafter, the nozzle water supply ports 72*a*, 72*b*, 72*c*, 72*d*, and 72*e* may include an upper nozzle water supply port 72*a* for supplying the circulating water to the upper nozzle 610*a*, a first intermediate nozzle water supply port 72*b* for supplying the circulating water to the first intermediate nozzle 610*b*, a second intermediate nozzle water supply port 72*e* for supplying the circulating water to the second intermediate nozzle 610*e*, a first lower nozzle water supply port 72*c* for supplying the circulating water to the first lower nozzle 610*c*, and a second lower nozzle water supply port 72*d* for supplying the circulating water to the second lower nozzle 610*d*.

Meanwhile, among the flow paths formed by the transfer conduit 71*a*, the first flow path is a section which guides the circulating water from an inflow port (71*h*, or outlet of the circulation pipe connection port 75) to the first intermediate nozzle water supply port 72*b* via the first lower nozzle water supply port 72*c*. In this section, the circulating water is guided in a first direction (clockwise direction, when viewed from the front).

Among the flow paths formed by the transfer conduit 71*a*, the second flow path is a section which guides the circulating water from the inflow port 71*h* to the second intermediate nozzle water supply port 72*e* via the second lower nozzle water supply port 72*d*. In this section, the circulating water is guided in a second direction (counterclockwise direction, when viewed from the front).

The first flow path and the second flow path extend from a single inflow port 71*h*. In other words, one end of the first flow path becomes the inflow port 71*h*, and at this time, the other end of the first flow path may be connected to the second flow path. That is, the two flow paths extending from a single common inflow port 71*h* meet each other to form the transfer conduit 71*a*.

In the transfer conduit 71*a*, a portion positioned above the first intermediate nozzle 610*b* and the second intermediate nozzle 610*e* forms a third flow path connecting the first flow path and the second flow path, and the upper nozzle water supply port 72*a* for discharging the circulating water to the upper nozzle 610*a* is formed on the third flow path.

The circulating water discharged through the upper nozzle water supply port 72*a* may be the circulating water which is entirely guided along the first flow path, may be the circulating water which is entirely guided along the second flow path, or may be the mixed circulating water of the circulating water which is guided along the first flow path and the circulating water which is guided along the second flow path, according to the water pressure of the first flow path and the water pressure of the second flow path.

The transfer conduit 71*a* is disposed around the outer circumferential portion of the gasket 601, and is connected to the pump 901 through the circulation pipe 18. Each of the nozzle water supply ports 72*a*, 72*b*, 72*c*, 72*d*, 72*e* protrudes inward along the radial direction from the transfer conduit 71*a*, and is inserted into the gasket 601 to supply the circulating water to a corresponding nozzle 610*a*, 610*b*, 610*c*, 610*d*, 610*e*.

The nozzle water supply pipe 701 may include a circulation pipe connection port 75 which is protruded from the transfer conduit 71*a* and is connected to the circulation pipe 18. The circulation pipe connection port 75 may protrude outward along the radial direction from the transfer conduit 71*a*.

Meanwhile, each of the nozzles 610*a*, 610*b*, 610*c*, 610*d*, 610*e* may include a nozzle inflow pipe 611 (see FIGS. 11 to 13) protruded inwardly in the radial direction from the extension unit 63 of the gasket 601 and a nozzle head 612 connected to the nozzle inflow pipe 611.

The nozzle inflow pipe 611 has one end in which a port through hole is formed and which is connected to the extension unit 63, and has the other end connected to a corresponding nozzle 610*a*, 610*b*, 610*c*, 610*d*, 610*e*.

The gasket 601 may further include a plurality of port insertion pipes 650*a*, 650*b*, 650*c*, 650*d* and 650*e* protruded from the outer circumferential portion of the gasket 601, in positions corresponding to the plurality of nozzle inflow pipes 611. Each of the port insertion pipes 650*a*, 650*b*, 650*c*, 650*d*, and 650*e* communicates with a corresponding nozzle inflow pipe 611, and each of the nozzle water supply ports 72*a*, 72*b*, 72*c*, 72*d*, 72*e* is inserted into a corresponding port insertion pipe 650*a*, 650*b*, 650*c*, 650*d*, 650*e*. The circulating water discharged from the nozzle water supply ports 72*a*, 72*b*, 72*c*, 72*d*, and 72*e* is supplied to the nozzle head 612 through the nozzle inflow pipe 611.

Meanwhile, in order to securely connect the nozzle water supply pipe 701 to the gasket 601, the port insertion pipe 650*a*, 650*b*, 650*c*, 650*d*, 650*e* and the nozzle water supply port 72*a*, 72*b*, 72*c*, 72*d*, 72*e* can be united to each other by using a clamp (not shown), in a state in which the nozzle water supply port 72*a*, 72*b*, 72*c*, 72*d*, 72*e* is inserted into the port insertion pipe 650*a*, 650*b*, 650*c*, 650*d*, 650*e*. That is, the outer circumferential portion of the port insertion pipe 650*a*, 650*b*, 650*c*, 650*d*, 650*e* is tightened by using the clamp so that the nozzle water supply port 72*a*, 72*b*, 72*c*, 72*d*, 72*e* can be fixed so as not to be detached.

Each of the port insertion pipes 650*a*, 650*b*, 650*c*, 650*d*, 650*e* and a corresponding nozzle inflow pipe 611 are extended in the substantially same line and, preferably, extended toward the center O of the nozzle water supply pipe 701.

The plurality of nozzles 610*a*, 610*b*, 610*c*, 610*d*, and 610*e* may include the upper nozzle 610*a* which sprays the circulating water downward, a pair of intermediate nozzles 610*b* and 610*e* which are disposed below the upper nozzle 610*a* to spray the circulating water downward, while spraying the circulating water deeper into the drum 32 in comparison with the upper nozzle 610*a*, and a pair of lower nozzles 610*c* and 610*d* which are disposed below the pair of intermediate nozzles 610*b* and 610*e*, and sprays the circulating water upward.

The pair of lower nozzles 610*c* and 610*d* may include a first lower nozzle 610*c* and a second lower nozzle 610*d* which are symmetrically disposed.

The pair of intermediate nozzles 610*b* and 610*e* may include a first intermediate nozzle 610*b* and a second intermediate nozzle 610*e* which are symmetrically disposed.

Hereinafter, the configuration of the upper nozzle 610*a* described with reference to FIGS. 10, 11, and 15 may be identically applied to other nozzles 610*b*, 610*c*, 610*d*, and 610*e*. Referring to FIG. 10, FIG. 11, and FIG. 15, the upper nozzle 610*a* may be formed in the extension unit 63 of the gasket 601, and preferably, is protruded from the inner circumferential surface of the outer diameter unit 65*b* Specifically, the nozzle inflow pipe 611 is in the form of a cylindrical shape, and is protruded from the inner circumferential surface of the outer diameter unit 65*b* and is connected to a corresponding nozzle head 612.

The nozzle head 612 may include a collision surface 612*a* with which water discharged from the nozzle water supply port 72*a* collides, and a left side surface 612*b* and a right side surface 612*c* which respectively extend from the left side and the right side of the collision surface 612*a*, and define the left and right boundaries of the water current flowing along the collision surface 612*a*.

The angle (α) formed by the left surface 612*b* and the right surface 612*c* of the nozzle head 612 is approximately 45 to 55 degrees, preferably, 50 degrees, but is not necessarily limited thereto.

A plurality of protrusions 612*d* may be disposed in the lateral direction (or in the width direction of the water current) in the end of the collision surface 612*a* which forms an outlet of the nozzle head 612, or in a portion near the outlet. The water current progressing along the collision surface 612*a* collides with the protrusion 612*d*, and then is sprayed through the outlet. In the case of the water current sprayed through the nozzle head 612, a portion of the water which passed through between the protrusions 612*d* and is sprayed becomes thick, while a portion of the water sprayed after passing over the protrusion 612*d* is formed to be relatively thin. Accordingly, it is formed in such a manner that a thin water film is spread between thick main water currents.

The circulation pipe connection port 75 is connected to the transfer conduit 71*a* from below any one of the plurality of nozzles 610*a*, 610*b*, 610*c*, 610*d*, and 610*e*. Preferably, the circulation pipe connection port 75 is connected to the lowermost point of the transfer conduit 71*a*.

That is, the inflow port 71*h* of the transfer conduit 71*a* through which the water introduced from the circulation pipe connection port 75 may be positioned in the lowermost point. The pair of intermediate nozzles 610*b* and 610*e* are formed in the upper side of the inflow port 71*h* and may be disposed on the left and right sides respectively based on the inflow port 71*h*. The pair of intermediate nozzles 610*b* and 610*e* are disposed symmetrically with respect to a vertical line OV passing through the center O of the transfer conduit 71*a* (see FIG. 10), and therefore, the spraying direction of respective intermediate nozzles 610*b* and 610*e* is also symmetrical with respect to the vertical line OV.

The pair of intermediate nozzles 610*b* and 610*e* may be positioned above the center O of the nozzle water supply pipe 71*a* or the center C of the drum 32 (Note that OH indicated in FIG. 10 is a horizontal line passing through the center O). Since each intermediate nozzle 610*b*, 610*e* sprays the circulating water downward, when the drum 32 is viewed from the front, the circulating water passes through an area above the center C of the drum 32 in the opening side of the drum 32, and is sprayed downwardly inclined as it moves deeper into the drum 32.

The pair of lower nozzles 610*c* and 610*d* are disposed above the inflow port 71*h*, but below the pair of intermediate nozzles 610*b* and 610*e*. The pair of lower nozzles 610*c* and 610*d* may be disposed in the left and right sides of the inflow port 71*h* and, preferably, disposed symmetrically with respect to the vertical line OV so that the spraying directions of respective lower nozzles 610*c*, 610*d* are symmetrical with respect to the vertical line OV.

The pair of lower nozzles 610*c* and 610*d* may be positioned below the center O of the nozzle water supply pipe 701 or the center of the drum 32. Since respective lower nozzles 610*c* and 610*d* spray the circulating water upward, when the drum 32 is viewed from the front, the circulating water passes through an area below the center C of the drum 32 in the opening side of the drum 32, and is sprayed upwardly inclined as it moves deeper into the drum 32.

The upper nozzle 610*a* is preferably disposed on a vertical line OV, and the shape of the circulating water sprayed through the upper nozzle 610*a* is symmetrical with respect to the vertical line OV.

Meanwhile, the transfer conduit 71*a* may include a plurality of uplift portions 717*a*, 717*b*, 717*c*, 717*d*, and 717*e* which are convex outwardly in the radial direction in comparison with a peripheral portion. The uplift portions 717*a*, 717*b*, 717*c*, 717*d*, and 717*e* may be formed in positions corresponding to the plurality of nozzle inflow pipes 611, and are convex in a direction away from the outer circumferential portion of the gasket 601. The nozzle water supply ports 72*a*, 72*b*, 72*c*, 72*d*, and 72*e* may be protruded from the respective uplift portions 717*a*, 717*b*, 717*c*, 717*d*, and 717*e*.

As shown in FIGS. 10 and 13, the uplift portions 717*a*, 717*b*, 717*c*, 717*d*, and 717*e* are disposed in a position corresponding to the upper nozzle 610*a*, a pair of intermediate nozzles 610*b* and 610*e*, and a pair of lower nozzles 610*c* and 610*d*, respectively. Hereinafter, these are, sequentially from the top to the counterclockwise direction, referred to as a first uplift portion 717*a*, a second uplift portion 717*b*, a third uplift portion 717*c*, a fourth uplift portion 717*d*, and a fifth uplift portion 717*e*. Connecting units 711, 712, 713, 714, 715, and 716 corresponding to a section between the uplift portions 717*a*, 717*b*, 717*c*, 717*d*, and 717*e* are referred to as a first connecting unit 71*l*, a second connecting unit 712, a third connecting unit 713, 714, a fourth connecting unit 715, and a fifth connecting unit 716, respectively.

Here, the third connecting unit 713, 714 is positioned between the outer circumferential portion of the gasket 601 and the lower balancer 83, 84. The third uplift portion 717*c* is disposed between the first upper balancer 81 and the first lower balancer 83, and the fourth uplift portion 717*d* is disposed between the second upper balancer 82 and the second lower balancer 83. As in the embodiment, when the third uplift portion 717*c* and the fourth uplift portion 717*d* are difficult to be disposed as a gap between the lower balancer 83 and the outer circumferential portion of the gasket 601 is narrow, the third connecting unit 713, 714 is disposed within the gap, and the third uplift portion 717*c* and the fourth uplift portion 717*d* are disposed between the lower balancer 83, and the tipper balancers 81 and 82, thereby facilitating the mounting of the nozzle water supply pipe 701.

Referring to FIG. 14, the cross-section of the transfer conduit 71*a* may have a shape in which a height defined in the radial direction is shorter than a width defined in the longitudinal direction (or the front-rear direction of the washing machine) of the gasket 601. For example, the cross-section of the transfer conduit 71*a* may have a substantially rectangular shape. In this case, the long side of the rectangle becomes the above mentioned width, and the short side becomes the above mentioned height. Due to such a structure, the transfer conduit 71*a* can be installed within a narrow gap between the gasket 601 and the balancers 81, 82, 83, and 84.

The cross-section of the inner space (i.e., a space through which the circulating water is guided) formed by the transfer conduit 71*a* may also be formed in a shape having a height h shorter than the width d.

The inner side cross-section of the transfer conduit 71*a* (i.e., the cross-section of the inner space formed by the transfer conduit 71*a*) may be formed such that the area of annular shape becomes smaller as it progresses from the lower side to the upper side. Since a height from the pump 901 increases toward the upper side of the transfer conduit 71*a*, the width of the inner cross-section in the upper side of the transfer conduit 71*a* rather than the lower side is reduced in order to compensate for water pressure. The cross-section SA and the cross-section SB shown in (b) in FIG. 14 show the inner cross-section of the transfer conduit 71*a* in points A and B indicated in (a) in FIG. 14, and show that the width d (A) of the cross-section in the point A is shorter than the width (d(B)) of the cross-section in the point B. (d(A)<d (AB)<d(B)

Meanwhile, the circulating water supplied through the circulation pipe 18 flows into the nozzle water supply pipe 71*a* through the circulation pipe connection port 75, is branched to both sides and rises along the flow path, and sprayed sequentially from the nozzle positioned below. The operating pressure of the pump 901 may be controlled to such an extent that the sent water can reach the upper nozzle 610*a*.

The controller may vary the spraying pressure of the nozzles 610*a*, 610*b*, 610*c*, 610*d*, and 610*e* by controlling the speed of the first pump motor 92. As one embodiment of such a spraying pressure control, the speed of the first pump motor 92 can be variably controlled within a range in which spraying is simultaneously performed by all of the nozzles 610*a*, 610*b*, 610*c*, 610*d*, and 610*e*. A filtration motion in which the laundry is rotated together with the drum 32 in a state in which the laundry adheres to the inner surface of the drum 32 may be performed, while the circulating water is sprayed by the nozzles 610*a*, 610*b*, 610*c*, 610*d*.

The filtration motion may be performed a plurality of times. The acceleration of the first pump motor 92 can be synchronized with the start timing of each of the filtration motions, and the deceleration can be synchronized with the timing of braking the drum 32 for the finish of each of the filtration motions.

That is, when the drum 32 starts to accelerate for the filtration motion, the first pump motor 92 is also accelerated so that the spraying pressure through the nozzle 610*a*, 610*b*, 610*c*, 610*d*, 610*e* can be maximized when the laundry is completely attached to the drum 32 and rotated together with the drum 32 (i.e., a state in which the centrifugal force is larger than the gravity so that the laundry does not fall, even when the laundry reaches the apex due to the rotation of the drum 32). When the rotation speed of the pump motor is maximized while the filtration motion is being performed, the circulating water current sprayed from the nozzles 610*a*, 610*b*, 610*c*, 610*d*, and 610*e* reaches deepest into the drum 32. Particularly, the circulation water sprayed through the intermediate nozzle 610*b*, 610*e* can reach the deepest portion of the drum 32 in comparison with other nozzles 610*a*, 610*c*, and 610*d*.

Referring to FIG. 10, with respect to the center O of the nozzle water supply pipe 701 (or the center of the gasket 601), when the intermediate nozzle 610*b*, 610*e* forms an angle θ1 with the tipper nozzle 610*a* and the lower nozzle 610*c*, 610*d* forms an angle θ2 with the intermediate nozzle 610*b*, 610*e*, θ1 may be approximately 50 degrees to 60 degrees, preferably, 55 degrees as shown in FIG. 10, but not necessarily limited thereto. In addition θ2 may be approximately 50 to 65 degrees, and preferably, 55 degrees as shown in FIG. 10, but it is not necessarily limited thereto.

The gasket 601 may be provided with the direct water nozzle 42 (see FIG. 4). The direct water nozzle 42 sprays water (i.e., direct water) supplied from an external water source (e.g., a faucet) into the drum 32. The rim unit 64 of the gasket 601 may be provided with a first installation pipe 61*c* (see FIG. 15) in which the direct water nozzle 42 is installed.

The gasket 601 may be formed symmetrically with respect to a certain straight line when viewed from the front, and the direct water nozzle 42 may be positioned on the straight line. Since the first nozzles 610*b* and 610*c* are disposed symmetrically with respect to the second nozzles 610*d* and 610*e* based on the straight line, when spraying is performed simultaneously through the plurality of nozzles 610*b*, 610*c*, 610*d*, and 610*e* and the direct water nozzle 42, the overall shape of the water currents sprayed through these nozzles 610*b*, 610*c*, 610*d*, 610*e*, and 42 is balanced to achieve a symmetry between the left and the right, when viewed from the front.

The gasket 601 may be provided with a steam spray nozzle 47. The washing machine according to an embodiment of the present invention may include a steam generator (not shown) for generating steam. The steam spray nozzle 47 sprays the steam generated by the steam generator into the drum 32. The rim unit 64 of the gasket 601 may be provided with a second installation pipe 61*d* (see FIG. 15) in which the steam spray nozzle 47 is installed. Meanwhile, contrary to the embodiment, it is also possible that the steam spray nozzle 47 is installed in the first installation pipe 61*c* and the direct water nozzle 42 is installed in the second installation pipe 61*d*.

Figure 18:
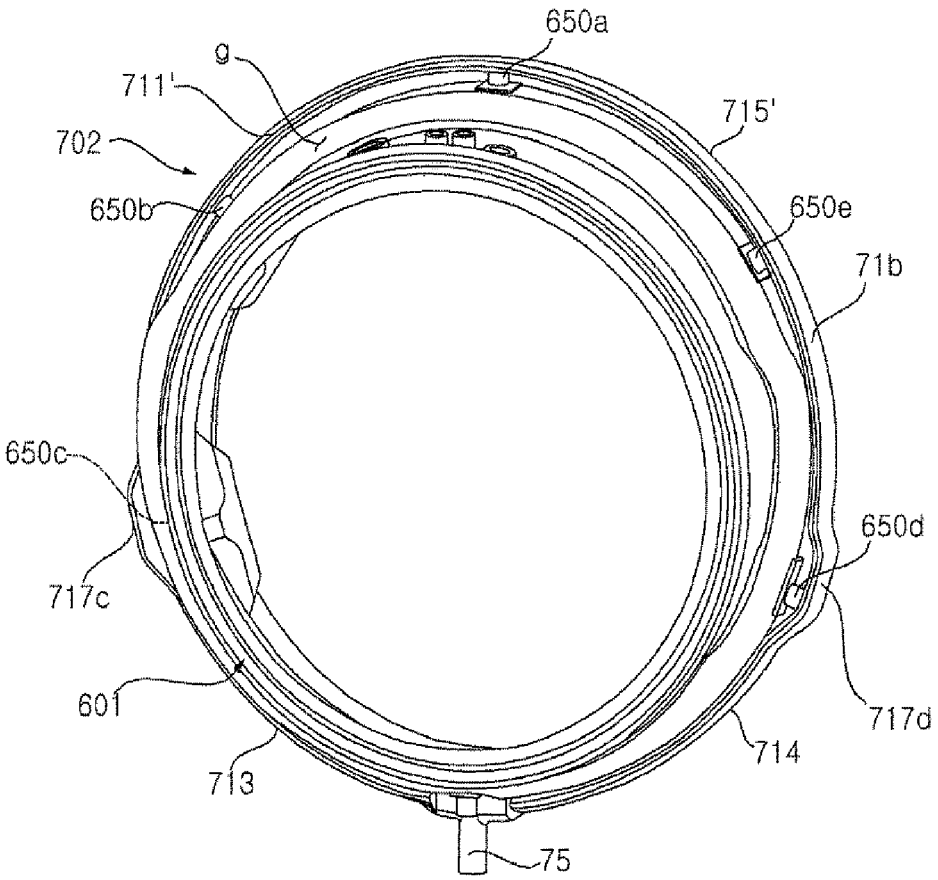
FIG. 18 is a view showing a nozzle water supply pipe provided in a washing machine according to a second embodiment of the present invention.

FIG. 18 is a view showing a nozzle water supply pipe provided in a washing machine according to a second embodiment of the present invention.

Referring to FIG. 18, the nozzle water supply pipe 702 according to another embodiment of the present invention is different from the nozzle water supply pipe 702 according to the above-described embodiment only in a configuration of the uplift portions 717*c* and 717*d* and the connecting units 711', 713, 714 and 715' constituting the transfer conduit 71*b*, and the other configurations are the same. Hereinafter, the same reference numerals are assigned to the same configurations as those in the above-described embodiment, and the description thereof will be omitted herein.

In comparison with the above-described embodiment, the annular nozzle water supply pipe 702 is provided with uplift portions 717*c* and 717*d* formed in a position corresponding to the pair of lower nozzles 610*c* and 610*d* respectively, while the uplift portion is not formed in the positions corresponding to the upper nozzle 610*a* and the intermediate nozzles 610*b* and 610*c*. The connecting units 711', 713, 714, and 715' are disposed substantially on a certain circumference, and the uplift portions 717*c* and 717*d* protrude outward along the radial direction from the circumference.

As shown in FIG. 7, a gap between the upper balancers 81 and 82 and the outer circumferential portion of the gasket 601 may be configured to be larger than a gap between the lower balancers 83 and 84 and the outer circumferential portion of the gasket 601. In particular, the gap between the upper balancers 81 and 82 and the outer circumferential portion of the gasket may be sufficiently broad to dispose the port insertion pipe 650*a*, 650*b*, 650*e* within the gap. However, the gap between the lower balancers 83 and 84 and the outer circumferential portion of the gasket 601 may be relatively narrow so that the port insertion pipe 650*c*, 650*d* cannot be disposed.

In this case, as in the embodiment, even if the uplift portion 717*c*, 717*d* is formed only in the positions corresponding to the lower nozzles 610*c* and 610*d*, the connection units 713 and 714 between the uplift portions 717*c* and 717*d* may be disposed between the lower balancers 83 and 84 and the outer circumferential portion of the gasket 601, and the uplift portions 717*c* and 717*d* may be disposed between the upper balancers 81 and 82 and the lower balancers 83 and 84, so that the nozzle water supply pipe 70*a* can be installed.

Meanwhile, the g indicated in the drawing, which is not explained, is a gap formed between the connecting units 71 and 715' and the outer circumferential portion of the gasket 601.

Figure 19:
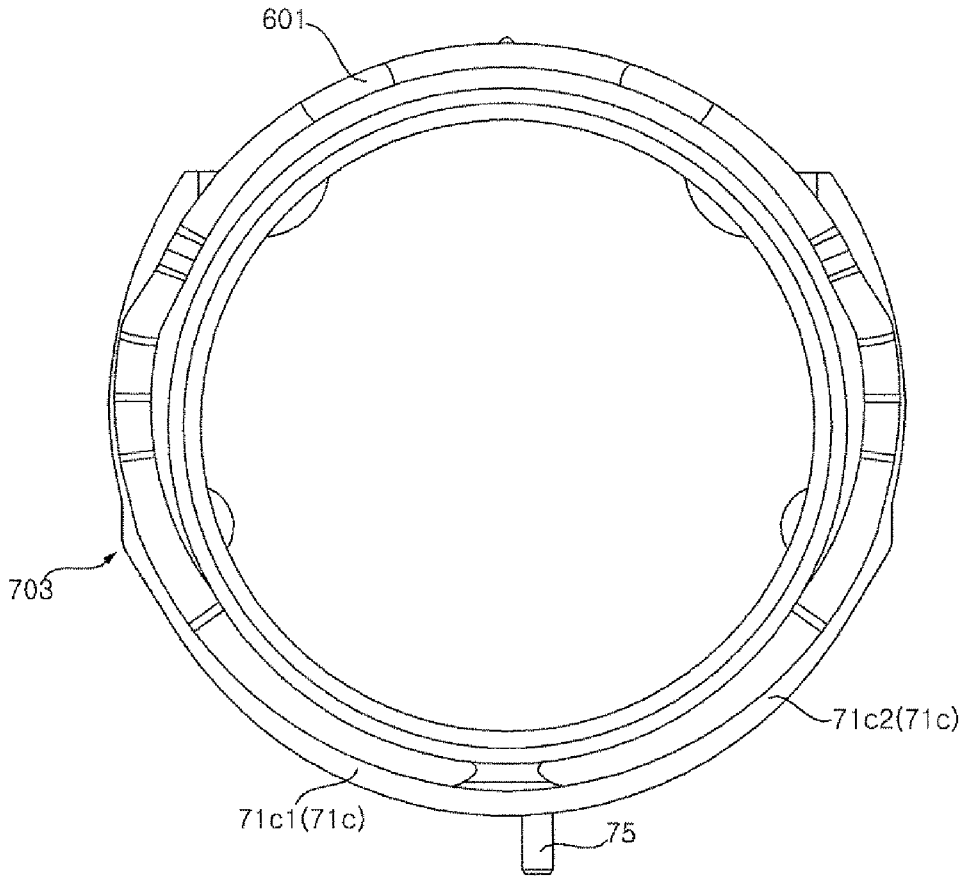
FIG. 19 is a front view showing a state in which a nozzle water supply pipe is installed in a gasket in a washing machine according to a third embodiment of the present invention.
Figure 20:
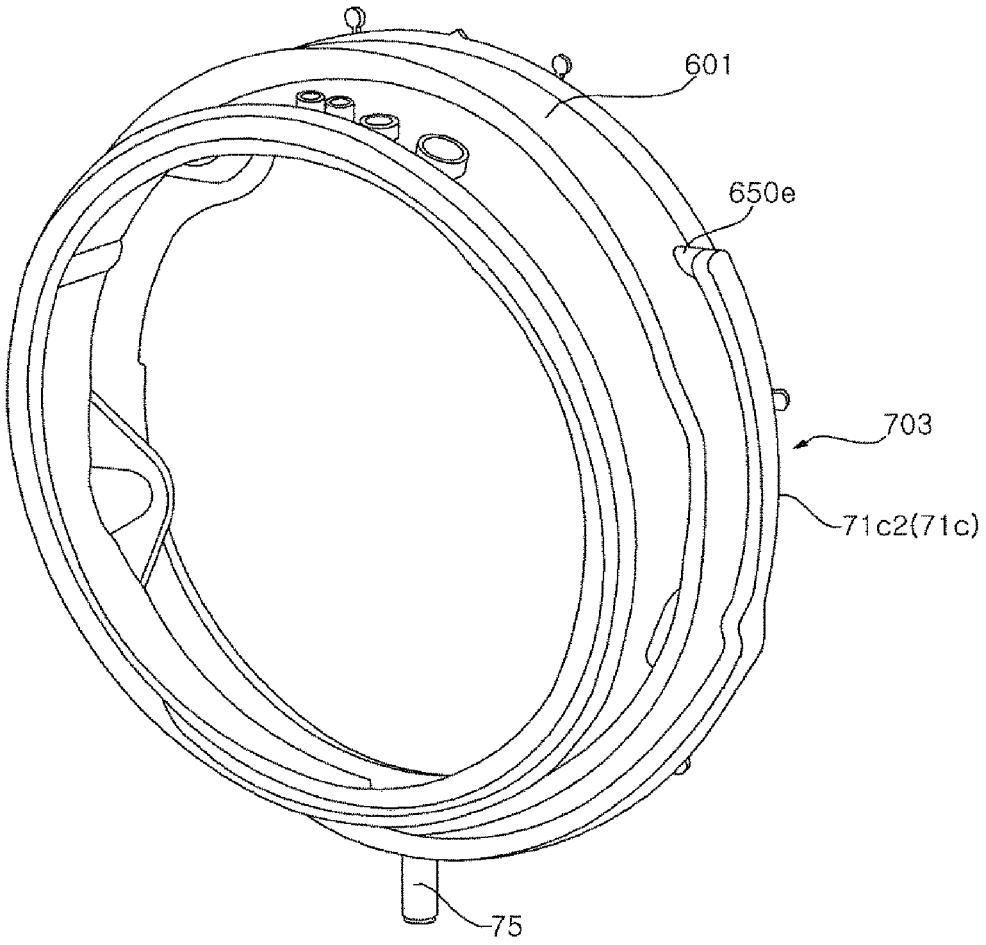
FIG. 20 is a perspective view of FIG. 19 from another angle.
Figure 21:
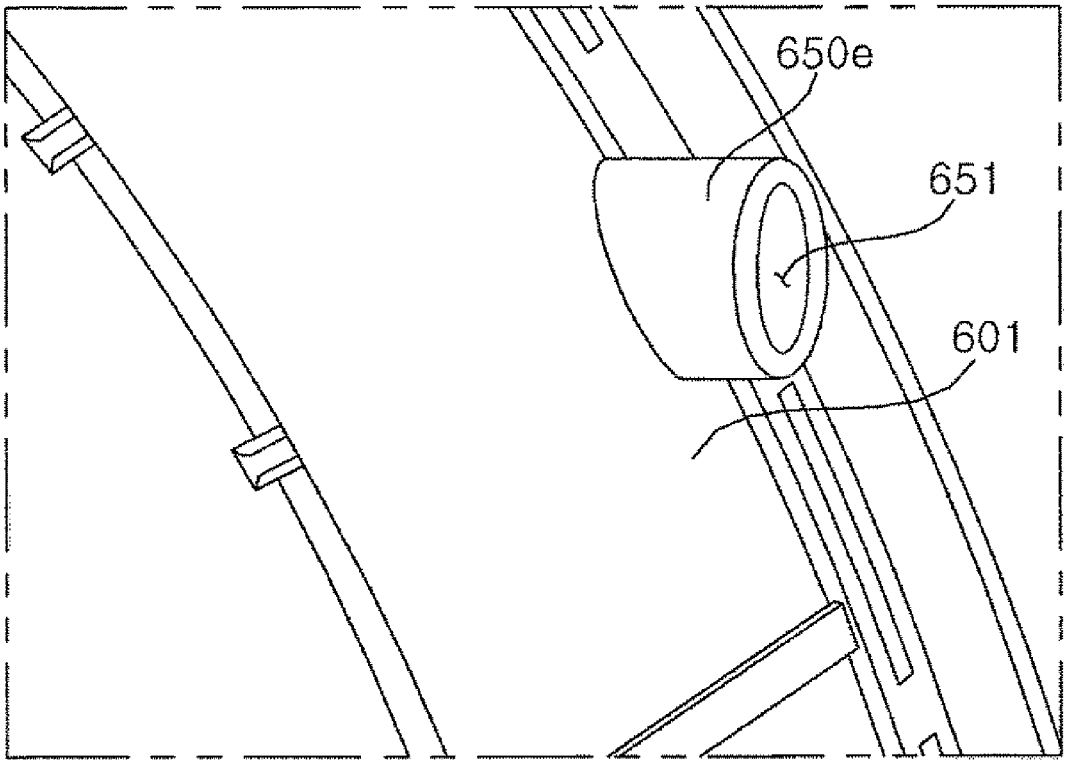
FIG. 21 shows a port insertion pipe shown in FIG. 19.
Figure 22:
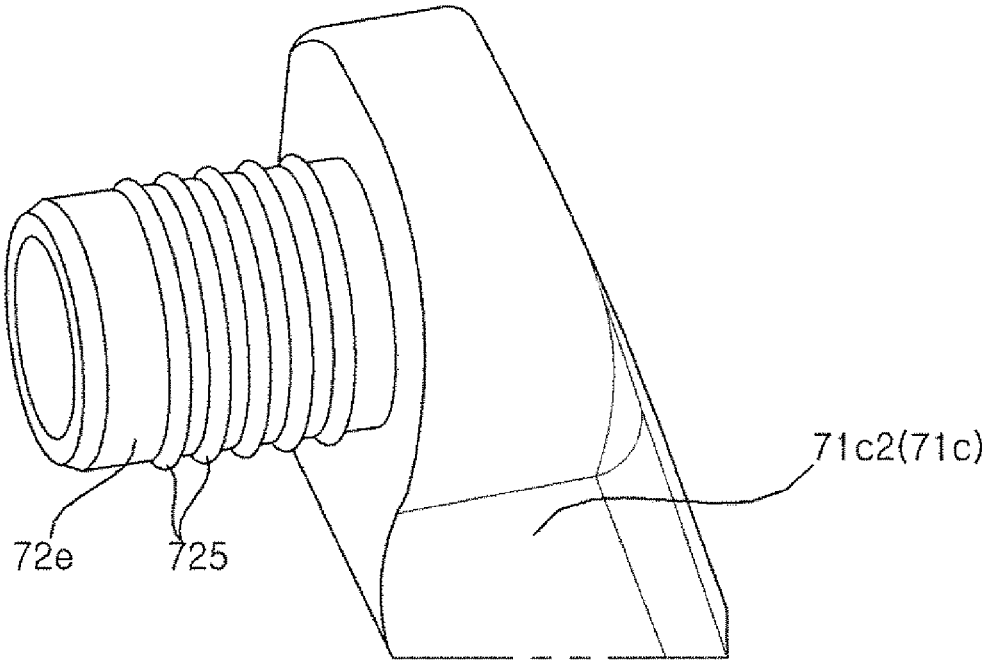
FIG. 22 shows a nozzle water supply port shown in FIG. 19.
Figure 23:
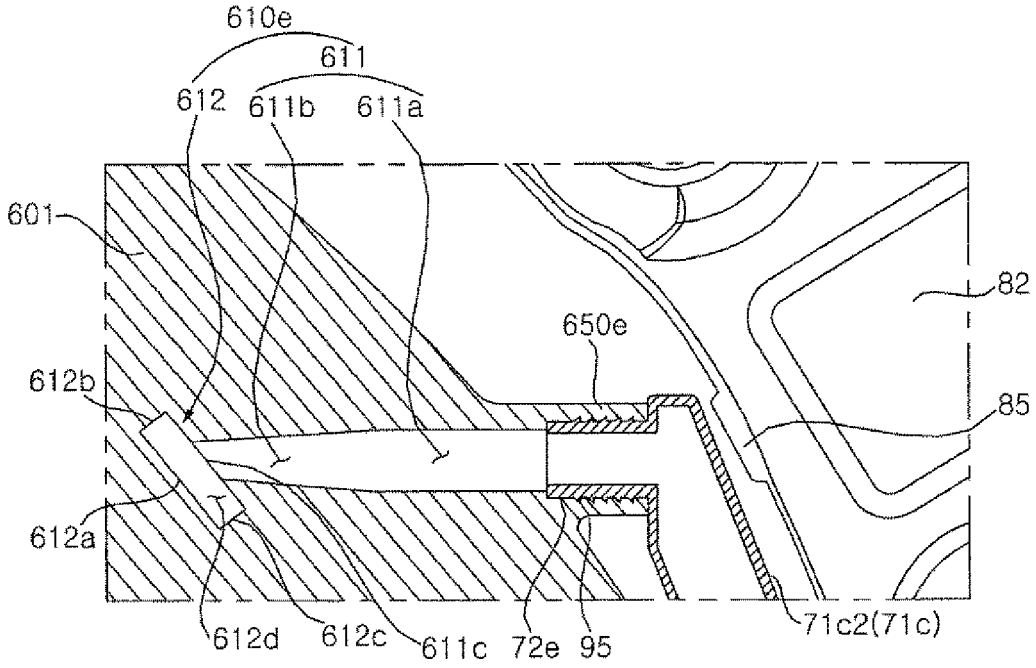
FIG. 23 is a cross-sectional view taken at a portion where the port insertion pipe and the nozzle water supply port are coupled.

FIG. 19 is a front view showing a state in which a nozzle water supply pipe is installed in a gasket in a washing machine according to a third embodiment of the present invention. FIG. 20 is a perspective view of FIG. 19 from another angle. FIG. 21 shows a port insertion pipe shown in FIG. 19. FIG. 22 shows a nozzle water supply port shown in FIG. 19. FIG. 23 is a cross-sectional view taken at a portion where the port insertion pipe and the nozzle water supply port are coupled.

Hereinafter, the same reference numerals are assigned to the same configurations as those in the above-described embodiment, and the description thereof will be omitted herein.

The nozzle water supply pipe 703 may include a circulation pipe connection port 75, a transfer conduit 71*c*, and a plurality of water supply ports 72*b*, 72*c*, 72*d*, 72*e* protruded from the transfer conduit 71*c*.

The nozzle water supply pipe 703 branches the circulating water discharged from the circulation pipe 18 to form a first sub-flow FL1 and a second sub-flow FL2. At least one first nozzle water supply port 72*b*, 72*c* is formed on a first flow path through which the first sub-flow FL1 is guided so that the circulating water is discharged to a corresponding first nozzle 610*b*, 610*c* through each of the first nozzle water supply ports 72*b*, 72*c*. Similarly, at least one second nozzle water supply port 72*d*, 72*e* is formed on a second flow path through which the second sub-flow FL2 is guided so that the circulating water is discharged to a corresponding second nozzles 610*d*, 610*e* through each of the second nozzle water supply ports 72*d*, 72*e*.

The transfer conduit 71*c* may include a first conduit portion 71*c*1 forming the first flow path and a second conduit portion 71*c*2 forming the second flow path. One end of the first conduit portion 71*c*1 and one end of the second conduit portion 71*c*2 are connected to each other, and the circulation pipe connection port 75 is protruded from the connected part. However, the other end of the first conduit portion 71*c*1 and the other end of the second conduit portion 71*c*2 are separated from each other, unlike the above-described embodiments. That is, the transfer conduit 71*c* is formed in a Y-shape as a whole, and is configured to branch the circulating water introduced through a single opening (i.e., the circulation pipe connection port 75) into two flow paths to guide. At this time, the two flow paths are separated from each other.

The transfer conduit 71*c* is formed in a annular shape as a whole, but a part of the circumference is cut. That is, the portion cut on the circumference corresponds to a portion between the first conduit portion 71*c*1 and the second conduit portion 71*c*2.

The nozzle water supply ports 72*b*, 72*c*, 72*d* and 72*e* formed in the transfer conduit 71*c* protrude inward along the radial direction from the transfer conduit 71*c* and are inserted into the gasket 601 to supply the circulating water to a corresponding nozzle 610*b*, 610*c*, 610*d*, 610*e*. The nozzle water supply ports 72*b*, 72*c*, 72*d* and 72*e* are inserted into the port insertion pipes 650*b*, 650*c*, 650*d* and 650*e* formed in the gasket 601.

In a state in which the nozzle water supply port 72*b*, 72*c*, 72*d*, 72*e* is inserted into a corresponding port insertion pipe 650*b*, 650*c*, 650*d*, 650*e*, a fastening member such as a wire or a clamp may be used to fasten both components so that both components are not separated. However, in this case, the assembling of the fastening member increases the number of assembling operations, thereby deteriorating the productivity of the product.

Hereinafter, referring to FIG. 21 to FIG. 23, a method of fixing the nozzle water supply port 72*b*, 72*c*, 72*d*, 72*e* and the port insertion pipe 650*b*, 650*c*, 650*d*, 650*e* so as not to be easily separated without using a fastening member will be considered.

In particular, in the following description, it is illustrated that the nozzle water supply port 72*e* for supplying the circulating water to the intermediate nozzle 610*e* is coupled to the port insertion pipe 650*e*. However, it is not limited thereto, and other nozzle water supply ports 72*b*, 72*c*, and 72*d* and corresponding port insertion pipes 650*b*, 650*c*, and 650*d* may also be coupled in substantially the same manner. Furthermore, the coupling between the nozzle water supply ports 72*a*, 72*b*, 72*c*, 72*d*, and 72*e* and the port insertion pipes 650*a*, 650*b*, 650*c*, 650*d*, and 650*e* in the above mentioned embodiments can be achieved in a similar manner.

The nozzle water supply port 72*e* is press-fitted into a press-fit hole 651 formed in the port insertion pipe 650*e* and is coupled to the gasket 601. The outer diameter of the nozzle water supply port 72*e* is preferably larger than the diameter of the press-fit hole 651 so that the nozzle water supply port 72*e* can be press-fitted into the press-fit hole 651 formed in the port insertion pipe 650*e* and coupled to the gasket 601. Here, since the press-fit hole 651 is interpreted to have the same meaning as the inner diameter of the port insertion pipe 650*e*, it is preferable that the outer diameter of the nozzle water supply port 72*e* is formed larger than the inner diameter of the port insertion pipe 650*e*.

The nozzle water supply port 72*e* is provided with an press-fit protrusion 725 on the outer circumferential surface. The press-fit protrusion 725 is formed in an annular shape continuous in the circumferential direction on the outer circumferential surface of the nozzle water supply port 72*e*. The press-fit protrusion 725 may be formed in plural along the longitudinal direction of the nozzle water supply port 72*e*. In the present embodiment, five press-fit protrusions 725 are formed along the longitudinal direction of the nozzle water supply port 72*e*, but the number of the press-fit protrusions 725 formed in the nozzle water supply port 72*e* is not limited thereto.

The nozzle water supply port 72*e* is press-fitted into the press-fit hole 651 formed in the port insertion pipe 650*e* and is coupled to the port insertion pipe 650*e*. At this time, the press-fit protrusion 725 can be press-fitted in the radial direction while being in close contact with the inner circumferential surface of the port insertion pipe 650*e*. Since the gasket 601 is formed of a material having an elastic force, the press-fit protrusion 725 elastically deforms the inner circumferential surface of the port insertion pipe 650*e* while being in close contact with the inner circumferential surface of the port insertion pipe 650*e*, and can be press-fitted in the radial direction on the inner circumferential surface.

When the direction in which the nozzle water supply port 72*e* is inserted into the port insertion pipe 650*e* is defined as a front direction, the press-fit protrusion 725 has a rear surface formed as a vertical surface, and has a front surface extending forward from the vertical is formed to be an inclined surface whose slope is gentler than the vertical surface. Therefore, when the nozzle water supply port 72*e* is press-fitted into the press-fit hole 651 formed in the port insertion pipe 650*e*, the inclined surface facilitates press-fitting, and after the press-fitting is completed, the nozzle water supply port 72*e* cannot not be easily separated from the port insertion pipe 650*e* due to the vertical surface.

Further, since the nozzle water supply pipe 70 can be coupled to the gasket 60 without using a fastening member (e.g., a clamp), a time required for the operation for tightening the fastening member is not required.

In addition, since it is not necessary to fix the fastening member to the outer circumferential surface of the port insertion pipe 650*e*, the length of the port insertion pipe 650*e* can be shortened so that the resistance of flow path due to the length of the port insertion pipe 650*e* can be reduced.

Further, thanks to the short length of the port insertion pipe 650*e*, when the nozzle water supply port 72*e* is completely press-fitted into the port insertion pipe 650*e*, it is not necessary to bend the transfer conduit 71*c* outwardly convexly to form an uplift portion, or it is possible to reduce the height or the length of the uplift portion or to bend the uplift portion gently, thereby reducing the resistance of the flow path of the water flowing through the transfer conduit 71*c*. Further, thanks to the short length of the port insertion pipe 650*e*, a space in which the nozzle water supply pipe 70 can be disposed between the gasket 60 and the balancer 81, 82 can be secured, and the balancer 81, 82, 83, 84 having a large volume can be installed in this secured space.

The port insertion pipe 650*e* and the nozzle inflow pipe 611 (see FIGS. 15 to 17 and refer to the above relevant description) extend on the substantially same line. The longitudinal direction of the nozzle inflow pipe 611 is disposed substantially horizontally, not toward the center O of the gasket 601. Thus, the nozzle inflow pipe 611 does not guide the water toward the center of the gasket 601, but guides the water in a horizontal direction.

As described above with reference to FIG. 12, FIGS. 15 to 17, the nozzle head 612 may include a collision surface 612*a* with which water discharged from an outlet 611*c* of the nozzle inflow pipe 611 collides, a left side surface 612*b* extending from the left side of the collision surface 612*a* and defining a left boundary of the water current flowing along the collision surface 612*a*, and a right side surface 612*c* extending from the right side of the collision surface 612*b* and defining a right boundary of the water current flowing along the collision surface 612*a*. The collision surface 612*a*, the left side surface 612*b*, and the right side surface 612*c* extend to the outlet 612*d* of the nozzle head 612. The collision surface 612*a* of the nozzle head 612 may face the outlet 611*c* of the nozzle inflow pipe 611 and be inclined toward the center O of the gasket 601.

As described above, the longitudinal direction of the nozzle inflow pipe 611 is disposed substantially horizontally, not toward the center O of the gasket 601 to guide the water in a horizontal direction, and only the collision surface 612*a* of the nozzle head 612 is inclined toward the center O of the gasket 601. Therefore, the water that flows through the nozzle inflow pipe and is guided to the nozzle head 612 is less affected by the gravity, so that the spray pattern of the water sprayed into the drum 32 from the plurality of nozzles 610*b*, 610*c*, 610*d*, and 610*e* can be maintained uniformly.

If the longitudinal direction of the nozzle inflow pipe 611 is not disposed substantially horizontally and is disposed toward the center O of the gasket 601, the water flowing through the nozzle inflow pipe 611 of the upper nozzle 610*b*, 610*e* is sprayed into the drum 32 faster than the lower nozzle 610*c*, 610*d* due to the gravity applied to the water flowing downward, and the water flowing through the nozzle inflow pipe 611 of the lower nozzle 610*c*, 610*d* is sprayed into the drum 32 slower than the upper nozzle 610*b*, 610*e* due to the gravity applied to the water flowing upward, so that it is difficult to uniformly maintain the spray pattern of the water sprayed into the drum 32 from the plurality of nozzles 610*b*, 610*c*, 610*d*, and 610*e*. However, in the present embodiment, since the longitudinal direction of the nozzle inflow pipe 611 is disposed substantially horizontally to guide the water in the horizontal direction, the spray pattern of the water sprayed into the drum 32 from the plurality of nozzles 610*b*, 610*c*, 610*d*, and 610*e* can be uniformly maintained.

The nozzle inflow pipe 611 may include an opening portion 611*a* and an outlet portion 611*b*. The opening portion 611*a* extends in the longitudinal direction in the press-fit hole 651 of the port insertion pipe 650*e* into which the nozzle water supply port 72*e* is press-fitted and is formed to have the same diameter as the press-fit hole 651. The outlet portion 611*b* extends in the longitudinal direction in the opening portion 611*a* and connects the opening portion 611*a* and the nozzle head 612, and the diameter of the outlet portion 611*b* gradually decreases from the opening portion 611*a* toward the nozzle head 612. The diameter of the opening portion 611*a* is formed to be the same as the diameter of the press-fit hole 651 so that the water discharged from the nozzle water supply port 72*e* receives less resistance at the opening portion 611*a* to reduce the flow path resistance. The outlet 611*c* of the outlet portion 611*b* is formed to have the smallest diameter so that high pressure water can be discharged to the nozzle head 612.

Meanwhile, the nozzle water supply pipe 703 is disposed between the outer circumferential surface of the gasket 601 and the balancer 81, 82, 83, 84. Since the nozzle water supply pipe 703 is disposed between the outer circumferential surface of the gasket 601 and the balancer 81, 82, 83, 84, the nozzle water supply pipe 703 can be installed in an existing space without having to secure a separate space.

As described above, the nozzle water supply pipe 703 includes uplift portion 717*c*, 717*d*. The uplift portion 717*c*, 717*d* is formed to be convex toward the balancer 83, 84 in a position corresponding to the lower nozzle water supply port 72*c*, 72*d*. Since the uplift portion 717*c*, 717*d* is formed to be convex toward the balancer 83, 84 in a position corresponding to the lower nozzle water supply port 72*c*, 72*d*, when the lower nozzle water supply port 72*c*, 72*d* attempts to escape from the port insertion pipe 650*c*, 650*d* of the gasket 601, the uplift portion 717*c*, 717*d* comes into contact with the balancer 83, 84 to restrain the movement of the lower nozzle water supply ports 72*c*, 72*d*, so that the separation of the lower nozzle water supply port 72*c*, 72*d* can be prevented.

However, it is difficult to form a structure like the uplift portion 717*c*, 717*d* in the tipper end of the nozzle water supply pipe 703 because the nozzle water supply pipe 703 is formed in an annular shape having an open top. Therefore, in order to prevent the upper nozzle water supply port 72*b*, 72*e* from being separated from the port insertion pipe 650*b*, 650*e*, in a position corresponding to the upper nozzle water supply port 72*b*, 72*e*, a separation preventing rib 85 for preventing the nozzle water supply ports 72*b*, 72*e* from being separated is protruded from the balancer 81, 82. The separation preventing rib 85 is protruded from the inside of the balancer 81, 82 toward the portion where the upper nozzle water supply port 72*b*, 72*e* of the nozzle water supply pipe 703 is formed so as to be slightly spaced from the nozzle water supply pipe 703. When the upper nozzle water supply port 72*b*, 72*e* attempts to escape from the port insertion pipe 650*b*, 650*e* of the gasket 601, the nozzle water supply pipe 703 comes into contact with the separation preventing rib 85 to restrain the movement of the upper nozzle water supply ports 72*b*, 72*e*, so that the separation of the upper nozzle water supply ports 72*b*, 72*e* can be prevented.

Figure 24:
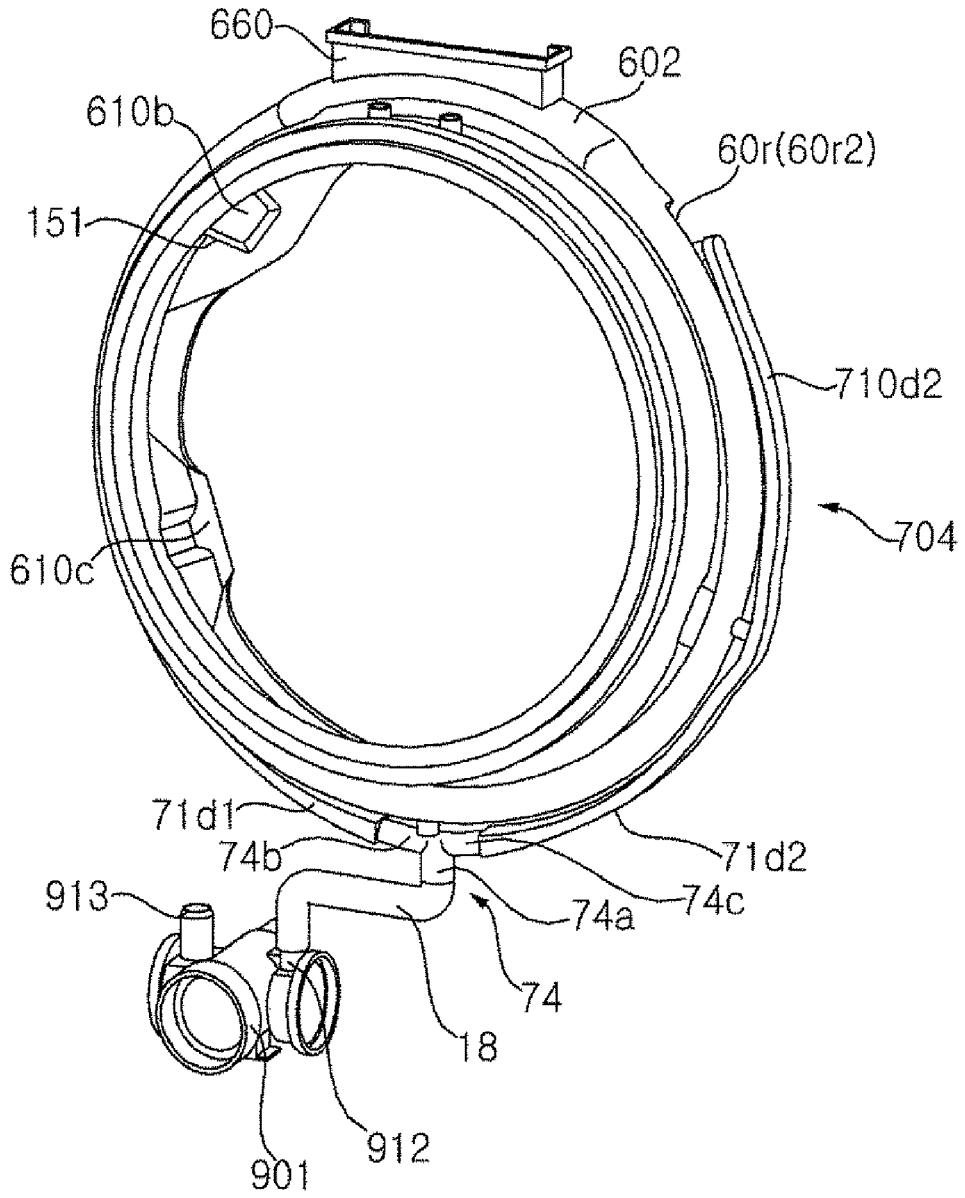
FIG. 24 shows a state in which nozzle water supply pipes are installed in the gasket in a washing machine according to a fourth embodiment of the present invention.
Figure 25:
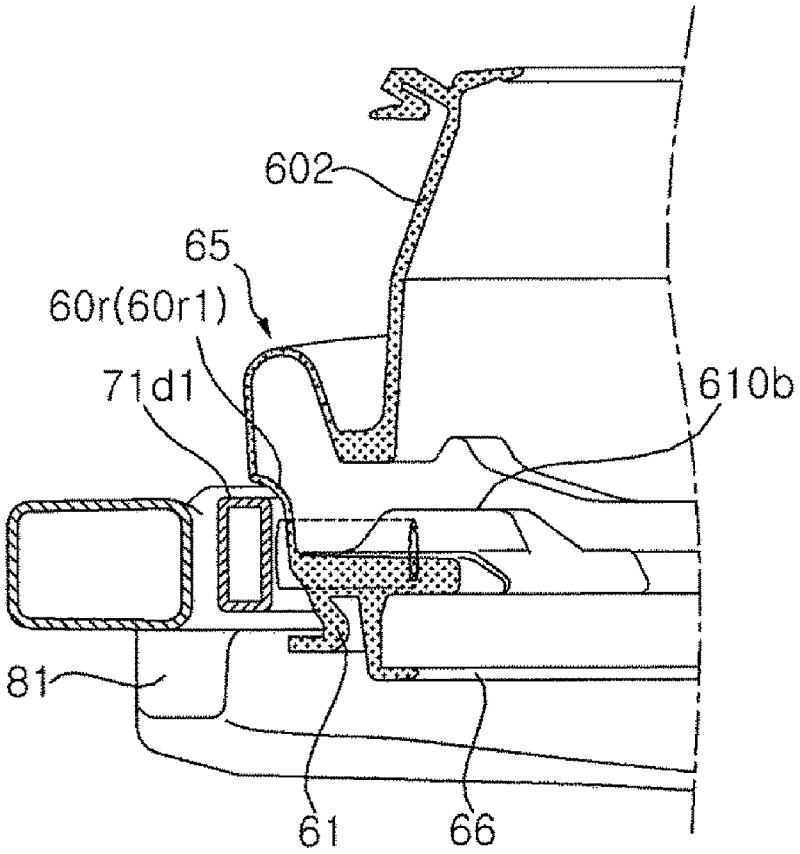
FIG. 25 is a cross-sectional view of the assembly, cut to show a seat portion, shown in FIG. 24.
Figure 26:
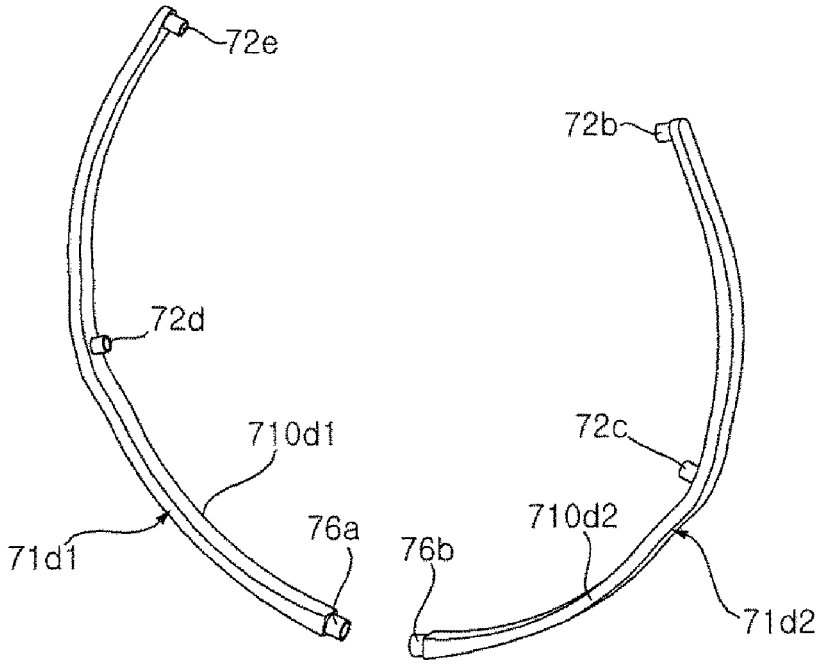
FIG. 26 shows a first nozzle water supply pipe and a second nozzle water supply pipe shown in FIG. 24.
Figure 27:
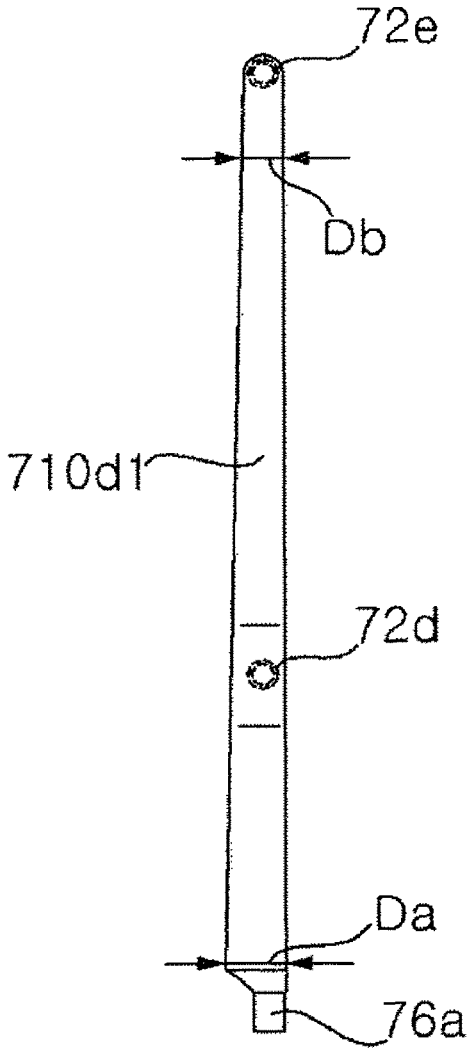
FIG. 27 is a side view of the first nozzle water supply pipe.

FIG. 24 shows a state in which nozzle water supply pipes are installed in the gasket in a washing machine according to a fourth embodiment of the present invention. FIG. 25 is a cross-sectional view of the assembly, cut to show a seat portion, shown in FIG. 24. FIG. 26 shows a first nozzle water supply pipe and a second nozzle water supply pipe shown in FIG. 24. FIG. 27 is a side view of the first nozzle water supply pipe.

Referring to FIG. 24 to FIG. 27, the nozzle water supply pipe 704 branches the circulating water discharged from the circulation pipe 18 to form a first sub-flow FL1 and a second sub-flow FL2. The nozzle water supply pipe 704 is provided with at least one first nozzle water supply port 72*b*, 72*c* formed on a first flow path through which the first sub-flow FL1 is guided so that the circulating water is discharged to a corresponding first nozzle 610*b*, 610*c* through each of the first nozzle water supply ports 72*b*, 72*c*. Similarly, at least one second nozzle water supply port 72*d*, 72*e* is formed on a second flow path through which the second sub-flow FL2 is guided so that the circulating water is discharged to a corresponding second nozzles 610*d*, 610*e* through each of the second nozzle water supply ports 72*d*, 72*e*.

More specifically, the nozzle water supply pipe 704 may include a first conduit 71*d*1 forming the first flow path, a second conduit 71*d*2 forming the second flow path, and a distribution pipe 74. The nozzle water supply pipe 704 differs from the third embodiment in that the first conduit 71*d*1 and the second conduit 71*d*2 are connected to each other by the distribution pipe 74, and the other configurations are substantially the same.

Each of the conduits 71*d*1 and 71*d*2 includes a cylindrical conduit portion 710*d*1, 710*d*2 and a nozzle water supply port 72*b*, 72*c*, 72*d*, 72*e* protruded from the conduit portion 710*d*1, 710*d*2.

The cross section of the conduit portion 710*d*1, 710*d*2 may have a shape in which the height defined in the radial direction is shorter than the width defined in the longitudinal direction of the gasket 601 (or the front-rear direction of the washing machine). For example, the cross section of the conduit portion 710*d*1, 710*d*2 may have a substantially rectangular shape. In this case, the long side of the rectangle becomes the above mentioned width, and the short side becomes the above mentioned height.

A seating groove 60*r* may achieve a shape corresponding to the conduit portion 710*d*1, 710*d*2. For example, as described above, when the cross section of the conduit portion 710*d*1, 710*d*2 is a rectangle, the cross section of the seating groove 60*r* nay have a shape in which the width of the groove in the front-rear direction is longer than the depth of the groove in the radial direction. Such a structure allows the conduit 71*d*1, 71*d*2 to be easily installed in the seating groove 60*r*.

The distribution pipe 74 discharges the circulating water introduced through a single opening through two outlets. Specifically, the distribution pipe 74 includes a circulation pipe connection port 74*a* connected to the circulation pipe 18, and a first conduit connection port 74*b* and a second conduit connection port 74*c* which are branched from the circulation pipe connection port 74*a*. The first conduit connection port 74*b* is connected to the first conduit 71*d*1 and the second conduit connection port 74*c* is connected to the second conduit 71*d*2.

According to the embodiment, the washing machine may provide a drying function as well as a washing function. Such a washing machine may include a drying heater for heating the air and a air blowing fan for supplying the air heated by the heater into the tub 31. After the washing is completed, the drying heater and the air blowing fan may be operated to dry the laundry in the drum 32.

The gasket 602 may be provided with an air supply duct 660 for discharging the air sent by the air blowing fan into the tub 31. The gasket 602 differs from the gasket 601 of the above embodiment in that the gasket 602 further includes the air supply duct 660. However, the other configurations described in the above embodiments can be directly applied to the present embodiment.

The first conduit 71*d*1 is positioned in the left side based on the air supply duct 660 and the second conduit 71*d*2 is positioned in the right side based on the air supply duct 660.

One end of the first conduit 71*d*1 and one end of the second conduit 71*d*2 are connected to the distribution pipe 74 respectively. The other end of the first conduit 71*d*1 and the other end of the second conduit 71*d*2 are closed respectively, and are separated from each other. Particularly, the first conduit 71*d*1 and the second conduit 71*d*2 are disposed on both sides of the air supply duct 660 respectively, so that the first conduit 71*d*1 and the second conduit 71*d*2 are not interfered with the air supply duct 660.

The circulating water discharged from the circulation pipe 18 is branched by the distribution pipe 74 so that the first sub-flow FL1 is transferred to the first conduit 71*d*1 and the second sub-flow FL2 is transferred to the second conduit 71*d*2.

Since the circulating water is introduced through a single opening (circulation pipe connection port 74*a*), if the first conduit 71*d*1 and the second conduit 71*d*2 are symmetrical with each other, the flow rate introduced to the first conduit 71*d*1 and the second conduit 71*d*2 are the same.

The washing machine 100 according to the present invention can spray fluid into the drum 32 by the number of nozzle water supply ports 72*a*, 72*b*, 72*c*, 72*d*, and 72*e* formed in the respective transfer conduits 71*a*, 71*b*, and 71*c*. Therefore, the fluid can be sprayed into the drum 32 at various angles to wet the accommodated laundry, so that the washing performance can be improved. That is, the fluid can be multi-sprayed at various angles through the nozzle.

Particularly, since the spraying pressure of the plurality of nozzles is varied through the speed control of the first pump motor 92 while the circulating water is simultaneously sprayed through the plurality of nozzles 610*a*, 610*b*, 610*c*, 610*d*, and 610*e*, the circulating water can be dynamically applied into the drum 32 evenly, and in particular, to the laundry in any position inside the drum 32. Referring to FIG. 24 and FIG. 25, a seating groove 60*r* extending in the circumferential direction may be formed on the outer circumferential surface of the gasket 602. The seating grooves 60*r* can be formed on both left and right sides of the gasket 602 when viewed from the front. The seating groove 60*r* may be formed in the folded unit 65 of the gasket 602, and is preferably formed on the outer circumferential surface of the outer diameter unit 61*b*.

Hereinafter, the seating groove formed in the left side is referred to as a first seating groove 60*r*1, and the seating groove formed in the right side is referred to as a second seating groove 60*r*2. At least a portion of the first conduit 71*d*1 is positioned in the first seating groove 60*r*1 and at least a portion of the second conduit 71*d*2 is positioned in the second seating groove 60*r*2.

The width of the seating groove 60*r* may have a length corresponding to the width of the conduit 71*d*1, 71*d*2. According to the embodiment, the seating groove 60*r* may be formed such that the conduit 71*d*1, 71*d*2 does not protrude to the outside of the seating groove 60*r*. When the respective conduits 71*d*1 and 71*d*2 are not protruded from the gasket 601, it is possible to prevent the respective conduits 71*d*1 and 71*d*2 from colliding with other structures such as the balancer 81, 82, 83, 84.

Two nozzle water supply ports 72*b* and 72*c* may be formed in the first conduit 71*d*1. Similarly, two nozzle water supply ports 72*d* and 72*e* may be formed in the second conduit 71*d*2. That is, a total of four nozzle water supply ports 72*b*, 72*c*, 72*d*, and 72*e* are formed in the first conduit 71*d*1 and the second conduit 71*d*2 to supply the circulating water to a total of four nozzles 610*b*, 610*c*, 610*d*, and 610*e*. When the direct water nozzle 42 is installed, the pump 901 is operated to control the water supply unit 33 so that water is supplied through the direct water supply pipe 39 while the circulating water is supplied through the circulation pipe 18. Accordingly, the spraying can be performed simultaneously through a total of five nozzles 610*b*, 610*c*, 610*d*, 610*e*, and 42.

In the first conduit 71*d*1 and the second conduit 71*d*2, coupling units 76*a* and 76*b* which are fitted to one side of the distribution pipe 74 are formed in both one ends, respectively. The coupling unit 76*a*, 76*b* has a protruded cylindrical shape.

Referring to FIG. 27, the inner cross-sectional area of the first conduit 71*d*1 becomes smaller as it progresses from the lower portion to the upper portion. Since the first conduit 71*d*2 is positioned to be more higher from the ground as it progresses from the lower portion to the upper portion, the inner cross-sectional area of the first conduit 71*d*1 is implemented to be smaller in the tipper portion rather than the lower portion in order to compensate the water pressure so as to move the fluid toward the nozzles 610*b*, 610*c*, 610*d*, 610*e* with the same pressure That is, the first conduit 71*d*1 may have a smaller width db in the upper portion than the width Da in the lower portion where the coupling unit 76*a* is positioned, and may have a tapered shape toward the tipper portion.

In comparison with the first conduit 71*d*1, the second conduit 71*d*2 has a symmetrical structure in which the left and right are reversed, and the configuration thereof is substantially the same. Therefore, the above description can be directly applied to the second conduit 71*d*2.

Figure 28:
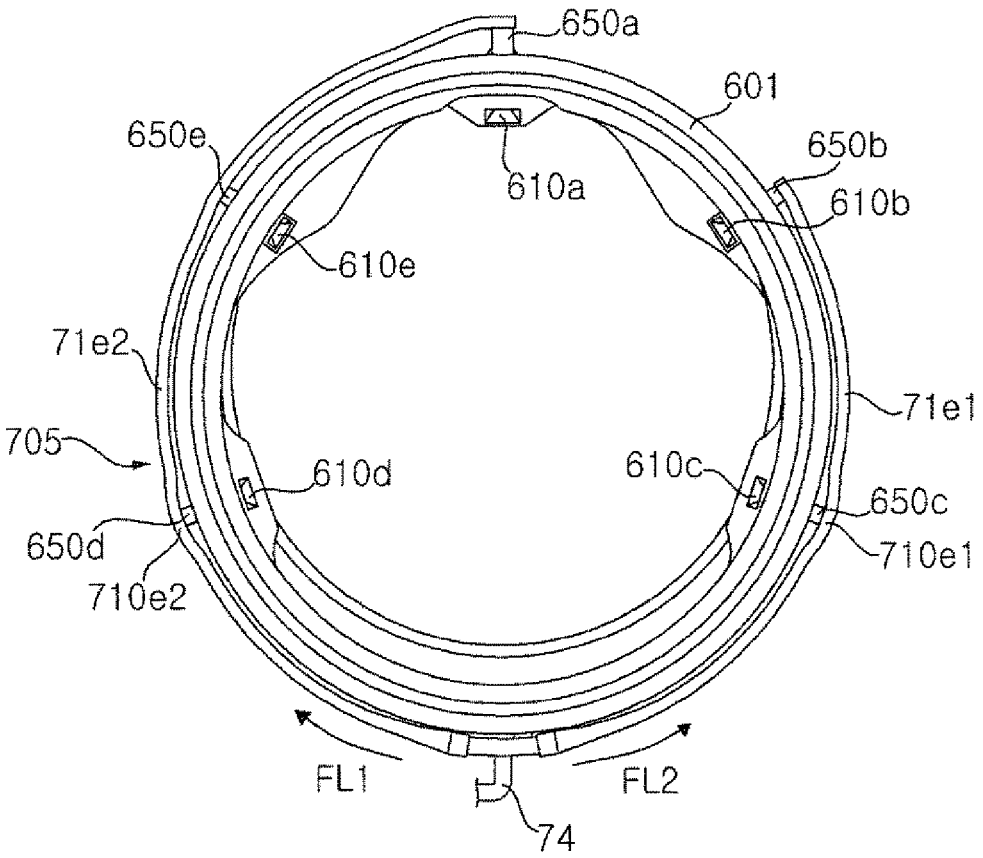
FIG. 28 shows a state in which nozzle water supply pipes are installed in a gasket in a washing machine according to a fifth embodiment of the present invention.

FIG. 28 shows a state in which nozzle water supply pipes are installed in a gasket in a washing machine according to a fifth embodiment of the present invention. Referring to FIG. 28, the nozzle water supply pipe 705 branches the circulating water discharged from the circulation pipe 18 to form a first sub-flow FL1 and a second sub-flow FL2. The nozzle water supply pipe is provided with at least one first nozzle water supply port 72*b*, 72*c* formed on a first flow path through which the first sub-flow FL1 is guided so that the circulating water is discharged to a corresponding first nozzle 610*b*, 610*c* through each of the first nozzle water supply ports 72*b*, 72*c*. Similarly, at least one second nozzle water supply port 72*d*, 72*e* is formed on a second flow path through which the second sub-flow FL2 is guided so that the circulating water is discharged to a corresponding second nozzles 610*d*, 610*e* through each of the second nozzle water supply ports 72*d*, 72*e*.

More specifically, the nozzle water supply pipe 705 may include a first conduit 71*e*1 forming the first flow path, a second conduit 71*e*2 forming the second flow path, and a distribution pipe 74. Each of the conduits 71*e*1 and 71*e*2 includes a cylindrical conduit portion 710*e*1, 710*e*2 and a nozzle water supply port 72*a*, 72*b*, 72*c*, 72*d*, 72*e* protruded from the conduit portion 710*e*1, 710*e*2.

The nozzle water supply pipe 705 is configured to include the first conduit 71*e*1, the second conduit 71*e*2, and the distribution pipe 74, in the same manner as the nozzle water supply pipe 704 according to the above described fourth embodiment. However, the nozzle water supply pipe 705 according to the present embodiment is different from the above described fourth embodiment in that the number of the nozzle water supply ports 72*b* and 72*c* provided in the first conduit 71*e*1 is different from the number of the nozzle water supply ports 72*d* and 72*e*, and 72*a* provided in the second conduit 71*e*2.

The first conduit 71*e*1 and the second conduit 71*e*2 may have an asymmetric shape. In addition, the length of the first conduit portion 710*e*1 and the length of the second conduit portion 710*e*2 may be different from each other.

A total of five nozzle water supply ports 72*a*, 72*b*, 72*c*, 72*d*, and 72*e* formed by the first conduit 71*e*1 and the second conduit 71*e*1 are inserted to a total of five nozzle inflow pipes 611 formed in the gasket 601, respectively. The circulating water may be simultaneously sprayed into the drum 32 through the five nozzles 610*a*, 610*b*, 610*c*, 610*d*, and 610*e*.

Figure 29:
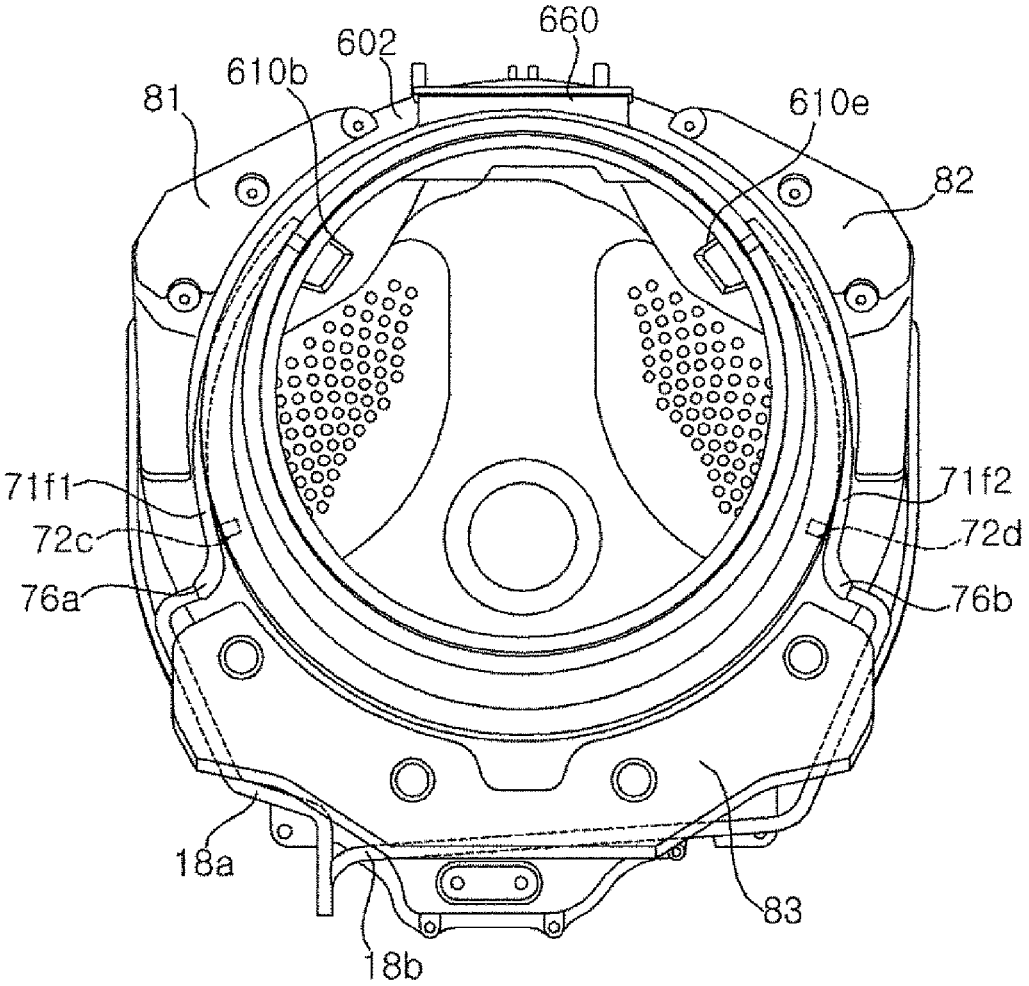
FIG. 29 shows a state in which nozzle water supply pipes are installed in a gasket in a washing machine according to a sixth embodiment of the present invention.
Figure 30:
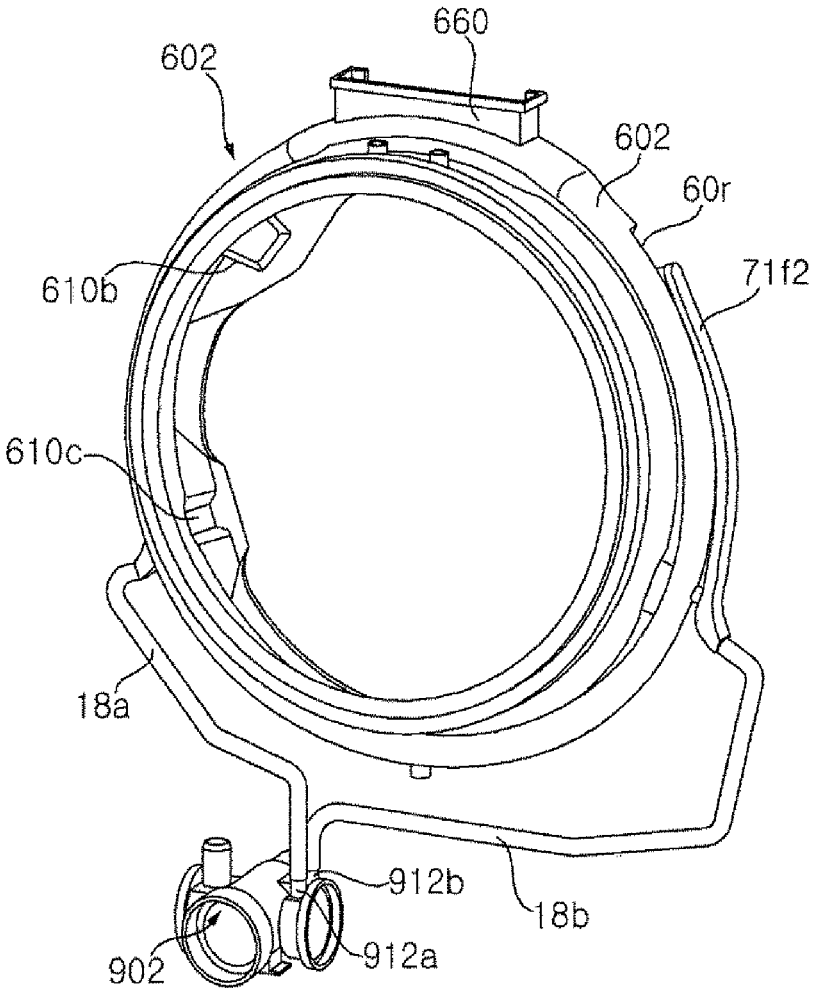
FIG. 30 shows a part of the configurations shown in FIG. 29 from another angle.
Figure 31:
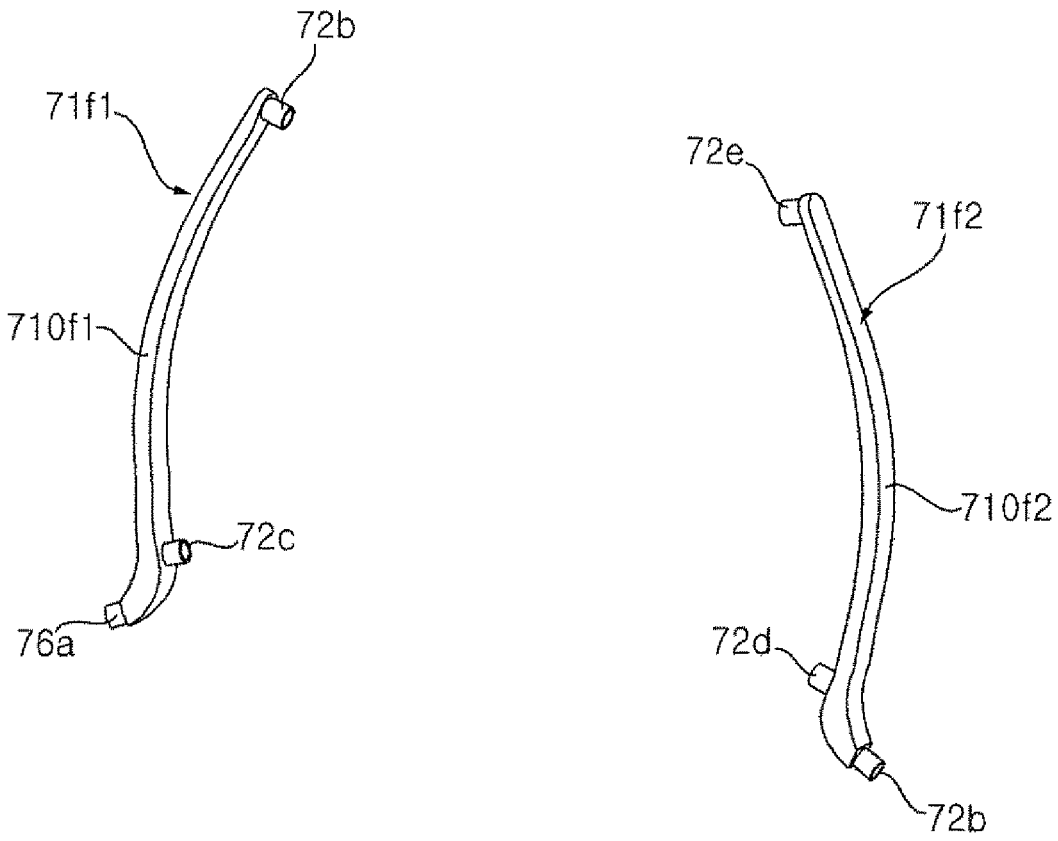
FIG. 31 shows a first nozzle water supply pipe and a second nozzle water supply pipe shown in FIG. 29 and FIG. 30.
Figure 32:
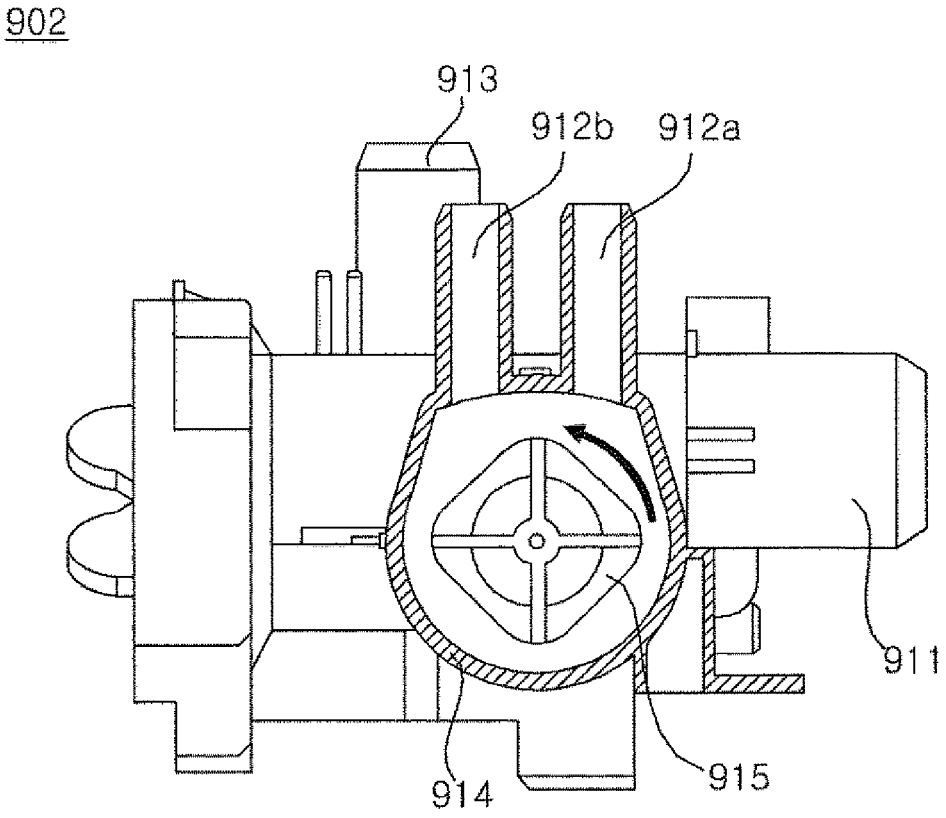
FIG. 32 shows another embodiment of a pump.

FIG. 29 shows a state in which nozzle water supply pipes are installed in a gasket in a washing machine according to a sixth embodiment of the present invention. FIG. 30 shows a part of the configurations shown in FIG. 29 from another angle. FIG. 31 shows a first nozzle water supply pipe and a second nozzle water supply pipe shown in FIG. 29 and FIG. 30. FIG. 32 shows another embodiment of a pump.

Referring to FIGS. 29 to 32, the washing machine according to the present embodiment includes a first conduit 71*f*1 and a second conduit 71*f*2 for guiding the circulating water discharged from the pump 902.

The pump 902 includes two ports for discharging the circulating water, Hereinafter, the two ports are referred to as a first circulating water discharge port 912*a* and a second circulating water discharge port 912*b*. With this structure, when the first impeller 915 is rotated, the circulating water in the first chamber 914 is simultaneously discharged through the first circulating water discharge port 912*a* and the second circulating water discharge port 912*b*.

The first conduit 71*f*1 is connected to the first circulating water discharge port 912*a* by the first circulation pipe 18*a* and the second conduit 71*f*2 is connected to the second circulating water discharge port 912*b* by the second circulation pipe 18*b*.

That is, among the total circulating water discharged from the pump 902, the first sub-flow FL1 is supplied to the first nozzles 610*b* and 610*c* along the first flow path formed by the first circulation pipe 18*a* and the first conduit 71*f*1, and the second sub-flow FL2 is supplied to the second nozzles 610*d* and 610*e* along the second flow path formed by the second circulation pipe 18*b* and the second conduit 71*f*2.

Each of the conduits 71*f*1 and 71*f*2 includes a cylindrical conduit portion 710*f*1, 710*f*2 and a nozzle water supply port 72*b*, 72*c*, 72*d*, 72*e* protruded from the conduit portion 710*f*1, 710*f*2. The gasket 602 is provided with nozzles 610*b*, 610*c*, 610*d*, and 610*e* corresponding to the nozzle water supply port 72*b*, 72*c*, 72*d*, 72*e* to be supplied with the circulating water from a corresponding water supply port 72*b*, 72*c*, 72*d*, 72*e*. The nozzles 610*b*, 610*c*, 610*d*, and 610*e* may include a pair of intermediate nozzles 610*b* and 610*e* and a pair of lower nozzles 610*c* and 610*d*.

According to the embodiment, when one large lower balancer 83 is provided in the lower portion of the front surface of the tub 31, it may be difficult to install the distribution pipe 74 without interfering with the lower balancer 83. In the present embodiment, the conduits 71*f*1 and 71*f*2 are connected to the two circulation pipes 18*a* and 18*b*, which are separated from each other, without using the distribution pipe 74. In particular, the connection of each conduit 71*f*1, 71*f*2 and the circulation pipe 18*a*, 18*b* is achieved between the upper balancer 81, 82 and the lower balancer 83 so that interference with the lower balancer 83 can be avoided.

Meanwhile, the pump 902 has different flow rates discharged through the first discharge port 912*a* and the second discharge port 912*b*. Among the first discharge port 912*a* and the second discharge port 912*b*, the discharge port having the larger flow rate depends on the direction of rotation of the first impeller 915. That is, in the structure in which the opening 912*a*1 of the first discharge port 912*a* and the opening of the second discharge port 912*b*2 are disposed on the inner circumferential surface of the first chamber 916, considering a section where the angle between the first opening 912*a*1 and the second opening 912*a*2 does not exceed 180 degrees, more flow rate is discharged through the second discharge port 912*a* positioned in the upstream side based on the rotation direction of the first impeller 915 in the above mentioned section.

At this time, from the viewpoint of the first discharge port 912*a*, the pump housing 91 is in the form of a volute wound in the rotation direction of the first impeller 915. From the viewpoint of the second discharge port 912*b*, the pump housing 91 is in the form of a volute reversely wound for the rotation direction or a spiral structure. Here, the direction of rotation of the first impeller 915 is controllable by the controller 91 (see FIG. 42) as in the above described embodiment. When a tangent vector with respect to a certain circumference in the rotation direction of the first impeller 915 at the opening of the first discharge port 912*a* is defined, the tangent vector and the direction (or the direction in which the first discharge port 912*a* extends from the opening) of the water current transferred along the first discharge port 912*a* forms an acute angle with respect to each other.

Since the flow rate discharged through the first discharge port 912*a* is larger than the flow rate discharged through the second discharge port 912*b*, a deviation may occur between the discharge water pressure P1 of the first nozzles 610*b* and 610*e* which are supplied with water through the first conduit 71*f*1 and the discharge water pressure P2 of the second nozzles 610*d* and 610*e* which are supplied with water through the second conduit 71*f*2 (P1>P2). In this case, there is a problem that the circulating water sprayed through the nozzles 610*b*, 610*c*, 610*d*, and 610*e* can not uniformly applied to the laundry in the drum 31.

Figure 33:
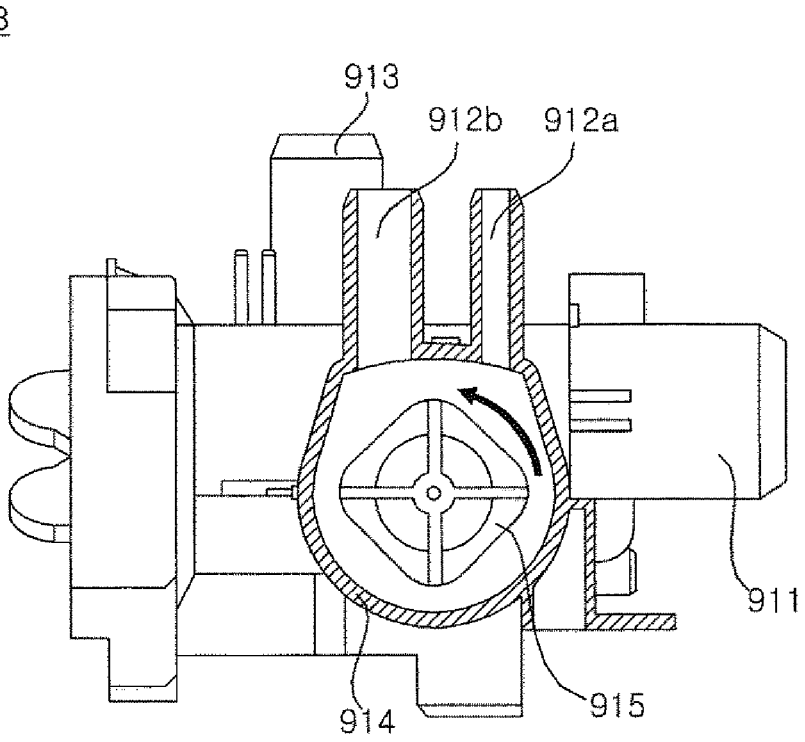
FIG. 33 shows another embodiment of a pump.

The pump 903 shown in FIG. 33 is designed to solve the above problem. Referring to FIG. 33, the second discharge port 912*b* of the pump 903 has a larger inner diameter than the first discharge port 912*a*. The flow rate discharged to the second discharge port 912*b* is increased to correct a flow rate difference between the first discharge port 912*a* and the second discharge port 912*b*. The respective inner diameters of the first discharge port 912*a* and the second discharge port 912*b* are preferably set such that the same flow rate is discharged through the first discharge port 912*a* and the second discharge port 912*b*.

Figure 34:
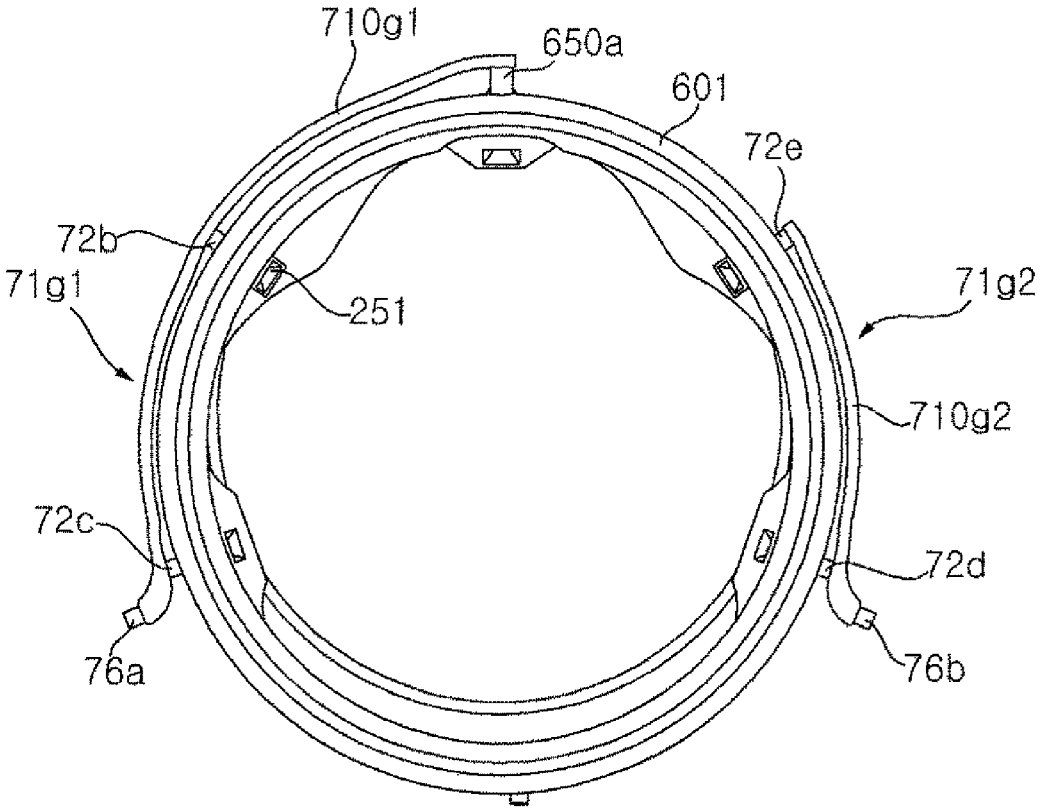
FIG. 34 shows a state in which nozzle water supply pipes are installed in a gasket in a washing machine according to a seventh embodiment of the present invention.

FIG. 34 shows a state in which nozzle water supply pipes are installed in a gasket in a washing machine according to a seventh embodiment of the present invention. Referring to FIG. 34, the first conduit 71*g*1 and the second conduit 71*g*2 according to the present embodiment are similar to the conduits 71*e*1 and 71*e*2 according to the fifth embodiment described with reference to FIG. 28. However, there is a difference in that respective conduits 71*g*1 and 71*g*2 are connected with the pump 902, 903 by the first circulation pipe 18*a* and the second circulation pipe 18*b* like the conduits 71*f*1 and 71*f*2 according to the sixth embodiment described with reference to FIG. 29 and FIG. 30.

Hereinafter, the same reference numerals are assigned to the same components as those described above, and the description thereof will be omitted according to the above description.

It is preferable that the first conduit 71*g*1 is connected to one of the first discharge port 912*a* and the second discharge port 912*b* which has a large discharge flow rate.

For example, in the case of applying the pump 902 described with reference to FIG. 32, it is preferable to connect the first circulation pipe 18*a* connected to the first discharge port 912*a* to the first conduit 71*g*1.

In addition, in the case of applying the pump 903 described with reference to FIG. 33, it is preferable that the first circulation pipe 18*a* connected to the first discharge port 912*a* is connected to the first conduit 71*g*1. However, if the discharge flow rate of the second discharge port 912*b* is larger than that of the first discharge port 912*a* due to the difference between the inner diameter of the first discharge port 912*a* and the inner diameter of the second discharge port 912*b*, it is also possible to connect the second circulation pipe 18*b* connected to the second discharge port 912*b* with the first conduit 71*g*1.

Figure 35:
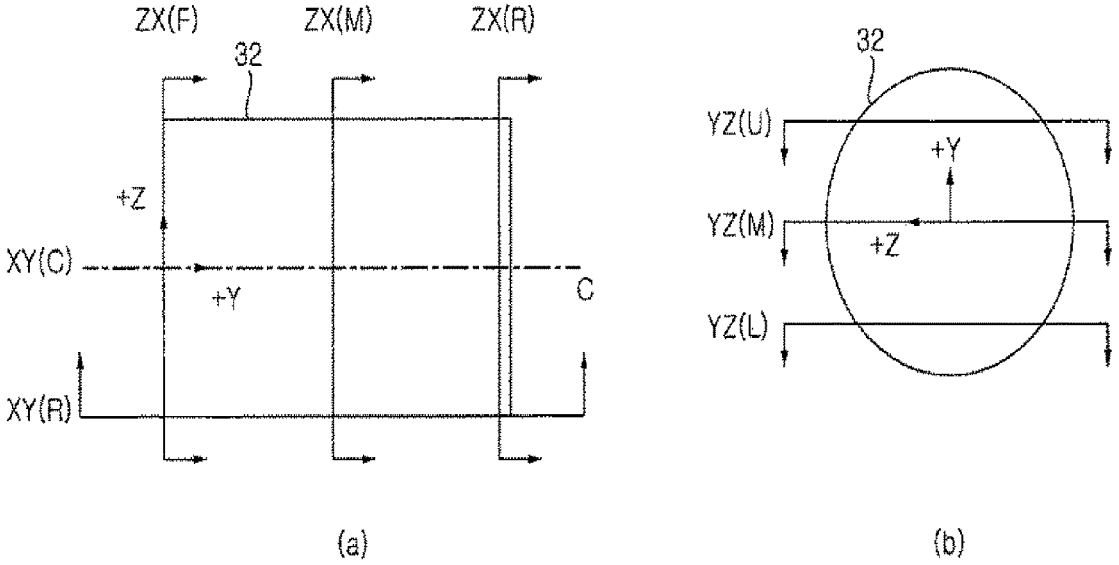
FIG. 35 schematically shows a drum (a) viewed from the top downward and a drum (b) viewed from the front.

FIG. 35 schematically shows a drum (a) viewed from the top downward and a drum (b) viewed from the front. Referring to FIG. 35, terms to be used hereinafter will be defined.

FIG. 35 is a diagram showing a state in which the rear direction, the upward direction, and the leftward direction are indicated by +Y, +X, +Z, respectively, based on the front view of the drum 32, ZX(F) indicates the ZX plane approximately in the front surface of the drum 32, ZX(M) indicates the ZX plane approximately in the intermediate depth of the drum 32, and ZX(R) indicates the ZX plane approximately in the vicinity of the rear surface portion 322 of the drum 32.

In addition, XY(R) indicates the XY plane positioned in the right end of the drum 32, and XY(C) indicates the XY plane (or vertical plane) to which the center C of the drum 32 belongs.

In addition, YZ(M) indicates the YZ plane of approximately intermediate height of the drum 32, YZ(U) indicates the YZ plane positioned in the upper side of YZ(M), and YZ(L) indicates the YZ plane positioned in the lower side of YZ(M).

Figure 36:
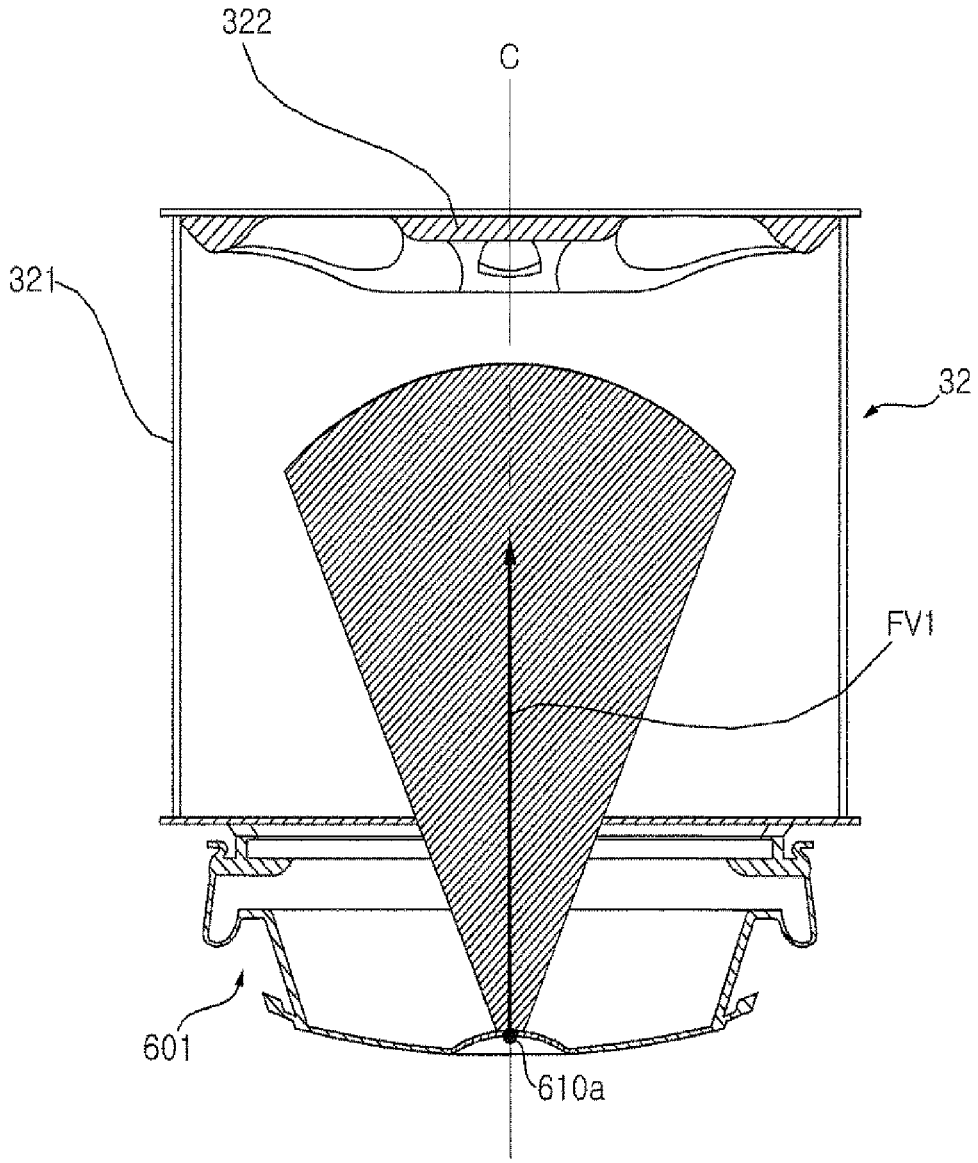
FIG. 36 is a view showing a spray pattern of an upper nozzle taken along YZ(U) indicated in FIG. 35.
Figure 37:
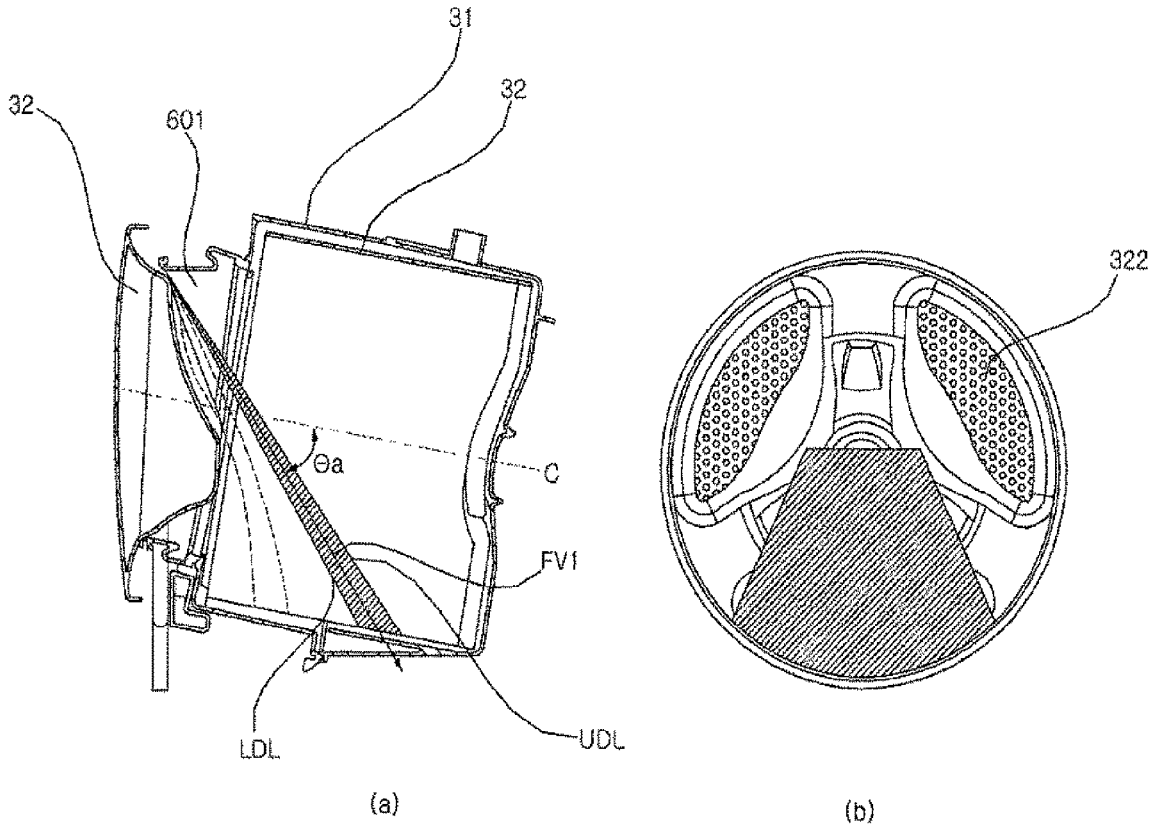
FIG. 37 is a view (a) of a spray pattern of an tipper nozzle taken along XY(R) indicated in FIG. 35 and a view (b) taken along ZX(M) indicated in FIG. 34.

FIG. 36 is a view showing a spray pattern of an upper nozzle taken along YZ(U) indicated in FIG. 35. FIG. 37 is a view (a) of a spray pattern of an upper nozzle taken along XY(R) indicated in FIG. 35 and a view (b) taken along ZX(M) indicated in FIG. 35.

Referring to FIGS. 36 and 37, as shown in (a) in FIG. 37, the water current sprayed through the upper nozzle 610*a* is sprayed in the form of a water film having a certain thickness, and the thickness of the water film may be defined between the upper boundary (UDL) and the lower boundary (LDL). Hereinafter, the water current shown in the drawings indicates the surface forming the upper boundary UDL, and the surface forming the lower boundary (LDL) is omitted.

The water current indicated by a dotted line in (a) in FIG. 37 represents the case (i.e., the case where the rotation speed of the pump motor is decreased) where the water pressure is lower than the case (the case of maximum water pressure) where it is indicated by a solid line. Since the intensity of the water current weakens as the water pressure drops, it can be recognized that the area of the water current is shifted to the opening side of the drum 32.

In particular, the window 22 more protrudes toward the drum 32 than the upper nozzle 610*a*. Accordingly, when the number of rotations of the pump motor is lowered below a certain level, the water current sprayed through the upper nozzle 610*a* can reach the window 22, and in this case, there is an effect that the window 22 is cleaned.

The water current sprayed through the upper nozzle 610*a* is symmetrical with respect to XY(C), and does not reach the rear surface portion 322 of the drum 32. As described above, since the spraying direction of the upper nozzle 610*a* is determined according to the configuration (e.g., the angle at which the collision surface 612*a* is tilted) of the collision surface 612*a*, even if the water pressure is continuously increased, the sprayed area cannot get out of a certain area. The water currents indicated by the solid line in FIGS. 36 to 41 show the state when the water current is sprayed at the maximum intensity through the respective nozzles.

Referring again to FIGS. 36 to 37, the upper nozzle 610*a* may be configured to spray the circulating water toward a side surface portion 321 of the drum 32. Specifically, the upper nozzle 610*a* sprays the circulating water downward toward the inside of the drum 32. At this time, the sprayed circulating water reaches the side surface portion 321, but does not reach the rear surface portion 322. Preferably, the water current sprayed through the upper nozzle 610*a* reaches the side surface portion 321 of the drum 32 in an area exceeding half the depth of the drum 32 (see (b) in FIG. 37).

Meanwhile, in FIG. 36 and FIG. 37, the spraying direction of the upper nozzle 610*a* is indicated by a vector FV1. Specifically, the vector FV1 indicates the flow direction at the center of the water current sprayed in the form of water film, based on the outlet of the upper nozzle 610*a*.

As shown in FIG. 36, the vector FV1 is in the same direction as the rotation center line C when viewed from the top, and forms an angle θa with respect to the rotation center line C when viewed from the side, as shown in FIG. 37. θa is approximately 35 to 45 degrees, preferably 40 degrees.

Figure 38:
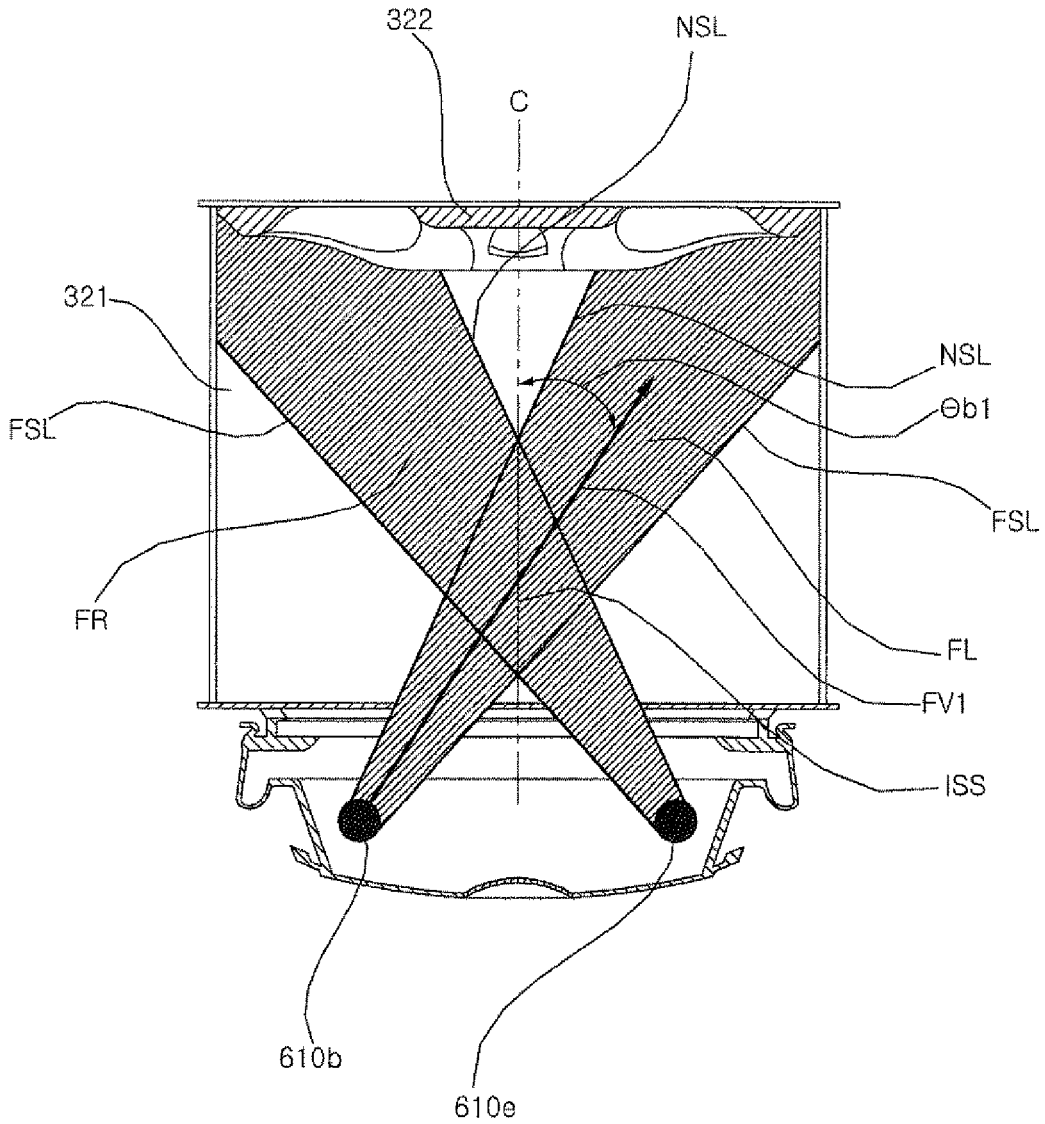
FIG. 38 is a view showing a spray pattern of an intermediate nozzles taken along YZ(U) indicated in FIG. 35.
Figure 39:
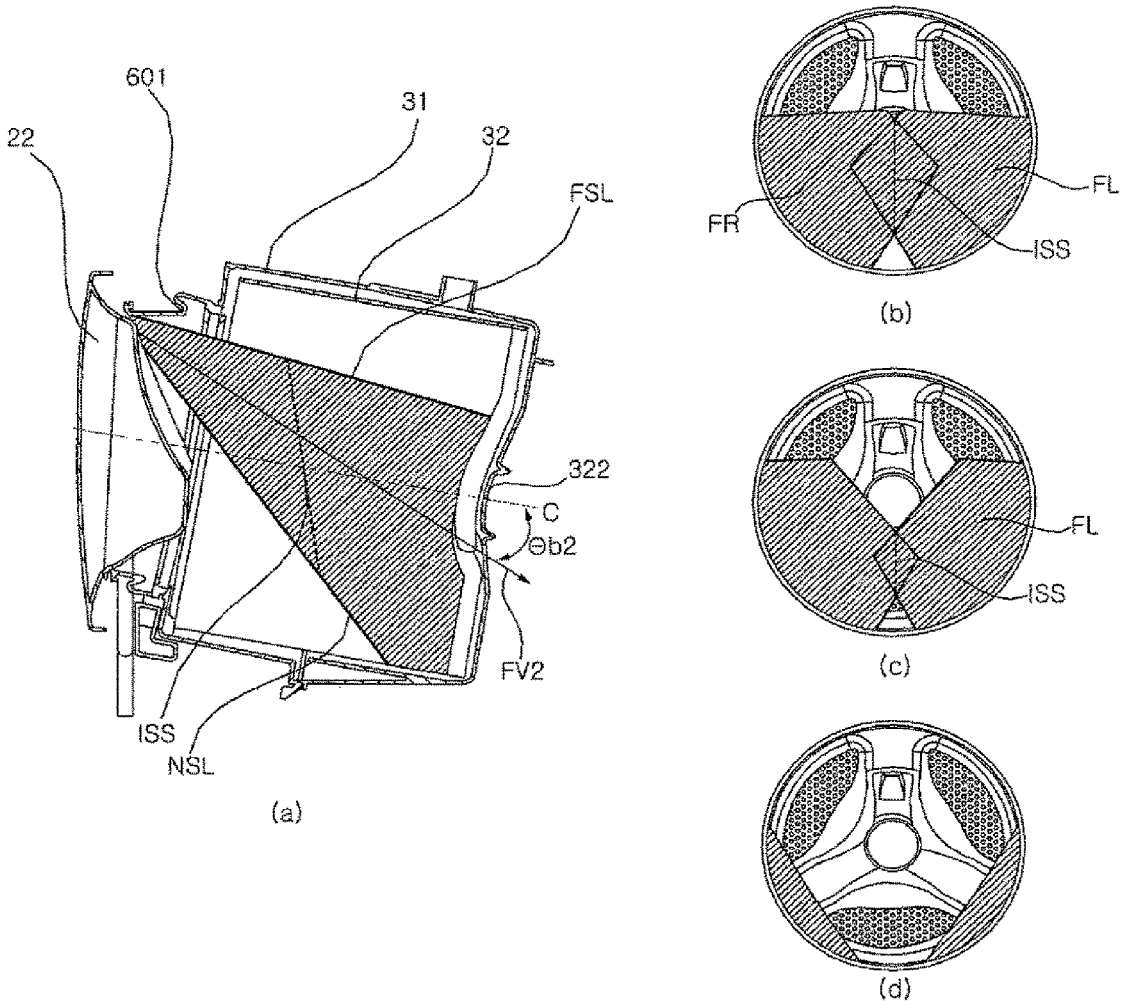
FIG. 39 shows a spray pattern (a) of a first intermediate nozzle taken along XY(R) indicated in FIG. 35, a spray pattern (b) of intermediate nozzles 610*b*, 610*e* taken along ZX(F) indicated in FIG. 35, a spray pattern (c) of intermediate nozzles taken along ZX(M), and a spray pattern (d) of intermediate nozzles taken along ZX(R).

FIG. 38 is a view showing a spray pattern of an intermediate nozzles taken along YZ(U) indicated in FIG. 35. FIG. 39 shows a spray pattern (a) of a first intermediate nozzle taken along XY(R) indicated in FIG. 35, a spray pattern (b) of intermediate nozzles 610*b*, 610*e* taken along ZX(F) indicated in FIG. 35, a spray pattern (c) of intermediate nozzles taken along ZX(M), and a spray pattern (d) of intermediate nozzles taken along ZX(R).

Referring to FIG. 38 and FIG. 39, a pair of the intermediate nozzles 610*b* and 610*e* may include a first intermediate nozzle which is disposed in one side (or a first area) of the left and right sides based on the XY(C) plane and sprays the circulating water toward the other side (or a second area), and a second intermediate nozzle which is disposed in the other side based on the XY(C) plane and sprays the circulating water toward the one side.

The first intermediate nozzle 610*b* and the second intermediate nozzle 610*e* are disposed symmetrically with respect to the XY(C) plane, and the spraying directions of the respective intermediate nozzles are also symmetrical to each other. The water current sprayed through each intermediate nozzle has a width defined between one side boundary NSL near the nozzle side and the other side boundary FSL opposite to the one side boundary NSL.

The one side boundary NSL may be positioned below the other side boundary FSL. Preferably, one side boundary NSL meets the side surface portion 321 of the drum 32, and the other side boundary FSL, meets the side surface portion 321 of the drum 32 in a position higher than one side boundary NSL. That is, the water current sprayed by the intermediate nozzle 610*b*, 610*e* forms a tilted water film which is downwardly directed to one side from the other side.

The water current sprayed through each of the intermediate nozzles 610*b* and 610*e* reaches an area formed between a point where one side boundary NSL meets the side surface portion 321 of the drum 32 and a point where the other side boundary FSL meets the side surface portion 321 of the drum, and the area includes an area meeting the rear surface portion 322 of the drum 32. That is, a section where the water current meets the drum 32 passes by the rear surface portion 322 of the drum 32 while proceeding downward toward the point where one side boundary NSL meets the side surface portion 321 of the drum 32 from the point where the other side boundary FSL meets the side surface portion 321 of the drum.

Hereinafter, it is illustrated that the first intermediate nozzle 610*b* is disposed in the left side (hereinafter, referred to as "left area") based on the XY(C) plane, and the second intermediate nozzle 610*e* is disposed in the right side (hereinafter, referred to as "right area") based on the XY(C) plane, and the spray pattern of the intermediate nozzles 610*b* and 610*e* will be described in more detail.

The first intermediate nozzle 610*b* sprays the circulating water toward the right area. That is, the water current sprayed through the first intermediate nozzle 610*b* is not symmetrical with respect to the XY(C) plane but is deflected to the right side.

The left boundary NSL (one side boundary NSL) of the water current FL sprayed through the first intermediate nozzle 610*b* is positioned below the right boundary FSL (or the other side boundary FSL), and meets the side surface portion 321 of the drum 32. The right boundary FSL (or the other side boundary FSL) of the water current FL sprayed through the first intermediate nozzle 610*b* also meets the side surface portion 321 of the drum 32.

The right boundary FSL of the water current FL sprayed through the first intermediate nozzle 610*b* meets the side surface portion 321 of the drum 32, preferably, in a position higher than the center C of the drum 32.

The section where the water current F L sprayed through the first intermediate nozzle 610*b* meets the rear surface portion 322 of the drum 32 while proceeding downwardly to the left from the point where the right boundary FSL meets the side surface portion 321 of the drum 32, meets again the side surface portion 321 of the drum 32 and then reaches the point where the left boundary NSL meets the side surface portion 321 of the drum 32.

The second intermediate nozzle 610*e* sprays the circulating water toward the left area. That is, the water current sprayed through the second intermediate nozzle 610*e* is not symmetrical with respect to the XY(C) plane but is deflected to the right.

The right boundary NSL (one side boundary NSL) of the water current FL sprayed through the second intermediate nozzle 610*e* is positioned below the left boundary FSL (or the other side boundary FSL), and meets the side surface portion 321 of the drum 32. The left boundary FSL (or the other side boundary FSL) of the water current FL sprayed through the second intermediate nozzle 610*e* also meets the side surface portion 321 of the drum 32.

The left boundary FSL of the water current FL sprayed through the second intermediate nozzle 610*e* meets the side surface portion 321 of the drum 32, preferably, in a position higher than the center C of the drum 32.

The section where the water current FL sprayed through the second intermediate nozzle 610*e* meets the drum 32 meets the rear surface portion 322 of the drum 32 while proceeding downwardly to the right from the point where the left boundary FSL meets the side surface portion 321 of the drum 32, meets again the side surface portion 321 of the drum 32 and then reaches the point where the right boundary NSL meets the side surface portion 321 of the drum 32.

In the drawing, a portion (hereinafter, referred to as "intersection section") where the water current FL sprayed from the first intermediate nozzle 610*b* intersects with the water current FR sprayed from the second intermediate nozzle 610*e* is indicated as ISS. The intersection section ISS starts from the front side than the middle depth of the drum 32 and proceeds rearward and then is terminated before reaching the rear surface portion 322 of the drum 32. The intersection section ISS forms a line segment progressing downward from the front end to the rear end when viewed from the side (see (a) in FIG. 39). The intersection section ISS is terminated, preferably, at a depth deeper than the intermediate depth of the drum 32 (see (c) in FIG. 39).

Referring to FIG. 38 and FIG. 39, the spraying direction of the intermediate nozzle 610*b*, 610*e* is indicated by a vector FV2. Specifically, the vector FV2 indicates the direction of flow at the center of the water current sprayed in a water film form, based on the outlet of the intermediate nozzle 610*b*, 610*e*.

The vector FV2 forms an angle θb1 with respect to the rotation center line C when viewed from above as shown in FIG. 38, and forms an angle θ*b*2 with respect to the rotation center line C when viewed from the side as shown in FIG. 39. The angle θb1 is approximately 5 to 15 degrees, preferably 10 degrees, and the angle θb2 is approximately 30 to 40 degrees, preferably 34 to 35 degrees.

Figure 40:
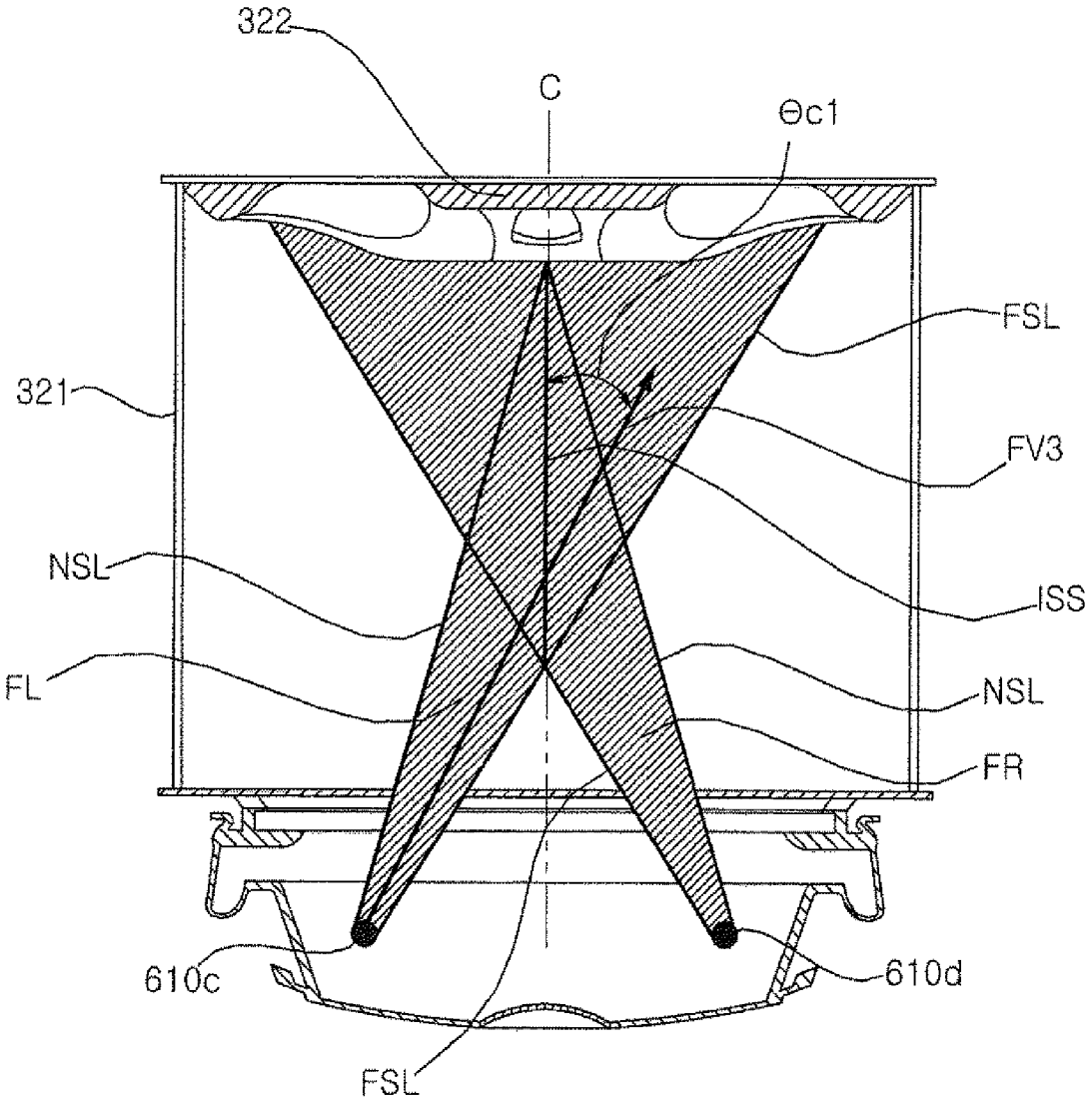
FIG. 40 is a view showing a spray pattern of lower nozzles taken along YZ(U) indicated in FIG. 35.
Figure 41:
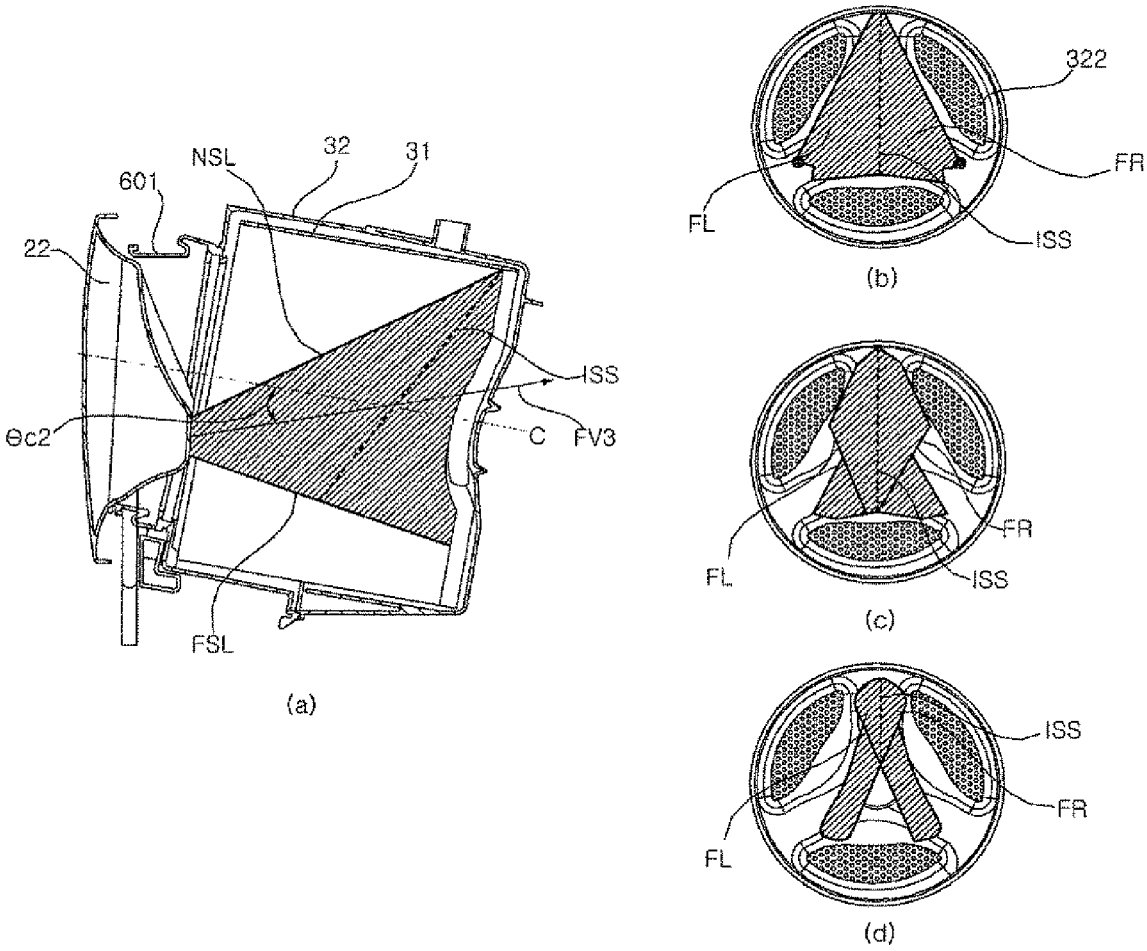
FIG. 41 shows a spray pattern (a) of a first lower nozzle taken along XY(R) indicated in FIG. 35, a spray pattern (b) of lower nozzles taken along ZX(F) indicated in FIG. 35, a spray pattern (c) of lower nozzles taken along ZX(M), and a spray pattern (d) of lower nozzles taken along ZX(R).

FIG. 40 is a view showing a spray pattern of lower nozzles taken along YZ(U) indicated in FIG. 35. FIG. 41 shows a spray pattern (a) of a first lower nozzle taken along XY(R) indicated in FIG. 35, a spray pattern (b) of lower nozzles taken along ZX(F) indicated in FIG. 35, a spray pattern (c) of lower nozzles taken along ZX(M), and a spray pattern (d) of lower nozzles taken along ZX(R).

Referring to FIG. 40 and FIG. 41, a pair of lower nozzles 610*c* and 610*d* may include a first lower nozzle 610*c* which is disposed in one side (or a first area) of the left and right sides based on the XY(C) plane and sprays the circulating water toward the other side (or a second area) and a second lower nozzle 610*d* which is disposed in the other side based on the XY(C) plane and sprays the circulating water toward the one side.

The first lower nozzle 610*c* and the second lower nozzle 610*d* are disposed symmetrically with respect to the XY(C) plane, and the spraying directions of the respective lower nozzles are also symmetrical to each other. The water current sprayed through each lower nozzle has a width defined between one side boundary NSL near the nozzle side and the other side boundary FSL opposite to the one side boundary NSL.

The one side boundary NSL may be positioned above the other side boundary FSL. Preferably, one side boundary NSL meets the rear surface portion 322 of the drum 32, and the other side boundary FSL meets the rear surface portion 322 of the drum 32 in a position lower than one side boundary NSL. That is, the water current sprayed by the lower nozzle 610*c*, 610*d* forms a tilted water film which is downwardly directed to the other side from one side.

The water current sprayed through each of the lower nozzles 610*c* and 610*d* reaches an area formed between a point where one side boundary NSL meets the rear surface portion 322 of the drum 32 and a point where the other side boundary FSL meets the rear surface portion 322 of the drum.

Hereinafter, it is illustrated that the first lower nozzle 610*c* is disposed in the left side (hereinafter, referred to as "left area") based on the XY(C) plane, and the second lower nozzle 610*d* is disposed in the right side (hereinafter, referred to as "right area") based on the XY(C) plane, and the spray pattern of the lower nozzles 610*c* and 610*d* will be described in more detail.

The first lower nozzle 610*c* sprays the circulating water toward the right area. That is, the water current sprayed through the first lower nozzle 610*c* is not symmetrical with respect to the XY(C) plane but is deflected to the right side.

The left boundary NSL (one side boundary NSL) of the water current FL sprayed through the first lower nozzle 610*c* is positioned above the right boundary FSL (or the other side boundary FSL), and meets the rear surface portion 322 of the drum 32. The right boundary FSL (or the other side boundary FSL) of the water current FL sprayed through the first lower nozzle 610*c* also meets the rear surface portion 322 of the drum 32.

The left boundary NSL of the water current FL sprayed through the first lower nozzle 610*c* meets the rear surface portion 322 of the drum 32, preferably, in a position higher than the center C of the drum 32. The right boundary FSL of the water current FL sprayed through the first lower nozzle 610*c* meets the rear surface portion 322 of the drum 32, preferably, in a position lower than the center C of the drum 32.

The section where the water current FL sprayed through the first lower nozzle 610*c* reaches the point where the right boundary FSL meets the rear surface portion 322 of the drum 32 while proceeding downwardly to the right from the point where the left boundary NSL meets the rear surface portion 322 of the drum 32.

The second lower nozzle 610*d* sprays the circulating water toward the right area. That is, the water current sprayed through the second lower nozzle 610*d* is not symmetrical with respect to the XY(C) plane but is deflected to the right.

The right boundary NSL (one side boundary NSL) of the water current FL sprayed through the second lower nozzle 610*d* is positioned above the left boundary FSL (or the other side boundary FSL), and meets the rear surface portion 322 of the drum 32. The left boundary FSL (or the other side boundary FSL) of the water current FL sprayed through the second lower nozzle 610*d* also meets the rear surface portion 322 of the drum 32.

The right boundary NSL of the water current FL sprayed through the second lower nozzle 610*d* meets the rear surface portion 322 of the drum 32, preferably, in a position higher than the center C of the drum 32. The left boundary NSL of the water current FL sprayed through the first lower nozzle 610*c* meets the rear surface portion 322 of the drum 32, preferably, in a position lower than the center C of the drum 32.

The section where the water current FL sprayed through the second lower nozzle 610*d* meets the drum 32 reaches the point where the left boundary FSL meets the rear surface portion of the drum 32, while proceeding downwardly to the left from the point where the left boundary NSL meets the rear surface portion 322 of the drum 32.

In the drawing, a portion (hereinafter, referred to as "intersection section") where the water current FL sprayed from the first lower nozzle 610*c* intersects with the water current FR sprayed from the second lower nozzle 610*d* is indicated as ISS. The intersection section (ISS) forms a line segment upward from the front end to the rear end when viewed from the side (see (a) in FIG. 41). The intersection section ISS preferably is terminated at a depth deeper than the middle depth of the drum 32 (preferably, closer to the rear surface portion 322 than the middle depth of the drum 32) (see (d) in FIG. 41).

Referring to FIG. 40 and FIG. 41, the spraying direction of the lower nozzle 610*c*, 610*d* is indicated by a vector FV3. Specifically, the vector FV3 indicates the direction of flow at the center of the water current sprayed in a water film form, based on the outlet of the intermediate nozzle 610*c*, 610*d*.

The vector FV3 forms an angle θc1 with respect to the rotation center line C when viewed from above as shown in FIG. 40, and forms an angle θc2 with respect to the rotation center line C when viewed from the side as shown in FIG. 41. The angle θc1 is approximately 15 to 25 degrees, preferably 20 degrees, and the angle θc2 is approximately 20 to 30 degrees, preferably 25 to 26 degrees.

Figure 42:
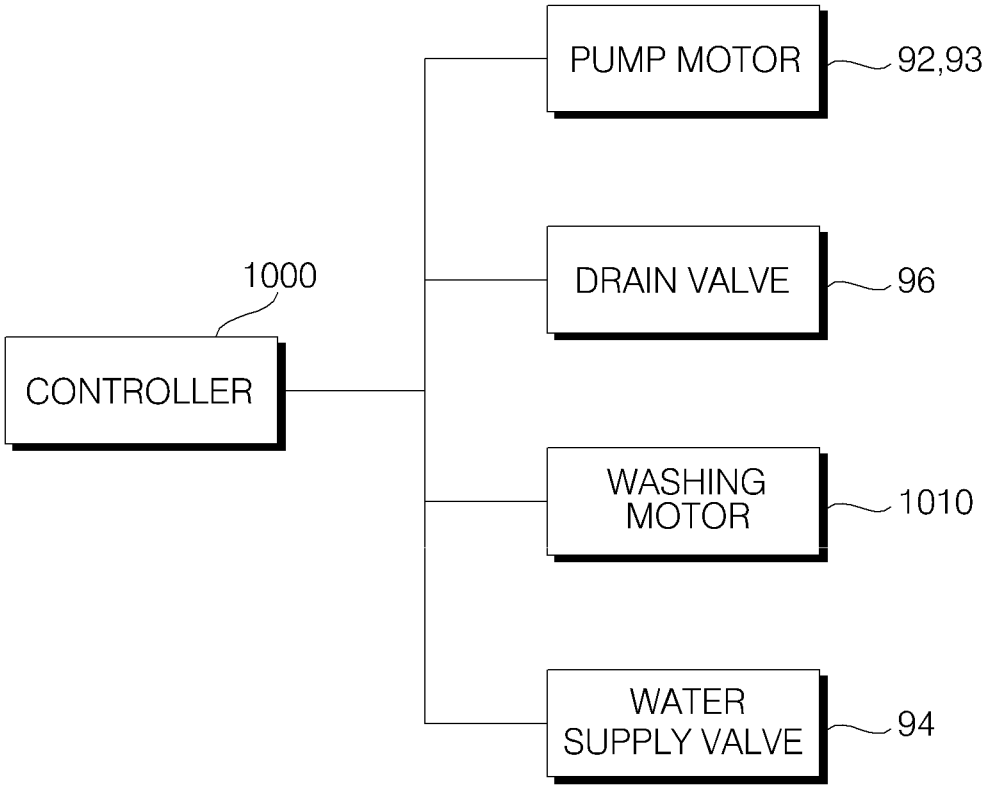
FIG. 42 is a block diagram showing a control relationship between configurations commonly applied to washing machines according to embodiments of the present invention.

FIG. 42 is a block diagram showing a control relationship between configurations commonly applied to washing machines according to embodiments of the present invention.

When the user inputs settings (e.g., washing course, washing, rinsing, spin-dry time, spin-dry speed, etc.) through an input unit provided on the control panel 14, the controller 91 controls the washing machine to be operated according to the inputted settings. For example, control algorithms for a water supply valve 94, a washing motor 1010, a pump motor 92, 93, the water supply valve 94, and a drain valve 96 may be stored in the memory (not shown) and the controller can control the washing machine to operate according to an algorithm corresponding to the setting inputted through the input unit.

In the following description, it is illustrated that the pump motors 92, 93 includes a circulation pump motor 92 for spraying water into the tub 31 through a nozzles 610*c*, 610*d* and a drain pump motor 93 for draining the water in the tub 31.

Under the control of the controller 91, the circulation pump may be operated (e.g., during washing) or the drain pump may be operated (e.g., during draining) according to a certain algorithm.

Meanwhile, the controller 91 may control not only the circulation pump motor 92 but also the drain pump motor 93, and furthermore may control the overall operation of the washing machine. It can be understood that the control of each unit mentioned below is performed under the control of the controller 91 even if it is not mentioned.

Although the intermediate nozzle 610*b*, 610*e* and the lower nozzle 610*c*, 610*d* are structurally different in the position and shape of disposition, it can be considered that both have the same function based on the fact that the water pumped by the circulation pump motor 92 is sprayed into the tub 31 and the position where the water is sprayed into the tub 31 varies depending on the rotation speed of the circulation pump motor 92. The control method of the washing machine described below can be applied to both the intermediate nozzle and the lower nozzle. In the following description of the first embodiment, the 'nozzle' is illustrated as a configuration including the lower nozzles 610*c* and 610*d*. It should be understood, however, that this is for convenience of explanation, and that the control method according to the first embodiment described below can be applied equally or equivalently even when an intermediate nozzle is included.

Figure 43:
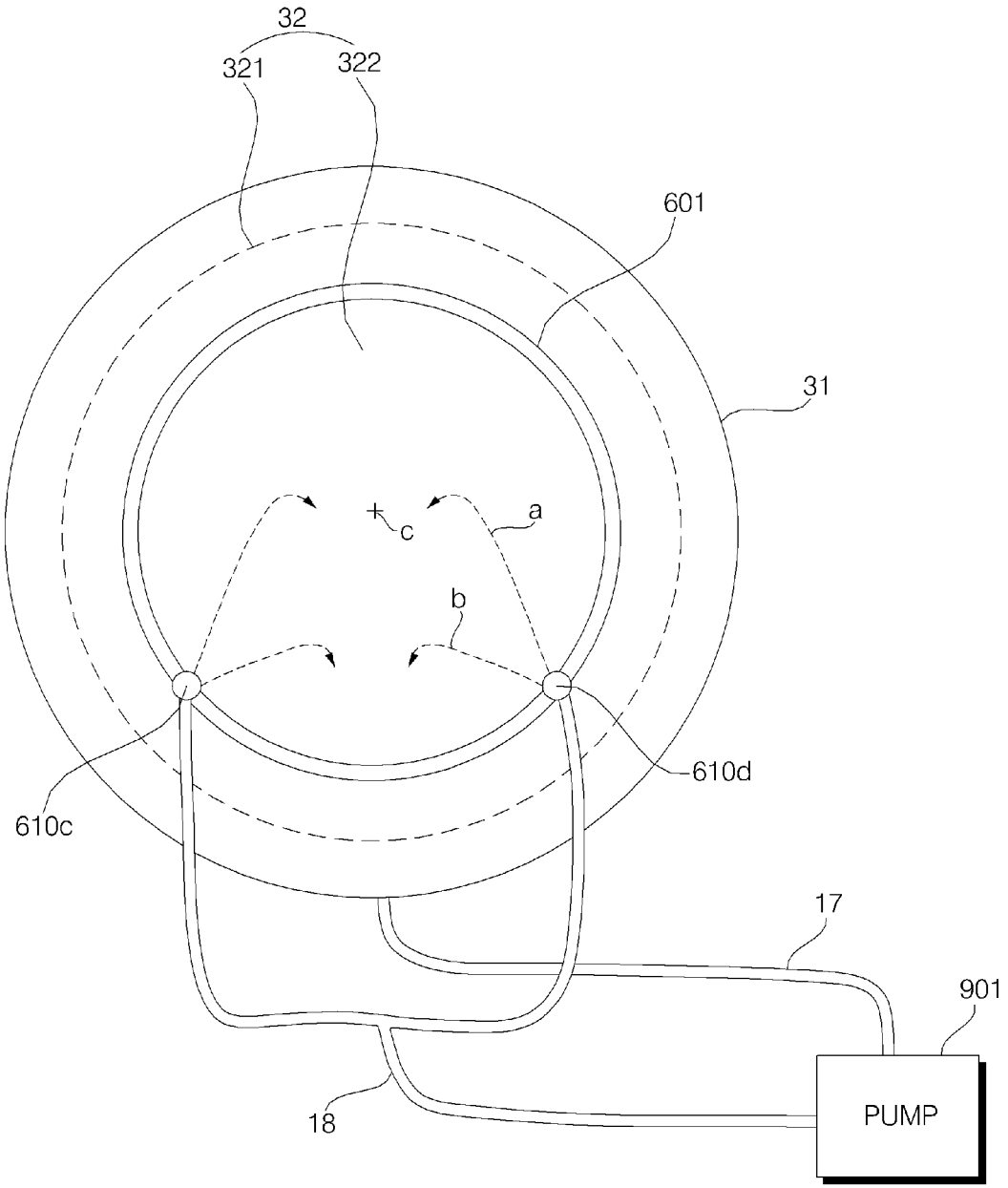
FIG. 43 schematically shows main components commonly applied to washing machines according to embodiments of the present invention.

FIG. 43 schematically shows main components commonly applied to washing machines according to embodiments of the present invention.

In FIG. 43, when water is supplied by the pump 36 with a sufficient water pressure, the spray pattern is indicated as "a", and when the water pressure is lower than the above pressure, it is indicated as "b". That is, as the rotation speed of the pump 36 is varied, the shape of the water current sprayed through the nozzle 610*c*, 610*d* can be varied between a and b.

Meanwhile, FIG. 43 illustrates that there are two nozzles, but it is also possible to include the intermediate nozzle 610*b*, 610*e* and the lower nozzle 610*c*, 610*d* as shown in FIG. 10.

The nozzle may be provided according to any one of the above-described embodiments with reference to FIG. 8 to FIG. 30. That is, it is sufficient when a plurality of nozzles include the nozzles 610*c* and 610*d* shown in FIG. 43, and the nozzles may be four nozzles 610*b*, 610*c*, 610*d* and 610*e* or five nozzles 610*a*, 610*b*, 610*c*, 610*d*, and 610*e*.

Meanwhile, FIG. 43 shows that the circulation pipe 18 connected to the pump 901 is branched so that the water is transferred to the respective nozzles 610*c* and 610*d*. Alternatively, a plurality of circulation pipes may be connected to the pump 901 respectively.

Figure 44:
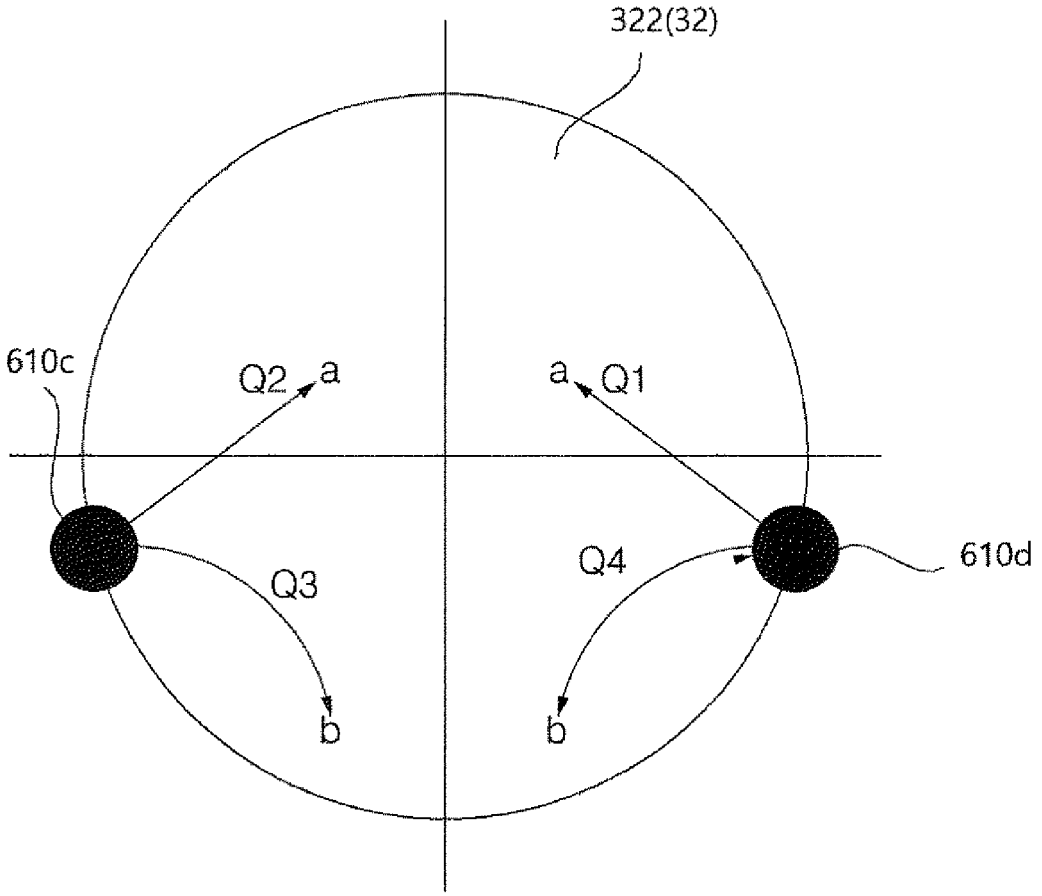
FIG. 44 schematically shows a drum viewed from the front, and shows the spraying range of each nozzle.
Figure 45:
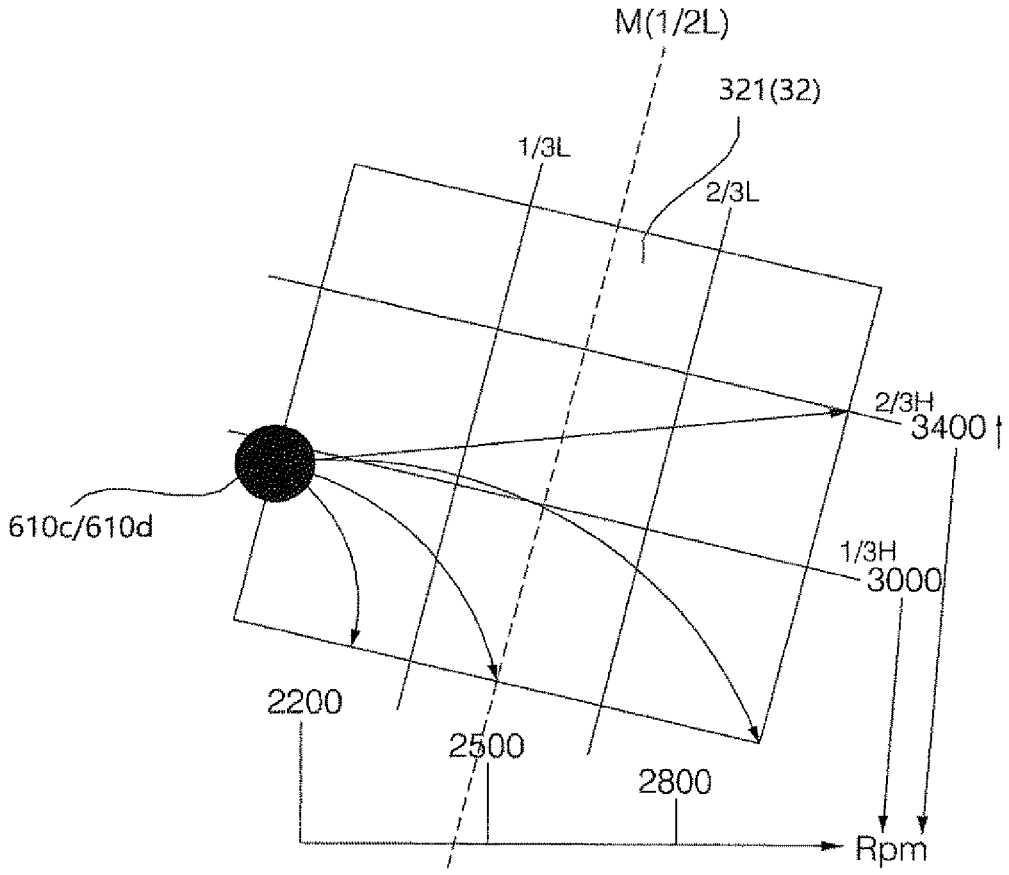
FIG. 45 schematically shows a drum viewed from the side, and shows the spraying range of each nozzle.

FIG. 44 schematically shows a drum viewed from the front, and shows the spraying range of each nozzle. FIG. 45 schematically shows a drum viewed from the side, and shows the spraying range of each nozzle.

Referring to FIG. 44, when quadrants Q1, Q2, Q3 and Q4 are defined by quartering the drum 32 viewed from the front, the lower nozzle 610*c* is disposed in a third quadrant Q3, the lower nozzle 610*d* is disposed in a fourth quadrant Q4. FIG. 45 shows a lower limit b of the water current sprayed through the respective nozzles 610*c* and 610*d* when the circulation pump motor 92 rotates at 2600 rpm, and shows an upper limit when the circulation pump motor 92 rotates at rpm.

According to the rotation speed of the circulation pump motor 92, the lower nozzle 610*c* is configured to spray water into the area reaching the third quadrant Q3 and the second quadrant Q2. That is, as the speed of the circulation pump motor 92 increases, water is sprayed upwardly through the lower nozzle 610*c*, and when the circulation pump motor 92 is rotated at the maximum speed, the water current sprayed from the lower nozzle 610*c* reaches the second quadrant Q2 on the rear surface portion 322 of the drum 32.

According to the rotation speed of the circulation pump motor 92, the lower nozzle 610*d* is configured to spray water into the area reaching the fourth quadrant Q4 and the second quadrant Q1. That is, as the speed of the circulation pump motor 92 increases, water is sprayed upwardly through the lower nozzle 610*d*, and when the circulation pump motor 92 is rotated at the maximum speed, the water current sprayed from the lower nozzle 610*d* reaches the first quadrant Q1 on the rear surface portion 322 of the drum 32.

Referring to FIG. 45, when a first area, a second area, and a third area are defined sequentially from the front by trisecting the drum 32 viewed from the side, as the rotation speed of the circulation pump motor 92 gradually increases, it can be seen that the water current sprayed from the nozzle 610*c*, 610*d* reaches the deeper position of the drum 32. As shown in the drawing, when the rotation speed of the circulation pump motor 92 is 2200 rpm, the water current sprayed from the nozzle 610*c*, 610*d* reaches the first area of the side surface portion 321 of the drum 32. In the case of 2500 rpm, it reaches the second area, and in the case of 2800 rpm, reaches the third area. When the rotation speed of the circulation pump motor 92 is further enhanced, water current reaches the rear surface portion 322 of the drum 32. At 3000 rpm, the water current reaches ⅓ of the height H of the drum 32. At 3400 rpm, the water current reaches ⅔ of the height H of the drum 32. When the rotation speed of the circulation pump motor 92 reaches 3400 rpm, the height of the water current becomes the maximum, and the structure of the nozzles 610*c*, 610*d* does not increase the spraying height any more, but can strengthen the intensity of the water current.

Meanwhile, the rotation speed value Rpm of the circulation pump motor 92 in FIG. 45 is a value according to an embodiment of the present invention, which may vary depending on the size and shape of the water supply pipe, and the specification of the pump. However, as the rotation speed of the circulation pump motor 92 is increased as shown in FIG. 45, the tendency of the water current to reach the upper side of the rear surface portion 322 from the front of the drum 32 may be the same.

The drum driving motion means a combination of the rotation direction and the rotation speed of the drum 32. The falling direction or the falling time point of the laundry placed inside the drum 32 is changed by the drum driving motion, and thus, the flow of laundry in the drum 32 is changed. The drum driving motion is implemented by controlling the washing motor by the controller.

The laundry is raised by the lifter 34 provided on the inner circumferential surface of the drum 32 when the drum 32 rotates, so that the shock applied to the laundry can be differentiated by controlling the rotation speed and the rotation direction of the drum 32. That is, friction between laundry, friction between laundry and fluid, and dropping impact of laundry may be differentiated. In other words, the laundry can be knocked or scrubbed for washing at different degrees, and the laundry can be dispersed or turned upside down at different degrees.

Meanwhile, in order to implement such various drum driving motions, the washing motor is preferably a direct-connection type motor. That is, it is preferable that the stator of the motor is fixed to the rear of the tub 31, and the driving shaft 38*a* rotated together with the rotor of the motor drives the drum 32 directly. This is because, by controlling the rotation direction and torque of the motor, time delay or backlash can be prevented as much as possible, and the drum driving motion can be controlled immediately.

On the other hand, in the form of transmitting the rotational force of the motor to the rotary shaft through a pulley or the like, the drum driving motion such as tumbling driving or spinning driving, in which time delay or backlash is allowed is available, but is not suitable for implementing various other drum driving motions. Since the scheme of driving the washing motor and the drum 32 is obvious to those skilled in the art, a detailed description thereof is omitted.

Figure 46:
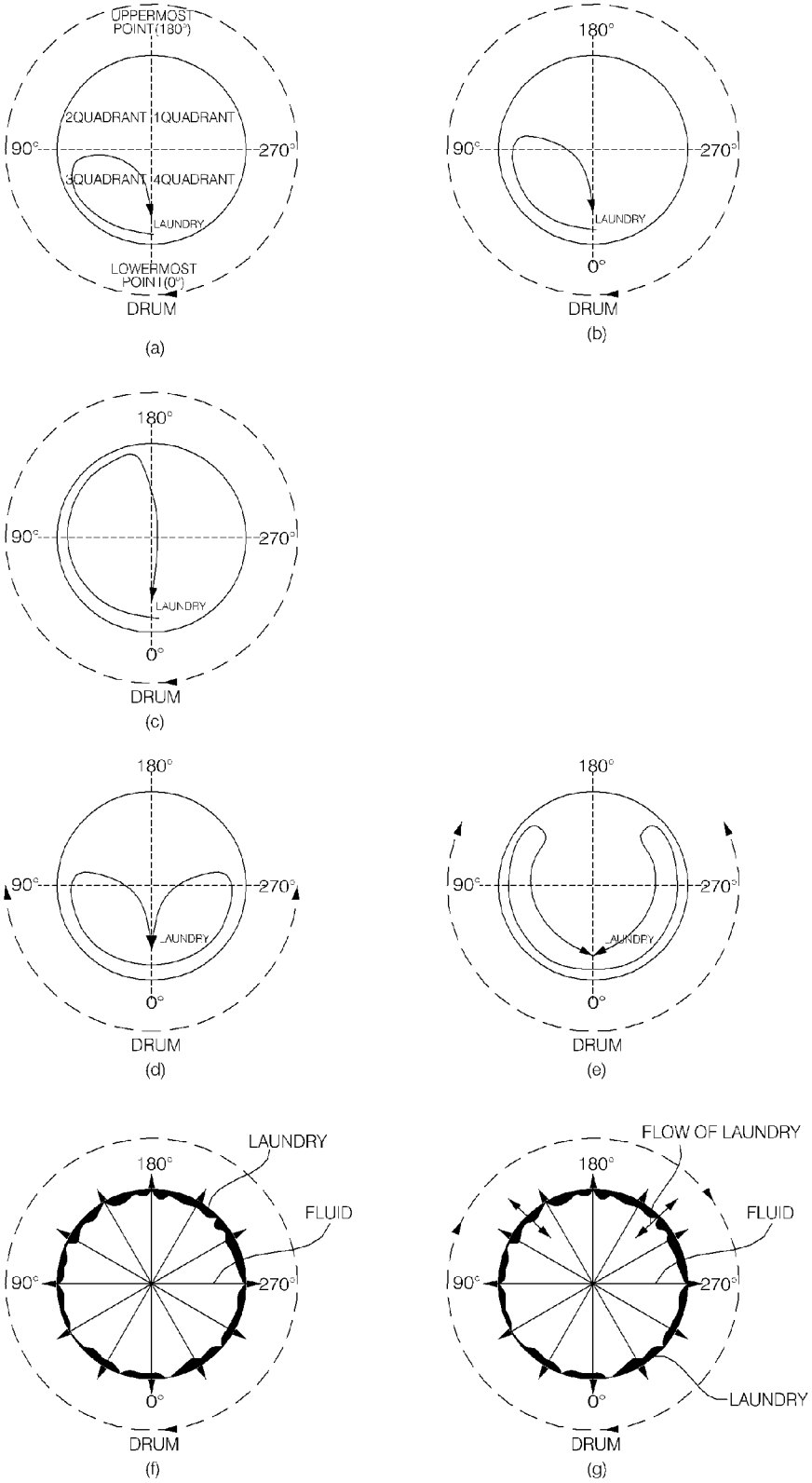
FIG. 46 is a view showing drum driving motions.

(a) in FIG. 46 is a view showing a rolling motion. In the rolling motion, the washing motor rotates the drum 32 in one direction (preferably, one rotation or more), and the laundry on the inner circumferential surface of the drum 32 is controlled to fall toward the lowermost point of the drum 32 from a position less than about 90 degrees in the rotation direction of the drum 32.

For example, when the washing motor rotates the drum 32 at about 40 RPM, the laundry positioned at the lowermost point of the drum 32 is raised by a certain height along the rotation direction of the drum 32, and then flows toward the lowermost point of the drum 32 as it rolls at a position of less than about 90 degrees from the lowermost point of the drum 32 in the rotation direction. Visually, when the drum 32 rotates in the clockwise direction, the laundry continuously rolls in the third quadrant of the drum 32.

In the rolling motion, the laundry is washed through friction with the fluid, friction between the laundry, and friction with the inner circumferential surface of the drum 32. At this time, the flip of the laundry is sufficiently generated, and the effect of smoothly scrubbing the laundry is obtained.

Here, the rotation speed (rpm) of the drum 32 is determined in relation to the radius of the drum 32. As the rotation speed of the drum 32 increases, the centrifugal force applied to the laundry in the drum 32 also increases. The flow of the laundry in the drum 32 is changed due to the difference in magnitude between the centrifugal force and the gravity. Obviously, the rotational force of the drum 32 and the friction between the drum 32 and the laundry should also be considered. As described above, when considering the various forces applied to the laundry, the rotation speed of the drum 32 in the rolling motion is determined in a range where the sum of the centrifugal force and the frictional force is smaller than the gravitational force 1G.

(b) in FIG. 46 is a view showing a tumbling motion. In the tumbling motion, the washing motor rotates the drum 32 in one direction (preferably, one rotation or more), and the laundry on the inner circumferential surface of the drum 32 is controlled to fall toward the lowermost point of the drum 32 from a position about 90 to 110 degrees in the rotation direction of the drum 32. The tumbling motion is a drum driving motion generally used in washing and rinsing, since the mechanical force is generated only by controlling the drum 32 to rotate in one direction at an appropriate rotation speed.

That is, the laundry put into the drum 32 is positioned at the lowermost point of the drum 32 before the washing motor is driven. When the washing motor provides torque to the drum 32, the drum 32 is rotated, and the laundry rises to a certain height from the lowermost point in the drum 32 by the lifter 34 provided on the inner circumferential surface of the drum 32 or the frictional force with respect to the inner circumferential surface of the drum 32. For example, when the washing motor rotates the drum 32 by about 46 rpm, the laundry falls toward the lowermost point of the drum 32 from a position of about 90 to 110 degrees in the rotation direction in the lowermost point of the drum 32.

The rotation speed of the drum 32 in the tumbling motion may be determined in a range where the centrifugal force is generated larger than in the case of the rolling motion, but less than gravity.

Visually, in the tumbling motion, when the drum 32 rotates clockwise, the laundry rises from the lowermost point of the drum 32 to the position of 90 degrees or the second quadrant and is separated into the inner circumferential surface of the drum 32 and falls toward the lowermost point of the drum 32

Therefore, in the tumbling motion, the laundry is washed by the impact force caused by the friction with the fluid and the falling. In particular, the laundry is washed by a greater mechanical force than in the case of the rolling motion. Particularly, in the tumbling motion, there is an effect that the tangled laundry is separated and the laundry is dispersed.

(c) in FIG. 46 is a view showing a step motion. In the step motion, the washing motor rotates the drum 32 in one direction (preferably, not enough for one rotation), and the laundry on the inner circumferential surface of the drum 32 is controlled to fall toward the lowermost point of the drum 32 from a position (preferably, a position of about 146 to 161 degrees in the rotation direction of the drum 32, but not necessarily limited thereto, and an angular position greater than 161 degrees is also available within a range not exceeding 180 degrees) near the uppermost point of the drum 32.

That is, the step motion is a motion for maximizing the impact force applied on laundry by rotating the drum 32 at a speed at which the laundry does not fall from the inner circumferential surface of the drum 32 due to the centrifugal force (i.e., a speed at which the laundry is rotated together with the drum 32 in a state in which the laundry is adhered to the inner circumferential surface of the drum 32 by the centrifugal force), and then abruptly braking the drum 32.

For example, when the washing motor rotates the drum 32 at a speed of about 60 rpm or more, the laundry is rotated by the centrifugal force without falling (i.e., rotated together with the drum 32 in a state of adhering to the inner circumferential surface of the drum 32). In this process, when the laundry is positioned near the uppermost point (180 degrees in the rotation direction) of the drum 32, the washing motor may be controlled such that the torque in the direction opposite to the rotation direction of the drum 32 is applied to the washing motor.

Since the laundry rises at the lowermost point of the drum 32 along the rotation direction of the drum 32 and then falls to the lowermost point of the drum 32 while the drum 32 stops, fall head becomes maximized. Therefore, the impact force applied to the laundry is also maximized. The mechanical force (e.g., impact force) generated by such a step motion is larger than the above-described rolling motion or tumbling motion.

Visually, in the step motion, when the drum 32 rotates clockwise, the laundry positioned at the lowermost point of the drum 32 passes through the third quadrant (see Q3 in FIG. 44) and the second quadrant (see Q2 in FIG. 44) to move to the uppermost point (180 degrees) of the drum 32, and is suddenly separated from the inner circumferential surface of the drum 32 to fall toward the lowermost point of the drum 32. Therefore, the step motion has the largest fall head, and provides the mechanical force more effectively as the amount of laundry is smaller.

Meanwhile, as a control method of the washing motor for braking the drum 32, reverse phase braking is preferable. The reverse phase braking is a method in which braking is achieved by generating a rotational force in a direction opposite to the direction in which the washing motor is rotating. The phase of the power supplied to the washing motor can be reversed in order to generate a rotational force in a direction opposite to the direction in which the washing motor is rotating, thereby achieving the rapid braking. Therefore, the reverse phase braking is suitable for step motion.

After the washing motor is braked, the washing motor applies again a torque to the drum 32 to raise the laundry positioned in the lowermost point of the drum 32 to the uppermost point. That is, a step motion is implemented by applying a torque to rotate in the forward direction, then applying a torque to rotate instantaneously in the reverse direction to achieve an abrupt stopping, and then applying torque to rotate in the forward direction again.

The step motion is a motion for performing washing by rubbing the fluid introduced through the through holes 47 formed in the drum 32 and the laundry when the drum 32 rotates and performing washing by falling the laundry by using the impact force when the laundry is positioned at the uppermost point of the drum 32.

(d) in FIG. 46 is a view showing a swing motion. In the swing motion, the washing motor rotates the drum 32 in both directions, and the laundry is controlled to fall from a position of less than about 90 degrees in the rotation direction of the drum 32 (preferably, a position of about 30 to 45 degrees in the rotation direction of the drum 32, but not necessarily limited thereto, and an angular position greater than 45 degrees is also available within a range not exceeding 90 degrees). For example, when the washing motor rotates the drum 32 counterclockwise at about 40 rpm, the laundry positioned at the lowermost point of the drum 32 is raised in a counterclockwise direction by a certain height. At this time, the washing motor stops the rotation of the drum 32 before the laundry reaches the position of about 90 degrees in the counterclockwise direction, and accordingly, the laundry moves toward the lowermost point of the drum 32 from a position of less than about 90 degrees counterclockwise.

After the rotation of the drum 32 is stopped like this, the washing motor rotates the drum 32 clockwise at about 40 RPM to raise the laundry 32 at a certain height along the rotation direction (i.e., clockwise direction) of the drum 32. The washing motor is controlled such that the rotation of the drum 32 is stopped before the laundry reaches the position of about 90 degrees in the clockwise direction, so that the laundry falls toward the lowermost point of the drum 32 at a position of less than about 90 degrees clockwise.

That is, the swing motion is a motion in which the forward rotation/stop of the drum 32 and the reverse rotation/stop are repeated. Visually, the swing motion repeats the process in which the laundry positioned at the lowermost point of the drum 32 passes through the third quadrant (see Q3 in FIG. 44) of the drum 32 and rises to the second quadrant (see Q2 in FIG. 44) and then falls smoothly, and passes through again the fourth quadrant (see Q4 in FIG. 44) of the drum 32 and rises to the first quadrant (see Q1 in FIG. 44) and then falls smoothly. That is, visually, in the swing motion, the laundry flows in a form of letter 8 lying sideways over the third quadrant Q3 and the fourth quadrant Q4 of the drum 32.

At this time, power generation braking is suitable for the braking of the washing motor. The power generation braking minimizes the load occurred in the washing motor, minimizes the mechanical wear of the washing motor, and enables to control the impact applied to the laundry.

The power generation braking is a braking system that uses the fact that the washing motor serves as a generator due to rotational inertia when the current applied to the washing motor is turned off. When the electric current applied to the washing motor is turned off, the direction of the current flowing through the coil of the washing motor is opposite to the direction of the electric current before the power is turned off, so that the force (right hand rule of Fleming) is applied in the direction that hinders the rotation of the washing motor to brake the washing motor. The power generation braking does not brakes the washing motor abruptly, unlike the reverse phase braking, and smoothly changes the rotation direction of the drum 32.

(e) in FIG. 46 is a view showing a scrub motion. The scrub motion is a motion in which the washing motor rotates the drum 32 in the both directions alternately, and the laundry is controlled to fall from a position of about 90 degrees or more in the rotation direction of the drum 32.

For example, when the washing motor rotates the drum 32 in the forward direction at about 60 rpm or more, the laundry positioned at the lowermost point of the drum 32 is raised to a certain height in the forward direction. At this time, when the laundry reaches a position corresponding to the setting angle (preferably, 139 to 150 degrees, but not necessarily limited thereto, and 150 degrees or more is also available) of about 90 degrees or more in the forward direction, the washing motor provides a reverse torque to the drum 32 to temporarily stop the rotation of the drum 32. Then, the laundry on the inner circumferential surface of the drum 32 is dropped abruptly.

Then, the washing motor rotates the drum 32 in the reverse direction at about 60 rpm or more, and the dropped laundry is raised again to a certain height of 90 degrees or more in the reverse direction. When the laundry reaches a position corresponding to the setting angle (e.g., 139 to 150 degrees) of 90 degrees or more in the reverse direction, the washing motor provides again a reverse torque to the drum 32 to stop the rotation of the drum 32. At this time, the laundry on the inner circumferential surface of the drum 32 falls toward the lowermost point of the drum 32 at a position of 90 degrees or more in the reverse direction.

The scrub motion enables the laundry to be washed by allowing the laundry to fall abruptly at a certain height. At this time, it is preferable that the washing motor is reverse-phase braked to brake the drum 32.

Since the rotation direction of the drum 32 is abruptly changed, the laundry does not deviate greatly from the inner circumferential surface of the drum 32, so that the effect of scrubbing very strongly can be obtained.

The scrub motion repeats the process in which the laundry that passed through the third quadrant (see Q3 in FIG. 44) in the forward direction and moved to the second quadrant (see Q2 in FIG. 44) falls abruptly, and passes through again the fourth quadrant (see Q4 in FIG. 44) in the reverse direction and moves to a part of the first quadrant (see Q1 in FIG. 44) and then falls. Therefore, visually, it is repeated that the laundry is raised and then dropped along the inner circumferential surface of the drum 32.

(f) in FIG. 46 is a view showing a filtration motion. The filtration motion is a motion in which the washing motor rotates the drum 32 so that the laundry is not separated from the inner circumferential surface of the drum 32 by the centrifugal force, and in this process, the fluid is sprayed into the drum 32 through the nozzle 610*c*, 610*d*.

Since the fluid is sprayed into the drum 32 while the laundry is closely contacted with the inner circumferential surface of the drum 32 after the laundry is dispersed, such sprayed fluid passes through the laundry by the centrifugal force and then escapes to the tub 31 through the through hole 47 of the drum 32.

The filtration motion broadens the surface area of the laundry, while the laundry is evenly wet as the fluid permeates the laundry.

(g) in FIG. 46 is a view showing a squeeze motion. The squeeze motion is a motion of repeating the process in which the washing motor rotates the drum 32 so that the laundry is not separated from the inner circumferential surface of the drum 32 by the centrifugal force and then the rotation speed of the drum 32 is lowered to separate the laundry from the inner circumferential surface of the drum 32, and of spraying the fluid into the drum 32 through the nozzle 610*c*, 610*d* while the drum 32 is rotating.

The filtration motion is different from the squeeze motion in that the filtration motion continues to rotate at a speed at which the laundry does not fall from the inner circumferential surface of the drum 32, while the squeeze motion changes the rotation speed of the drum 32 so that the laundry is repeatedly adhered to and separated from the inner circumferential surface of the drum 32.

Figure 47:
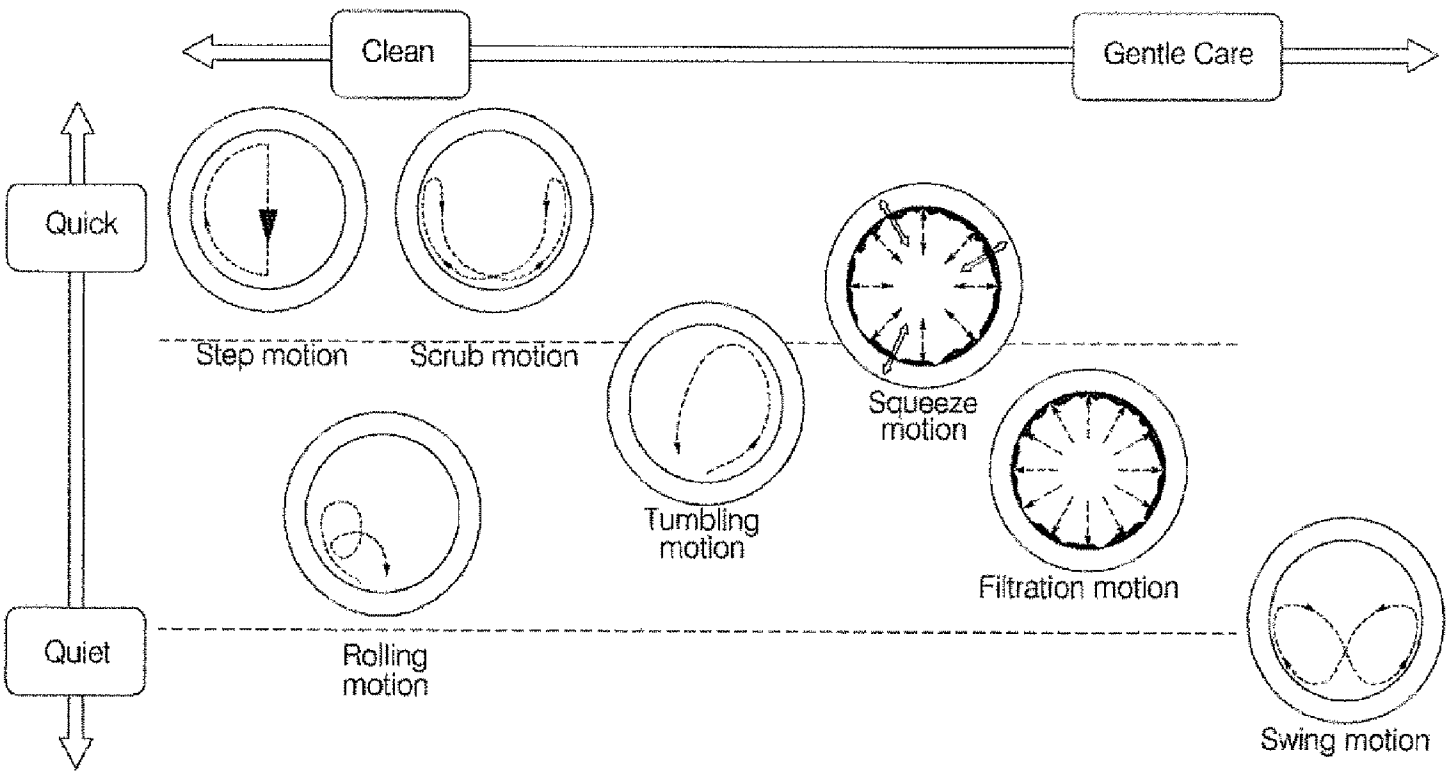
FIG. 47 is a graph comparing washing power and vibration level of drum driving motions.

FIG. 47 is a graph comparing washing power and vibration level of drum driving motions. In FIG. 47, the horizontal axis represents the washing force, and it is easy to separate the dirt contained in the laundry when progressing to the left. The vertical axis represents the vibration or noise level, and the vibration level increases toward the upper side, but the washing time for the same laundry decreases.

The step motion and the scrub motion have an excellent washing power and thus are motions suitable for a case where the contamination of laundry is severe and a washing course for reducing washing time. In addition, the step motion and the scrub motion are motions having high levels of vibration and noise. Therefore, it is an undesirable motion for a washing course for gentle care or when the washing course needs to minimize noise and vibration.

The rolling motion is a motion that has an excellent washing power, a low vibration level, a minimal damage to laundry, and a low motor load. Therefore, it can be applied to all washing courses, but it is particularly suitable for initial detergent dissolving and laundry wetting. However, rolling motion has a disadvantage that washing time is longer in comparison with the tumbling motion, when washing is performed in the same level, instead of low vibration level.

In the tumbling motion, the washing force is lower than the scrub motion, but the vibration level is intermediate between the scrub motion and the rolling motion. The tumbling motion is applicable to all washing courses, but is particularly useful for the step for laundry dispersion.

The squeeze motion is similar to the tumbling motion, and vibration level is higher than the tumbling motion. The squeeze motion is useful for the step of rinsing, since the fluid is discharged to the outside of the drum 32 through the laundry in the process of repeatedly adhering and separating the laundry to/from the inner circumferential surface of the drum 32.

In the filtration motion, the washing force is lower than the squeeze motion, and the degree of noise is motion similar to rolling motion. In the filtration motion, since fluid is discharged to the tub 31 through the laundry in a state in which the laundry is adhered to the inner circumferential surface of the drum 32, the filtration motion is a useful motion for wetting the laundry or applying detergent water to the laundry in the early stage of washing.

The swing motion is a motion having the lowest vibration level and washing power. Thus, the swing motion is a motion that is useful for a low noise or low vibration washing course, and is suitable for gentle care.

Figure 48:
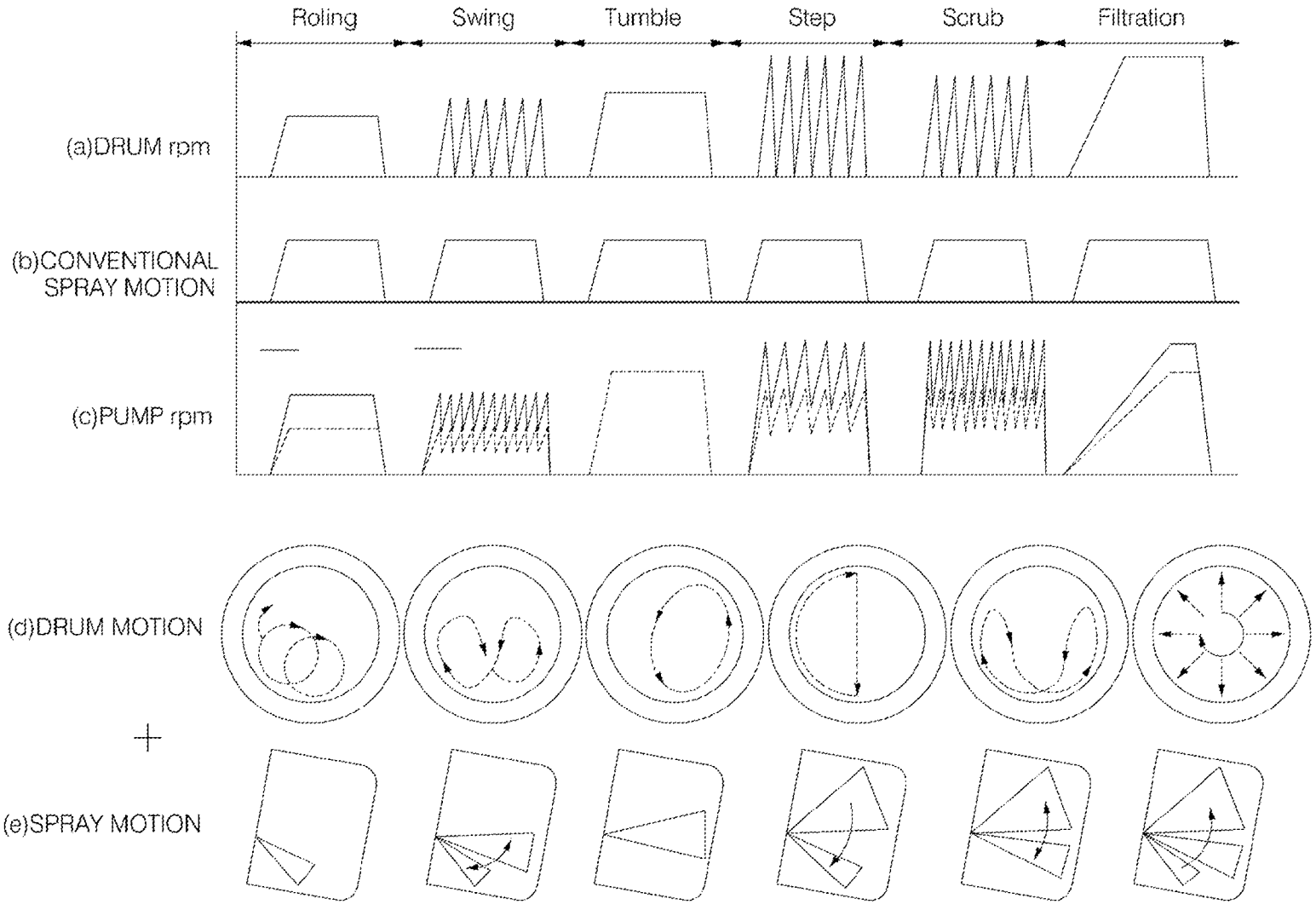
FIG. 48 is a view for explaining a spraying motion in each drum driving motion in comparison with the conventional one.

FIG. 48 is a view for explaining a spraying motion in each drum driving motion in comparison with the conventional one. (a) in FIG. 48 is a graph showing the rotation speed of the drum 32 or the washing motor for each drum driving motion, (b) is a graph showing the rotation speed of the pump motor in each drum driving motion in a conventional washing machine provided with a constant speed pump, (c) is a graph showing the rotation speed of the circulation pump motor 92 in each drum driving motion in the washing machine according to an embodiment of the present invention, (d) shows the movement of laundry in each drum driving motion, and (e) shows a spray pattern (hereinafter, referred to as "spray motion") through the nozzle 610*c*, 610*d* in each drum driving motion in the washing machine according to an embodiment of the present invention.

Referring to FIG. 48, since the conventional washing machine cannot change the speed of the pump motor, even if the drum driving motion is changed, the pump motor should always be rotated at a constant speed. Therefore, in the conventional washing machine, the water current sprayed through the nozzle 610*c*, 610*d* cannot effectively cope with the movement of the laundry caused by the type of the drum driving motion, and there was a difficulty in the control of the power consumption, washing performance, the laundry wetting performance, and the like. The present invention attempts to solve the above problems by suitably controlling the rotation speed of the circulation pump motor 92 according to the drum driving motion, and further, in this process, by considering the amount of the laundry.

Particularly, in the case of drum driving motions (hereinafter, referred to as "drop-inducing motion caused by braking". e.g., swing motion, step motion, or scrub motion) that are separated and fall from the side surface portion 321 by the braking of the drum 32, when the laundry is raised by the rotating drum 32 while adhering to the side surface portion 321 of the drum 32 and reaches a certain height, the rotation speed of the circulation pump motor 92 is controlled to vary within a certain range, and the range is set according to the amount of laundry.

In the case of the rolling motion, the tumbling motion, and the filtration motion, the rotation speed of the circulation pump motor 92 is set according to the amount of laundry, in a section where the rotation speed of the circulation pump motor 92 is maintained uniformly.

Meanwhile, referring to (c) in FIG. 48, in the case of the rolling motion, the swing motion, the step motion, the scrub motion, and the filtration motion, the rpm of the circulation pump motor 92 can be controlled in a different manner. In the drawing, the rpm of the circulation pump motor 92 in the case of a large amount of laundry is indicated by a solid line, and the rpm of the circulation pump motor 92 in the case of the small amount of laundry is indicated by a dotted line. In the case of the tumbling motion, the rpm of the circulation pump motor 92 can be controlled in the same manner regardless of the amount of laundry.

In each of the drum driving motions shown in FIG. 48, the operations of the washing motor and the circulation pump motor 92 are associated with each other.

Hereinafter, the method of controlling the washing motor and the circulation pump motor will be described with reference to FIG. 49.

Figure 49:
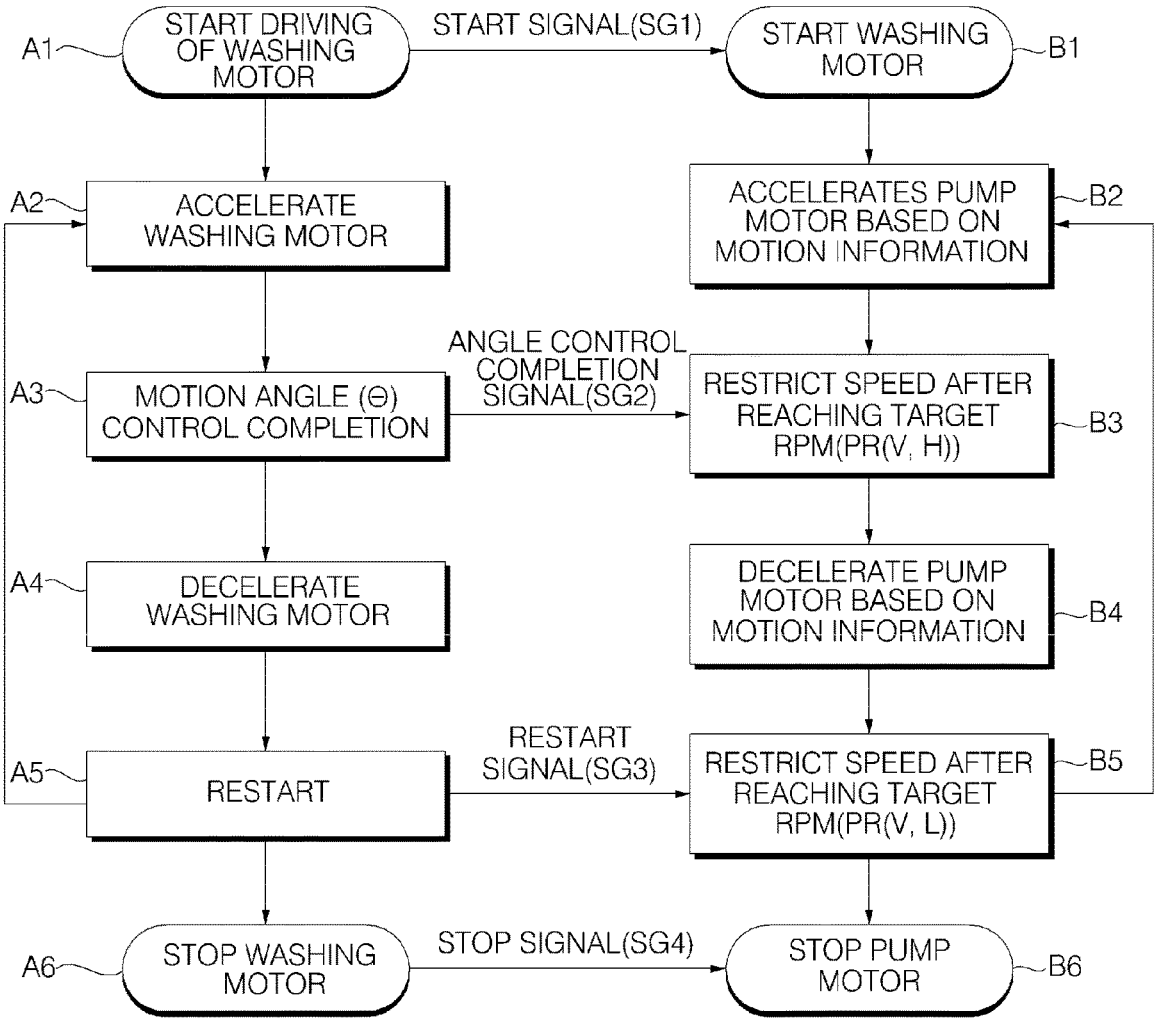
FIG. 49 is a flowchart showing a control method of a washing motor and a pump motor in the drum driving motion.

FIG. 49 is a flowchart showing a control method of a washing motor and a pump motor 92 in the drum driving motion.

In FIG. 49, A1 to A6 indicate control steps of the washing motor, and B1 to B6 indicate control steps of the circulation pump motor 92.

In the process of operation of the washing machine, when a preset drum driving motion is performed, the controller controls the washing motor and the circulation pump motor 92 according to a method determined for each drum driving motion.

Specifically, the controller starts the driving of the washing motor (A1), and accelerates the washing motor (A2). A sensor for sensing the rotational angle of the drum 32 may be provided. When the rotational angle of the drum 32 sensed by the sensor reaches a value θ (hereinafter, referred to as a "motion angle") determined for each drum driving motion (A3), the controller can control the washing motor to decelerate (A4).

In the case of the rolling motion, the tumbling motion, and the filtration motion, since the rotation of the drum 32 is continued for one or more revolutions, the motion angle θ has a value of 360 degrees or more.

On the other hand, in the case of the drop-inducing motion caused by braking such as swing motion, step motion, and scrub motion, in order to induce the drop of the laundry, the motion angle θ is set to a suitable value according to the characteristic of each drum driving motion within 180 degrees. For example, the motion angle θ may be a value ranging from 30 to 45 degrees in the case of swing motion, a value ranging from 146 to 161 degrees in the case of step motion, and a value ranging from 139 to 150 degrees in the case of scrub motion.

As the drum 32 is decelerated and stopped, the drum driving motion is completed once and the drum driving motion is performed again (A5). The controller repeats the steps A2 to A5 until the execution of the drum driving motion reaches a preset number of times, and stops the operation of the washing motor when reaching the preset number of times (A6).

Meanwhile, when the washing motor starts to be driven at step A1, the controller applies a start signal SG1 to the circulation pump motor 92, and the driving of the circulation pump motor 92 is started in response to the start signal SG1 (B1). Then, the controller accelerates the circulation pump motor 92 according to the setting determined for each drum driving motion based on motion information (i.e., information on the drum driving motion currently being performed) (B2).

Meanwhile, at step A3, when the rotational angle of the drum 32 reaches the motion angle θ, the controller applies an angle control completion signal SG2 to the circulation pump motor 92.

In the case of the drop-inducing motion caused by braking, in response to the angle control completion signal SG2, at B2, the circulation pump motor 92 stops (or braking the circulation pump motor 92) the acceleration, after the rotation speed reaches an upper value Pr(V, H) determined for each drum driving motion, and is decelerated (134, 135) according to the setting determined for each drum driving motion.

Thereafter, at step A5, when the drive of the washing motor is started again, the controller applies a restart signal SG3 to the circulation pump motor 92, and the circulation pump motor 92 stops deceleration (135) when the rotation speed reaches a lower limit value Pr(V, L) determined for each drum driving motion, in response to the restart signal SG3 (B2), and the steps B2 to B5 are repeated.

Meanwhile, in the case of swing motion, tumbling motion, or filtration motion, when the angle control completion signal SG2 is applied to the circulation pump motor 92, the circulation pump motor 92 is rotating while maintaining the rotation speed determined for each drum driving motion, Therefore, in the case of these motions, in response to the angle control completion signal SG2, deceleration of the circulation pump motor 92 is performed (B4).

Meanwhile, in the case of any drum driving motion, or when the washing motor is stopped at step A6, the controller applies a stop signal SG4 to the circulation pump motor 92, and the circulation pump motor 92 is stopped in response to the stop signal SG4.

Figure 50:
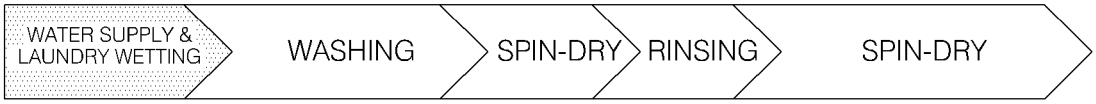
FIG. 50 shows a whole washing sequence applied to the washing machine of the present invention.

As shown in FIG. 50, the washing machine may be configured to sequentially perform a water supply/laundry wetting process, a spin-dry process, a process, and a spin-dry process.

The water supply/laundry wetting process is a process of wetting the laundry by supplying water along with the detergent. The water supply/laundry wetting process may include, more specifically, a detergent dissolving step and a laundry wetting step.

In the detergent dissolving step, the water supply valve 94 can be controlled by the controller so that the detergent-dissolved water is supplied into the tub 31.

In the laundry wetting step, the water supply valve 94 can be controlled by the controller so that water is additionally supplied into the tub 31.

In the water supply/laundry wetting process, step motion and filtration motion can be performed.

The washing process is a process for rotating the drum 32 according to a preset algorithm to remove contamination on the laundry, and the rolling motion and the tumbling motion may be performed.

The spin-dry process is a process of draining water and removing water from the laundry while rotating the drum 32 at a high speed.

The rinsing process is a process of removing the detergent on the laundry, may perform the water supply, and may perform the rolling motion and the tumbling motion, and then the spin-dry process can be performed again.

Hereinafter, a control method for the washing motor and the circulation pump motor 92 for each drum driving motion will be described in more detail.

<Rolling Motion/Tumbling Motion>

Figure 51:
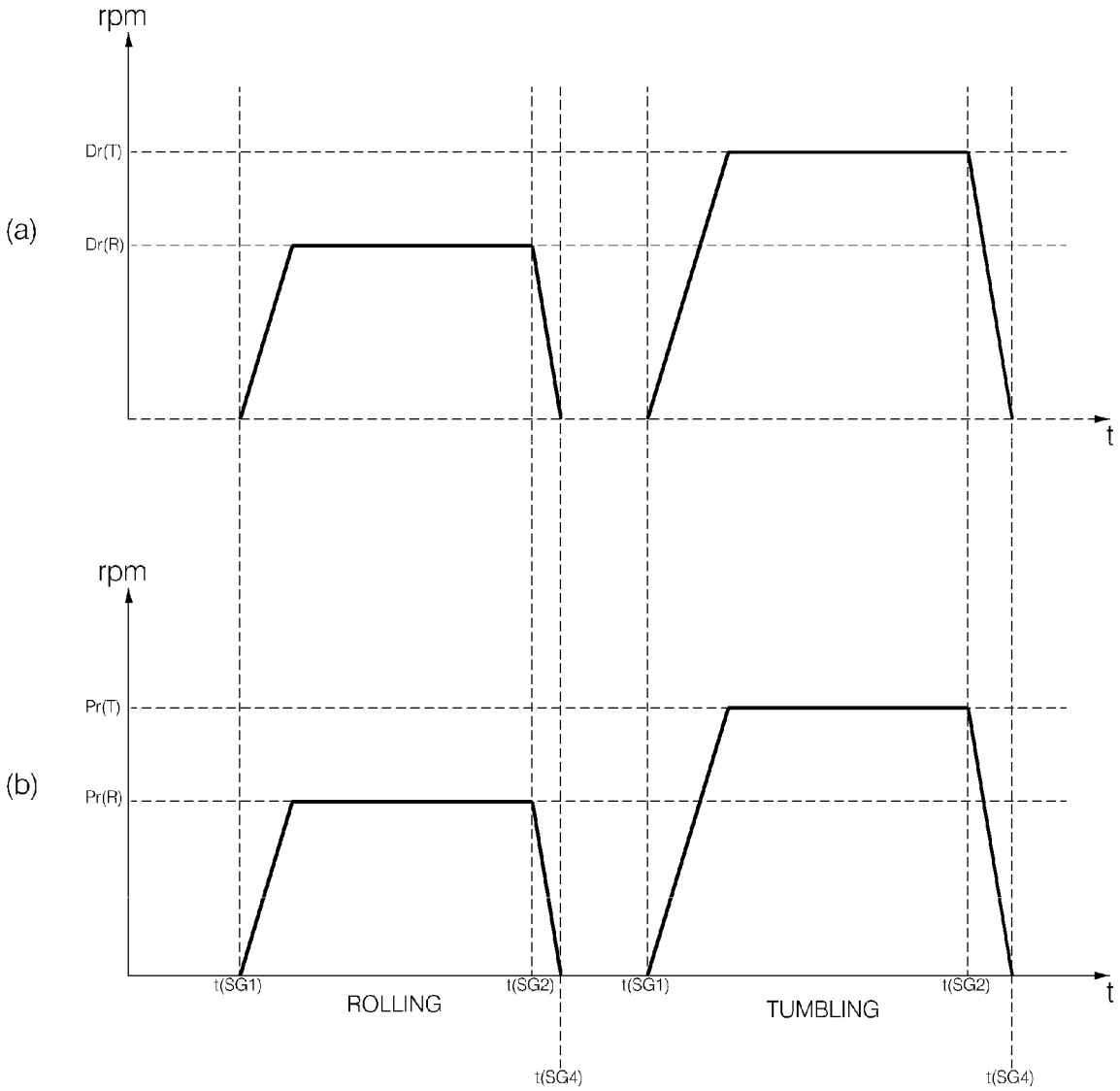
FIG. 51 is graphs showing a speed (a) of a washing motor and a speed (b) of a pump motor in a rolling motion and a tumbling motion.
Figure 58:
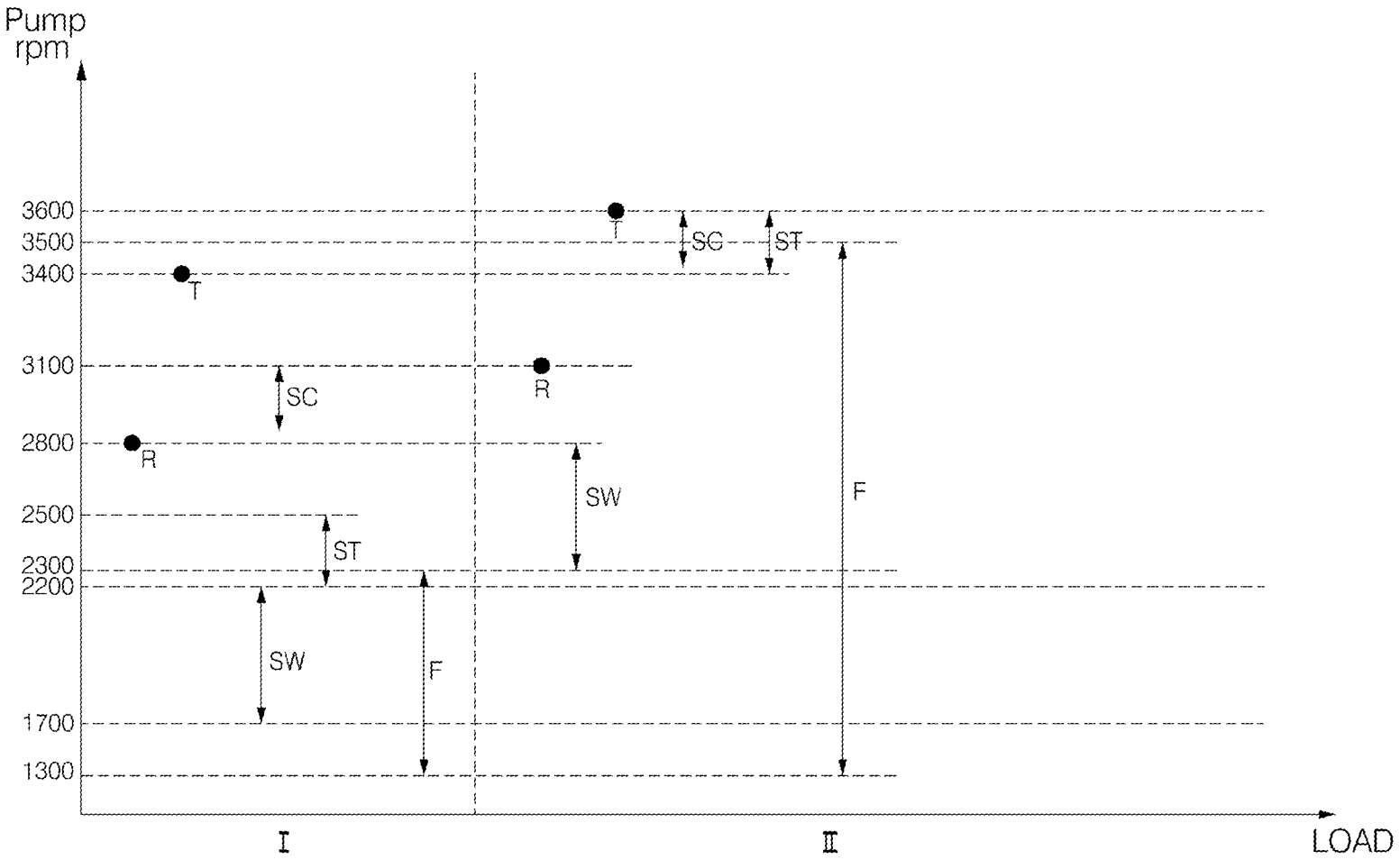
FIG. 58 is a graph which compares the speed of a pump motor in each drum driving motion at a time when the amount of the laundry falls within a first laundry amount range I with the speed of a pump motor at a time when the amount of the laundry falls within a first laundry amount range II.

FIG. 51 is graphs showing a speed (a) of a washing motor and a speed (b) of a pump motor in a rolling motion and a tumbling motion. FIG. 58 is a graph which compares the speed of a pump motor in each drum driving motion at a time when the amount of the laundry falls within a first laundry amount range I with the speed of a pump motor at a time when the amount of the laundry falls within a first laundry amount range 1I.

The control method of the washing machine according to an embodiment of the present invention includes a first step of rotating the drum 32 in one direction so that the laundry on the side surface portion 321 of the drum 32 falls from a position raised to a position corresponding to less than about 90 degrees of rotation angle of the drum 32, and a second step of rotating the drum 32 in one direction so that the laundry on the side surface portion 321 of the drum 32 falls from a position raised to a height higher than a position corresponding to less than 520 degrees of rotation angle of the drum 32. The second step may be performed after the first step, but the present invention is not limited thereto, and the second step may be performed before the first step.

During the first step, the number of rotations of the pump 901 is controlled as a preset first number of rotations, During the second step, the number of rotations of the pump 901 is controlled as a second number of rotations higher than the first number of rotations.

The driving motion of the drum 32 at the first step may correspond to the rolling motion. The driving motion of the drum 32 at the second step may be the rolling motion or the tumbling motion, but is preferably the tumbling motion. That is, the second step may be a step of performing the tumbling motion in which the drum is rotated in one direction so that the laundry on the side surface portion 321 of the drum 32 falls from a position corresponding to about 90 to 110 degrees of the rotation angle of the drum 32.

Hereinafter, it is illustrated that the first step performs rolling motion and the second step performs tumbling motion.

Referring to FIG. 51 and FIG. 58, the rolling motion and the tumbling motion are performed in a state in which water is contained in the tub 31 so that the water current can be sprayed through the nozzle 610*c*, 610*d*. Referring to FIG. 51, in the rolling motion, the controller controls the washing motor to rotate the drum 32 in one direction so that the laundry on the side surface portion 321 of the drum 32 is raised to a position corresponding to less than about 90 degrees of rotation angle of the drum 32. During the rolling motion, the washing motor or drum 32 is accelerated to the rotation speed Dr(R), and then can be rotated while maintaining the Dr(R) for a certain period of time. The rotation speed Dr(R) is preferably 37 to 40 rpm, but is not necessarily limited thereto.

During the rolling motion, the rotation speed of the circulation pump motor 92 is controlled as a preset rotation speed Pr(R). In FIG. 51, t(SG1) is the generation timing of the start signal SG1 (see FIG. 49), t(SG2) is the generation timing of the angle control completion signal SG2 (see FIG. 49), and t(SG4) is the generation timing of the stop signal (SG4, see FIG. 49). Hereinafter, the same is also displayed in the other embodiment.

The rotation speed Pr(R) can be set according to the amount of laundry. Prior to the execution of the drum driving motion, the controller rotates the washing motor, and in this process, the amount of laundry can be sensed. The amount of laundry may be determined based on the principle that the rotational inertia of the drum 32 varies according to the amount of the laundry put into the drum 32. For example, in the process of accelerating the washing motor, the amount of laundry may be obtained based on the time taken to reach a preset target speed, or based on the acceleration slope of the washing motor, or in the process of braking the washing motor, may be obtained based on the time taken to stop the washing motor, based on the deceleration slope, or based on the back electromotive force in the power generation braking. However, the present invention is not limited thereto, and since various known methods for obtaining the amount of laundry in the washing machine technology are well known, it is obvious that these known technologies can be applied. Hereinafter, even when not described, it is assumed that a step of sensing the amount of laundry is performed before the execution of each drum driving motion.

The controller may set the rotation speed (Pr(R)) according to the laundry amount range to which the sensed laundry amount belongs. For example, the laundry amount can be subdivided from a first level to a ninth level. When the laundry amount range is divided into a small amount (or a first laundry amount range (I), see FIG. 58) and a large amount (or a second laundry amount range (II), see FIG. 58), the case where the sensed laundry amount ranges from a first level to a fourth level may be classified as a small amount, and the case where the sensed laundry amount ranges from a fifth level to a ninth level may be classified as a large amount. However, the present invention is not limited thereto, and the laundry amount range can be divided for each level.

In the embodiment, in the case of the large amount of laundry, the rotation speed Pr(R) is set to be higher than the case of the small amount of laundry. For example, in the case of the small amount, the rotation speed Pr(R) may be set to 2800 rpm, and in the case of the large amount, the rotation speed Pr(R) may be set to 3100 rpm. Particularly in the case of the small amount of laundry, the water current from the nozzle 610*c*, 610*d* does not need to reach the rear surface portion 322 of the drum 32 (2800 rpm or less, see FIG. 45), because most of the laundry moves in the front portion of the drum 32.

On the other hand, when the amount of the laundry is large, the laundry reaches the center of the drum 32, so that the water current sprayed from the nozzle 610*c*, 610*d* should reach the height of the center of the drum 32. Therefore, it is preferable that the water is made to reach the first quadrant (Q1, see FIG. 44) and the second quadrant (Q2, see FIG. 44). To this end, the rotation speed of the circulation pump motor 92 is set to approximately 3000 rpm or more, preferably 3100 rpm.

In the case of tumbling motion, the control of the washing motor and the circulation pump motor 92 is achieved in a manner similar to the rolling motion. However, the rotation speed Dr(R) of the washing motor is higher than that of the rolling motion, and the rotation speed Pr(T) of the circulation pump motor 92 is also set higher than that of the rolling motion, for the same amount of laundry. Meanwhile, the rotation speed Dr(T) of the washing motor is preferably 46 rpm, but it is not necessarily limited thereto.

Meanwhile, in the case of tumbling motion, it is important to apply a stronger mechanical force to the laundry than in the case of rolling motion, so that the water pressure sprayed through the nozzle 610*c*, 610*d* needs to be sufficient irrespective of the amount of laundry. Therefore, in the case of the tumbling motion, the circulation pump motor 92 can be rotated at a constant speed having a value between 3400 and 3600 rpm irrespective of the amount of laundry. However, it is obvious that the rotation speed Pr(T) may be set to be higher than that in the case of a small amount, when the amount of laundry is large. For example, in the case of a small amount of laundry, the rotation speed Pr(T) may be set to 3400 rpm, and in the case of a large amount, the rotation speed Pr (T) may be set to 3600 rpm.

The steps of controlling the pump 901 while performing the above-described rolling motion and tumbling motion are suitable for the washing and/or rinsing processes, among the series of washing processes shown in FIG. 50.

Figure 52A:
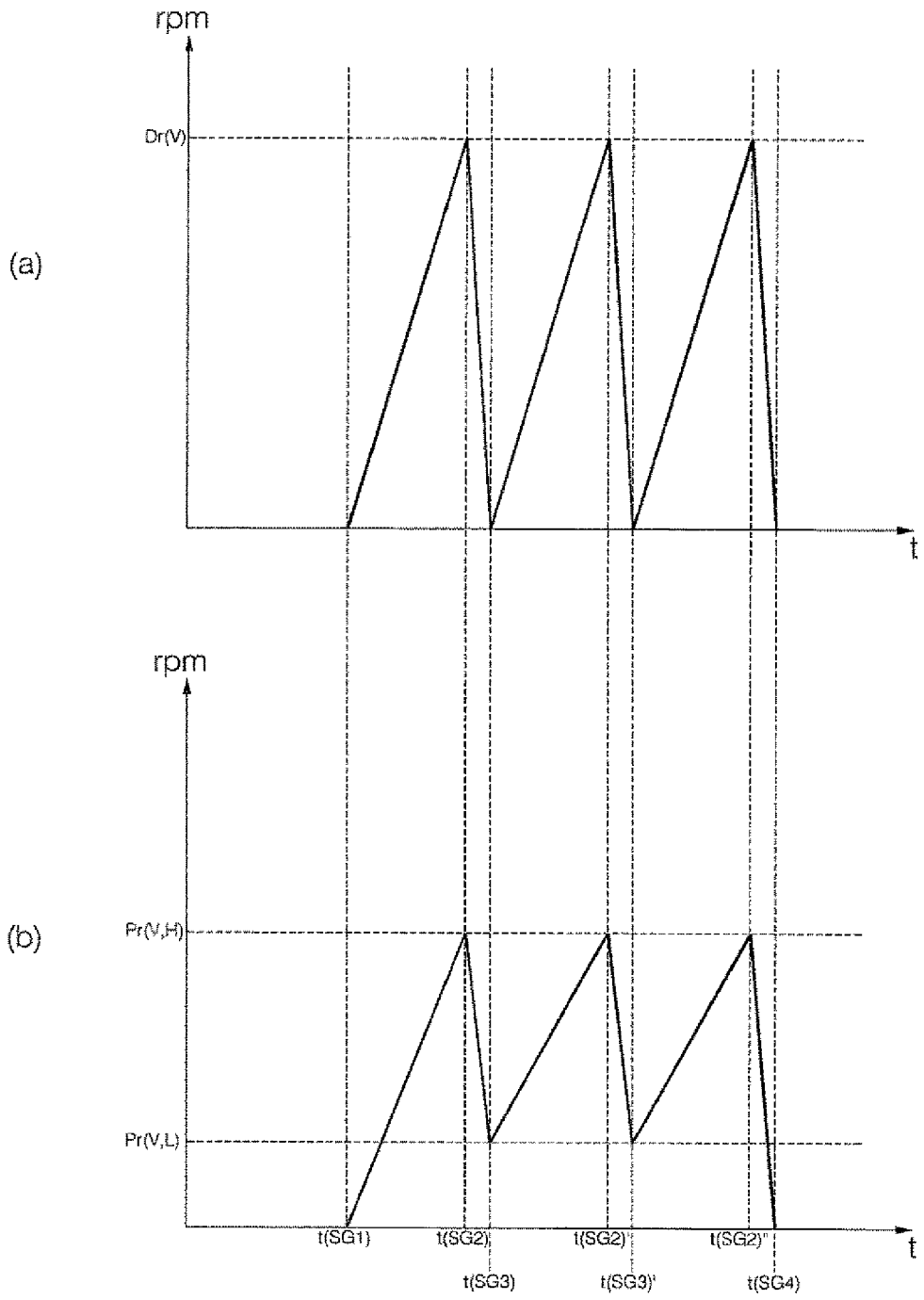
FIG. 52A is graphs showing a speed (a) of a washing motor and a speed (b) of a pump motor in a swing motion, a scrub motion, and a step motion according to an embodiment of the present invention.

FIG. 52A is a graph showing the speed (a) of the washing motor and the speed (b) of the pump motor in the swing motion, the scrub motion, and the step motion according to an embodiment of the present invention.

Referring to FIGS. 52A and 58, in the case of the drop-inducing motion by braking, the controller controls the rotation speed of the circulation pump motor 92 to be variable while the drum 32 is rotated.

The drop-inducing motion by braking is performed in a state in which water is contained in the tub 31 so that the water can be sprayed through the nozzle 610*c*, 610*d*. During the drop-inducing motion by braking, the controller controls the washing motor to brake the drum 32 so that the laundry on the side surface portion 321 of the drum 32 falls from the side surface portion 321, after the drum is rotated at a speed at which the laundry on the side surface portion 321 of the drum 32 is raised without falling from the side portion 321 by the centrifugal force. That is, during the drop-inducing motion by braking, the washing motor increases to a preset rotation speed Dr(V), and is decelerated until it stops.

The rotation speed Dr(V) may be set differently for each drum driving motion. Since the rotation speed Dr(V), i.e., the maximum rising height of the laundry increases in the order of the swing motion, the scrub motion, and the step motion, much larger centrifugal force should be applied in the order of the above motions. Therefore, the rotation speed Dr(V) may also be set to a larger value in the order of the above motions.

However, the maximum rising height of the laundry in the drop-inducing motion by braking may be determined by the rotation angle (or the motion angle θ) at which the drum 32 is braked. Thus, even when the rotation angle Dr(V) is set to be the same in all of the swing motion, the scrub motion, and the step motion, if the motion angle θ in each motion is set differently, the maximum rising height of the laundry (or the height at which the laundry begins to fall) may also vary. In either case, it is preferable that the motion angle θ is set to be higher in the order of the swing motion, the scrub motion, and the step motion. Within the range satisfying these premises, for example, the motion angle θ may be set in the range of 30 to 45 degrees in the case of the swing motion, in the range of 139 to 150 degrees in the case of the scrub motion, and in the range of 146 to 161 degrees in the case of the step motion.

Meanwhile, during operation of the drop-inducing motion by braking, the controller increases the rotation speed of the circulation pump motor 92 while the laundry is rising (or while the washing motor is accelerated), and decreases the rotation speed of the circulation pump motor 92 while the laundry is failing (or when the washing motor is decelerated by braking). At this time, the circulation pump motor 92 can be varied within the range of the rotation speed set for each drum driving motion.

FIG. 52A shows the upper value of the rotation speed range as the maximum rotation speed Pr(V, H) and the lower limit value as the minimum rotation speed Pr(V, L).

The maximum rotation speed of the circulation pump motor 92 described below is not a speed at which the circulation pump motor 92 can rotate maximally, but an upper limit of the rotation speed of the circulation pump motor 92, and can be defined as a preset value.

The minimum rotation speed of the circulation pump motor 92 described below is a lower limit of the rotation speed of the circulation pump motor 92, and can be defined as a preset value.

Prior to the execution of the drum driving motion, the controller rotates the washing motor, and in this process, the laundry amount can be sensed. The method of sensing the laundry amount may be configured as described above in the description of the rolling/tumbling motion, or may employ other methods.

The rotation speed range is set according to the laundry amount. That is, the controller sets the maximum rotation speed Pr(V, H) and the minimum rotation speed Pr(V, L) according to the laundry amount. In each drum drive motion, the rotation speed range can be set to a higher band as the laundry amount increases.

For example, in the case of the scrub motion, when the sensed laundry amount falls within a small amount (or the first laundry amount range I, see FIG. 58), the rotation speed of the circulation pump motor 92 can be varied between the minimum rotation speed Pr(V, L) 2800 rpm and the maximum rotation speed Pr(V, H) 3100 rpm. In addition, when the sensed laundry amount is a large amount (or the second laundry amount range II, see FIG. 58), the rotation speed of the circulation pump motor 92 can be varied between the minimum rotation speed Pr(V, L) rpm and the maximum rotation speed Pr(V, H) 3600 rpm.

In the case of the step motion, when the sensed laundry amount falls within a small amount (or the first laundry amount range I, see FIG. 58), the rotation speed of the circulation pump motor 92 can be varied between the minimum rotation speed Pr(V, L) 2200 rpm and the maximum rotation speed Pr(V, H) 2500 rpm. In addition, when the sensed laundry amount is a large amount (or the second laundry amount range II, see FIG. 58), the rotation speed of the circulation pump motor 92 can be varied between the minimum rotation speed Pr(V, L) 3400 rpm and the maximum rotation speed Pr(V, H) 3600 rpm.

Meanwhile, in the case of the swing motion, a range in which the rotation speed of the circulation pump motor 92 can be varied according to the laundry amount can be set in the same manner as the scrub motion or the step motion.

In the case of the swing motion, when the sensed laundry amount falls within a small amount (or the first laundry amount range I, see FIG. 58), the rotation speed of the circulation pump motor 92 can be varied between the minimum rotation speed Pr(V, L) 1700 rpm and the maximum rotation speed Pr(V, H) 2200 rpm. In addition, when the sensed laundry amount is a large amount (or the second laundry amount range II, see FIG. 58), the rotation speed of the circulation pump motor 92 can be varied between the minimum rotation speed Pr(V, L) 2300 rpm and the maximum rotation speed Pr(V, H) 2800 rpm.

At this time, preferably, the circulation pump motor 92 is set within a range (e.g., 1700 to 2800 rpm, see FIG. 45) in which the water current sprayed from the nozzles 610*c* and 610*d* does not reach the rear surface portion 322 of the drum 32.

However, in the case of the swing motion, since the fall head of the laundry is not large in comparison with the scrub motion or the step motion, the rotation speed range of the circulation pump motor 92 can be set to be constant regardless of the laundry amount. For example, for both small or large amount of laundry, the circulation pump motor 92 can be varied between 2200 rpm which is the minimum rotation speed Pr(V, L) and 2800 rpm which is the maximum rotation speed Pr(V, H).

Hereinafter, the operation of the washing motor and the pump motor in the swing motion, the scrub motion, and the step motion according to an embodiment of the present invention will be described in detail with reference to FIGS. 49, 52A, and 55.

Referring to FIGS. 49 and 52A, when the washing motor is driven (A1) and the start signal SG1 is generated (t=(t (SG1)), the controller starts driving the circulation pump motor 92 (B1).

The controller can accelerate the washing motor to a preset maximum rotation speed Dr(V) (A2). The maximum rotation speed Dr(V) is not a speed at which the washing motor can rotate maximally, but the upper limit of the rotation speed of the washing motor, and can be defined as a preset value.

When the circulation pump motor 92 starts driving, the controller can control the circulation pump motor 92 to be accelerated, based on motion information (132).

The controller can accelerate the circulation pump motor 92 to the maximum rotation speed Pr(V, H). When the circulation pump motor 92 reaches the target RPM (Pr(V, H)), the controller can stop the acceleration and restrict the speed (B3).

The controller can rotate the washing motor up to a set motion angle θ. The controller can control the washing motor so that the time at which the washing motor reaches the maximum rotation speed Dr(V) and the time at which the washing motor rotates to the motion angle θ correspond to each other.

The controller completes the control of the washing motor up to the motion angle θ (A3), and the controller can decelerate the circulation pump motor 92 based on the motion information when the angle control completion signal SG2 is generated (t=t(SG2))(B4).

That is, when the angle control completion signal SG2 is generated (A3) in the state (B3) in which the speed is restricted as the circulation pump motor 92 reaches the target RPM(Pr(V, H)), the controller can decelerate the circulation pump motor 92 (B4).

Meanwhile, referring to FIG. 52A, the controller can control the washing motor and the circulation pump motor 92 so that the time at which the washing motor reaches the maximum rotation speed Dr(V) and the time at which the circulation pump motor 92 reaches the maximum rotation speed Pr(V, H) correspond to each other.

However, actually, a delay such as the time required for the controller to process or the time when the signal is transmitted may occur between the time point (T(SG2)) at which the angle control completion signal SG2 is generated as the washing motor completes the control up to the motion angle θ (or reaches the maximum rotation speed Dr (V))(A3) and the time point at which the deceleration of the circulation pump motor 92 is started based on the generated angle control completion signal SG2.

Therefore, the graph of FIG. 52A does not mean that the time point t(SG1) at which the washing motor reaches the maximum rotation speed Dr(V) and the time point at which the circulation pump motor 92 reaches the maximum rotation speed Pr(V, H) are absolutely coincident, but can be interpreted to mean that the time point t(SG1) at which the washing motor reaches the maximum rotation speed Dr(V) and the time point at which the circulation pump motor 92 reaches the maximum rotation speed Pr(V, H) are controlled to be coincident, without intention to make artificial time difference. This is, particularly, a portion of FIG. 52A different from FIG. 52B which will be described later.

When the controller completes (or reaches the maximum rotation speed Dr(V)) the control of the washing motor up to the motion angle θ (A3), the controller can decelerate the washing motor (A4).

Alternatively, when the controller completes (or reaches the maximum rotation speed Dr(V)) the control of the washing motor tip to the motion angle θ (A3), the controller may brake the washing motor.

In the case of a motion in which the acceleration and deceleration of the washing motor is repeated plural times (e.g., step motion, scrub motion, swing motion) based on the motion information, the controller may return to the step A2 of accelerating the washing motor to restart the steps of A2 to A4 (A5).

The controller can decelerate the circulation pump motor 92 up to the minimum rotation speed Pr(V, L). When the circulation pump motor 92 reaches the target RPM (Pr(V, L)), the controller can stop the deceleration to restrict the speed (B5).

When the restart signal SG3 is generated, the controller returns to the step B2 for accelerating the circulation pump motor 92 and can restart the steps 133 to 134 (135).

Referring to FIG. 52A, when the circulation pump motor 92 is completely braked (rpm=0) and the restart signal SG3 is generated (t=t(SG3)), the circulation pump motor 92 can be restarted.

That is, when the restart signal SG3 is generated (t=t (SG3)) in the state (B5) in which the speed is restricted as the circulation pump motor 92 reaches the target RPM (Pr(V, L)), the controller can accelerate the circulation pump motor 92 again (B2).

Meanwhile, referring to FIG. 52A, the controller can control the washing motor and the circulation pump motor 92 so that the time point t(SG3) at which the washing motor is completely braked and the time point t(SG3) at which the circulation pump motor 92 reaches the minimum rotation speed Pr(V, L) correspond to each other.

However, actually, a delay such as the time required for the controller to process or the time when the signal is transmitted may occur between the time point (T(SG3)) at which the restart signal SG3 is generated, and the time point at which the acceleration of the circulation pump motor 92 is started based on the generated restart signal SG3. This can be understood to be the same reason as the delay occurring between the time point at which the angle control completion signal SG2 is generated and the time point at which the deceleration of the circulation pump motor 92 is started, as described above.

When it is determined that the set operation is completed based on the motion information, the controller can control the washing motor to stop (A6).

The controller can control the circulation pump motor 92 to stop when the washing motor is stopped and the stop signal SG4 is generated (t:=t(SG34)) (A6).

That is, when the stop signal SG4 is generated (t=t (SG4)) in the state (B5) in which the speed is restricted as the circulation pump motor 92 reaches the target RPM (Pr(V, L)), the controller can stop the circulation pump motor 92 (B6). Here, to stop the circulation pump motor 92 means to start the control so that the circulation pump motor 92 stops, or to control the circulation pump motor 92 to stop to correspond to the stopping point of the washing motor.

Referring to FIG. 52A, the controller can control the washing motor and the circulation pump motor 92 so that the time point when the washing motor stops and the time point when the circulation pump motor 92 stops correspond to each other.

However, actually, a delay such as the time required for the controller to process or the time when the signal is transmitted may occur between the time point (T(SG4)) at which the stop signal SG4 is generated, and the time point at which the circulation pump motor 92 is stopped based on the generated stop signal SG4. This can be understood to be the same reason as the delay occurring between the time point at which the angle control completion signal SG2 is generated and the time point at which the deceleration of the circulation pump motor 92 is started, as described above.

Figure 52B:
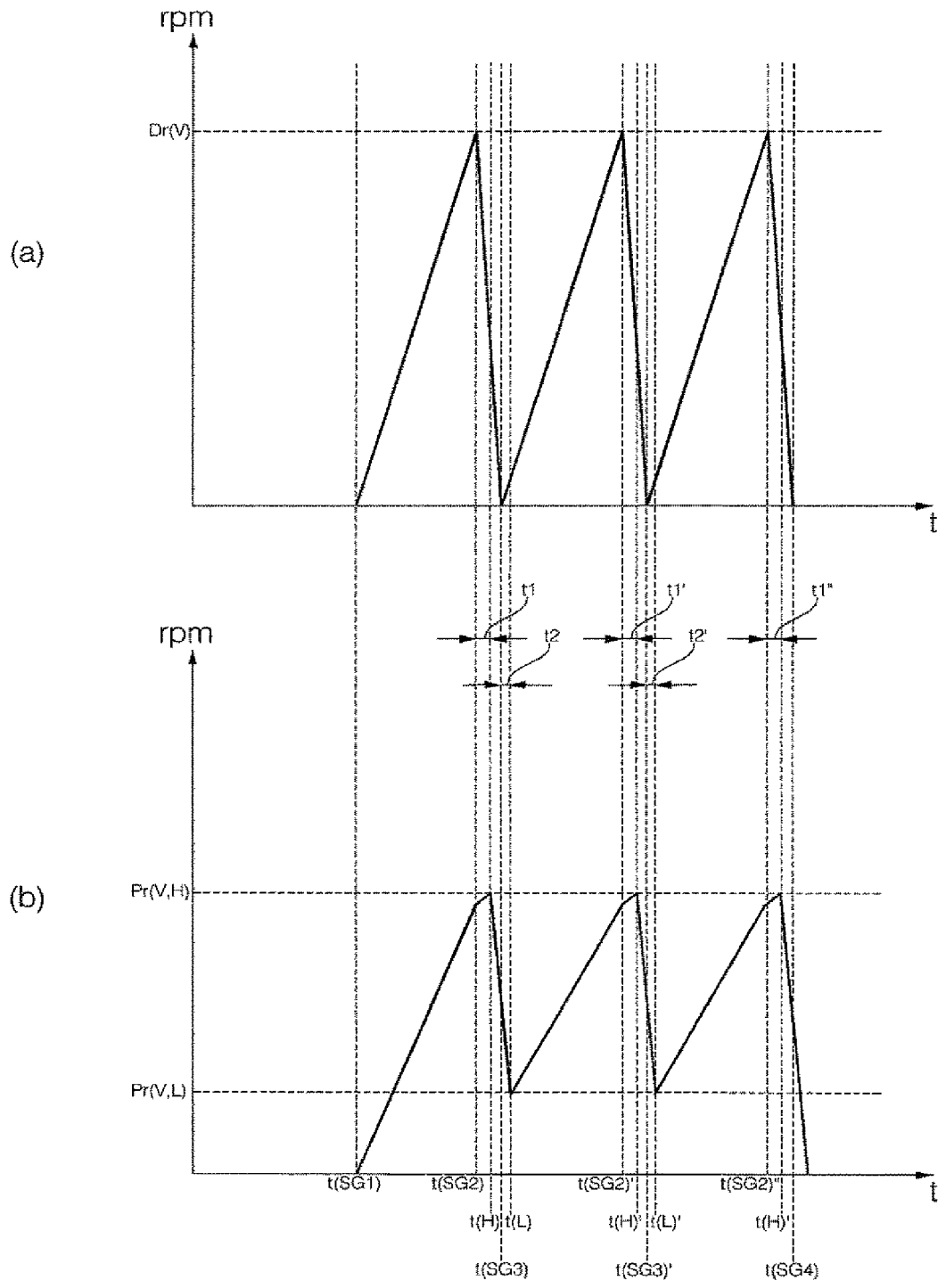
FIGS. 52B and 52C are graphs showing a speed (a) of a washing motor and a speed (b) of a pump motor in a swing motion, a scrub motion, and a step motion according to another embodiment of the present invention.
Figure 52C:
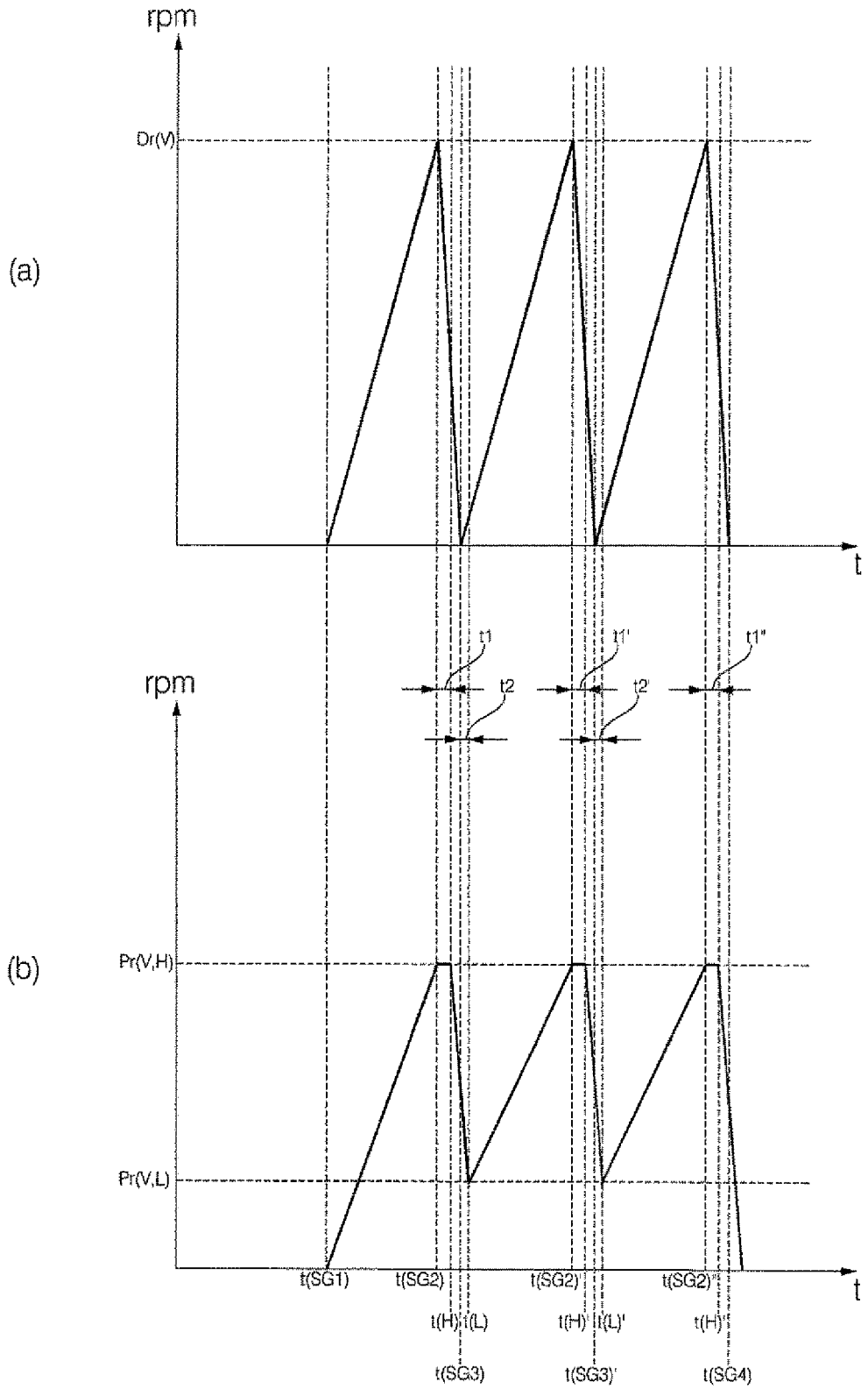

FIGS. 52B and 52C are graphs showing the speed (a) of the washing motor and the speed (b) of the pump motor in the swing motion, the scrub motion, and the step motion according to another embodiment of the present invention.

Hereinafter, a control method according to another embodiment of the present invention will be described with reference to FIGS. 52B and 52C, focusing on a portion different from FIG. 52A.

A description with reference to FIG. 52A of the steps (A1 to A2 and B1 to B2) in which the controller accelerates the circulation pump motor 92 in correspondence with the acceleration of the washing motor can also be applied to FIG. 52B.

The controller can control the deceleration of the circulation pump motor 92 to be started, after a first time t1 from the braking time point t=t(SG2) of the washing motor.

The controller can provide a control signal to the circulation pump motor 92 so that the circulation pump motor 92 decelerates after the lapse of the first time t1 after the braking of the washing motor.

The first time t1 is a time difference between the braking time point t=t(SG2) of the washing motor and the decelerating time point t=t(H) of the circulation pump motor 92, and may be a preset value.

Alternatively, the controller may control the circulation pump motor 92 to reach a preset maximum rotation speed Pr(V, H) after a second time from the time point when the washing motor reaches a preset maximum rotation speed Dr(V).

The second time may be a time difference between the time point (t(SG3)) when the washing motor reaches the maximum rotation speed Dr(V) and the time point t(H) when the circulation pump motor 92 reaches the maximum rotation speed Pr(V, H).

The first time t1 and the second time may be the same value. That is, the controller can brake the washing motor when the washing motor reaches the maximum rotation speed Dr(V), and can decelerate the circulation pump motor 92 when the circulation pump motor 92 reaches the maximum rotation speed Pr(V, H).

The controller completes the control of the washing motor up to the motion angle (A3), and when the angle control completion signal SG2 is generated (t=t(SG2)), controls the circulation pump motor 92 based on whether the circulation pump motor 92 reaches the target RPM Pr(V, 1H)).

Referring to FIG. 52B, when the angle control completion signal SG2 is generated (t(SG2)), before the circulation pump motor 92 reaches the maximum rotation speed Pr(V, H), the controller can accelerate the circulation pump motor 92 until reaching the maximum rotation speed Pr(V, H).

That is, the controller can accelerate the circulation pump motor 92 to the upper limit of the set rotation speed range, before the first time t1 elapses from the braking time point t (SG2) of the washing motor.

The controller can control the circulation pump motor 92 at a constant acceleration until the circulation pump motor 92 is decelerated from when the circulation pump motor 92 starts to accelerate.

Meanwhile, from the acceleration time point (or the acceleration time point t=t(SG1) of the washing motor) of the circulation pump motor 92 to the braking time point (t=t(SG2)), the controller can accelerate the pump motor 92 at a first acceleration slope, and can accelerate the circulation pump motor 92 at a second acceleration slope until the pump motor reaches the maximum rotation speed Pr(V, H) from the braking time point t(SG2) of the washing motor. The first acceleration slope and the second acceleration slope may have a preset value, and the second acceleration slope may be a value smaller than the first acceleration slope.

Referring to FIG. 52C, when it is determined that the circulation pump motor 92 has reached the maximum rotation speed Pr(V, H) before the first time (t1) elapses from the braking time point (t=t(SG2)) of the washing motor, the controller can control the circulation pump motor 92 to maintain the maximum rotation speed Pr(V, H).

The controller can decelerate the circulation pump motor 92 after the first time t1, when it is determined that the circulation pump motor 92 has reached the maximum rotation speed Pr(V, H) before the first time (t1) elapses from the braking time point (t=t(SG2)) of the washing motor.

Referring to FIG. 52B and FIG. 52C, the controller can control the washing motor and the circulation pump motor 92 so that the circulation pump motor 92 reaches the maximum rotation speed Pr(V, H), in a section between the time point t=t(SG2)) at which the washing motor reaches the maximum rotation speed Dr(V) and the time point (or the time point of stopping, t=t(SG3)) at which the washing motor reaches the minimum rotation speed.

Referring to FIG. 52B and FIG. 52C, the controller can control the circulation pump motor 92 to reach the minimum rotation speed t(L) after a third time t2 from the time point t=t(SG3) at which the washing motor is stopped and the restarting signal is generated. The third time t2 may be equal to or shorter than the second time t1.

Although not shown, the controller may control the washing motor and the circulation pump motor 92 so that the circulation pump motor 92 reaches the minimum rotation speed Pr(V, L) at the time point when the washing motor stops. That is, the third time t2 may be zero. Thus, the controller may control the circulation pump motor 92 to spray water toward the laundry which is rising in contact with the drum 32.

Referring to FIG. 52B and FIG. 52C, the controller may repeatedly perform the control of the washing motor and the circulation pump motor 92 as described above. The controller can repeatedly perform the control for accelerating and decelerating the washing motor while switching the rotation direction of the drum 32. In response to the repetition of the control for accelerating and decelerating the washing motor, the control for accelerating and decelerating the circulation pump motor 92 can be repeatedly perform ed. This enables to implement various drum driving motions.

Meanwhile, the controller may perform the control operation of the circulation pump motor 92 while delaying a preset time with respect to the control operation of the washing motor. That is, the waveform of the time-rotation speed graph of the washing motor and the waveform of the time-rotation speed graph of the circulation pump motor 92 differ only in the rotation speed range, and the graph of the circulation pump motor 92 can be controlled to be delayed by a preset time and follow the graph of the washing motor. In this case, t1 and t2 indicated in FIG. 52B and FIG. 52C can be set to the same value.

According to the control method of the washing machine configured as described above, during operation of the drop-inducing motion by braking, it is possible to increase the water pressure applied to the laundry falling in the drum 32, thereby increasing the washing effect by applying a physical impact.

For example, referring to FIG. 52B, during the acceleration of the washing motor, the laundry (cloth) rises while being in contact with the drum 32, the laundry falls from the side surface portion 321 of the drum 32 when the washing motor is braked (t(SG2)). At this time, the circulation pump motor 92 rotates at the maximum rotation speed Pr(V, H), and sprays the water at the maximum intensity through the nozzle 610*c*, 610*d*, so that it is possible to physically strike the failing laundry.

Although not shown, the controller can control the circulation pump motor 92 to decelerate at the third acceleration slope until the first time t1 elapses from the braking time t(SG2) of the washing motor. When the first time t1 is elapsed, the controller can control the circulation pump motor 92 to be decelerated at the fourth acceleration slope more sharply than the third acceleration slope. That is, the controller starts to slowly decelerate the circulation pump motor 92 when the washing motor is braked, and can decelerate the circulation pump motor 92 more abruptly when the first time t1 elapses from the time of braking the washing motor.

In this case, similarly, when the washing motor is braked (t(SG2)), the washing effect can be enhanced by using the water pressure of the water current sprayed from the nozzle, with respect to the dropping laundry.

<Filtration Motion>

Figure 53:
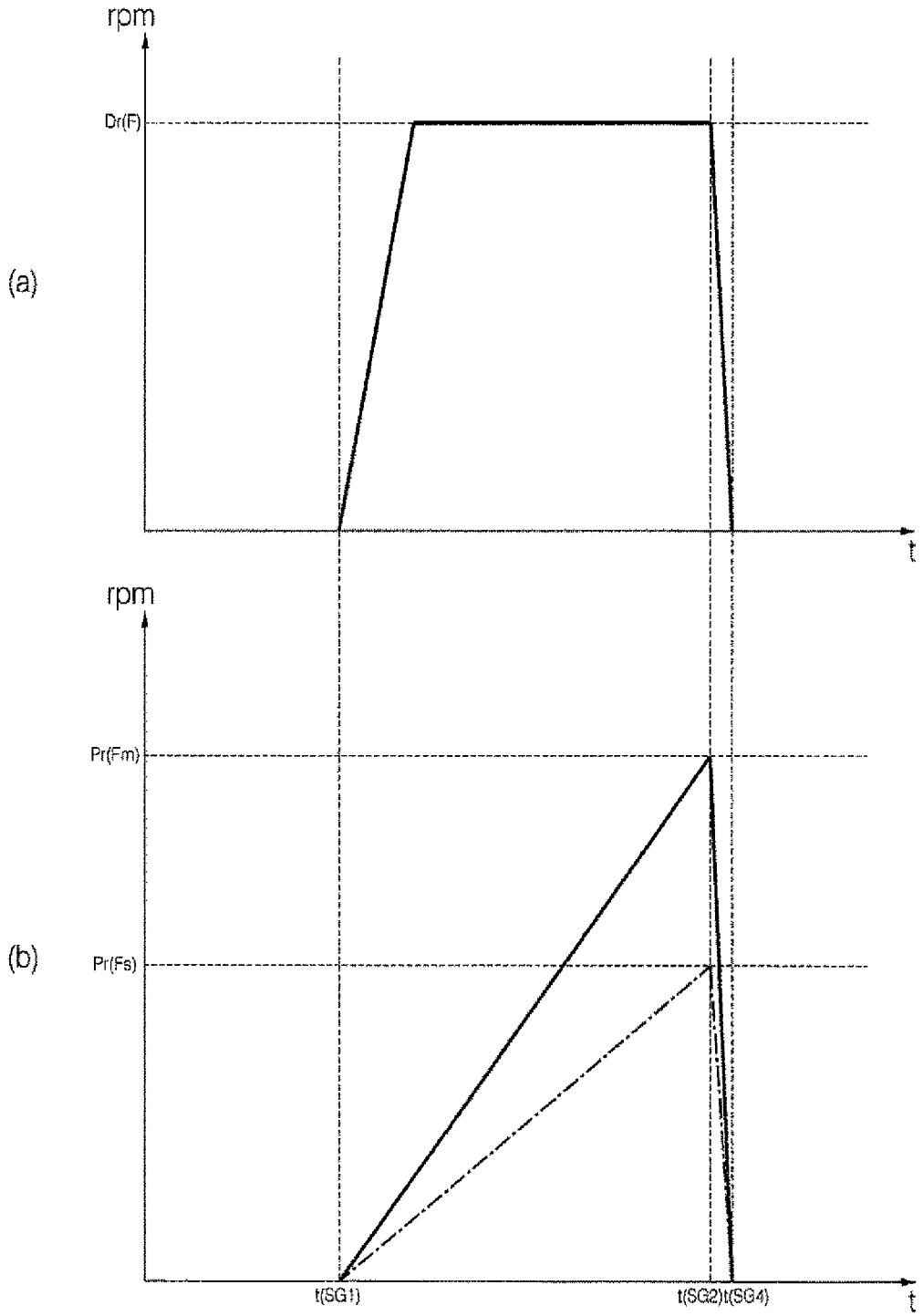
FIG. 53 shows a change (a) in the number of rotations of a drum and a change (b) in the number of rotations of a pump according to an embodiment of the present invention.
Figure 56:
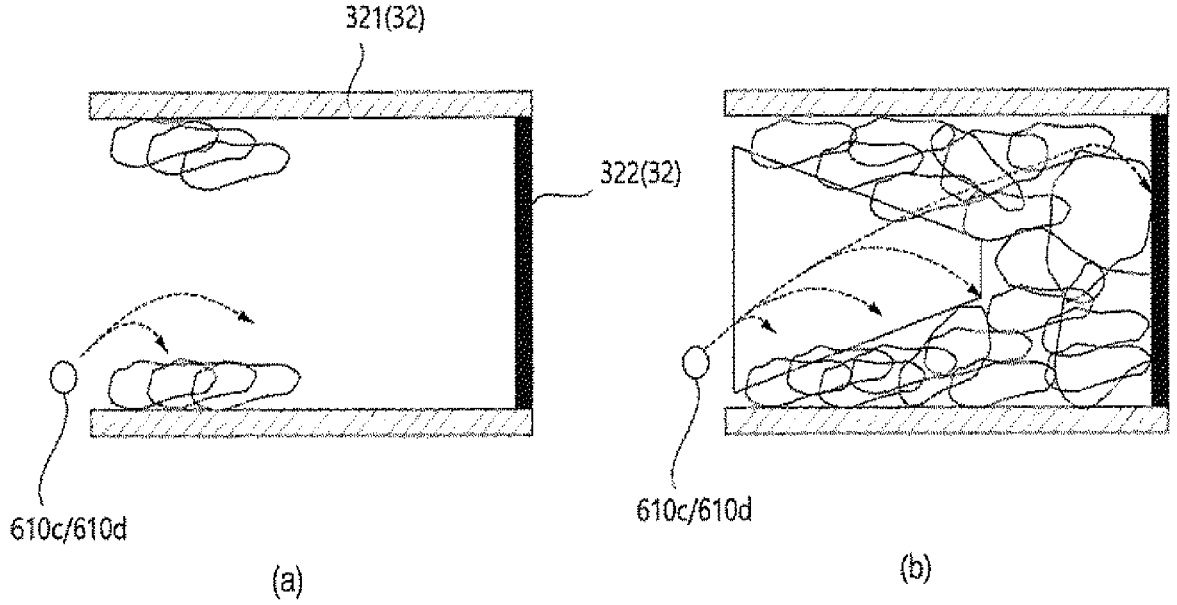
FIG. 56 shows a disposition of laundry in a drum during operation of a filtration motion, (*a*) shows a case where a small amount of laundry is inputted into the drum, and (b) shows a case where a large amount of laundry is inputted.
Figure 57:
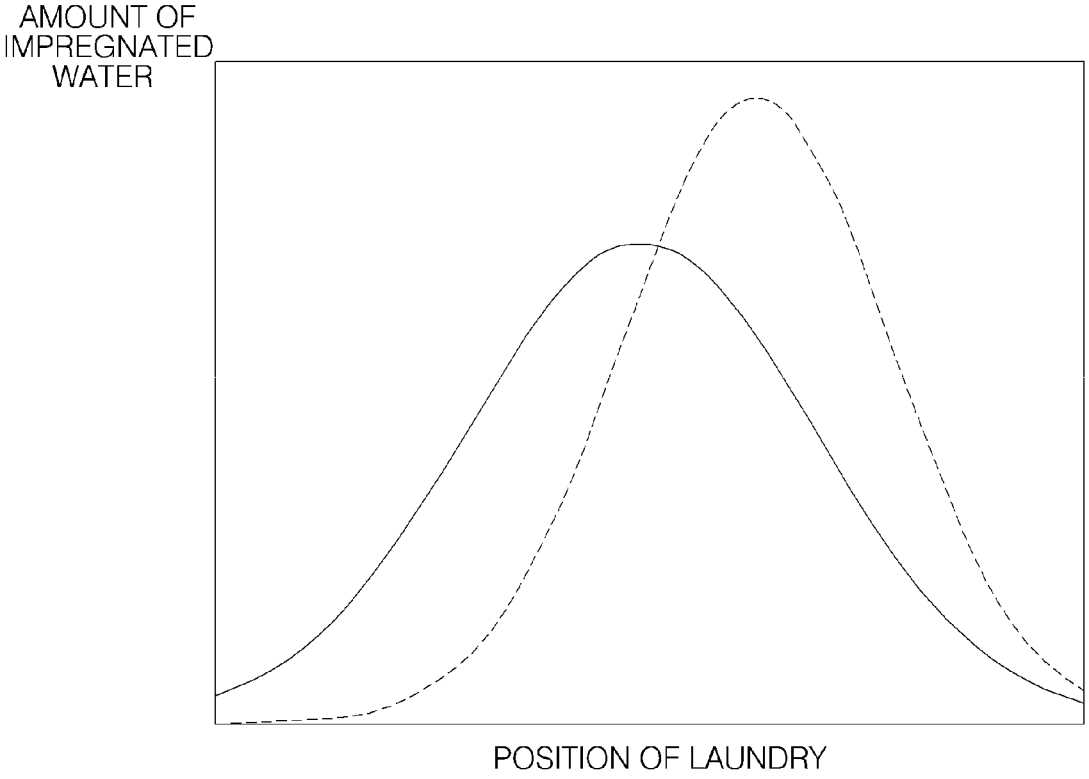
FIG. 57 shows the amount of water impregnated in laundry positioned at the rear surface portion of a drum, when the number of rotations of a pump is fixed at 3600 rpm during operation of the filtration motion, and when the number of rotations of the pump is increased from 0 to 3500 rpm.
Figure 59:
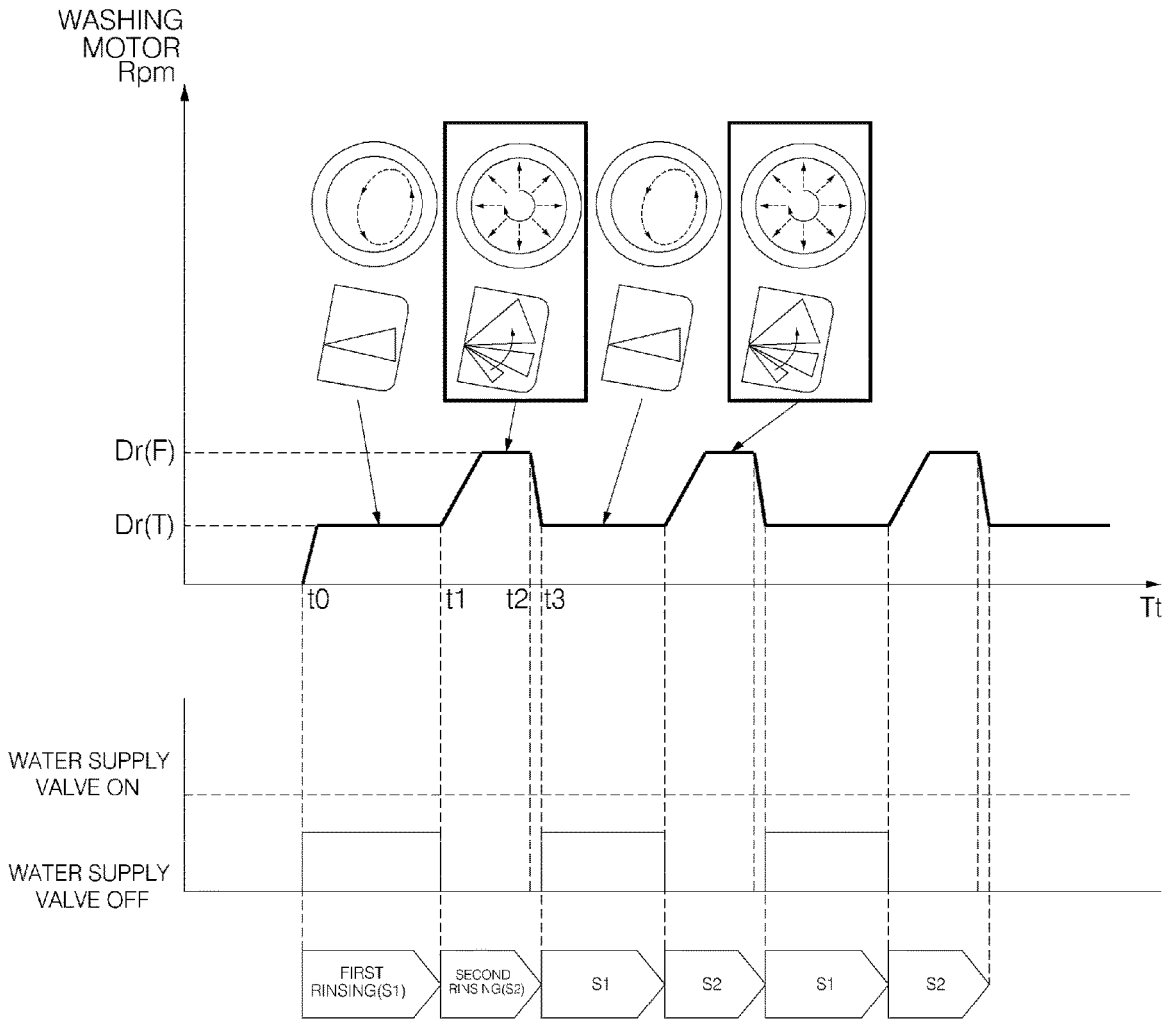
FIG. 59 is a graph showing operations of a washing motor and a water supply valve in each step of a rinsing process of the washing machine according to an embodiment of the present invention.

FIG. 53 shows a change (a) in the number of rotations of a drum and a change (b) in the number of rotations of a pump according to an embodiment of the present invention. FIG. 56 shows a disposition of laundry in a drum during operation of a filtration motion, (a) shows a case where a small amount of laundry is inputted into the drum, and (b) shows a case where a large amount of laundry is inputted. FIG. 57 shows the amount of water impregnated in laundry positioned at the rear surface portion of a drum, when the number of rotations of a pump is fixed at 3600 rpm during operation of the filtration motion, and when the number of rotations of the pump is increased from 0 to 3500 rpm. FIG. 59 is a graph showing operations of a washing motor and a water supply valve in each step of a rinsing process of the washing machine according to an embodiment of the present invention.

The method for controlling the washing machine according to an embodiment of the present invention includes a step of rotating the drum 32 in one direction so that the laundry in the drum 32 does not fall from the side surface portion 321 of the drum 32. This step corresponds to the above-described filtration motion.

Referring to FIG. 53, FIG. 56, and FIG. 58, during operation of the filtration motion, the controller controls the rotation speed (Pr(F)) of the circulation pump motor 92 to increase while the drum 32 rotates (preferably, one rotation or more) in one direction. During operation of the filtration motion, when the rotation speed of the drum 32 starts to increase, the centrifugal force applied to the laundry is also increased, and the laundry, which is positioned near the side surface portion 321 of the drum 32, is in close contact with or adhered to the side surface portion 321 of the drum 32 in order. That is, in the filtration motion, during a process in which the rotation speed of the drum 32 starts to increase to reach a preset rotation speed Dr(F), in the early stage, a sufficient centrifugal force is not applied to the laundry placed in the center of the drum 32 so that a flow of the laundry is generated. Thereafter, when the rotation speed of the drum 32 is sufficiently increased, the position of most of the laundry (preferably, all laundry) in the drum 32 with respect to the drum 32 is fixed.

In particular, when the amount of the laundry put into the drum 32 is lower than a certain level, the laundry is collected generally in the opening side of the drum 32 during the filtration motion (see (a) in FIG. 56). In this case, it is preferable that the rotation speed of the pump 901 is controlled to be low so that the circulating water current sprayed from the nozzle 610*c*, 610*d* falls down to the front side of the drum 32.

On the other hand, when the amount of the laundry put into the drum 32 is equal to or higher than a certain level, the empty space surrounded by the laundry is extended rearward from the opening of the drum 32 in the process of increasing the rotation speed of the drum 32 and, eventually, forms a shape as shown in (b) in FIG. 56.

The control for increasing the rotation speed of the pump 901 during operation of the filtration motion is based on the expansion mechanism of the empty space in the drum 32 as described above that is found in the process of performing the filtration motion. That is, in the process of expanding the empty space to the rear side of the drum 32, the spraying pressure of the nozzle 610*c*, 610*d* is also increased in association with the expansion of the empty space so that the water current can reach the deep inside the drum 32.

In the filtration motion, the controller accelerates the washing motor to reach a preset rotation speed Dr(F), and controls the rotation speed Dr(F) to be maintained for a preset period of time when reaching the rotation speed Dr(F). The rotation speed Dr(F) is determined within a range in which laundry is rotated while being adhered to the side surface portion of the drum 32, and may be varied depending on the amount of laundry, but is set, approximately, to 80 to 108 rpm.

In the filtration motions, the maximum rotation speed of the circulation pump motor 92 is set according to the amount of laundry. That is, the controller may set the maximum rotation speed Pr(F) according to the sensed laundry amount. The circulation pump motor 92 may set the maximum rotation speed Pr(Fm) in the case where the sensed laundry amount falls within a large amount (or a second laundry amount range II, see FIG. 58) to a larger value, in comparison with the maximum rotation speed Pr(Fs) in the case where the sensed laundry amount falls within a small amount (or a first laundry amount range I, see FIG. 58).

At this time, the rotation speed of the pump 901 may be configured to start rising in correspondence with a time point t t(SG1) at which the rotation of the drum 32 starts to be accelerated. That is, the acceleration of the rotation of the drum 32 and the time point of rising of the rotation speed of the pump 901 are interlocked (or synchronized).

In the filtration motion, the controller accelerates the circulation pump motor 92 up to a preset rotation speed Pr(F), and can control the rotation speed Pr(F) to be maintained when reaching the rotation speed Pr(F).

In (b) of FIG. 53, the graph indicated by the solid line shows the change in the rotation speed of the pump 901 when the laundry amount is equal to or larger than a reference value, and the graph indicated by the chain line shows the change in the rotation speed of the pump 901 when the laundry amount is less than the reference value. As shown in these drawings, the drum 32 can be braked when the rotation speed of the pump 901 reaches (t===t(SG2)) a preset maximum rotation speed Pr(Fm), Pr(Fs).

Figure 54:
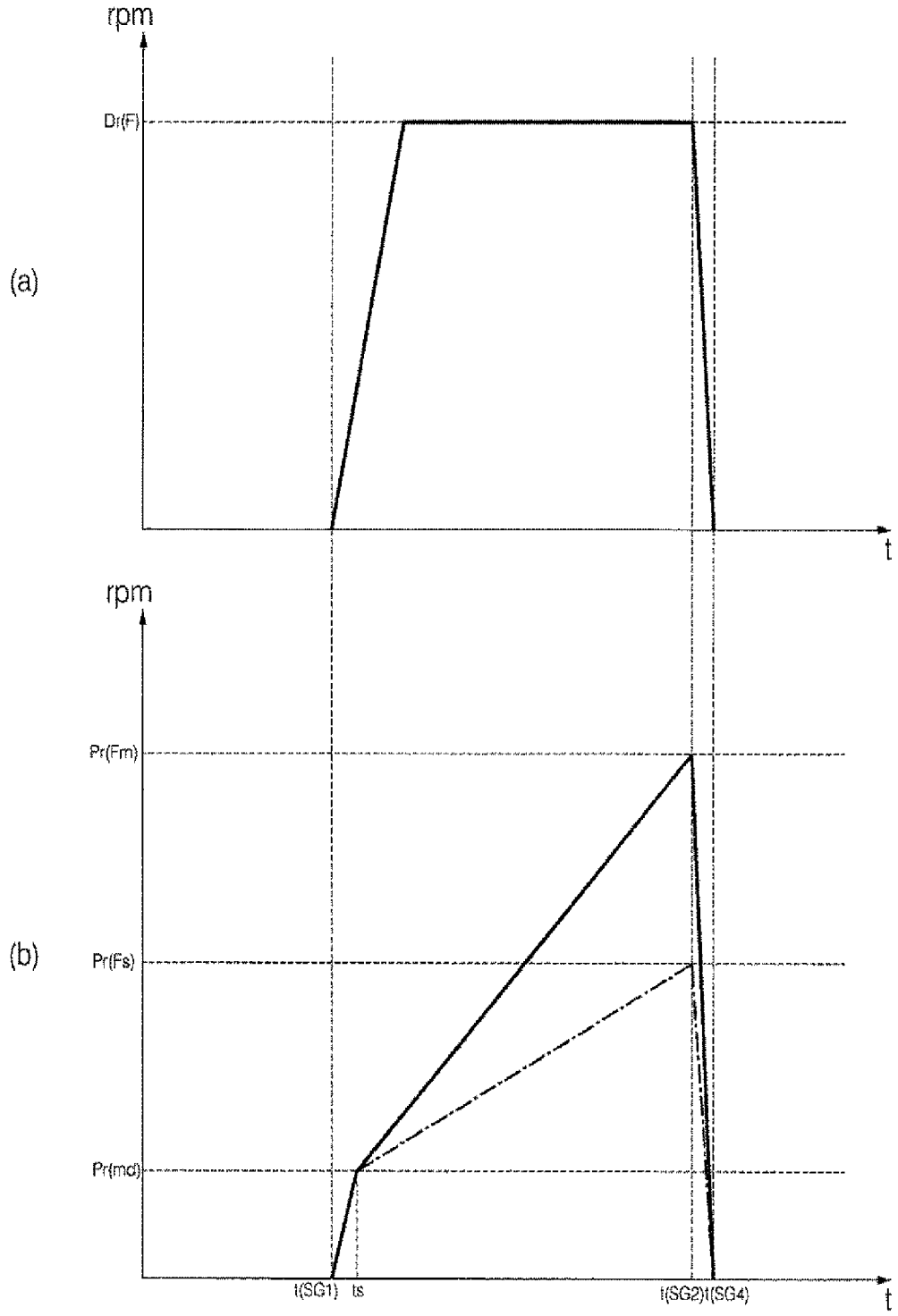
FIG. 54 shows a change (a) in the number of rotations of a drum and a change (b) in the number of rotations of a pump according to another embodiment of the present invention.

FIG. 54 shows a change (a) in the number of rotations of a drum and a change (b) in the number of rotations of a pump according to another embodiment of the present invention.

Referring to FIG. 54, FIG. 56, and FIG. 58, in the control method according to another embodiment of the present invention, the rotation speed of the pump 901 rises to a preset spraying rotation speed Pr(md) at a first rotation acceleration (the rotation acceleration in a section from t(SG1) to ts), and then rises to the maximum rotation speed Pr(Fm), Pr(Fs) at a second rotation acceleration (the rotation acceleration in a section from ts to t(SG2)) lower than the first rotation acceleration.

The spraying of water through the nozzle 610*c*, 610*d* is started, at the latest, when the rotation speed of the pump 901 reaches the spraying rotation speed Pr(md). That is, at the latest, when the rotation speed of the pump 901 reaches the spraying rotation speed Pr(md), the water transferred through the circulating water guide pipe 18 should reach the nozzle 610*c*, 610*d*. In this respect, it is preferable that the first rotation acceleration is set to be larger than the second rotation acceleration so that the spraying can be performed quickly through the nozzle 610*c*, 610*d*.

The spraying rotation speed Pr(md) and the maximum rotation speed Pr(Fm), Pr(Fs) can be set according to the amount of laundry (i.e., the amount of cloth). As shown in FIG. 56, since the laundry is gathered at the opening side of the drum 32 when the amount of laundry is relatively small (see (a) in FIG. 56), even when the rotation speed of the pump 901 is varied in a relatively low area in comparison with the case of a large amount of laundry (see (b) in FIG. 56), the laundry can be wet by the water current that is sprayed and falls from the nozzle 610*c*, 610*d*.

Preferably, when the sensed amount of laundry is less than a preset reference value, the maximum rotation speed may be set to the first rotation speed Pr(Fs), and when the sensed amount of laundry is equal to or larger than the reference value, the maximum rotation speed may be set to the second rotation speed Pr(Fm) higher than the first rotation speed Pr(Fs).

For example, when the sensed amount of laundry is less than the reference value, the rotation speed of the pump 901 is abruptly raised to 1300 rpm (spraying rotation speed) at the first rotation acceleration, and then raised to 2300 rpm gently at the second rotation acceleration (a value lower than the first rotation acceleration).

Meanwhile, although not shown in the drawing, if the sensed amount of laundry is equal to or larger than the reference value, the controller quickly may raise the rotation speed of the pump 901 to 1300 rpm (spraying rotation speed) at the first rotation acceleration, and then, raise to 3500 rpm gently at the second rotation acceleration (a value lower than the first rotation acceleration). Thereafter, the rotation speed of the pump 901 is lowered, and the drum 32 is also braked and stopped.

The control method of the washing machine configured as described above uses the filtration motion and the filtration spraying in the rinsing step to allow the water current to flow from the front portion of the drum 32 toward the rear surface portion 322, thereby improving the rinsing effect by pushing the foam toward the rear surface portion 322.

In addition, water can be evenly sprayed on the laundry during the filtration motion, so that the laundry can be adhered to the drum 32 well.

Figure 55A:
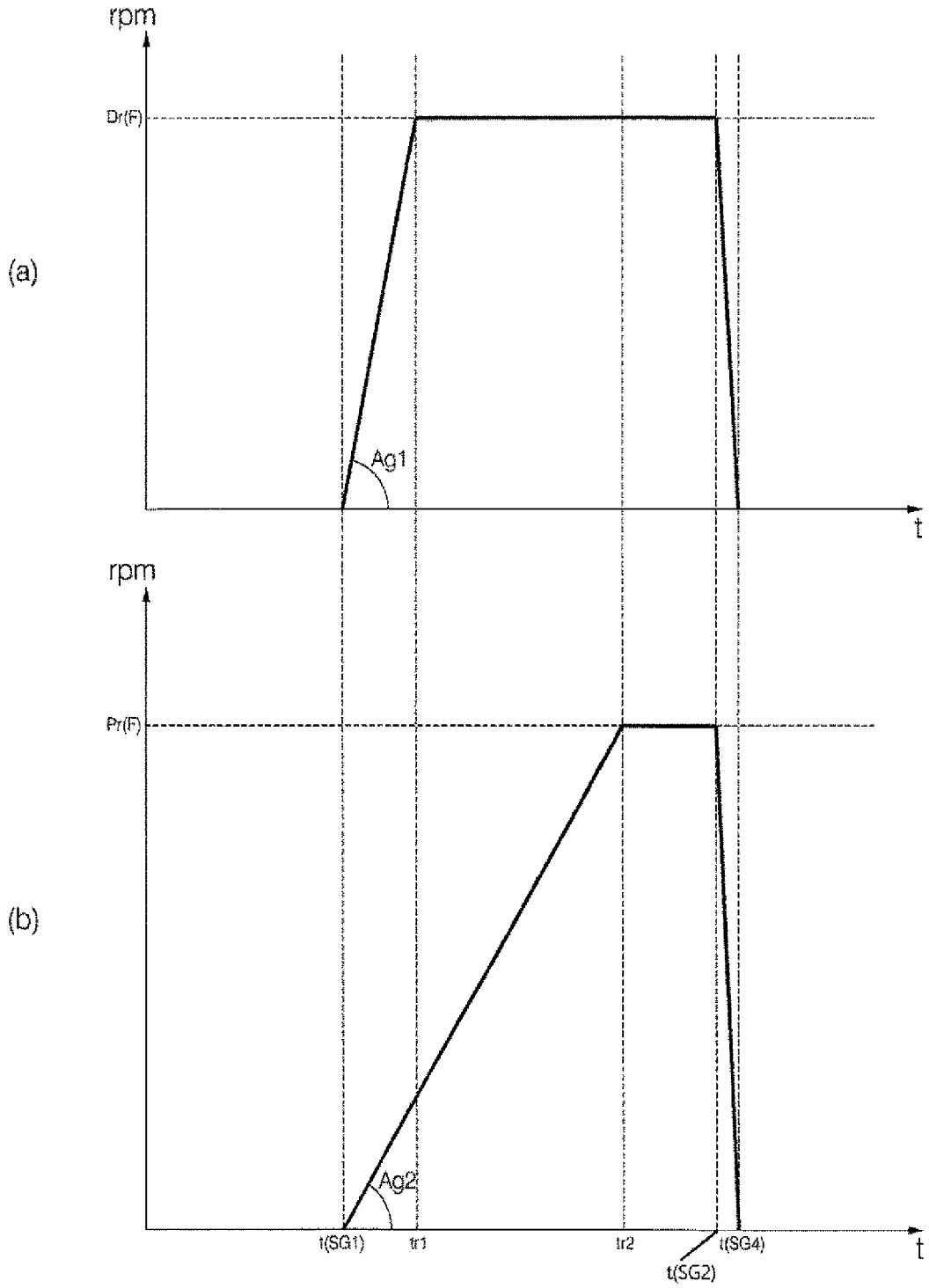
FIG. 55A shows a change (a) in the number of rotations of a drum and a change (b) in the number of rotations of a pump according to another embodiment of the present invention.

FIG. 55A shows the change (a) in the number of rotations of the drum and the change (b) in the number of rotations of the pump according to another embodiment of the present invention. Referring to FIG. 55A and FIG. 58, according to another embodiment of the present invention, in the filtration motion, the controller accelerates the circulation pump motor 92 until it reaches a preset rotation speed Pr(F), and controls the rotation speed Pr(F) to be maintained when reaching the rotation speed Pr(F).

The controller can accelerate the washing motor up to the rotation speed Dr(F) at a set first acceleration slope Ag1. The controller can set the first acceleration slope Ag1 based on the time tr1 at which the controller reaches the maximum rotation speed Dr(F). The time tr1 may be set differently depending on the amount of laundry.

Alternatively, the controller may control the rotation speed Dr(F) to be maintained until the washing motor rotates by a set angle. At this time, the set angle may vary depending on the amount of laundry.

The controller can accelerate the circulation pump motor 92 up to the rotation speed Pr(F) at a set second accelerator slope Ag2. The second acceleration slope Ag2 may be set to a value equal to or larger than the first acceleration slope Ag1.

Alternatively, the controller may set the second acceleration slope Ag2, based on the arrival time tr2 up to the maximum rotation speed Pr(F). The time tr2 may vary depending on the amount of laundry.

The controller can brake the washing motor, when the washing motor completes the control for the motion angle θ and the angle control completion signal SG2 is generated (t=t(SG2)).

The controller may decelerate the circulation pump motor 92, when the angle control completion signal SG2 is generated.

The controller can control the circulation pump motor 92 to stop, when the washing motor is stopped and the stop signal SG4 is generated (t=t(SG4)).

The control method of the washing machine according to the embodiments of the present invention may further include a step of sensing the amount of the laundry (hereinafter, referred to as "laundry amount") in the drum 32. Various methods of obtaining the laundry amount are already known. For example, the controller may accelerate the drum 32 in a state in which the laundry (or the cloth) is put in, and determine the laundry amount based on the time taken for the rotation speed of the drum 32 to reach a preset rotation speed. However, the present invention is not limited thereto.

The step of controlling the pump 901 while performing the above-described filtration motion is suitable for the water supply/laundry wetting process or the rinsing process among the series of processes according to FIG. 12.

Figure 55B:
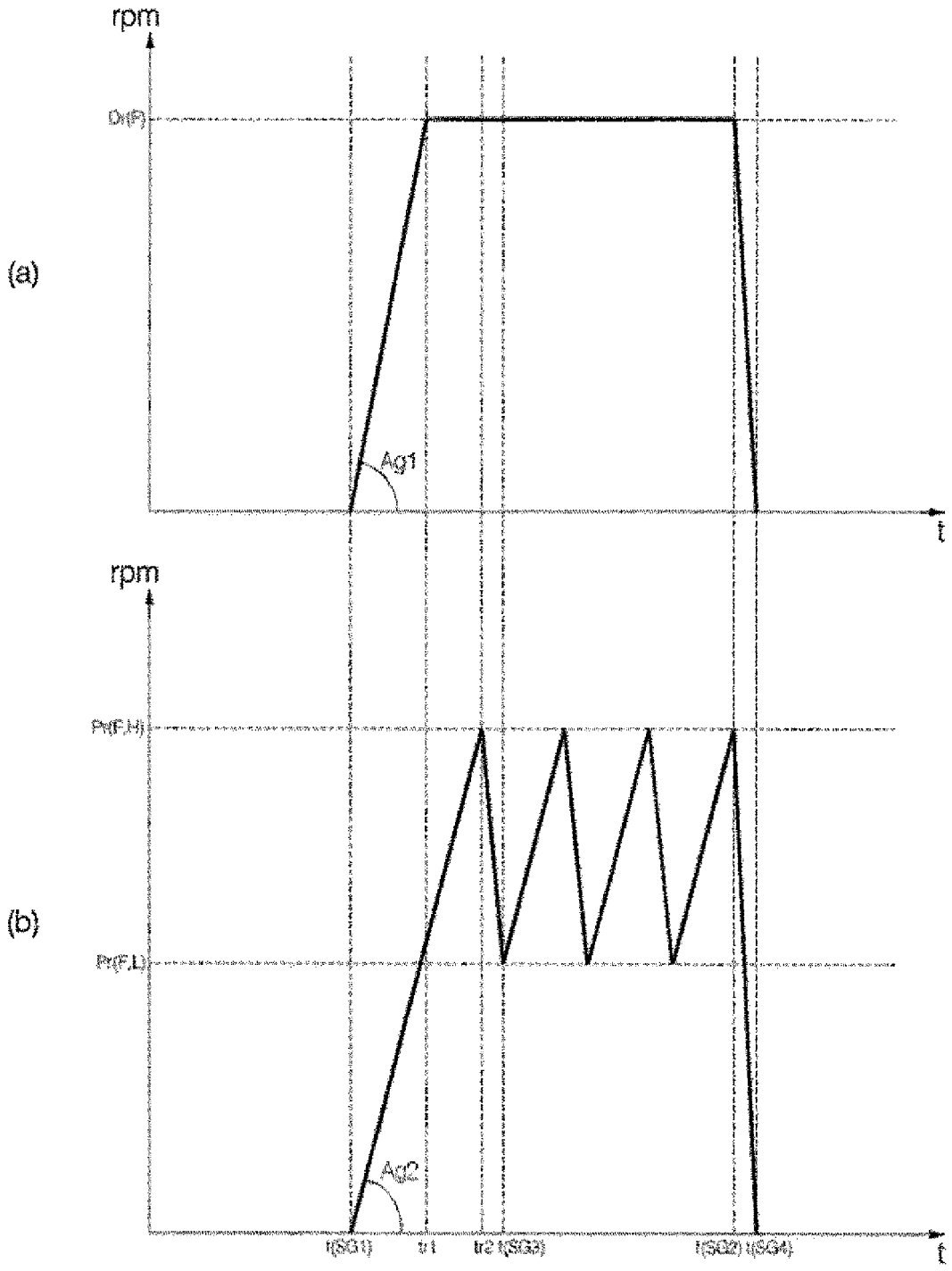
FIG. 55B shows a change (a) in the number of rotations of a drum and a change (b) in the number of rotations of a pump according to another embodiment of the present invention.

FIG. 55B shows the change (a) in the number of rotations of the drum and the change (b) in the number of rotations of the pump according to another embodiment of the present invention.

Referring to FIG. 55B, the controller can accelerate the washing motor so that the laundry in the drum 32 rotates while being in contact with the side surface portion 321 of the drum 32.

The controller can accelerate the washing motor until it reaches the maximum rotation speed Dr(F) at the first acceleration slope Ag1.

The controller can accelerate the circulation pump motor 92 in response to the acceleration of the washing motor so that water is sprayed through the nozzle 610*c*, 610*d*.

The controller can accelerate the circulation pump motor 92 until it reaches the maximum rotation speed Pr(F, H) at the second acceleration slope Ag2. The controller can set the second acceleration slope Ag2 of the circulation pump motor 92 in correspondence with the first acceleration slope Ag1 of the washing motor.

For example, the controller can set the value of the second acceleration slope Ag2 to be higher in proportion to the first acceleration slope Ag1.

After accelerating the washing motor up to the set maximum rotation speed Dr(F), the controller can control to maintain the first rotation speed Dr(F) at which the laundry rotates while being in contact with the drum 32. The first rotation speed Dr(F) may be set to a value equal to or less than the maximum rotation speed Dr(F).

In the present embodiment, a case where the first rotation speed Dr(F) is set to the same value as the maximum rotation speed Dr(F) will be described as an example.

The controller may decelerate the circulation pump motor 92 within a set rotation range and then accelerate again, while maintaining the washing motor at the first rotation speed Dr(F).

Referring to FIG. 45, the drum 32 can be defined as a first area, a second area, and a third area in order from the front side by dividing the drum 32 viewed from the lateral side into three sections by the space between the opened front surface and the rear surface portion 322.

The controller controls the circulation pump motor 92 so that the orientation of the water current sprayed through the nozzle 610*c*, 610*d* is changed from the second area to the first area, while the washing motor maintains the first rotation speed Dr(F).

For example, the controller controls the circulation pump motor 92 at the maximum rotation speed 2300 rpm set based on the laundry amount so that the orientation of the water current sprayed through the nozzle 610*c*, 610*d* is directed to the third area. Thereafter, the controller may control the circulation pump motor 92 at the set minimum rotation speed 1300 rpm to decelerate the circulation pump motor 92 so that the orientation of the water current is directed to the first area.

The controller can sense the laundry amount of in the drum 32 before accelerating the washing motor at the maximum rotation speed. As the method of sensing the laundry amount, the above-described method or other known methods can be used, and therefore, a detailed description thereof will be omitted.

The controller can set a range in which the water current is sprayed into the drum 32 through the nozzle 610*c*, 610*d*, based on the sensed laundry amount.

Referring to FIG. 45, the area of the drum 32 less than ⅓H may be defined as a first area, a second area, and a third area in order from the front side by dividing the drum 32 viewed from the lateral side into nine sections by the space between the opened front surface and the rear surface portion 322. The area of the drum 32 which is equal to or more than ⅓H and less than ⅔M may be defined as a fourth area, a fifth area, and a sixth area in order from the front side.

For example, in FIG. 45, when the sensed laundry amount is small, the controller may control the circulation pump motor 92 so that the orientation of the water current sprayed through the nozzle 610*c*, 610*d* is changed within the range of the first to third areas having a height from the side surface portion 321 of the drum 32 that is less than ⅓H.

For example, in the case where the sensed laundry amount is large, the controller can control the circulation pump motor 92 so that the orientation of the water current sprayed through the nozzle 610*c*, 610*d* changes within the range of the first to third areas and the sixth area. That is, when reaching the maximum rotation speed Pr(F, H), the controller can control the circulation pump motor 92 so that the water current sprayed through the at least one nozzle contacts the rear surface 42 of the drum 32.

According to the control method of the washing machine configured as described above, water can be evenly sprayed onto the laundry in the drum by adjusting the area to which the water is sprayed according to the laundry amount, thereby improving the washing effect.

In addition, by adjusting the area to which the water is sprayed according to the laundry amount, the water can be efficiently sprayed to the laundry in the drum.

In addition, as described above, the position of the laundry is fixed from the front portion of the drum while the drum accelerates, and the water to be sprayed is also sprayed from the front portion of the drum to the rear surface portion in correspondence with the acceleration of the washing motor, so that the laundry can be more effectively adhered to the drum.

Further, when an empty space surrounded by the laundry is formed by the filtration the water current can be sprayed to the laundry adjacent to the rear surface portion 322 of the drum 32 through the empty space.

Further, the filtration motion and the filtration spraying may be used in the rinsing step to make the water current flow from the front portion of the drum 32 toward the rear surface portion 322, thereby improve the rinsing effect by pushing the foam toward the rear surface portion 322.

The controller can control the circulation pump motor 92 to repeat the process of decelerating when reaching the upper limit Pr(F, H) of the rotation range and accelerating again when reaching the lower limit Pr(F, L).

Alternatively, the controller can control to repeat the acceleration and deceleration of the circulation pump motor 92 for each set time interval. The circulation pump motor 92 may be decelerated even when it does not reach the upper limit of the rotation range Pr(F, H), and may be accelerated even when it does not reach the lower limit Pr(F, L).

The controller may set the rotation range of the circulation pump motor 92 based on the sensed amount of laundry. The controller may set the upper limit of the rotation range of the circulation pump motor 92 to be higher as the sensed laundry amount is larger.

Referring to FIG. 58, in the case of the filtration motion according to the present embodiment, when the sensed laundry amount falls within a small amount (or the first laundry amount range I, see FIG. 58), the rotation speed of the circulating pump motor 92 can be varied between 1300 rpm, which is the minimum rotation speed Pr(F, L), and 2300 rpm, which is the maximum rotation speed Pr(F, H). In addition, when the sensed laundry amount falls within a large amount (or the second laundry amount range II, see FIG. 58), the rotation speed of the circulating pump motor 92 can be varied between 1300 rpm, which is the minimum rotation speed Pr(F, L), and 3500 rpm, which is the maximum rotation speed Pr(V, H).

Thus, the water sprayed through the nozzle 610*c*, 610*d* reciprocates back and forth of the drum 32 to increase the amount of water impregnated in laundry in the drum 32 as a whole, thereby improving the washing effect.

In addition, the water sprayed through the nozzle 610*c*, 610*d* can be uniformly sprayed without being concentrated in a certain area, thereby improving wetting of the laundry in the front surface portion of the drum 32.

The above-described filtration motion with reference to FIG. 55B can be used in the a rinsing step among the series of washing processes of FIG. 50. In addition, it may be used in the water supply/laundry wetting step, but, hereinafter, the case where the filtration motion is used in the rinsing step will be described in detail.

The controller can open the drain valve 96 and operate the drain pump so that water is drained from the tub 31 after performing the filtration motion according to FIC. 55B. The circulation pump motor 92 may be used as the drain pump. The circulation pump motor 92 may supply fluid pressure to the fluid under the control of the controller so that water is sprayed through the nozzle 610*c*, 610*d* or water in the tub 31 is discharged through the drain valve 96.

The controller can open the water supply valve 94 so that the detergent-undissolved water is supplied into the tub 31, after the water in the tub 31 is drained.

The controller may repeatedly perform a process of performing the filtering motion, draining the water from the tub 31, and supplying water into the tub 31, for a set number of times or a set period of time. The controller can set the number of times or period of time to be repeatedly performed, based on the amount of laundry in the drum 32.

The controller can control the water supplied into the washing machine through the water supply valve to be supplied into the tub 31 via a detergent box in which the washing detergent is accommodated. At this time, since the detergent has already been sprayed into the tub 31 in the washing step, the detergent-undissolved water can be supplied into the tub 31.

Alternatively, the controller may control the water supplied through the water supply valve to be sprayed into the drum 32 through the direct water nozzle 42.

Meanwhile, the controller can control the water supply valve 94 so that the detergent-undissolved water is supplied into the tub 31 during the filtration motion.

For example, after performing the filtration motion, the controller can drain the water in the tub 31 and perform the filtration motion while supplying the detergent-undissolved water into the tub 31. That is, it is possible to start the filtration motion while water is being supplied, thereby shortening the time required for the entire washing process. Alternatively, the filtration motion may be performed more earlier to expand the total operating time, thereby improving the effectiveness of the rinsing process.

Referring to FIG. 57, the amount of water impregnated in laundry positioned in the rear surface portion 42 of the drum 32 is shown, in the case where the rotation speed of the pump is fixed at 3600 rpm (i.e., when a conventional fixed rpm pump is used, indicated by a solid line) while the filtration motion is performed, and in the case where the rotation speed of a speed variable pump 901 is raised from 0 to 4600 rpm (i.e., the case of an embodiment of the present invention, indicated by a dotted line). In the graph, the x-axis indicates the position of the laundry, wherein the laundry is positioned deeper in the drum 32 when progressing from left to right, and the y-axis indicates the amount of water impregnated in laundry. As shown in the drawing, it can be seen that the laundry deeply positioned in the drum 32 of the present invention can be more wet than in the prior art.

Hereinafter, a method of controlling the washing machine according to an embodiment of the present invention will be described with reference to FIG. 59.

The user inputs various settings through the input unit provided on the control panel 14, and the operation of the washing machine is started. Depending on the input settings, the washing, rinsing, and spin-dry processes may be performed sequentially or selectively. The progress state of these processes can be displayed through a display unit provided on the control panel 14.

In the washing process, water is supplied into the tub 31 together with the detergent. The water supplied through the water supply valve 94 is supplied into the tub 31 via the detergent box. Accordingly, the detergent contained in the detergent box is supplied together with water. The washing process may include a step of driving the circulation pump motor 92 and spraying detergent water through the nozzle 610*c*, 610*d*.

The rinsing process is a process for removing the detergent from the laundry after the washing process, and the raw water (water not containing detergent) supplied through the water supply valve 94 is directly supplied into the tub 31. Since the detergent contained in the detergent box has already been discharged together with the water due to the water supply in the washing process, even if the water supplied through the water supply valve 94 passes through the detergent box during the water supply in the rinsing process, the detergent is not supplied any more. However, when the detergent box is divided into a space containing the detergent and a space containing the fabric softening agent, and when the water is supplied via the space containing the fabric softening agent during the rinsing process, the fabric softening agent may be supplied together with the water during the rinsing process.

The spin-dry process is a process in which the drum 32 is rotated at a high speed to remove water from the laundry after the rinsing process is completed and the thus removed water is drained by using the drain pump. Generally, the operation of the washing machine is completed when the spin-dry process is completed, but in the case of the washing machine having the drying function, the drying operation can be further performed after the spin-dry operation.

The method of controlling a washing machine according to an embodiment of the present invention may be performed during the rinsing process. The rinsing process may include a water supply step of opening the water supply valve 94 to supply water into the tub 31 and a step of performing the drum driving motion in a state in which the tub 31 is filled with a certain amount of water and controlling the operation of the circulation pump motor 92 in this process. The a rinsing process may further include a drain step of draining water in the tub 31 to the outside.

Particularly, the filtration motion can be performed during the rinsing process. In this process, as described above, the controller can raise the rotation speed of the circulation pump motor 92 to a preset rotation speed Pr(F) and control to maintain the rotation speed Pr(F). While the filtration motion is performed as described above, the control (hereinafter, referred to as "filtration spraying") of the circulation pump motor 92 corresponding to the increase in the rotation speed of the washing motor may be performed according to at least one of the embodiments described above with reference to FIG. 53 to FIG. 55.

The filtration spraying may be performed whenever the filtration motion is performed during the rinsing process, or the filtration spraying may be performed while the last filtration motion is being performed during the rinsing process.

As described above with reference to FIG. 56, in the filtration spraying, the spraying direction of the water current through the nozzle 610*c*, 610*d* is gradually directed to an upper side, in correspondence with the increase of the rotation speed of the circulation pump motor 92. Therefore, the water current sprayed from the nozzle 610*c*, 610*d* is gradually moved from the front portion of the drum 32 to the deep inside of the drum 32. Particularly, since the laundry is adhered to the side surface portion 321 of the drum 32 due to the filtration motion, the detergent is sequentially removed from the laundry positioned in the front portion of the side surface portion to the laundry positioned in the rear portion, by the water current sprayed from the nozzle 610*c*, 610*d*. Particularly, since the area on the drum 32 reached by the water current sprayed from the nozzle 610*c* and 610*d* is shifted from the front to the rear, the foam removed from the laundry is also moved and gathered by the water current in a certain direction from the front to the rear. Further, as the rotation of the drum 32 and the spraying of the water current are continued, the foam is diluted and, furthermore, is discharged through the through hole formed in the drum 32, thereby achieving an effect of reducing the re-contamination of laundry due to the foam.

Meanwhile, during operation of the filtration spraying, water supply for replenishing the drained water may be additionally performed through the control of the water supply valve 94.

The filtration spraying may be performed at least once during the rinsing process. After the filtration spraying is performed once, the water in the tub 31 is drained, and thereafter, the water supply and the filtration spraying can be performed again. In order to accomplish draining, when the pump 901 has a combined use for both drain and circulation, the pump 901 is operated in the drain mode, and when a separate drain pump is provided, the drain pump can be operated. Preferably, after the final water supply in the rinsing process, the filtration spraying is perform at least once.

The controller may open the water supply valve 94, and allow water to be sprayed into the drum 32 through the direct water nozzle 42, while the filtration spraying is being performed.

Hereinafter, referring to FIG. 59, an example of a process in which water is sprayed through the nozzle 610*c* and 610*d* while the drum driving motion is performed will be described in detail.

During the rinsing process, a first rinsing step S1 and a second rinsing step S2 may be performed. In the first rinsing step S1, tumbling motion is performed, and in this process, the circulation pump motor 92 is operated and spraying is performed through the nozzles 610*c*. 610*d*. The control of the washing motor for tumbling motion and the control of the circulation pump motor 92 in this process are as described above with reference to FIG. 53 to FIG. 58.

During operation of the first rinsing step S1, the controller may open the water supply valve 94 so that water is supplied into the tub 31. In the first rinsing step S1, the drain valve 96 is in a closed state, and the circulation pump motor 92 is operated to perform the spraying through nozzle 610*c*, 610*d* while tumbling motion is being performed.

The second rinsing step S2 is performed after the first rinsing step S1, and, when the second rinsing step S2 is started, the tub 31 is filled with the water supplied in the first rinsing step S1. In the second rinsing step S2, the filtration motion is performed. When the first rinsing step S1 is terminated, the controller may not stop the rotation of the washing motor, but may control the rotation speed of the washing motor to reach the rotation speed Dr(T) at which the filtration motion is performed by directly accelerating from the rotation speed Dr(T) at which the tumbling motion is performed.

While the second rinsing step S2 is being performed, the water supply valve 94 is opened and water can be further sprayed through the direct water nozzle 42.

When the second rinsing step S2 is terminated, the controller may not stop the rotation of the washing motor. When the rotation speed of the washing motor reaches the rotation speed Dr(T), the controller may control the circulation pump motor 92 to maintain the rotation speed Dr(T), and from this time, the first rinsing step S1 is performed again.

Meanwhile, the water level in the tub 31 may be adjusted by controlling the drain pump to perform the drain step before the second rinsing step S2 is completed and the first rinsing step S1 is performed again. At this time, when the first rinsing step S2 is performed again, the draining can be stopped. The controller can open the water supply valve 94 while the first rinsing step S2 is performed again.

Although not shown, during operation of the second rinsing step S2, the controller can control the drain valve 96 to be opened so that the water in the tub 31 is drained.

For example, during operation of the second rinsing step S2, the controller can open the drain valve 96 and control the drain pump so that the water in the tub 31 is drained, after performing the filtration spraying.

This makes it possible to effectively perform the rinsing step by efficiently performing the process of supplying the detergent-undissolved water in the rinsing step and the process of draining the detergent water mixed with the contaminants separated from the laundry as the detergent is dissolved, thereby reducing the driving time.

<Squeeze Motion>

Figure 60:
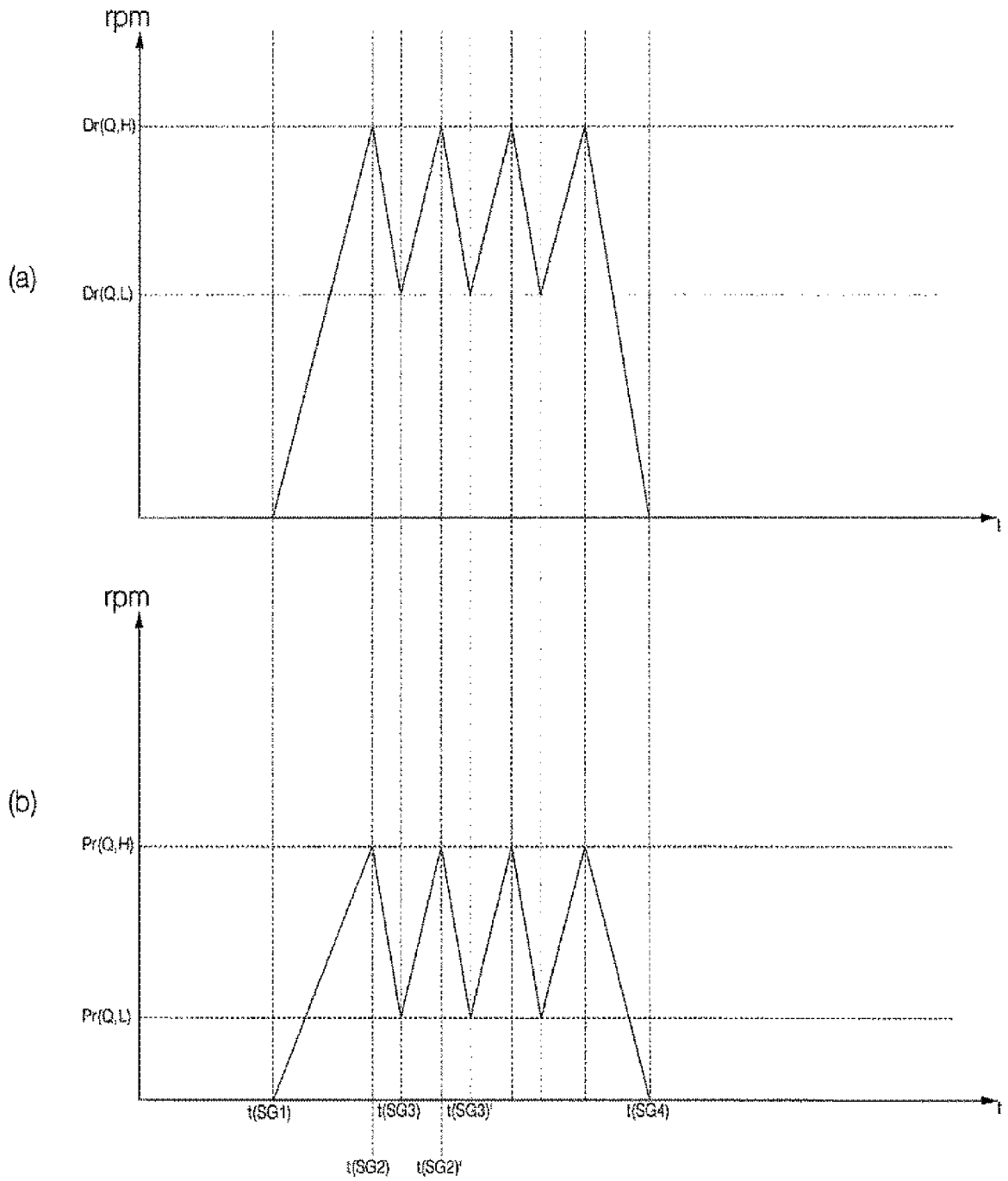
FIG. 60 shows a change (a) in the number of rotations of a drum and a change (b) in the number of rotations of a pump according to an embodiment of the present invention.
Figure 61:
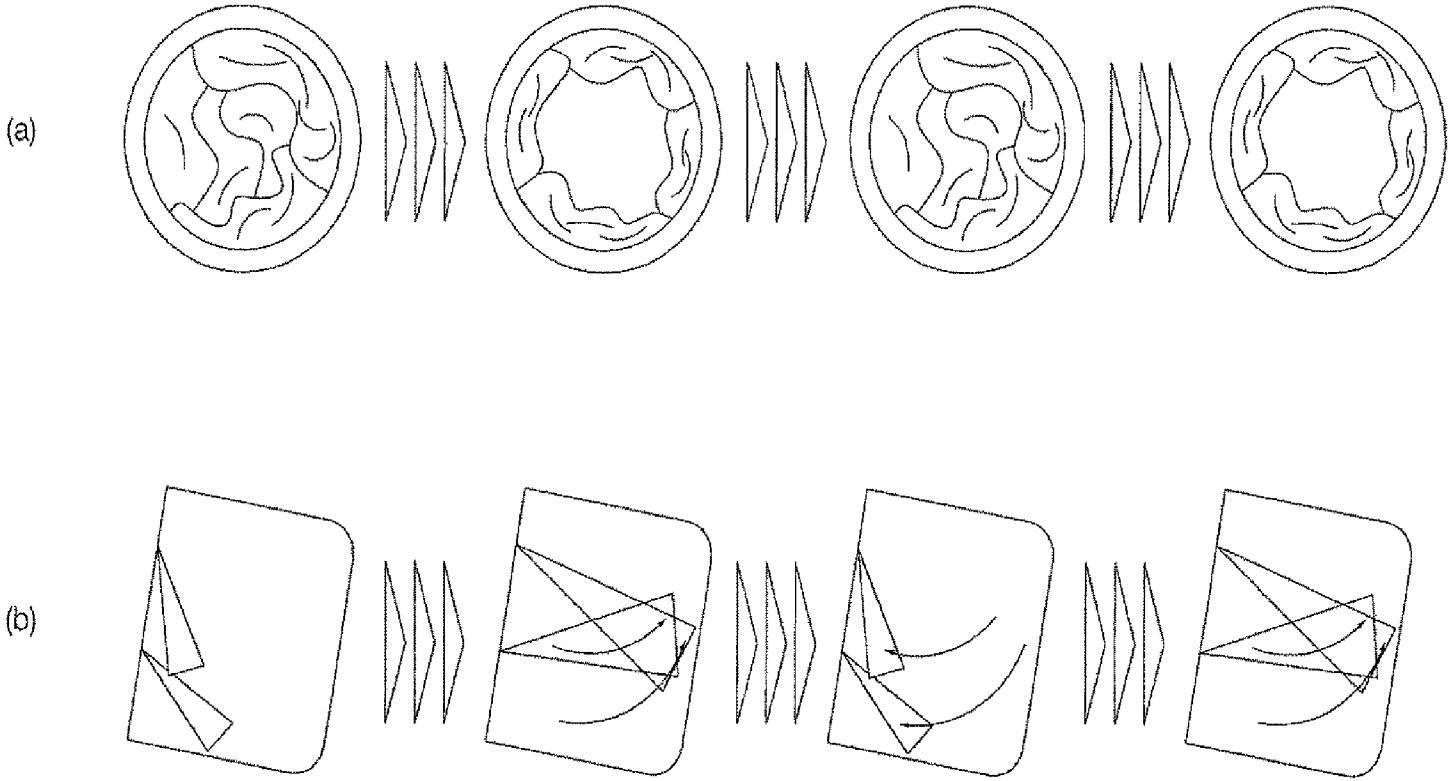
FIG. 61 is a view for explaining a squeeze motion according to an embodiment of the present invention.
Figure 62:
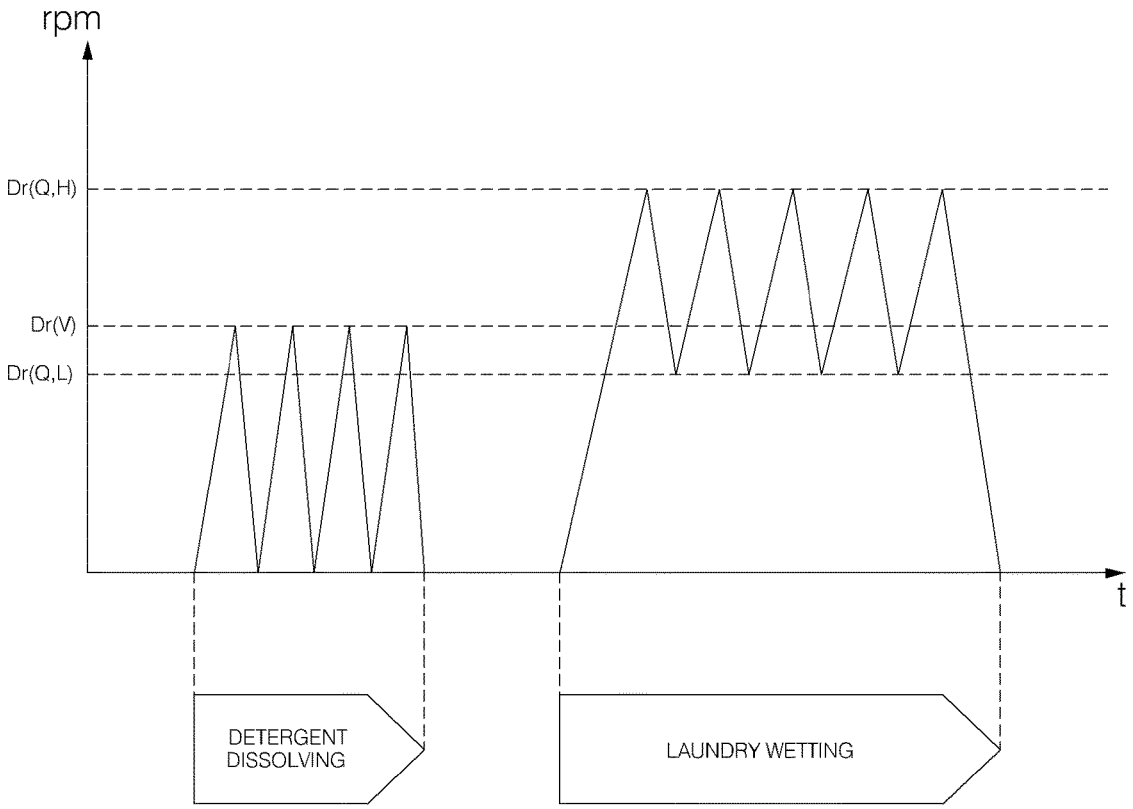
FIG. 62 is a view for explaining a water supply/laundry wetting process according to an embodiment of the present invention.

FIG. 60 shows a change (a) in the number of rotations of a drum and a change (b) in the number of rotations of a pump according to an embodiment of the present invention. FIG. 61 is a view for explaining a squeeze motion according to an embodiment of the present invention. FIG. 62 is a view for explaining a water supply/laundry wetting process according to an embodiment of the present invention.

The squeeze motion is a motion of repeating a process of rotating the drum 32 by the washing motor so that the laundry is not separated from the inner circumferential surface of the drum 32 by centrifugal force and then lowering the rotation speed of the drum 32 to separate the laundry from the inner circumferential surface of the drum 32, and spraying the fluid into the drum 32 through the nozzle 610*c*, 610*d* while the drum 32 is rotating.

The filtration motion and the squeeze motion are different in that the filtration motion makes the laundry to be in close contact with the inner surface 321 of the drum 32, whereas the squeeze motion makes the laundry to be adhered to the inner surface of the drum 32 and then separated.

In addition, while the filtration motion allows the position of the laundry to be fixed, the squeeze motion has the effect of squeezing the laundry while the laundry is adhered and dropped.

In addition, unlike the filtration motion, the squeeze motion has the effect of mixing the laundry while the laundry is adhered and dropped to some extent. Particularly, the laundry wetting effect can be improved by using the squeeze motion in the laundry wetting step.

Referring to FIG. 60, the controller can accelerate the washing motor up to the maximum rotation speed Dr(Q, H) so that the laundry in the drum 32 rotates together with the drum 32 and an empty space surrounded by the laundry is formed by the centrifugal force.

The maximum rotation speed Dr(Q, H) of the washing motor is not the rotation speed of maximum output in terms of performance of the washing motor, but can be defined as the upper limit of a preset rotation speed range.

The minimum rotation speed Dr(Q, L) of the washing motor can be defined as the lower limit of a preset rotation speed range.

In the squeeze motion, the maximum rotation speed Dr(Q, H) of the washing motor may be 70 rpm or more (preferably, 80 rpm).

Referring to (a) in FIG. 61, when the drum 32 starts to rotate, the laundry starts to rotate together with the drum 32 (the leftmost drawing in (a) in FIG. 61).

Referring to (b) in FIG. 61, the controller can accelerate the circulation pump motor 92 constituting the pump 901 within a rotation speed range in response to the acceleration of the washing motor so that water is sprayed through the nozzle 610*c*, 610*d*.

The controller can start the acceleration of the circulation pump motor 92 when the acceleration of the washing motor is started (t=t(SG1)).

When the circulation pump motor 92 is accelerated and rotated at a certain speed or more, water can be sprayed from the nozzle 610*c*, 610*d*. At this time, the water current sprayed from the nozzle can be directed to an area near the front surface of the drum 32 on the side surface portion 321 of the drum 32 (the leftmost drawing in (b) in FIG. 61).

The laundry in the drum 32 is brought into close contact with the side surface portion 321 of the drum 32 by the centrifugal force, when the drum 32 is rotated at a certain speed or more (70 to 80 rpm). At this time, a cylindrical space surrounded by the laundry is formed (the second drawing from the left side of (a) in FIG. 61).

The cylindrical space surrounded by the laundry can be expanded as the laundry is brought into close contact with the side surface portion 321 of the drum 32. That is, when the rotation speed of the drum 32 is increased to enhance the centrifugal force applied to the laundry, the cylindrical space surrounded by the laundry can be expanded.

The controller can accelerate the circulation pump motor 92 within the rotation speed range, in response to the acceleration of the washing motor. The controller can accelerate the circulation pump motor 92 up to the maximum rotation speed Pr(Q, H). The maximum rotation speed Pr(Q, H) of the circulation pump motor 92 in the squeeze motion may be a rotation speed (2200 to 3600 rpm, preferably 3500 rpm) at which the water current sprayed from at least one nozzle reaches the rear surface of the drum.

As the circulation pump motor 92 accelerates, the area of the water current sprayed from the nozzle 610*c* and 610*d* may be gradually moved toward the rear surface of the drum 32. When the circulation pump motor 92 is accelerated above a certain speed, the water current sprayed from the nozzle 610*c* and 610*d* may be directed to the rear surface portion 322 of the drum 32 (the second drawing from the left side of (b) in FIG. 61).

The controller may decelerate the washing motor up to the minimum rotation speed Dr(Q, L) so that the empty space surrounded by the laundry in the drum 32 is reduced.

The minimum rotation speed Dr(Q, L) of the washing motor in the squeeze motion can be set to 35 rpm or more and less than 55 rpm (preferably, 46 rpm).

As the rotation speed of the washing motor decreases, the rotation speed of the drum 32 and the laundry in the drum 32 also decreases. When the rotation speed of the laundry is decreased, the centrifugal force is weakened, so that the laundry can be partially separated from the side surface portion 321 of the drum 32. That is, the cylindrical space surrounded by the laundry can be reduced (the third drawing from the left side of (a) in FIG. 61).

The controller can decelerate the pump motor within the rotation speed range, in response to the deceleration of the washing motor. The controller can decelerate the circulation pump motor 92 up to the minimum rotation speed Pr(Q, L).

The minimum rotation speed Pr(Q, L) of the circulation pump motor 92 in the squeeze motion may be the rotation speed (1100 to 1600 rpm, preferably 1300 rpm) at which the water current sprayed from at least one nozzle reaches a point nearer to the front surface than the rear surface on the side surface portion 321 of the drum.

As the circulation pump motor 92 decelerates, the sprayed area of the water current sprayed from the nozzle 610*c* and 610*d* is gradually moved toward the front surface of the drum 32. When the circulation pump motor 92 is decelerated below a certain speed, the water sprayed from the nozzle 610*c*, 610*d* can be directed to an area nearer to the front surface of the drum 32 than to the rear portion 322 of the drum 32 on the side surface portion 321 of the drum 32 (the third drawing from the left side of (b) in FIG. 61).

The controller can accelerate the washing motor up to the maximum rotation speed Dr(Q, H) again so that the cylindrical space formed by the laundry in the drum 32 is expanded (the third drawing from the left side of (a) in FIG. 61).

The controller can accelerate the circulation pump motor 92 up to the maximum rotation speed Pr(Q, H) again, in response to the acceleration of the washing motor (the third drawing from the left side of (b) in FIG. 61).

The controller can control the washing motor so as to repeat the acceleration and deceleration within the rotation speed range.

The controller can control the circulation pump motor 92 so as to repeat the acceleration and deceleration, in response to the acceleration and deceleration of the washing motor.

Referring to FIG. 62, the above-described squeeze motion can be used in the laundry wetting step among the water supply/laundry wetting process.

The controller may perform a detergent dissolving step, before performing the laundry wetting step using the squeeze motion.

The controller may accelerate the washing motor so that the laundry on the side surface portion 321 of the drum 32 is raised without falling from the side surface portion 321 due to the centrifugal force in a state in which water is contained in the tub 31, and then brake the washing motor so that the laundry falls down from the side surface portion 321.

The controller can brakes the washing motor in a state in which the laundry positioned at the lowermost point of the drum 32 reaches the height corresponding to a set angle set at a rotational angle of less than 220 degrees of the drum 32.

The controller can brake the washing motor after accelerating the washing motor up to the maximum rotation speed Dr(V). The controller may repeat the process of accelerating the washing motor tip to the maximum rotation speed Dr(V) and then braking. The controller can repeat the process of braking after accelerating the washing motor up to the maximum rotation speed Dr(V) while changing the rotation direction of the drum 32 alternately.

The controller may control the nozzle 610*c* and 610*d* to spray water, and control the circulation pump motor 92 to accelerate in response to the acceleration of the washing motor, and to decelerate in response to the braking of the washing motor.

The controller may perform the above-described detergent dissolving step in a state in which the detergent-dissolved water is filled in the drum 32 at a first water level. The controller may perform the above-described laundry wetting step in a state in which the detergent-dissolved water is filled in the drum 32 at a second water level higher than the first water level.

Thus, in the detergent dissolving step, the detergent can be effectively dissolved, and in the laundry wetting step, laundry can be effectively wet by the fluid in which the detergent is dissolved in a short period of time.

Meanwhile, the controller can set the maximum rotation speed or the minimum rotation speed of the washing motor in the squeeze motion according to the amount of the laundry in the drum 32.

For example, if the maximum rotation speed of the washing motor is Dr(Q, H1) when the amount of laundry in the drum 32 is small, and if the maximum rotation speed of the washing motor is Dr(Q, H2) when the amount of laundry in the drum 32 is large, the controller can set the maximum rotation speed of the washing motor so that the value of Dr(Q, H2) is larger than Dr(Q, H1). Thus, even when the amount of laundry is large, the laundry can be brought into close contact with the side surface portion 321 of the drum 32.

The controller can set the rotation speed range of the circulation pump motor 92 according to the sensed amount of laundry.

For example, if the maximum rotation speed of the circulation pump motor 92 is Pr(Q, H1) when the amount of laundry in the drum 32 is small, and if the maximum rotation speed of the circulation pump motor 92 is Pr(Q, H2) when the amount of laundry in the drum 32 is large, the controller can set the maximum rotation speed of the circulation pump motor 92 so that the value Pr(Q, H2) is larger than the value Pr(Q, H1).

The maximum rotation speed of the circulation pump motor 92 may be defined by the upper limit of a preset rotation speed range of the circulation pump motor 92, not by the maximally rotatable speed depending on the performance of the circulation pump motor 92.

The minimum rotation speed of the circulation pump motor 92 may be defined by the lower limit of a preset rotation speed range of the circulation pump motor 92.

As described above with reference to FIG. 54, the laundry is accumulated from the front end of the drum 32 to the rear end, and, by increasing the maximum rotation speed of the circulation pump motor 92 according to the amount of the laundry, the water flow can reach the laundry near the rear surface portion 322 of the drum 32 so that the laundry wetting can be improved. Thus, the laundry can be more closely in contact with to the side surface portion 321 of the drum 32.

The control method of the washing machine using such configured squeeze motion is advantageous in that the time required for wetting the laundry with the detergent water at the initial stage of washing can be shortened, and as a result, the overall washing time can be shortened.

In addition, by varying the rotation speed of the circulation pump motor 92, and by effectively spraying the circulating water in correspondence with the flow of the laundry during the squeeze motion, the laundry can be effectively wet.

Meanwhile, the nozzle may include a pair of intermediate nozzles 610*b* and 610*c* for spraying water into the first area on the side surface portion 321 of the drum, and a pair of lower nozzles 610*c* and 610*d* for spraying water into the second area on the side surface portion 321 of the drum. At this time, the intermediate nozzles 610*b* and 610*e* and the lower nozzles 610*c* and 610*d* may be disposed so that at least a part of the first area and the second area are overlapped.

By performing the squeeze motion using such configured nozzle, the laundry can be effectively wet and the overall washing time can be shortened.

Control Method—Second Embodiment

Figure 63:
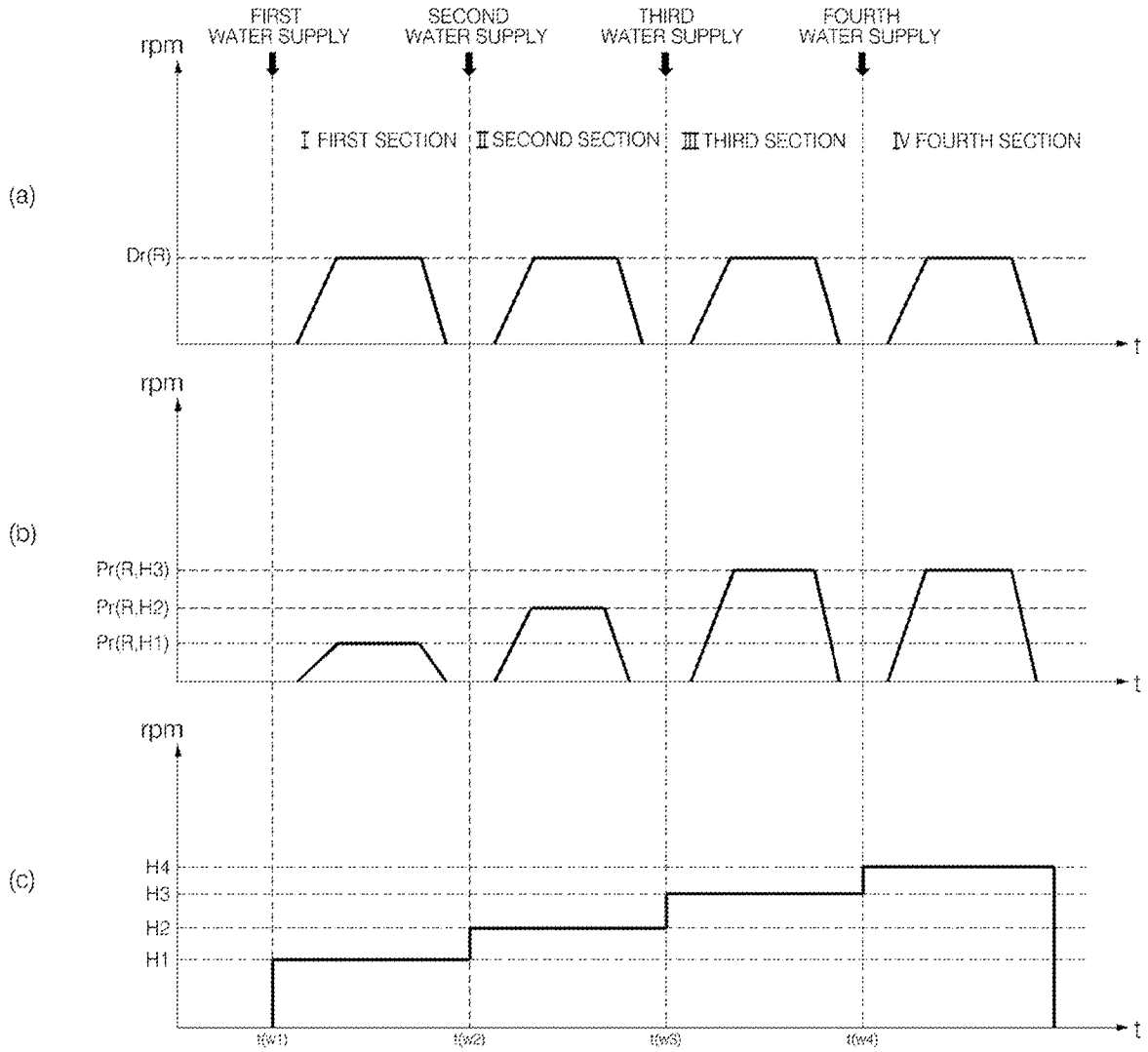
FIG. 63 is a view for explaining a control method of a washing machine according to another embodiment of the present invention.

FIG. 63 is a view for explaining a control method of a washing machine according to another embodiment of the present invention.

Referring to FIG. 63, the controller can control the washing motor so that the laundry in the drum 32 is raised by a first angle in the rotation direction of the drum 32 while being in contact with the side surface portion 321 of the drum 32.

The first angle may be an angle of less than 90 degrees. The controller may perform the rolling motion to rotate the drum 32 in one direction so that the laundry on the side surface portion 321 of the drum 32 falls from a position raised to a position corresponding to less than about 90 degrees of rotation angle of the drum 32.

Alternatively, the first angle may be an angle between 90 degrees and 130 degrees. The controller may perform the tumbling motion to rotate the drum 32 in one direction so that the laundry on the side surface portion 321 of the drum 32 falls from a position raised to a height higher than a position corresponding to less than 520 degrees of rotation angle of the drum 32.

The controller may accelerate the washing motor so that the laundry on the side surface portion 321 of the drum 32 is raised by the first angle while being in contact with the drum 32. After the drum 32 is rotated at a speed at which the laundry is raised without falling from the side surface portion 321 of the drum 32, the controller brakes the washing motor so that the laundry falls from the side surface portion 321, thereby performing the drop-inducing motion caused by braking.

The controller may set the first angle at which the laundry is raised while being in contact with the drum 32, differently for each drum driving motion, when performing the drop-inducing motion caused by braking. The first angle may be 30 to 45 degrees in the case of the swing motion. The first angle may be set to a value between 30 and 45 degrees in the case of the swing motion, between 139 and 150 degrees in the case of the scrub motion, and between 146 and 161 degrees in the case of the step motion.

Hereinafter, the process of controlling the washing motor by the controller so that the laundry in the drum 32 is raised by the first angle in the rotation direction of the drum 32 while being in contact with the side surface portion 321 of the drum 32 and then falls will be illustrated base on the case of the above mentioned rolling motion. However, in addition to the rolling motion, the tumbling motion, the step motion, the scrub motion, and the swing motion may be performed as the drum driving motion.

When controlling the washing motor so that the laundry in the drum 32 is raised by the first angle in the rotating direction of the drum 32 while being in contact with the side surface portion 321 of the drum 32, the controller may control the circulation pump motor 92 to rotate at a rotation speed set corresponding to the water level in the drum 32 so that the water is sprayed through the nozzle 610*c* and 610*d*.

Referring to FIG. 63, the controller may repeat the deceleration after accelerating the washing motor tip to a certain speed. This may correspond to the above-described tumbling motion or rolling motion.

The controller may control the water supply valve 94 such that the water level in the drum 32 is increased gradually when it is required to supply a certain amount of water or more into the drum 32, as in the main washing step.

The controller may control the water supply valve 94 to supply the detergent-dissolved water into the tub 31 so that the water level in the drum 32 reaches a first water level H1 (a first water supply).

The controller may control the water supply valve 94 so that the water level in the drum 32 reaches a second water level H2 higher than the first water level H1 (a second water supply).

The controller may control the water supply valve 94 so that the water level in the drum 32 reaches a third water level H3 higher than the second water level H2 (a third water supply).

The controller may control the water supply valve 94 so that the water level in the drum 32 reaches a fourth water level H4 higher than the third water level H3 (a fourth water supply).

The controller can set the circulation pump motor 92 to a I-section rotation speed Pr(R, H1), in a section I where the water level in the drum 32 is the first water level H1. The I-section rotation speed Pr(R, H1) can be set to 1800 to 2200 rpm (preferably 2000 rpm).

The controller can set the circulation pump motor 92 to a II section rotation speed Pr(R, H2) faster than the I section rotation speed Pr(R, H1), in a section II where the water level in the drum 32 is the second water level H2. The II-section rotation speed Pr(R, H2) can be set to 2250 to 2750 rpm (preferably 2500 rpm).

The controller can set the circulation pump motor 92 to a III section rotation speed Pr(R, H3) faster than the II section rotation speed Pr(R, H2), in a section III where the water level in the drum 32 is the third water level H3. The III-section rotation speed Pr(R, H3) can be set to 2520 to 3080 rpm (preferably 2800 rpm).

The controller can set the circulation pump motor 92 to the III section rotation speed Pr(R, H3), which is the maximum rotation speed based on the sensed laundry amount, in a section IV where the water level in the drum 32 is the fourth water level H4. That is, the controller can control the circulation pump motor 92 to maintain the maximum rotation speed without accelerating beyond the maximum rotation speed, even when the water level in the drum 32 is continuously increased by the additionally supplied water.

The controller can set the fourth water level H4 according to the sensed laundry amount.

The controller can set at least one of the first water level H1, the second water level H2, or the third water level H3 based on the set fourth water level H4. That is, when the fourth water level H4 is set, the controller can calculate the first water level H1, the second water level H2, and the third water level H3 according to a preset formula.

Alternatively, the controller may set at least one of the first water level H1, the second water level H2, or the third water level H3 according to the sensed laundry amount.

This makes it possible to sufficiently wet the laundry and effectively perform laundry by setting the water level in the drum to be higher 32 during washing as the amount of laundry is increased.

The controller may perform the first water supply (t=t(w1)) and perform the second water supply (t=t(w2)) after the set time. The time interval between the first water supply and the second water supply may be a preset value.

The controller may perform the second water supply (t=t(w2)) and perform the third water supply (t=t(w3)) after the set time. The time interval between the second water supply and the third water supply may be a preset value.

The controller may set the time interval between the first water supply and the second water supply to be different from the time interval between the second water supply and the third water supply.

For example, the controller can set the water supply time so that the time interval (tgap=t(w3)−t(w2)) between the second water supply and the third water supply has a value larger than the time interval (tgap=t(w2)−t(w1)) between the first water supply and the second water supply. This is because as the water level of the fluid in the drum 32 increases, the time required for washing may become longer.

Similarly, the controller may set the time interval between the third water supply and the fourth water supply to be different from the time interval between the first water supply and the second water supply, or the time interval between the second water supply and the third water supply.

This makes it possible to perform efficient washing in consideration of the water level of the fluid in each of the sections I to III.

The controller can change the rotation speed of the circulation pump motor 92 to correspond to the time point when the first water supply to the third water supply are performed. The controller can maintain the rotation speed based on the determination that the circulation pump motor 92 is rotating at the maximum rotation speed, when performing the fourth water supply.

The controller can set the rotation speed increase amount of the circulation pump motor based on the water supply amount during the first water supply to the third water supply. The controller can accelerate the circulation pump motor 92 at each time point of performing the first to the third water supply according to the set increase amount.

However, the rotation speed of the circulation pump motor 92 cannot exceed the maximum rotation speed set according to the sensed laundry amount. The controller can set the maximum rotation speed of the circulation pump motor 92 according to the amount of laundry a sensed in the laundry amount sensing step.

The controller can accelerate the circulation pump motor 92 step by step until reaching the set maximum rotation speed.

The controller can control to maintain the maximum rotation speed despite the change of the water level in the drum 32, after the circulation pump motor 92 reaches the maximum rotation speed.

Referring to FIG. 63, the water level in the drum 32 can be raised to the fourth water level H4 by the fourth water supply.

The controller can set the rotation speed of the circulation pump motor 92 to the maximum rotation speed Pr (R, H3) in the section IV in which the water level in the drum 32 is the fourth water level H4. That is, even when the water level in the drum 32 is continuously increased due to the additional water supply, the controller can control the circulation pump motor 92 not to accelerate beyond the maximum rotation speed.

During the last water supply in the washing step, in the present embodiment, during the fourth water supply, the controller can control the water supply valve 94 so that the fluid in which the bleaching agent or the fabric softening agent is dissolved flows into the tub 31.

Meanwhile, in each of the section I to the section IV, when the water level is decreased below the set water level (H1 to H4), the controller can perform additional water supply even in the middle of each section.

For example, when the washing motor is stopped, the water level in the drum 32 is sensed by using a sensor, and when it is determined that the water level in the drum 32 differs from a set water level by a preset value or more based on sensed information, the controller can control the water supply valve 94 so that water is additionally supplied into the drum 32.

The controller can control the circulation pump motor 92 in correspondence to the acceleration and deceleration of the washing motor, in each of the sections I to IV.

Alternatively, the controller may control the circulation pump motor 92 to rotate at a set speed for a certain time, in each of the sections I to IV. In this case, the circulation pump motor 92 may not necessarily be controlled in response to acceleration or deceleration of the washing motor.

When the water level in the drum 32 decreases below a certain height in each of the sections I to IV, the controller can brake the circulation pump motor 92 to prevent idle rotation. In this case, the controller can accelerate the circulation pump motor 92 again when the water level in the drum 32 reaches a certain height or more. As a result, idle rotation of the circulation pump motor 92 is prevented, and damage and noise of the motor can be prevented.

According to the control method of the washing machine according to the present embodiment, the water pressure sprayed through the nozzle 610*c* and 610*d* can be adjusted in response to the change in the water level in the drum 32, thereby improving the washing effect.

In addition, the laundry is washed by using the fluid having a high concentration while the water level of the drum 32 is maintained in a low water level, and then the laundry is washed by increasing the water level, so that the washing effect can be improved.

When the rotation speed of the circulation pump motor 92 is uniformly maintained at a high speed, the water level in the drum 32 is lowered and re-water supply is required. In this case, the water used for washing increases, or washing using fluid of high concentration can be difficult, According to the present embodiment, by changing the rotation speed of the circulation pump motor 92 according to the water level in the drum 32, it is possible to reduce the amount of water used for washing and to perform the high concentration washing at a low water level in the early stage of washing.

Further, when the water level in drum 32 becomes sufficiently high due to the added water supply, the water pressure sprayed through the nozzle can be improved, and the washing effect can be enhanced by the physical impact by the water pressure.

Further, by changing the amount of water added, the rotation speed of the pump motor, and the time difference between water supply according to the level of the fluid, efficient washing can be performed, thereby reducing the time required for the entire washing process.

Control Method—Third Embodiment

Figure 64:
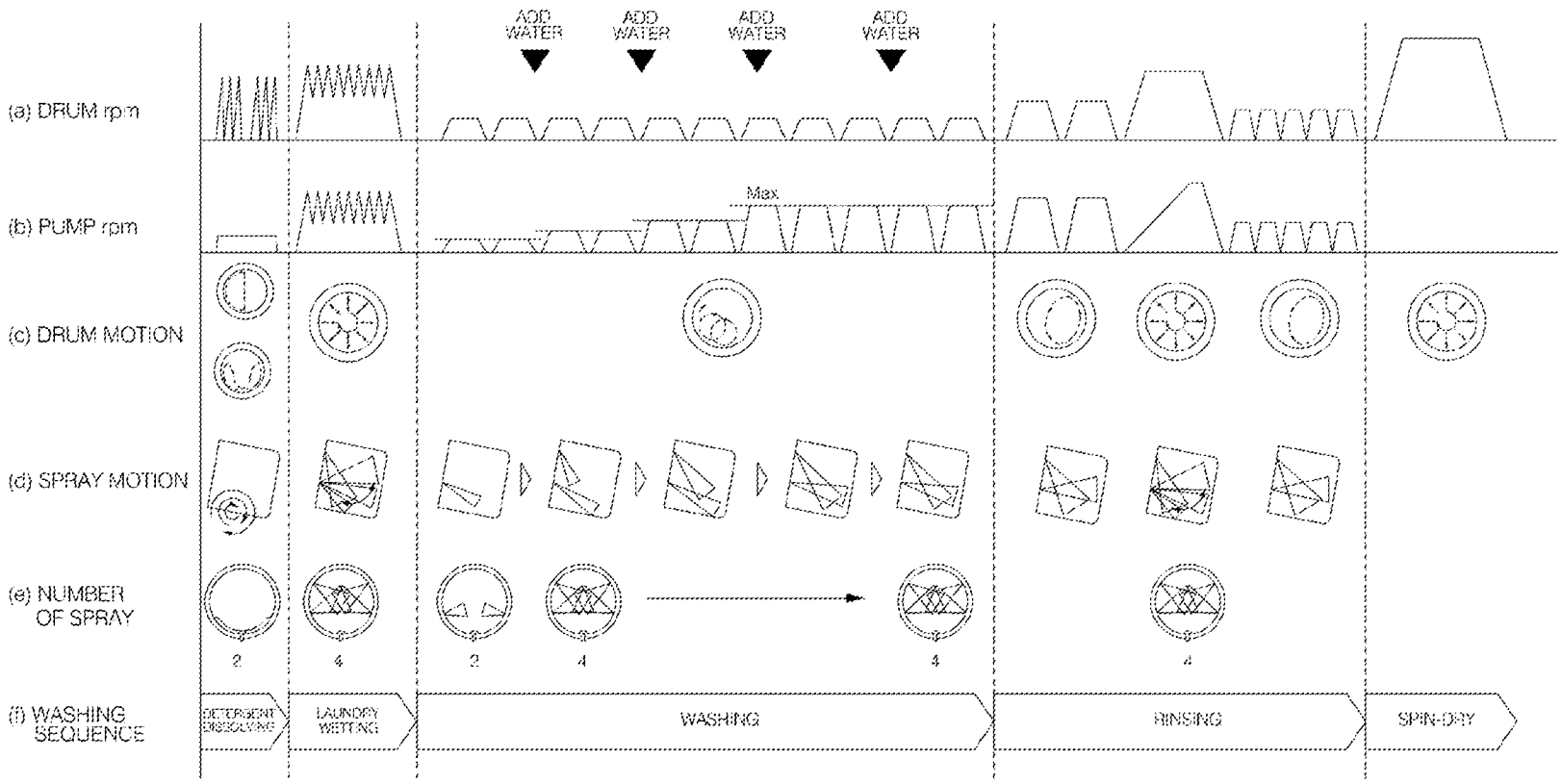
FIG. 64 is a view for explaining a control method of a washing machine according to another embodiment of the present invention.

FIG. 64 is a view for explaining a control method of a washing machine according to another embodiment of the present invention.

According to the third embodiment, the nozzle may include a pair of intermediate nozzles 610*b* and 610*e* and a pair of lower nozzles 610*c* and 610*d*. The nozzle may include a pair of intermediate nozzles 610*b* and 610*e*, a pair of lower nozzles 610*c* and 610*d*, and an upper nozzle 610*a*.

The tipper nozzle 610*a* may be a nozzle for supplying circulating water or a direct water nozzle for supplying water not mixed with detergent introduced through the water supply valve. Alternatively, the upper nozzle 61*a* may be a nozzle for supplying water mixed with a fabric softener when passing through the detergent container containing the fabric softener.

Hereinafter, the nozzle will be illustrated based on the case of the upper nozzle 610*a*, a pair of intermediate nozzles 610*b* and 610*e*, and a pair of lower nozzles 610*c* and 610*d*.

Referring to FIG. 64, first, the controller may perform a detergent dissolving step for dissolving the detergent in water. The controller can control the water supply valve 94 so that the water in which the detergent is dissolved flows into the tub 31.

In the detergent dissolving step, the controller CAN control the washing motor so that the laundry in the drum 32 is raised by a first angle in the rotation direction of the drum 32 while being in contact with the side surface portion 321 of the drum 32 (See FIGS. 64(*a*) and 64(*c*)).

Referring to FIGS. 64(*a*) and 64(*c*), in the detergent dissolving step according to the present embodiment, the controller can perform the step motion or the scrub motion. The controller can perform the step motion or the scrub motion by controlling the rotation speed of the washing motor as described in the detailed description of the step motion and the scrub motion.

In the detergent dissolving step, the controller can set the circulation pump motor 92 to a certain speed or less.

The controller can control the circulation pump motor 92 to rotate at a certain speed or less so that water sprayed into the drum 32 through the nozzle 610*b*, 610*c*, 610*d*, and 610*e* flows along the side surface portion 321 of the drum 32. The controller can control the circulation pump motor 92 to rotate at a second rotation speed at which the water sprayed from the nozzle 610*b*, 610*c*, 610*d* and 610*e* flows along the front surface of the drum 32 toward the lowermost point of the side surface portion 321

When the circulation pump motor 92 rotates at the second rotation speed, the water that has been sent through the circulation pump motor 92 is sprayed through the lower nozzle 610*c* and 610*d*, but may not reach the intermediate nozzle 610*b* and 610*e*. When the circulation pump motor 92 rotates at the second rotation speed, the water sprayed through the lower nozzle 610*c* and 610*d* flows along the gasket 601, and flows along the side surface portion 321 of the drum 32.

Alternatively, the controller may set the circulation pump motor 92 to the second rotation speed so that water is sprayed to the front portion of the side surface portion 321 of the drum 32 through the nozzle 610*b*, 610*c*, 610*d*, and 610*e*. The front portion on the side surface portion 321 of the drum 32 can be defined as a portion closer to the front surface of the drum 32 than the rear surface portion 322 on the side surface portion 321 of the drum 32. That is, referring to FIG. 45, the front portion on the side surface portion 321 of the drum 32 can be defined as a side surface portion 321 close to the nozzle 610*b*, 610*c*, 610*d*, and 610*e* based on M(½L).

The second rotation speed may be set to 1500 rpm or less. The second rotation speed may preferably be set to 1300 rpm.

By performing such configured detergent dissolving step, the detergent can be effectively dissolved in water in the early stage of washing, so that the washing effect can be enhanced in the subsequent washing step.

In addition, even when the amount of water in the drum is not sufficient in the early stage of washing, the circulation pump motor can be rotated to effectively dissolve the detergent.

The controller may perform the laundry wetting step following the detergent dissolving step. The controller can control the water supply valve 94 so that water is additionally introduced into the tub 31 in the laundry wetting step.

The controller can perform the above-described squeeze motion in the wetting step. The controller can set the rotation speed of the circulation pump motor 92 so that water is sprayed into the drum 32 through the four nozzles 610*b*, 610*c*, 610*d*, and 610*e* when the squeeze motion is performed in the wetting step.

The controller can control the circulation pump motor 92 or the water supply valve so that water is sprayed into the drum 32 through the upper nozzle 610*a* in the wetting step. For example, when the upper nozzle 610*a* is connected to the circulation pump motor 92 and water is sprayed, the controller can control the circulation pump motor 92 so that water is sprayed through the upper nozzle 610*a*. For example, the controller can open the water supply valve when the upper nozzle 610*a* is a direct water nozzle.

Referring to FIG. 64, when performing the squeeze motion, the controller can control the circulation pump motor 92 at a rotation speed of a certain value or more which causes water to be sprayed through the pair of intermediate nozzles 610*b* and 610*e* and the pair of lower nozzles 610*c* and 610*d*.

For example, when performing the squeeze motion, the controller can control the circulation pump motor 92 within the range of the rotation speed of 1400 to 3300 rpm (preferably to 3000 rpm).

When performing the squeeze motion, the controller can accelerate the rotation speed of the circulation pump motor 92 and then decelerate within the range of the rotation speed of 1600 to 3000 rpm. The controller can repeatedly perform the process of accelerating and then decelerating the circulation pump motor 92 within the rotation speed range during operation of the squeeze motion.

The nozzle 610*b*, 610*c*, 610*d* and 610*e* may be configured in such a manner that the water sprayed from the pair of intermediate nozzles 610*b* and 610*e* and the pair of lower nozzles 610*c* and 610*d* has an area overlapped with each other when viewed from the opened front side of the drum 32. That is, the nozzle 610*b*, 610*c*, 610*d* and 610*e* can form the water sprayed from the pair of the intermediate nozzles 610*b* and 610*e* and the pair of the lower nozzles 610*c* and 610*d* into a butterfly shape, when viewed from the opened front side of the drum 32.

In the washing machine provided as above, as the rotation speed of the circulation pump motor 92 is repeatedly accelerated and decelerated by the controller, based on the opened front side of the drum 32, the area where the water flows sprayed from the nozzle 610*b*, 610*c*, 610*d*, and 610*e* are overlapped with each other is increased and decreased repeatedly, and water can be uniformly sprayed into the drum 32.

Particularly, in the squeeze motion, the laundry is repeatedly brought into close contact with the side surface portion 321 of the drum 32 and is separated. Thus, by controlling the circulation pump motor 92 in response to such a flow of the laundry, the water sprayed through the nozzle 610*b*, 610*c*, 610*e* can effectively wet the laundry.

In addition, there is an advantage that a user can feel a sense of aesthetics.

The controller may perform the main washing step, after the laundry wetting step.

Referring to FIG. 63 and FIG. 64, the controller may decelerate the washing motor after accelerating the washing motor, in a state where the water level in the drum 32 is the first water level H1. The controller can decelerate the circulation pump motor 92 after accelerating the circulation pump motor 92 in a state where the water level in the drum 32 is the first water level H1.

Referring to FIG. 63, the controller can control the water supply valve 94 to supply the detergent-dissolved water into the tub 31 so that the water level in the drum 32 reaches the first water level H1 (a first water supply).

The controller can control the water supply valve 94 so that the water level in the drum 32 reaches the second water level 12 higher than the first water level H1 (a second water level).

The controller can control the water supply valve 94 so that the water level in the drum 32 reaches the third water level H3 which is higher than the second water level H2 (a third water level).

The controller can control the water supply valve 94 so that the water level in the drum 32 reaches the fourth water level H4 higher than the third water level H3 (a fourth water level). The controller can control the water supply valve 94 so that the water in which detergent such as a fabric softener is dissolved is introduced through the tipper nozzle 610*a*, during the last water supply of the main washing step.

For example, while being connected to a washing tub accommodating the fabric softener or like, water may be supplied to the washing tub through the water supply valve 94 to be mixed with the fabric softener, and the water mixed with the fabric softener may be supplied into the drum through the tipper nozzle 610*a* 32. In this case, the controller may control the water supply valve 94 to spray water mixed with the fabric softener through the upper nozzle 610*a* during the last water supply of the main washing step.

Meanwhile, referring to FIG. 10 and FIG. 64, when water is sprayed into the drum 32 from the upper nozzle 610*a*, the pair of intermediate nozzles 610*b* and 610*e*, and the pair of lower nozzles 610*c* and 610*d*, the sprayed water current can form a star shape when viewed from the opened front of the drum 32.

In this regard, the water level in the drum 32 can be lowered as the water introduced into the drum 32 is absorbed into the laundry in the laundry wetting step, and when the circulation pump motor 92 is operated at a certain speed or more in a state in which the water level in the drum 32 is low, an idle rotation may occur instead of a normal rotation, resulting in noise or damage to the apparatus.

The controller can control the circulation pump motor 92, in the rotation speed range of the section I rotation speed Pr(R, H1) or less, in the section I where the water level in the drum 32 is the first water level H1.

Thus, by controlling the spraying amount sprayed through the nozzle, the circulation pump motor 92 can be effectively controlled even when the water level in the drum is low. That is, by a maintaining the spraying amount to be low when the water level in the drum is low, the idling rotation of the motor can be prevented.

Referring to (d) and (e) of FIG. 64, when the circulation pump motor 92 rotates at the section I rotation speed Pr (R, H1), the pair of lower nozzles 610*c* and 610*d* So that water can be sprayed into the drum 32. That is, when the circulation pump motor 92 rotates at the section I rotation speed Pr(R, H1), the pressure provided by the circulation pump motor 92 may not be enough for the water to be raised to the intermediate nozzle 610*b* and 610*e* and sprayed.

The section I rotation speed Pr(R, H1) may be set to 1800 to 2200 rpm (preferably 2000 rpm).

The controller can control the circulation pump motor 92 in the range of the rotation speed of the section II rotation speed Pr(R, H2) or less, in the section II where the water level in the drum 32 is the second water level H2. The section II rotation speed Pr(R, H2) may be a value higher than the section I rotation speed Pr(IR, H1).

Referring to (d) and (e) of FIG. 64, when the circulation pump motor 92 rotates at the section II rotation speed Pr(R, H2), water can be sprayed into the drum 32 through the pair of intermediate nozzles 610*b* and 610*e* and the pair of lower nozzles 610*c* and 610*d*. That is, when the circulation pump motor 92 rotates at the section II rotation speed Pr(R, H2), a sufficient pressure can be provided by the circulation pump motor 92 so that the water can be raised to the intermediate nozzle and sprayed.

The controller can set the circulation pump motor 92 to the section II rotation speed Pr(R, H2) so that the water current sprayed from the nozzle 610*b*, 610*c*, 610*d*, and 610*e* can form a butterfly shape, as described above in the laundry wetting step, and be uniformly sprayed to the side surface portion 321 of the drum 32.

The section II rotation speed Pr(R, H2) may be set to 2250 to 2750 rpm (preferably, 2500 rpm).

The controller can control the circulation pump motor 92 in the range of the rotation speed of the section III rotation speed Pr(R, H3) or less, in the section III where the water level in the drum 32 is the third water level H3. The section III rotation speed Pr(R, H3) may be set to a value larger than the section II rotation speed Pr(R, H2).

Referring to (d) and (e) of FIG. 64, when the circulation pump motor 92 rotates at the section III rotation speed Pr(R, H3), water can be sprayed into the drum 32 through the pair of intermediate nozzles 610*b* and 610*e* and the pair of lower nozzles 610*c* and 610*d*.

The section III rotation speed Pr(R, H3) may be set to 2520 to 3080 rpm (preferably, 2800 rpm).

The controller can control the circulation pump motor 92, in the rotation speed range of the section III rotation speed Pr(R, H3) or less which is the maximum rotation speed, in the section IV where the water level in the drum 32 is the fourth water level H4. That is, even when the water level in the drum 32 continuously increases due to the additional water supply, the controller can maintain the rotation speed of circulation pump motor 92 without accelerating beyond the maximum rotation speed.

The controller can set the fourth water level H4 according to the sensed laundry amount.

The controller can set at least one of the first water level H1, the second water level H2, and the third water level H3 based on the set fourth water level H4. That is, when the fourth water level H4 is set, the controller can calculate the first water level H1, the second water level H2, and the third water level H3 according to a preset formula.

Alternatively, the controller may set at least one of the first water level H1, the second water level H2, and the third water level H3 according to the sensed laundry amount.

Thus, the water level in the drum 32 during washing can be set to be higher as the amount of laundry is increased, so that the laundry can be sufficiently wet and laundry can be effectively performed.

The controller may perform the first water supply (t=t(w1)), and perform the second water supply (t=t(w2)) after the set time. The time interval between the first water supply and the second water supply may be a preset value.

The controller can perform the second water supply (t=t(w2)), and perform the third water supply after the set time (t=t(w3)). The time interval between the second water supply and the third water supply may be a preset value.

The controller may set the time interval between the first water supply and the second water supply to be different from the time interval between the second water supply and the third water supply.

For example, the controller can set the time point of water supply in such a manner that the time interval (tgap=t(w3)−t(w2)) between the second water supply and the third water supply has a larger value than the time interval (tgap=t(w2)−t(w1)) between the first water supply and the second water supply. This is because as the water level of the fluid in the drum 32 increases, the time required for washing may become longer.

Similarly, the controller can set the time interval between the third water supply and the fourth water supply to be different from the time interval between the first water supply and the second water supply, or the time interval between the second water supply and the third water supply.

This makes it possible to perform efficient washing in consideration of the water level of the fluid in each of the sections I to IV.

The controller can change the rotation speed of the circulation pump motor 92 in correspondence with the time point when the first water supply to the third water supply are performed. The controller can maintain the rotation speed based on the determination that the circulation pump motor 92 rotates at the maximum rotation speed, at the time point of performing the fourth water supply.

The controller can set the rotation speed increase amount of the circulation pump motor 92, based on the water supply amount during the first water supply to the third water supply. The controller can accelerate the circulation pump motor 92 at each time point of performing the first to the third water supply according to the set increase amount.

However, the rotation speed of the circulation pump motor 92 cannot exceed the maximum rotation speed set according to the sensed laundry amount. The controller can set the maximum rotation speed of the circulation pump motor 92 according to the amount of laundry sensed in the laundry amount sensing step.

The controller can accelerate the circulation pump motor 92 step by step until it reaches the set maximum rotation speed.

After the circulation pump motor 92 reaches the maximum rotation speed, the controller can control the circulation pump motor 92 to maintain the maximum rotation speed despite the change of the water level in the drum 32.

Referring to FIG. 63, the water level in the drum 32 can be raised to the fourth water level H4 by the fourth water supply.

The controller can set the rotation speed of the circulation pump motor 92 to the maximum rotation speed Pr(R, H3), in the section IV where the water level in the drum 32 is the fourth water level H4. That is, even when the water level in the drum 32 continuously increases due to the additional water supply, the controller can maintain the rotation speed of circulation pump motor without accelerating beyond the maximum rotation speed.

During the last water supply in the washing step, i.e., in the fourth water supply in the present embodiment, the controller can control the water supply valve 94 so that the fluid in which the bleach is dissolved is introduced into the tub 31 through the tipper nozzle 610*a*.

Meanwhile, referring to FIG. 10 and FIG. 64, when water is sprayed into the drum 32 from the upper nozzle 610*a*, the pair of intermediate nozzles 610*b* and 610*e*, and the pair of lower nozzles 610*c* and 610*d*, the sprayed water current can form a star shape when viewed from the front of the drum 32 opened.

According to the control method of the washing machine according to the present embodiment, the intensity of water sprayed through the nozzle 610*b*, 610*c*, 610*d*, and 610*e* can be adjusted in response to the change in the water level in the drum 32, thereby improving washing effect.

In addition, the laundry can be washed by using the fluid having a high concentration while the water level in the drum 32 is maintained in a low level, and then the water level can be increased to wash the laundry, so that the washing effect can be improved.

When the rotation speed of the circulation pump motor 92 is uniformly maintained at a high speed, the water level in the drum 32 is lowered and re-water supply is required. In this case, the water used for washing may increase, or washing using a high concentration fluid may be difficult. According to the present embodiment, by changing the rotation speed of the circulation pump motor 92 according to the water level in the drum 32, it is possible to reduce the water amount used for washing and to perform the high concentration washing at a low water level in the early stage of washing.

In addition, when the water level in the drum 32 becomes sufficiently high due to the additional water supply, the water pressure sprayed through the nozzle 610*b*, 610*c*, 610*d*, and 610*e* may be increased, and the washing effect may be enhanced by physical impact by water pressure.

Further, by changing the amount of water added according to the level of the fluid, the rotation speed of the pump motor, and the time difference between water supplies, efficient washing can be performed, thereby reducing the time required for the entire washing process.

The controller may perform the rinsing step, after the main washing step.

In the rinsing step, the controller can perform the tumbling motion and the filtration motion described above. The controller may perform the filtration motion after performing the tumbling motion, or perform the tumbling motion after performing the filtration motion.

Alternatively, the controller may alternately perform the tumbling motion and the filtration motion alternately, or may combine the two.

Referring to FIG. 64, in the present embodiment, the controller can perform tumbling motion in the rinsing step.

The controller can control the circulation pump motor 92 to accelerate or decelerate in response to the acceleration or deceleration of the washing motor so that water is sprayed into the drum 32 through the nozzle 610*b*, 610*c*, 610*d* and 610*e* during operation of the tumbling motion.

The controller can perform the filtration motion after performing the tumbling motion. During operation of the filtration motion, the controller can accelerate the circulation pump motor 92 at a preset acceleration slope in response to the acceleration of the washing motor, so that the spraying range of the water sprayed through the nozzle 610*b*, 610*c*, 610*d*, and 610*e* can be changed.

After performing the filtration motion, the controller can perform the tumbling motion again.

During operation of the rinsing step, the controller can control the circulation pump motor 92, within the range of the rotation speed at which water is sprayed through the pair of intermediate nozzles 610*b* and 610*e* and the pair of lower nozzles 610*c* and 610*d*.

For example, the controller can control the circulation pump motor 92 to maintain the rotation speed of 2400 rpm or more for a certain time, during the tumbling motion. The controller can control the circulation pump motor 92 to set the maximum rotation speed to 2400 rpm or more or to maintain the rotation speed of 2400 rpm or more, during the filtration motion.

Accordingly, in the rinsing step, water is sprayed into the drum 32 over a larger area through the nozzles 610*b*, 610*c*, 610*d*, and 610*e*, thereby enhancing the rinsing effect and reducing the overall washing time.

The control method of the washing machine configured as described above can generate fluid of a high concentration by effectively dissolving the detergent in the early stage of washing, thereby improving the washing effect.

In addition, during the laundry wetting step to the rinsing step, water is uniformly sprayed to the inside of the drum 32 through the pair of intermediate nozzles 610*b* and 610*e* and the pair of lower nozzles 610*c* and 610*d* so that a laundry wetting effect can be improved, and a washing effect or a rinsing effect can be improved by applying water pressure to the laundry during washing.

In addition, in the main washing step, the water level in the drum 32 is gradually increased through several times of water supply, so that the laundry is washed with a high concentration of fluid in the early stage of washing, and a large amount of fluid can be used to increase the washing effect by using the falling effect in the latter half of the washing.

In addition, in the main washing step, the rotation speed of the circulation pump motor 92 is increased in correspondence with the fluid level, so that the laundry is effectively washed by the physical impact caused by the water current sprayed from the nozzles 610*b*, 610*c*, 610*d* and 610*e*.

Figure 65:
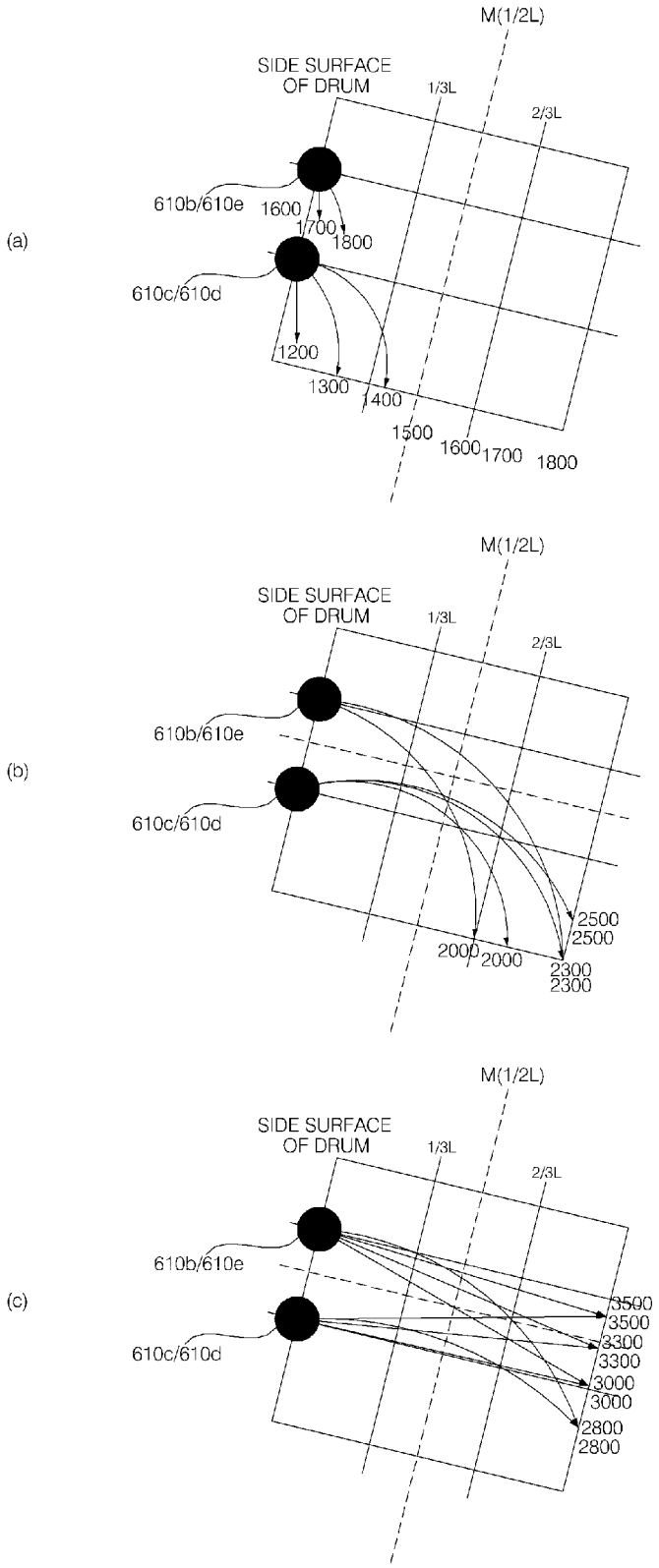
FIG. 65 is a view for explaining a spraying range of a nozzle according to the rotation speed of a pump motor according to another embodiment of the present invention.

FIG. 65 is a view for explaining a spraying range of a nozzle according to the rotation speed of a pump motor according to another embodiment of the present invention.

FIG. 65 shows the spraying range of the water current sprayed from the intermediate nozzle 610*b*, 610*e* and the lower nozzle 610*c*, 610*d* which spray water into the drum 32 as the circulation pump motor 92 rotates. In this case, the upper nozzle 610*a* may be a direct water nozzle, which is not connected to the circulation pump motor 92, but allows the water introduced through the water supply valve 94 to flow into the drum 32.

When a first area, a second area, and a third area are defined in order from the front side by trisecting the drum 32 viewed from the side, it can be seen that the water sprayed from the nozzle 610*b*, 610*c*, 610*d*, and 610*e* reaches the deeper position of the drum 32, as the rotation speed of the circulation pump motor 92 gradually increases.

As shown in the drawing, when the rotation speed of the circulation pump motor 92 is 1300 rpm, the water current sprayed from the nozzle 610*b*, 610*c*, 610*d*, and 610*e* reaches the first area of the side surface portion 321 of drum 32. In the case of 2000 rpm, the water current sprayed from the intermediate nozzle 610*b*, 610*e* reaches the second area, and the water current sprayed from the lower nozzle 610*c*, 610*d* reaches the third area. In the case of 2300 rpm, the water current sprayed from the nozzle 610*b*, 610*c*, 610*d*, and 610*e* reaches the third area.

When the rotation speed of the circulation pump motor 92 is further increased, the water current reaches the rear surface portion 322 of the drum 32. In the case of 3000 rpm, the water current reaches ⅓ of the height H of the drum 32. In the case of 3500 rpm, the water current reaches ⅔ of the height H of the drum 32. When the rotation speed of the circulation pump motor 92 reaches 3500 rpm, the height reached by the water current becomes the maximum, and, based on the structure of the nozzles 83*a* and 83*b*, the spraying height cannot be increased any more, but can strengthen only the intensity of water current.

Control Method—Fourth Embodiment

Figure 66:
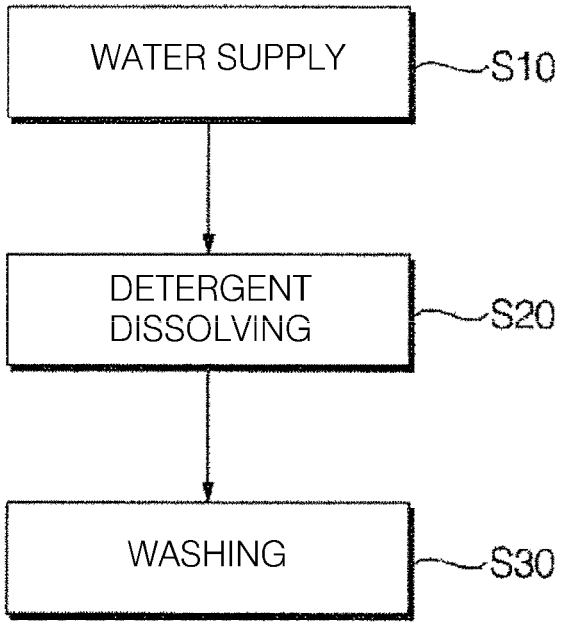
FIG. 66 is a flowchart illustrating a method of controlling a washing machine according to another embodiment of the present invention.
Figure 67:
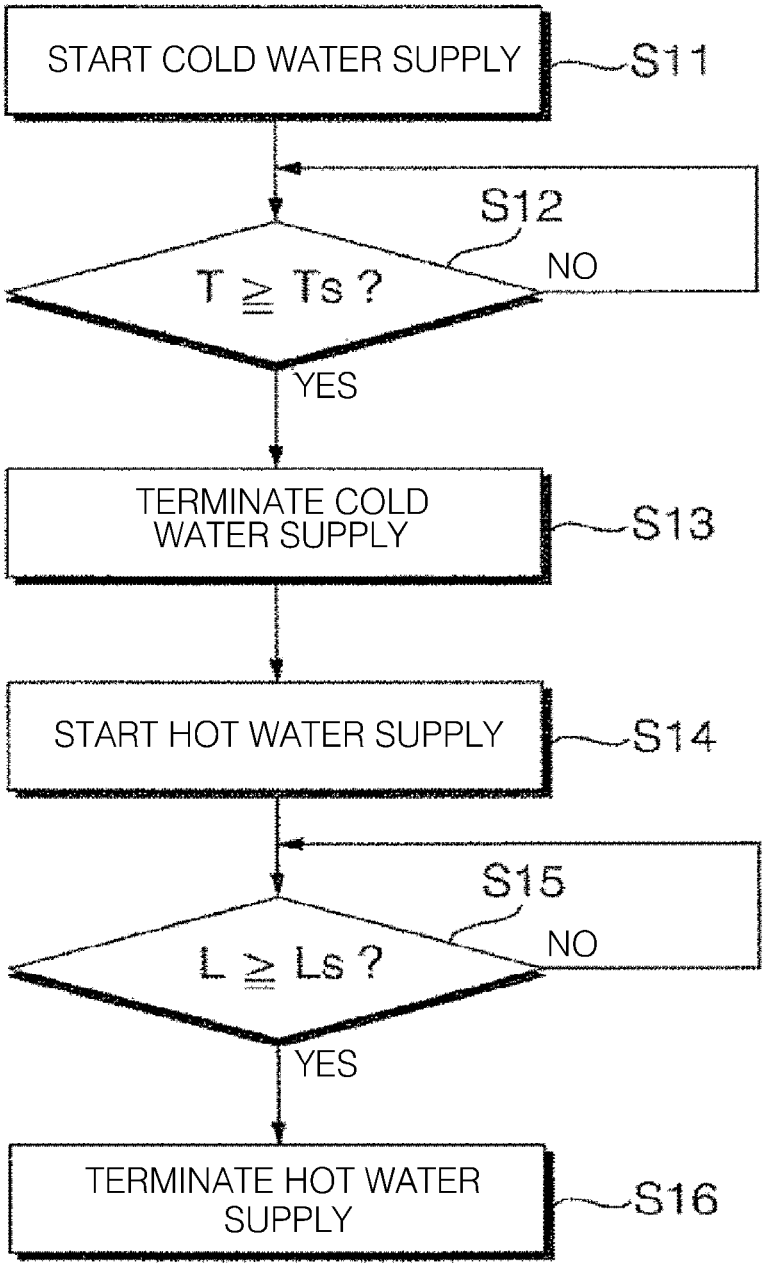
FIG. 67 is a flowchart showing an embodiment of a water supply step S10 shown in FIG. 66.
Figure 68:
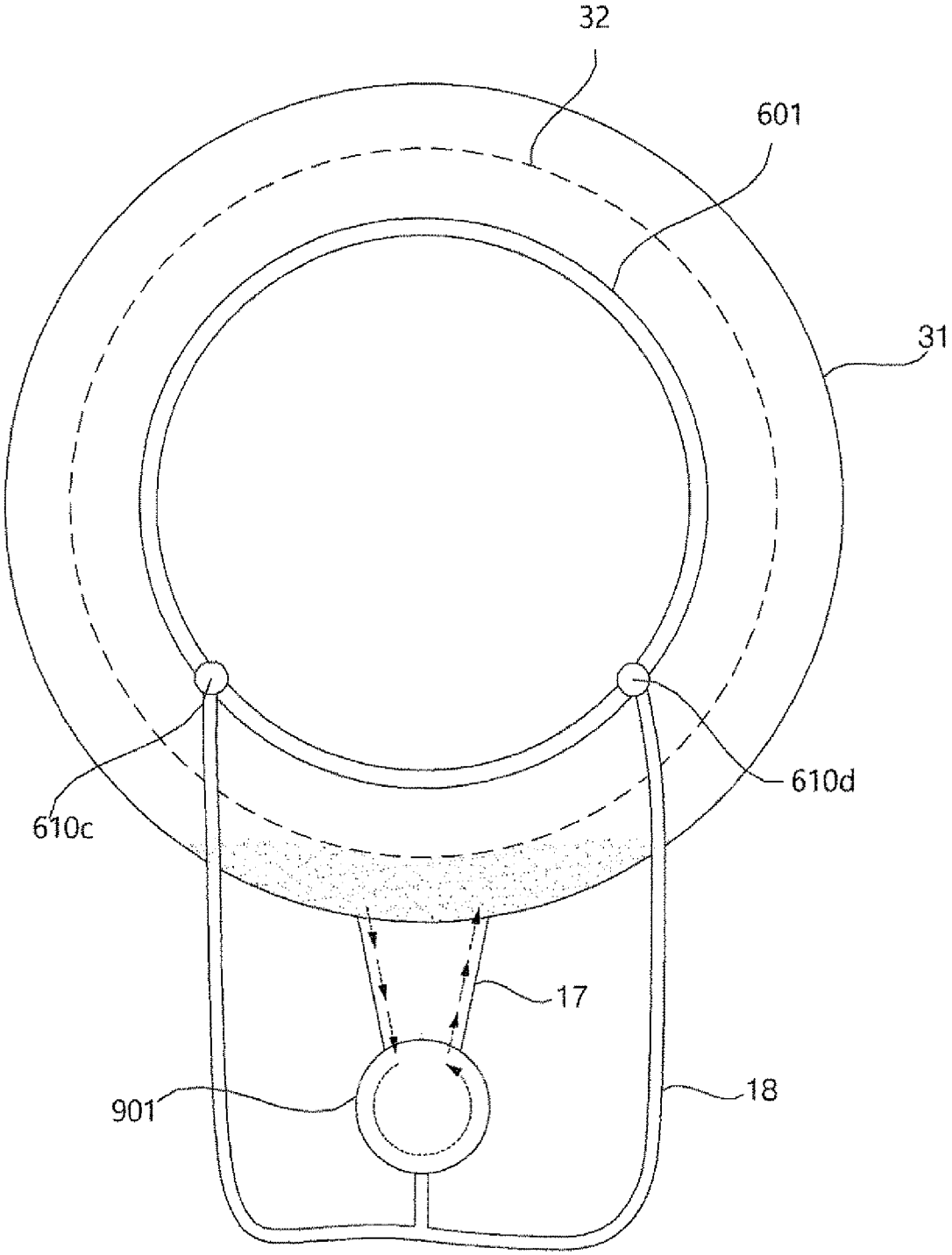
FIG. 68 schematically shows a main part of a washing machine according to another embodiment of the present invention.
Figure 69:
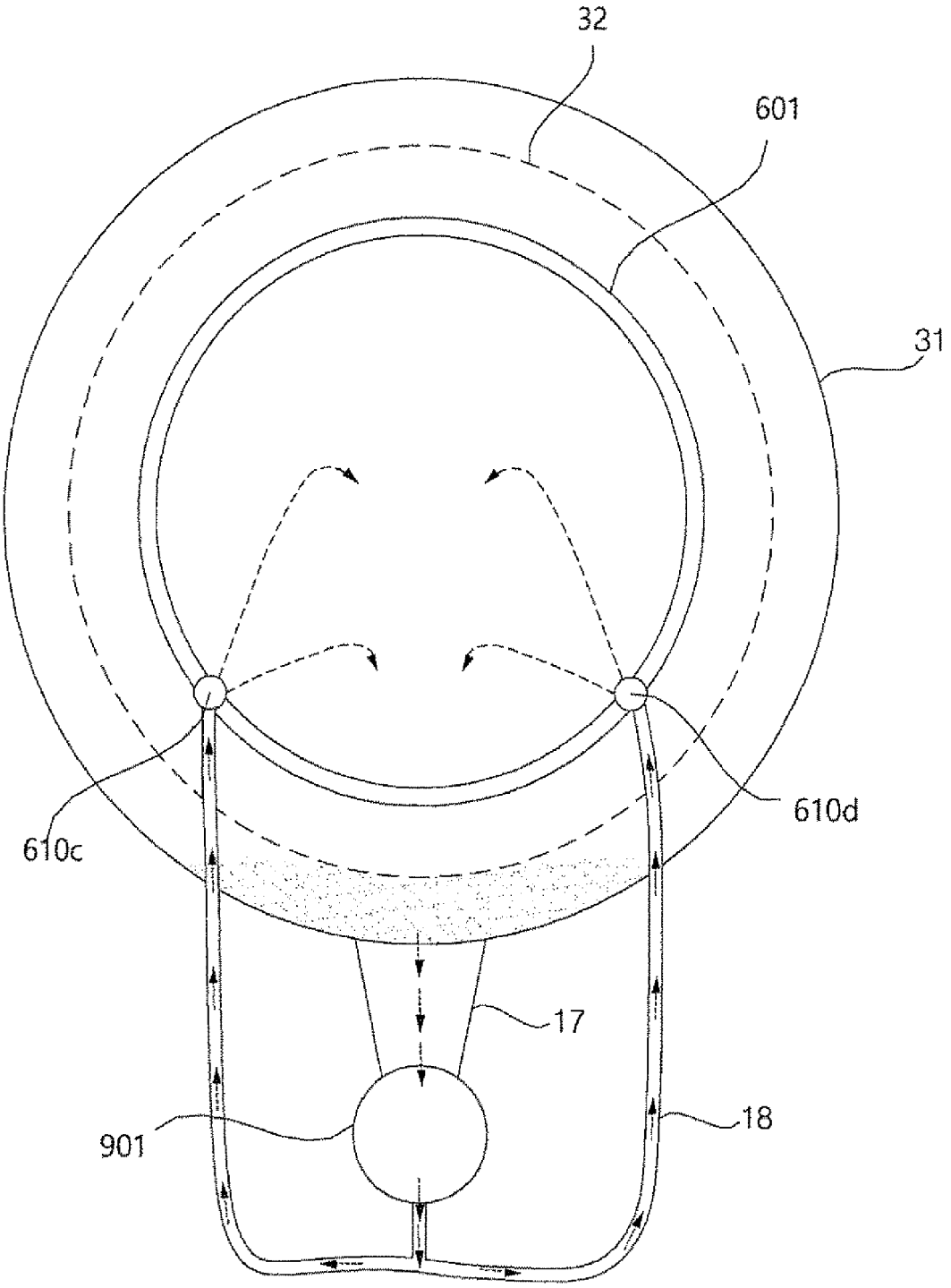
FIG. 69 schematically shows a main part of a washing machine according to another embodiment of the present invention.
Figure 70:
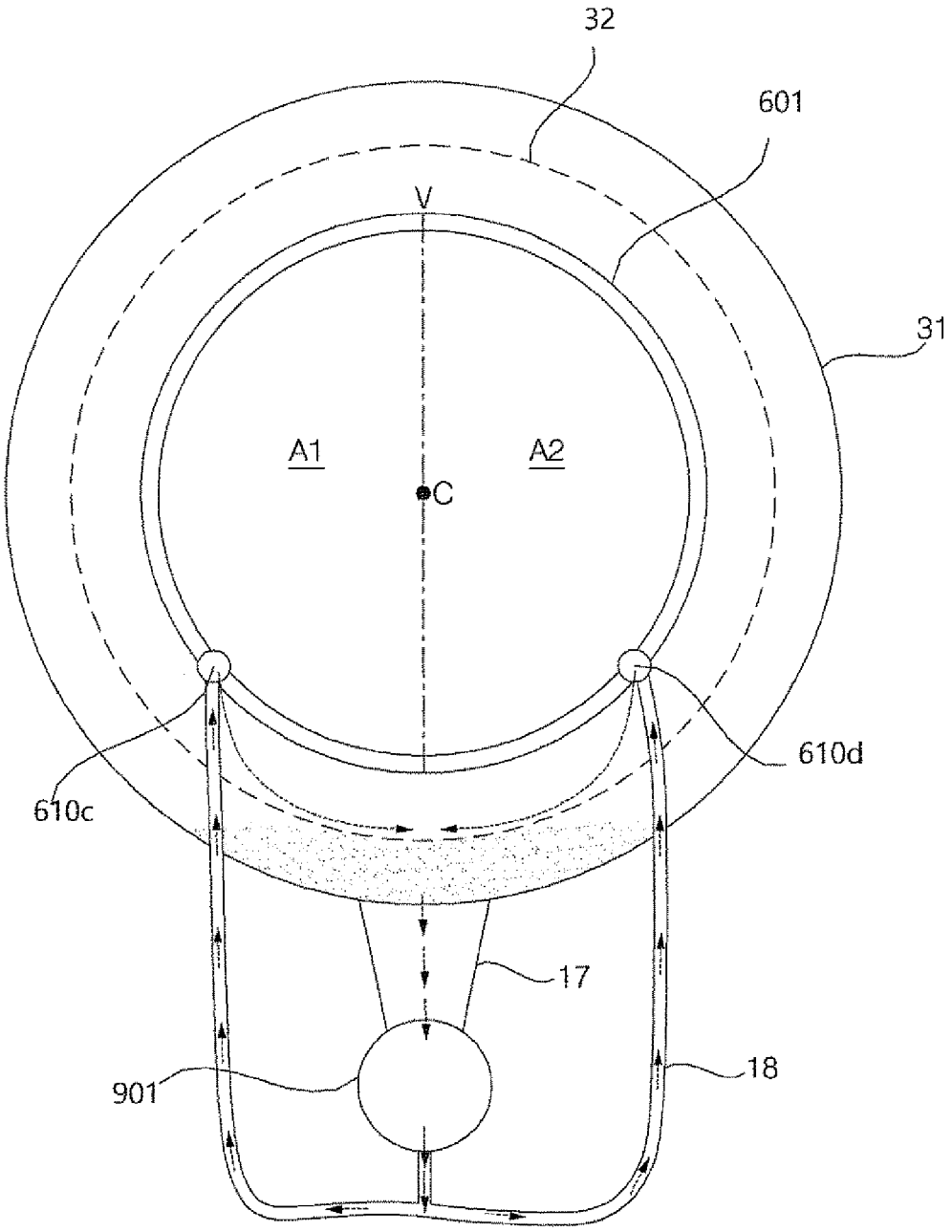
FIG. 70 schematically shows a main part of a washing machine according to another embodiment of the present invention.
Figure 71:
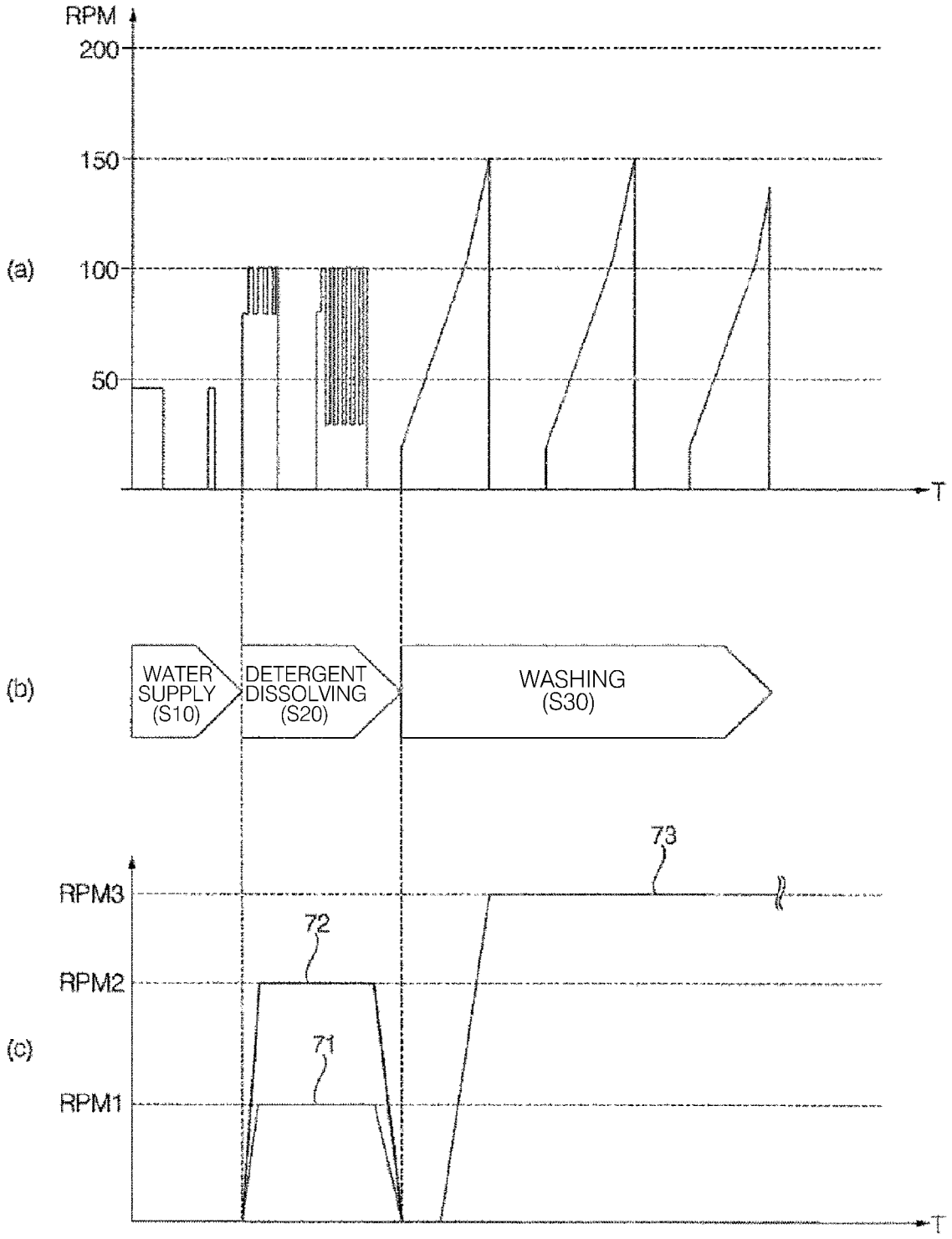
FIG. 71 shows a speed change (a) of an inner tank, a proceeding sequence (b) of each step forming the control method, and a speed change (c) of a pump, in the method of controlling a washing machine according to another embodiment of the present invention.

FIG. 66 is a flowchart illustrating a method of controlling a washing machine according to another embodiment of the present invention. FIG. 67 is a flowchart showing an embodiment of a water supply step S10 shown in FIG. 66. FIG. 68 schematically shows a main part of a washing machine according to another embodiment of the present invention, and more particularly, shows an example of a flow induced in the detergent dissolving step S20. FIG. 69 schematically shows a main part of a washing machine according to another embodiment of the present invention, and more particularly, shows an example of a flow induced in the washing step S30. FIG. 70 schematically shows a main part of a washing machine according to another embodiment of the present invention, and more particularly, shows an example of a flow induced in the detergent dissolving step S20. FIG. 71 shows a speed change (a) of an inner tank, a proceeding sequence (*b*) of each step forming the control method, and a speed change (c) of a pump, in the method of controlling a washing machine according to another embodiment of the present invention.

The control method of the washing machine according to a fourth embodiment of the present invention will illustrated based on a configuration in which the nozzle includes the lower nozzle 610*c* and 610*d*. However, the control method of the washing machine according to the fourth embodiment is applicable not only to the washing machine including the nozzle configured only of the lower nozzle 610*c* and 610*d*, but it is intended just for convenience of explanation. Hence, it can be understood that the control method of the washing machine according to the fourth embodiment can be equally applicable to a washing machine including the above mentioned plurality of nozzles 610*a*, 610*b*, 610*c*, 610*d*, and 610*e*.

The method for controlling the washing machine according to the fourth embodiment described below is for explaining an example of the detergent control method described in the control method of the washing machine according to the first to third embodiments described above in more detail.

The method of controlling a washing machine according to an embodiment of the present invention includes a step of controlling at least one water supply valve to supply water into the tub 31, a step of operating the pump 901 at a first speed RPM1 (see (c) in FIG. 71) at which the water sent by the pump 901 cannot reach at least one nozzle 610*c*, 610*d*, and a step of operating the pump 901 at a second speed RPM3 (see (c) in FIG. 71) at which the water sent by the pump 901 is sprayed through at least one nozzle 610*c*, 610*d*.

More specifically, referring to FIG. 66, the method of controlling a washing machine according to an embodiment of the present invention may include the water supply step S10, the detergent dissolving step S20, and the washing step S30.

The water supply step S10 is a step of supplying water into the tub 31. The water is supplied to the dispenser 35 through a valve assembly, and the detergent contained in the detergent accommodating portion of the dispenser 35 is supplied into the tub 31 together with the water.

Referring to FIG. 67, the water supply step S10 includes steps S11, S12, and S13 of opening a cold water valve for a preset time to supply cold water, and steps S14, S15, and S16 of opening a hot water valve to supply hot water after the preset time is elapsed.

More specifically, the cold water valve is opened, and cold water is supplied to the dispenser 35 (S11). The cold water thus supplied is supplied to the detergent accommodating portion of the dispenser 35, and is guided along the water supply bellows 37 together with the detergent contained in the detergent accommodating portion and is supplied into the tub 31.

The controller 91 determines whether a time T during which the cold water is supplied exceeds a preset time Ts (S12). If it is determined that the time T exceeds the preset time Ts, the controller 91 may close the cold water valve to terminate the cold water supply (S13).

Thereafter, the hot water valve is opened, and hot water is supplied to the dispenser 35 (S14). The hot water thus supplied is supplied to the detergent accommodating portion of the dispenser 35. Since the detergent contained in the detergent accommodating portion is already supplied to the tub 31 together with the cold water during the cold water supply (S11, S12, S13), the hot water is not supplied together with the detergent.

Meanwhile, the washing machine may include a water level sensor for sensing the water level L in the tub 31. The controller 91 may determine whether the water level L sensed by the water level sensor has reached a preset water level Ls (S12). If it is determined that the water level L has reached the preset water level Ls, the controller 91 may close the hot water valve to terminate the hot water supply (S16). The set water level Ls may be set within a range which the drum 32 cannot reach, but it is not necessarily limited thereto, and may be set slightly higher than the lowermost point of the drum 32. Referring to (a) in FIG. 71, during the water supply, the washing motor is rotated at about 50 rpm. At this time, the laundry in the drum 32 may be raised, by the lifter 45, to a height corresponding to a rotation angle of the drum 32, approximately, 90 to 110 degrees, and then dropped.

The amount of water supplied until completion of the water supply is preferably about 0.7 to 1.0 L, but is not limited thereto.

After the water supply is completed, the detergent dissolving step S20 may be performed. In the detergent dissolving step S20, the pump 901 is operated, but the water sent by the pump 901 is not discharged through the nozzle 610*c*, 610*d*. Referring to FIG. 68, the outlet of the pump is positioned below the outlet of the nozzle 610*c*, 610*d*. Therefore, in order that the water sent through the pump 901 is discharged through the nozzles 610*c*, 610*d*, the water pressure discharged from the pump 901 should be able to overcome the water level difference between the outlet of the nozzles 610*c* and 610*d* and the outlet of the pump 901. In the detergent dissolving step S20, the circulation pump motor 92 is rotated at the first speed RPM1 and the first speed RPM1 is set within a range in which the flow discharged from the pump 901 is not discharged through the nozzle 610*c*, 610*d*. The first speed RPM1 may be 1000 to 1800 rpm. Note that the graph indicated by 71 in (c) in FIG. 71 shows that the rotation of the circulation pump motor 92 is controlled at the first speed RPM1.

In the detergent dissolving step S20, even if the pump 901 is operated, as shown by the dotted arrow in FIG. 68, the flow is only stirred between the tub 31 and the pump 901, and the spraying through the nozzle 610*c* and 610*d* is not accomplished. In the detergent dissolving step S20, the detergent is uniformly dissolved in the water by the pump 901. Particularly, since the water spraying through the nozzle 610*c* and 610*d* is not accomplished, the detergent is prevented from being applied to the laundry in a state where the detergent is not dissolved evenly.

After the detergent dissolution step S20 is completed, the washing step S30 may be performed. In the washing step S30, the pump 901 is rotated at the second speed RPM3 (see (c) in FIG. 71). When the pump 901 is rotated at the second speed RPM3, the water sent by the pump 901 is sprayed through at least one nozzle 610*c*, 610*d*.

The second speed RMP3 is higher than the first speed RPM1 or the roll down speed, and is preferably 2000 to 4600 rpm. The water (hereinafter, "detergent water") in which the detergent is uniformly dissolved at the detergent dissolving step S20 can be sprayed through at least one nozzle 610*c*, 610*d*, and can be directly applied to the laundry in the drum 32.

In the washing step S30, while the detergent water is sprayed through the nozzle 610*c*, 610*d*, the rotation of the drum 32 can be controlled according to a preset washing algorithm. As an example, (a) in FIG. 71 shows that the process of repeatedly accelerating and braking the washing motor up to or above the speed (e.g., 100 rpm or more) at which the laundry adheres to the inner surface of the drum 32 due to the centrifugal force.

While the laundry adheres to the inner surface of the drum 32 and rotates, the detergent water sprayed through the nozzle 610*c*, 610*d* reaches the inner side of the drum 32. Accordingly, after the sprayed detergent water passed through the laundry, it can be discharged to the tub 31 through the through hole 47 formed in the drum 32. However, the present invention is not limited thereto, and it is obvious that the rotation of the drum 32 can be controlled in various ways in the washing step S30.

Meanwhile, the detergent dissolving step S20 can be implemented differently from the above description. In detail, as shown in FIG. 70, a first nozzle 610*c* and a second nozzle 610*d* are provided in a first area A1 and a second area A2 based on both sides of a vertical line V passing through the center C of the drum 32. When sufficient water pressure is applied, the water sprayed through the first nozzle 610*c* reaches the second area A2, and the water sprayed through the second nozzle 610*d* reaches the first area A1.

The rotation speed RPM2 of the circulation pump motor 92 in the detergent dissolving step S20 (see (c) of FIG. 71) can be controlled in a range in which the water sprayed through the first nozzle 610*c* flows down along a portion of the drum 32 belonging to the first area A1, and the water sprayed through the second nozzle 610*d* flows down along other portion of the drum 32 belonging to the second area A2. Hereinafter, the rotation speed of the circulation pump motor 92 at this time is referred to as a roll down speed. Note that the graph indicated by 72 in (c) in FIG. 71 shows that the rotation of the circulation pump motor 92 is controlled at the roll down speed RPM2.

Since the water is discharged through the nozzle 610*c*, 610*d*, the roll down speed RPM2 is higher than the speed RPM1 in the above-described embodiment, and is preferably 1800 to 2200 rpm.

When the pump 901 is operated, the water in which the detergent is not completely dissolved is discharged through the nozzle 610*c* and 610*d* at the beginning of operation. However, since the water pressure discharged through the nozzle 610*c*, 610*d* is relatively low, such a discharged water does not reach the opposite area which each nozzle faces, but flows down along the inner surface of the drum 32 at a distance close to the nozzle 610*c*, 610*d*. Since the water is circulated through the pump 901 and the nozzle 610*c*, 610*d*, the detergent can be dissolved more quickly.

In addition, since the water pressure discharged from the nozzle 610*c*, 610*d* is low and the discharged detergent water flows down along the inner surface of the drum 32, the non-dissolved detergent is less likely to be directly applied to the laundry, and the possibility of re-contamination of laundry due to the detergent can be reduced. When the pump 901 is rotated at the roll down speed RPM2, the water discharged through the nozzle 610*c*, 610*d* substantially immediately falls down after being sprayed from the nozzle 610*c*, 610*d* as the spraying pressure is low. Note that the graph indicated by 71 in (c) in FIG. 71 shows that the rotation of the circulation pump motor 92 is controlled at the first speed RPM1.

Meanwhile, in any of the above-described embodiments, the pump 901 can be continuously rotated in one direction in the detergent dissolving step S20. However, preferably, the pump 901 can be alternately rotated in both directions so that the water is more actively stirred.

During the detergent dissolving step S20, a step of controlling to repeatedly accelerate and decelerate the washing motor approximately between 80 rpm and 100 rpm, and/or a step of controlling to repeatedly accelerate and decelerate approximately between 40 rpm and 100 rpm may be performed.

The present invention described above can be implemented as computer readable codes on a medium on which a program is recorded. The computer readable medium includes all kinds of recording devices in which data that can be read by a computer system is stored. Examples of the computer-readable medium include a hard disk drive (HDD), a solid state disk (SSD), a silicon disk drive (SDD), a ROM, a RAM, a CD-ROM, a magnetic tape, a floppy disk, And may also be implemented in the form of a carrier wave (e.g., transmission over the Internet). In addition, the computer may include a processor or a controller.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

What is claimed is:

1. A washing machine comprising:

a casing having an opening defined at a front surface of the casing;

a tub disposed in the casing, the tub having an opening defined at a front surface of the tub;

a drum disposed in the tub;

a gasket that has a cylindrical shape and that connects the opening of the case and the opening of the tub;

a plurality of nozzles disposed at an inner circumferential portion of the gasket and configured to spray water into the drum;

a plurality of port insertion pipes that protrude from an outer circumferential portion of the gasket and that are in fluid communication with the plurality of nozzles, respectively;

a pump configured to pump water discharged from the tub; and a nozzle water supply pipe configured to guide water pumped by the pump to the plurality of nozzles, the nozzle water supply pipe comprising:

a transfer conduit that extends along the outer circumferential portion of the gasket and that is configured to guide water pumped by the pump to the plurality of nozzles, and a plurality of nozzle water supply ports that protrude from the transfer conduit and that are inserted into the plurality of port insertion pipes, respectively, wherein the transfer conduit comprises:

a connecting portion that extends along the outer circumferential portion of the gasket and that is disposed between the plurality of nozzle water supply ports, and at least one uplift portion spaced apart from the outer circumferential portion of the gasket and disposed farther from the outer circumferential portion of the gasket than the connecting portion, wherein at least one of the plurality of nozzle water supply ports protrudes from the at least one uplift portion, and wherein the at least one uplift portion is convex outwardly in a radial direction of the gasket.

2. The washing machine of claim 1, further comprising:

a circulation pipe that connects the pump to the nozzle water supply pipe and that is configured to guide water pumped by the pump; and a circulation pipe connection port that protrudes from the transfer conduit and that is connected to the circulation pipe, the circulation pipe connection port being configured to receive water from the circulation pipe.

3. The washing machine of claim 2, wherein the plurality of nozzle water supply ports comprise a first nozzle water supply port and a second nozzle water supply port, wherein the circulation pipe connection port, the first nozzle water supply port, and the second nozzle water supply port are arranged along the transfer conduit, and wherein the connecting portion extends in a curved shape between the first nozzle water supply port and the second nozzle water supply port, the connecting portion being configured to guide water pumped by the pump to the second nozzle water supply port.

4. The washing machine of claim 3, wherein the at least one uplift portion is convex in a direction away from the outer circumferential portion of the gasket.

5. The washing machine of claim 2, wherein the transfer conduit comprises:

a first conduit portion that extends from the circulation pipe connection port and that defines a first flow path; and a second conduit portion that extends from the circulation pipe connection port and that defines a second flow path, wherein a lower end of the first conduit portion and a lower end of the second conduit portion are connected to the circulation pipe connection port, and wherein an upper end of the first conduit portion and an upper end of the second conduit portion are separated from each other.

6. The washing machine of claim 2, wherein the transfer conduit extends upward from the circulation pipe connection port, and wherein an area of a cross-section of the transfer conduit decreases from a lower side of the transfer conduit to an upper side of the transfer conduit.

7. The washing machine of claim 6, wherein a width of the cross-section of the transfer conduit decreases from the lower side of the transfer conduit to the upper side of the transfer conduit.

8. The washing machine of claim 1, wherein the plurality of nozzles comprise:

a pair of lower nozzles disposed at a left side and a right side of the gasket, respectively, the pair of lower nozzles being configured to spray water upward; and a pair of intermediate nozzles disposed at the left side and the right side of the gasket, respectively, the pair of intermediate nozzles being disposed above the pair of lower nozzles and configured to spray water downward.

9. The washing machine of claim 8, wherein the plurality of nozzles further comprise an upper nozzle disposed above the pair of intermediate nozzles and configured to spray water downward, and wherein the pair of intermediate nozzles are configured to spray water farther into the drum than the upper nozzle.

10. The washing machine of claim 8, wherein the plurality of port insertion pipes comprise a lower port insertion pipe that is in fluid communication with one of the pair of lower nozzles, wherein the at least one uplift portion comprises a lower uplift portion disposed at a position corresponding to the lower port insertion pipe, the lower uplift portion being disposed below a horizontal line passing through a center of the gasket, and wherein the plurality of nozzle water supply ports comprise a lower nozzle water supply port that protrudes from the lower uplift portion and that is inserted into the lower port insertion pipe.

11. The washing machine of claim 10, further comprising:

an upper balancer disposed at an upper portion of the front surface of the tub; and a lower balancer disposed at a lower portion of the front surface of the tub and spaced apart from the upper balancer in a vertical direction, wherein the lower uplift portion is disposed between the upper balancer and the lower balancer.

12. The washing machine of claim 9, wherein a horizontal distance between one of the pair of lower nozzles and a center of the drum is greater than a horizontal distance between the upper nozzle and the center of the drum.

13. The washing machine of claim 1, wherein the transfer conduit extends in a circumferential direction of the gasket.

14. The washing machine of claim 1, wherein one of the plurality of nozzle water supply ports protrudes from a middle point of the at least one uplift portion.

15. The washing machine of claim 1, wherein the transfer conduit comprises a first conduit portion that extends along a left side or a right side of the outer circumferential portion of the gasket, and wherein the at least one uplift portion comprises:

a lower uplift portion disposed at the first conduit portion and positioned below a horizontal line passing through a center of the gasket; and an upper uplift portion disposed at the first conduit portion and positioned above the horizontal line passing through the center of the gasket.

16. The washing machine of claim 5, wherein the first conduit portion extends upwardly along a left side of the outer circumferential portion of the gasket, wherein the second conduit portion extends upwardly along a right side of the outer circumferential portion of the gasket, and wherein the at least one uplift portion comprises:

a first lower uplift portion disposed at the first conduit portion and positioned below a horizontal line passing through a center of the gasket; and a second lower uplift portion disposed at the second conduit portion and positioned below the horizontal line passing through the center of the gasket.

17. The washing machine of claim 16, wherein the at least one uplift portion further comprises:

a first upper uplift portion disposed at the first conduit portion and positioned above the horizontal line passing through the center of the gasket; and a second upper uplift portion disposed at the second conduit portion and positioned above the horizontal line passing through the center of the gasket.

18. The washing machine of claim 17, wherein the at least one uplift portion further comprises a top uplift portion disposed above the first upper uplift portion and the second upper uplift portion.

19. The washing machine of claim 18, wherein the transfer conduit has a circular shape surrounding the outer circumferential portion of the gasket.

* * * * *